United States Patent [19]

Hollidge

[11] Patent Number: 5,027,282

[45] Date of Patent: Jun. 25, 1991

[54] INTERACTIVE PUMP SYSTEM

[76] Inventor: Peter W. Hollidge, 46 Rondeau Drive, Willowdale, Ontario, Canada, M2H 1R7

[21] Appl. No.: 449,970

[22] PCT Filed: Aug. 5, 1988

[86] PCT No.: PCT/GB88/00651

§ 371 Date: Dec. 28, 1989

§ 102(e) Date: Dec. 28, 1989

[87] PCT Pub. No.: WO89/00974

PCT Pub. Date: Feb. 9, 1989

[30] Foreign Application Priority Data

Aug. 6, 1987 [CA] Canada ..... 543862

[51] Int. Cl.[5] ..... G06F 15/46

[52] U.S. Cl. ..... 364/479; 235/381; 364/138; 364/465

[58] Field of Search ..... 364/429, 465, 510, 131–136, 364/188, 189; 235/375, 380, 381, 382.5; 340/825.35; 222/52, 23–28, 36, 37, 78

[56] References Cited

U.S. PATENT DOCUMENTS

| | | | |
|---|---|---|---|
| 4,247,899 | 1/1981 | Schiller et al. | 364/479 X |
| 4,550,859 | 11/1985 | Dow Jr. et al. | 364/465 X |
| 4,589,069 | 5/1986 | Endo et al. | 364/465 |
| 4,630,754 | 12/1986 | Komukai | 364/146 |

FOREIGN PATENT DOCUMENTS 2028768 3/1980 United Kingdom .

*Primary Examiner*—Joseph Ruggiero

*Attorney, Agent, or Firm*—Rogers, Bereskin & Parr

[57] ABSTRACT

An interactive pump system capable of interacting with and responding to responses from a user, having a pump (105), a central processing unit (705) connected to the pump (105), and a display and input unit (1407) including a plurality of instruction displays and being connected to the pump and the central processing unit. The pump transmits transaction data concerning fluid pumped to the display and input unit which displays the transaction data, displays one instruction display, and transfers input responses from a user to the central processing unit. The central processing unit processes the input responses and controls the pump according to the response.

16 Claims, 7 Drawing Sheets

INTERACTIVE PUMP SYSTEM

The invention relates to pump systems more particularly but not exclusively the invention relates to gasoline pump interactive systems.

BACKGROUND OF THE INVENTION

For many years gasoline pumps were mechanical devices. They did not accept payment from customers prior to allowing the customer to pump gas. In self service operations, customers would often drive away from the station without paying for gas which they had pumped into their cars.

These mechanical devices did not keep track of transaction data for individual transactions.

In order to diagnose any problems the pump may have had, a serviceman was required to actually be at the pump location.

In the electronic age pumps are made to operate on electronic systems. These electronic pumps can accept prepayment when equipped with a card and note reading facility. Transaction data is displayed to customers via liquid crystal displays similar in function and layout to the mechanical display system used in mechanical pumps. The electronic pump can keep track of transaction data for itself.

Neither the mechanical pump nor the electronic pump is very user friendly. A customer encountering the pump for the first time is often intimidated by the cold look of the solely numerical display and the separate card and note reader. Even to a veteran self service pump user, pump problems encountered during use can cause this feeling of intimidation. The provision of a long list of printed instructions does not improve the situation.

The object of the invention is to provide improved prepayment, point of sale information, display, instruction, remote system problem diagnostic, and remote problem correction capabilities.

SUMMARY OF THE INVENTION

An interactive pump system capable of interacting with and responding to responses from a user, comprises; a pump means; a central processing unit connected to the pump means; and a display and input means including a plurality of instruction displays, and being connected to the pump means and the central processing unit; wherein the pump means transmits transaction data concerning fluid pumped to the display and input means which displays the transaction data, displays one instruction display, and transfer input responses from a user to the central processing unit, and the central processing unit processes the input responses and controls the pump means according to the responses.

The invention can be capable of taking a user through a transaction with step by step instruction displays dependant on the input responses of the user.

Additionally the central processing unit can concurrently run separate tasks controlling the pump means and the display and input means, and an application task receiving and processing the input responses and transferring resultant pump directions to the task controlling the pump means.

The means of control may include the transfer of commands to, and receiving of responses from, the pump means and the display and input means. The display and input means processing the responses from the user and transferring resultant requests to the application task. The application task processing the requests and transferring directions to the pump task.

Similarly the pump task can be capable of processing responses from the pump means and transferring resultant pump requests to the application task. The application task would be capable of processing the requests and transferring resultant directions to the display and input task. The display and input task processes the display and input directions.

The system can employ a queue and queue task controlling the queue. The queue would accept requests from the controlling tasks and transfer them to the application task when required. Thus the system is capable of responding to responses from any of the controlling tasks.

The display and input means may be divided into separate display means and input means. Correspondingly the display and input task would be divided into a display task and an input task with corresponding command, response, requests, and direction flow. The application task would process each of the requests and transfer resultant directions.

The display means can employ a graphics generator, a video mixer, and a monitor. The graphics generator generating graphic displays. The mixer mixing the graphic displays with the transaction data and the monitor displaying the resultant instruction display.

A sync generator can be used to synchronize the transaction data with the graphic displays.

A motion display source may be used as an alternate source of displays. The motion display source output and the mixer output being selected and combined in a video combiner. The output of the video combiner being displayed on the monitor. The sync generator could be employed to synchronize the transaction data and both instruction display sources. The application task can direct the selection and combining through a switch task controlling a switch sending signals to the sync generator.

An audio signal source can be used by the display means to create audio instruction displays.

Payment means with a corresponding prepayment task transferring commands to and receiving responses from the payment means can be used to accept credit cards or cash prior to using the pump means. The payment means may include a card reader and a cash reader controlled by a card note controller. The card note controller being controlled by the payment means.

A kiosk computer added to the system can keep track of point of sale data received from the pump means via the central processing unit and control the pump via the central processing unit for transactions which do not employ the card and cash reader.

An external source connected to the central processing unit can be employed to access the central processing unit for remote diagnostics and remote system correction.

The input responses can be taken from a touch screen connected to the central processing unit.

The monitor can display graphic or motion instruction displays taking the customer step by step through the transaction, while the touch sensitive screen accepts the input responses from the user. The instructions displayed at any one time can be made to relate solely to the action with which the customer is involved at any given time. The display can relate a great deal of information while being simple, colourful and pleasing to the eyes and ears.

The task structure resists system failure caused by problems in any one task. Systems problems which are capable of software solutions may be corrected at remote locations using the external source.

The kiosk computer may be added to the system to keep track of point of sale information and to possibly forward the point of sale information to a centralized host computer. The kiosk computer could also reset price information at the pump. The price information may have originally been relayed from the host computer.

Through the modem connection the system may be used to authorize credit cards via a remote authorization computer.

A laser disc player and signal decoder may be employed as the motion display signal source.

BRIEF DESCRIPTION OF THE DRAWINGS

For a better understanding of the present invention, and to show more clearly how it may be carried into effect, reference will now be made by way of example to the accompanying drawings, which show a preferred embodiment of the present invention, and in which;

FIG. 15 is a drawing of a language choice display employed in the system of FIG. 14.

FIG. 16 is a drawing of preset choices display employed in the system of FIG. 14.

FIG. 17 is a drawing of payment choices display employed in the system of FIG. 14.

FIG. 18 is a drawing of card selection display employed in the system of FIG. 14.

FIG. 19 is a drawing of pay at the kiosk display employed in the system of FIG. 14.

FIG. 20 is a drawing of thank you display employed in the system of FIG. 14.

FIG. 21 is a drawing of cash deposit display employed in the system of FIG. 14.

FIG. 22 in a drawing of receipt and refund display employed in the system of FIG. 14.

DETAILED DESCRIPTION OF THE PREFERRED EMBODIMENT

Figure 1:
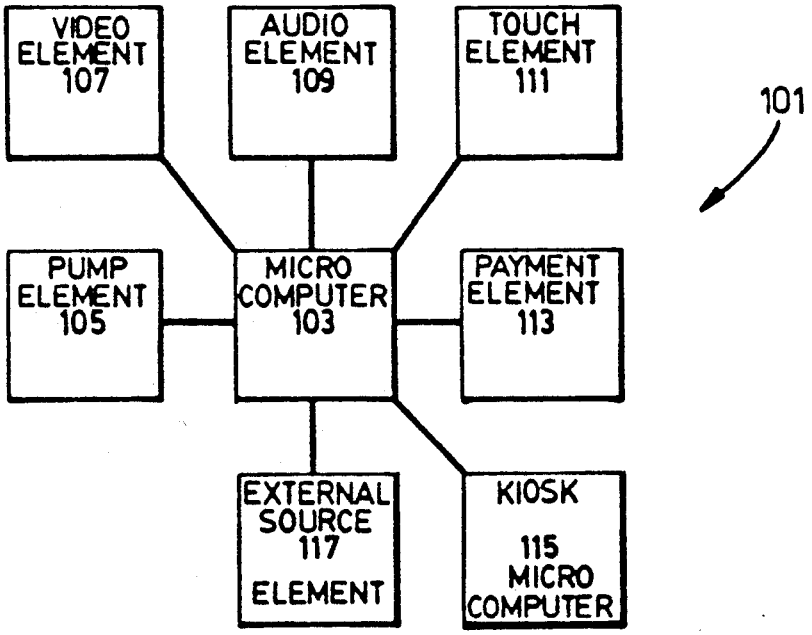
FIG. 1 is a pump system hardware block diagram according to the preferred embodiment of the present invention.

Reference will now be made to FIG. 1 showing system hardware 101 for a gasoline pump interactive system. The hardware 101 is composed of eight elements; system microcomputer element (PC) 103, pump element 105, video element 107, audio element 109, touch element 111, payment element 113, kiosk microcomputer element 115, and external source element 117.

The microcomputer 103 is connected to elements 105 through 117. The pump 105 is additionally connected to the video element 107.

Figure 14:
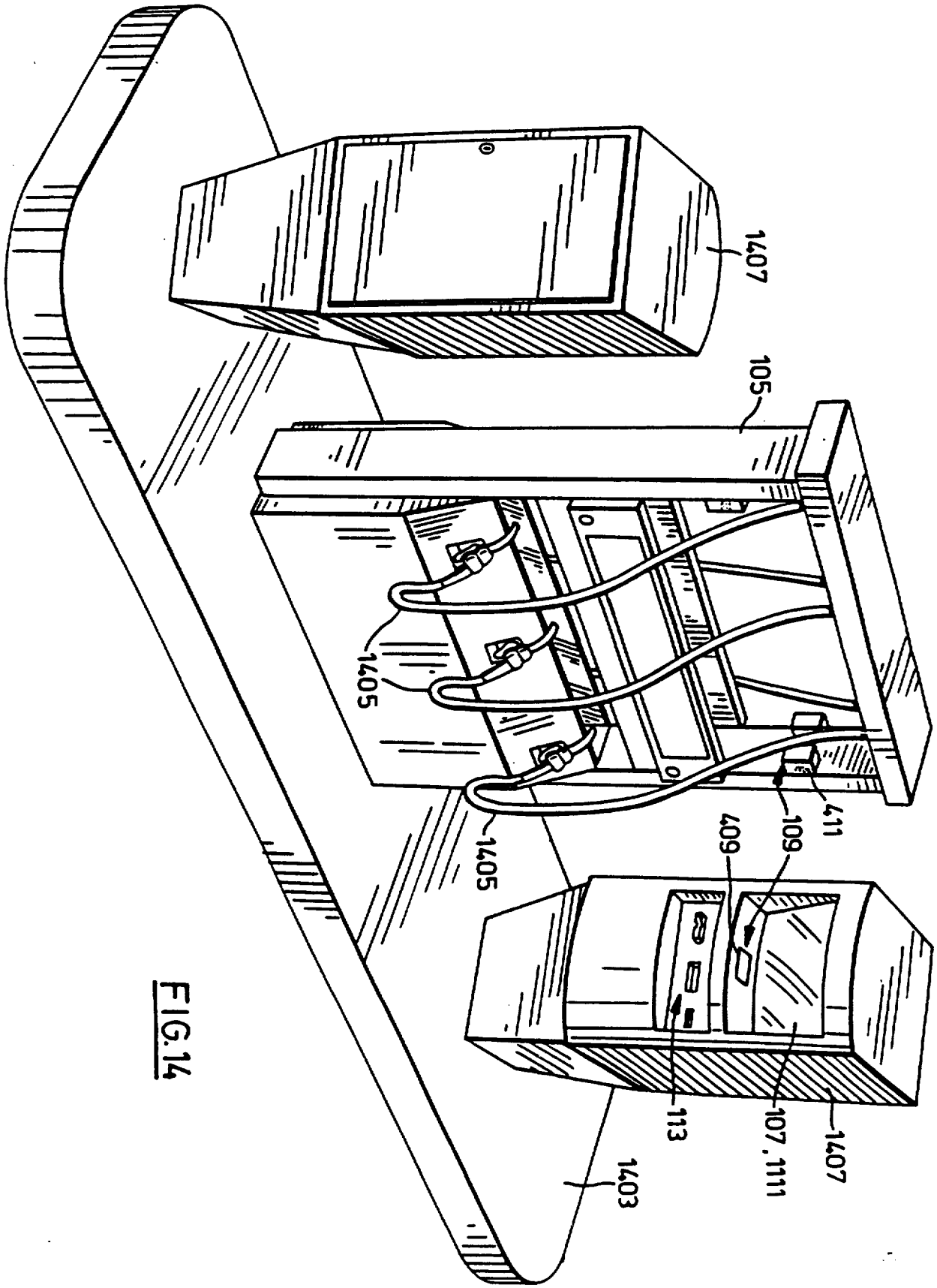
FIG. 14 is a perspective view of a gasoline station island employing a pump system according to the preferred embodiment of the present invention.

As shown in FIG. 14, the pump 105 sits on a gasoline station island 1403. The pump 105 shown is actually designed to handle two systems. The three hoses 1405 on one side of the pump 105 can be used by one customer while the three hoses on the other side are used by another.

Correspondingly there are shown two interactive columns 1407. The columns 1407 each service one system. Each column 107 contains a video, audio, touch, and payment element 107, 109, 111, 113. The touch and video elements 111, 107 lie one behind the other and therefore occupy the same space on the figure. Column and pump speakers 409, 411, part of the audio element 109, appear on the column 1407 and the pump 105.

The PC and external source elements 103, 117, not shown, are shared by two systems.

The kiosk computer 115, shared by all the systems in the station, is situated in a kiosk, not shown, central to the station.

Reference will now be made to FIGS. 1 through 8 which detail how the various elements 103 through 117 make up seven corresponding circuits; pump circuit 201, video circuit 301, audio circuit 401, touch circuit 501, payment circuit 601, kiosk circuit 701, and external circuit 801.

SYSTEM MICROCOMPUTER

The PC 103 maintains control over all functions of the system. A Tandy HD3000, AT class, was used as the system PC 103 in the preferred embodiment. The PC 103 operated on the QNX operating system manufactured by Quantum Software Systems, Ltd. The compiler supported the C computer language.

It will be evident to those skilled in the art that it is not necessary to use this particular brand of microcomputer, operating system or language. Any computer of sufficient size and speed, having the required number of input/output lines, and supporting a task driven operating system with intertask communication will be suitable. The system software which controls the PC 103 will be described later in this description.

PUMP CIRCUIT

Figure 2:
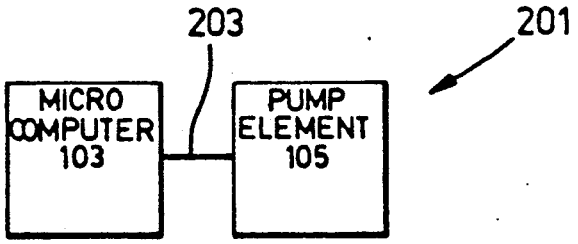
FIG. 2 is a block diagram of a pump circuit employed in the system of FIG. 1.

Reference will now be made to FIG. 2 in detailing the pump circuit 201. The pump 105 used in the preferred embodiment was a LTS Sierra 7000 multiple product dispenser (MPD) having six hoses capable of serving two customers one of three different types of gasoline at any one time.

The liquid crystal display of the pump 105 has been removed and the display lines fed to the PC 103 and the video circuit 301. The pump 105 connection to the PC 103 is a 20 mAMP current loop control link 203. The information flow on the control link is full duplex. The microcomputer 103 is an active transmitter and receiver to the pump passive receiver and transmitter. Signal speed is selectable between 4800 and 1200 Baud. In the preferred embodiment 4800 Baud was used.

Data transfer is asynchronous. Character length is 7 data bits with one even parity bit. There is one start bit and two stop bits. The character set is in ASCII code. The bit sequence is least significant bit first while the byte sequence is most significant byte first. The byte sequence therefore starts with the beginning of the message.

It is not necessary to use this particular pump to produce the desired results, an electronically controlled pump having similar functions would be suitable. Modifications would have to be made to the system software and possible the hardware connections to correspond with the changes in the pump 105 control sequence and command set.

The control sequence and command set of the pump 105 used in the preferred embodiment will now be outlined:

| CONTROL CHARACTERS | | | |
|---|---|---|---|
| ENQ | (05H) | ⁻E | Start Character from PC or MPD |
| ACK | (06H) | ⁻F | Positive Acknowledgment from MPD |
| NAK | (15H) | ⁻U | Negative Acknowledgment from MPD |
| DEL | (7FH) | | End of Data Block |
| BCC | | | Block Check Character<br>The BCC Character is obtained by taking the exclusive - or (XOR) across all 7 bits of the ASCII character for all transmitted characters excluding the BCC character. |

| SPECIAL CHARACTERS | | |
|---|---|---|
| | | length |
| SEQ | 1 = | Sequence, range 20H to 5FH for PC, 60H to 7EH for MPD |
| ID | 1 = | Pump no. 30 Hex (0) + PUMP no. |
| | 1 = | Hose no. 30 Hex (0) + HOSE no. (1, 2 or 3)<br>eg. ID of Pump 12 Hose 2 = 3CH, 32H |

Note: ID of HOSE #0 means 'any hose' and PUMP #0 means 'this pump'.

PROTOCOL SPECIFICATION

The Protocol consists of a series of command strings sent from the PC 103 to the MPD 105. The MPD 105 responds to these commands by returning Data or Status or by controlling hardware within the MPD 105.

There are two modes of the application, an event driven system where the MPD 105 generates event-messages as a result of actions in the MPD 105 and a polling system where the PC 103 is interrogating the MPD 105 to find out about actions of the MPD 105. In both instances, actions of the MPD 105 are controlled by the PC 103.

SUMMARY OF MESSAGES

A. Events

Only one type of event message exists: the MPD 105 status message with the same contents as returned in function 'S'.

B. Functions

Functions are initiated by the PC 103 controlling the MPD 105 and replied by the MPD 105.

1. Functions for use in transactions

| Function | Action | Reply |
|---|---|---|
| 'S' | get status | MPD Status |
| 'C' | Authorize pump | MPD Status |
| 'D' | get transaction pump | MPD status + transaction data |
| 'N' | pump motor on | MPD status |
| 'F' | pump motor off | MPD status |
| 'T' | set sale complete | MPD status |
| 'E' | set pre-pay data | 'L' |
| 'R' | get pre-pay | pre-pay status, reply 'X', 'M' |

2. Functions for use other than transactions

| | | |
|---|---|---|
| 'G' | set MPD prices | 'K' |
| 'B' | read back MPD prices | price file data as in 'G' |
| 'O' | get options | MPD status and option status |
| 'P' | reset Power-Up bit | MPD status |
| 'V'– | read MPD S/W version | MPD version # |
| 'X' | read Cash Totals | MPD Cash Totals; Volume and $$ Product Code 'C' |
| 'Y' | read Credit Totals | MPD Credit Totals; Volume/$$ Product Code 'C' |

TYPICAL MESSAGE FORMATS AND ERROR REPLIES

Event message: originator MPD

PC ← ENQ SEQ ID data DEL BCC MPD

Function message: originator PC

PC BCC DEL Func./Data ID SEQ ENQ → MPD

← ACK SEQ ID data DEL BCC negative reply: by MPD

PC ← NAK SEQ ID ESTAT DEL BCC MPD

ESTAT: a 2-byte error status with the following interpretation:

sequence 1:

| | | |
|---|---|---|
| Byte 1 | B7–B4 | B3–B0 |
| | 0100 | 0001 = time out |
| | 0100 | 0010 = message length |
| | 0100 | 0011 = BCC |
| | 0100 | 0100 = Sequence range |
| | 0100 | 0101 = Sequence match |
| | 0100 | 0110 = ID invalid |
| | 0100 | 0111 = command out of context |
| | 0100 | 1000 = command unknown |
| Byte 2 | always 80H ('@') | |

sequence 2:

| | | |
|---|---|---|
| Byte 1 | always 80H ('@') | |
| Byte 2 | B7–B4 | B3–B0 |
| | 0100 | 0001 = authorize invalid |
| | 0100 | 0010 = pump on invalid |
| | 0100 | 0011 = pre-pay not received |
| | 0100 | 0100 = prices not received |
| | 0100 | 0101 = data bad (not ASCII) |
| | 0100 | 0110 = data not accepted |
| | 0100 | 0111 = ----- |
| – | 0100 | 1000 = ----- |

Events

The MPD 105 will optionally send status messages as events.

Any change of the contents of the regular status bytes is sent as an event once only. The status bytes reflect the operational status of the MPD 105.

Event message format:

-continued

PC ← ENQ SEQ ID STATUS DEL BCC MPD

BCC DEL ID SEQ ACK → or:

BCC DEL ID SEQ NAK →

LIST OF EVENTS: for details see 'S' command.
Transaction related
Hook Status
Pump motor Command Status
Pump reset complete (888-blank-all zero-sequence)
Normal/Attended Mode
Sale Complete
Error related
Power Up Restart/System Restart
Pump Time Out
Temperature Measurement Failure
Pulser Failure
Local Price change
Pump Not In Service (find out more in Options)

1. CODE 'S'

This command returns MPD 105 pump status and error information at any time.

PC BCC DEL 'S' ID SEQ ENQ → MPD

← ACK SEQ ID STATUS DEL BCC

STATUS (2 BYTES)

| | |
|---|---|
| First Byte - | B0 = Hook Status - Off Hook = 1 |
| Pump Status - | B1 = Pump Motor Command Status - On = 1 |
| | B2 = Zero Fuel - Zero = 0 |
| | B3 = Attended/Manual Mode - Manual = 1 |
| | B4 = Sale complete = 1* |
| | B5 = 0 - future: Units - Liters/USG; USG = 1 |
| | B6 = 1 |
| | B7 = 0 |
| Second Byte - | B0 = Power up restart, system restar** |
| Error Status - | B1 = Pump Time Out |
| | B2 = Temperature Failure |
| | B3 = Pulser Failure |
| | B4 = Local Price Change = 1 |
| | B5 = Pump Not In Service = 1; - see Option |
| Status | B6 = 1 |
| | B7 = 0 |

Notes:
*The Sale Complete bit indicates that the PC 103 has processed this sale, bit is set to 'not complete' by handle 'on hook' at the end of a transaction. (see function 'T')
**The power up restart / system restart flag is latched until acknowledged by the PC 103 by sending function 'P'.

2. CODE 'C'

This command initiates a MPD 105 segment test and reset and authorizes the MPD 105 for a new transaction.

PC BCC DEL 'C' ID SEQ ENQ → MPD

← ACK SEQ ID STATUS DATA DEL BCC

The 'Zero Fuel' bit of the first status byte is interrogated as an indication of a successful MPD 105 Clear & Authorization Cycle. The pump motor is turned on subsequently, a separate Pump ON command is not required.

3. CODE 'D'

This command returns last/current pump transaction data along with status information at any state of a transaction.

PC BCC DEL 'D' ID SEQ ENQ → MPD

← ACK SEQ ID STATUS DATA DEL BCC

Status Format:
Identical to CODE 'S'
Data Format:

| | |
|---|---|
| PPU [cents*10] = 4 Bytes | (xxx.x) |
| Volume [units] = 6 Bytes | (xxx.xxx) Gallons or Liters |
| Sales [cents*10] = 6 Bytes | (xxx.xxx) Unrounded |
| Product code = 1 Byte | upper case ASCII 'A'-'H' for CASH price<br>lower case ASCII 'a'-'h' for CREDIT price |

Note:
(a) Decimal point is implied
(b) all data is in ASCII.

4. CODE 'N'

This command initiates switching the Pump Motors on.

PC BCC DEL 'N' ID SEQ ENQ → MPD

← ACK SEQ ID STATUS DEL BCC

The Status is checked for successful 'Pump Motors On'.

5. CODE 'F'

This command initiates switching the Pump Motors off.

PC BCC DEL 'F' ID SEQ ENQ → MPD

← ACK SEQ ID STATUS DEL BCC

6. CODE 'T'

This command sets the Sale Complete bit in the status byte.

PC BCC DEL 'T' ID SEQ ENQ → MPD

← ACK SEQ ID STATUS DEL BCC

The status is checked for 'Sale Complete'.

7. CODE 'E'

This command sends a string of Pre-Payment Data to the MPD 105.

PC BCC DEL 'E' ID SEQ ENQ → MPD

← ACK SEQ ID 'L' DEL BCC

BCC DEL DATA ID SEQ ENQ →

Data Format:

Pre-Payment Amount [cents]=4 Bytes (xx.xx)

If there is no Pre-Payment Data within 3 seconds of the MPD 105 sending the 'OK' response, or if there is a break in the Pre-Payment Data Transmission greater then 3 seconds then the MPD 105 will abort the 'E' command and return to a general 'LISTEN' mode.

If any errors are detected in the Transmission, Data or setting up of the Pre-Payment Data within the MPD 105, then an error is indicated that can be extracted via code 'R'.

All Data is in ASCII numeric.

8. CODE 'R'

This command usually follows a code 'E' command and extracts the status of the setting up of the Pre-Payment file within the MPD 105.

```
PC  ---BCC DEL 'R' ID SEQ ENQ--->  MPD
    <---ACK SEQ ID RSTAT DEL BCC---
```

RSTAT Format:
Consists of 1 Byte containing ASCII 'M' or 'X'
'M' indicates a successful Pre-Payment setup
'X' indicates an error during code 'E'

9. CODE 'G'

This command primes the MPD 105 to receive a string of Central Product Price Data.

```
PC  ---BCC DEL 'G' ID SEQ ENQ--->  MPD
    <---ACK SEQ ID 'K' DEL BCC---
    ---BCC DEL DATA ID SEQ ENQ--->
```

Data Format

| | | | |
|---|---|---|---|
| Hose1 | PPU-cash, | PPU-credit | 8 bytes |
| Hose2 | PPU-cash, | PPU-credit | 8 bytes |
| Hose3 | PPU-cash, | PPU-credit | 8 bytes |
| | total message: | | 24 bytes |

Structure of PPU: =PPU [cents*10] =4 Bytes (xxx.x)

The hose number is implied by the position of PPU.

If there is no Product Data within 3 seconds of the MPD 105 sending the 'OK RESPONSE', or if there is a break in the Product Data Transmission greater than 3 seconds then the MPD 105 will abort the 'G' command and return to a general 'LISTEN' mode.

If any errors are detected in the transmission, Data, or setting up of the Central Price File within the MPD 105, then the appropriate error bit is set in the error byte of the Pump Status (extracted via CODE 'S').

All Data is in ASCII Numeric, decimal point is implied.

10. CODE 'B'

This command allows the PC 103 to read back the Product Price File in the MPD 105.

```
PC  ---BCC DEL 'B' ID SEQ ENQ--->  MPD
    <---ACK SEQ ID DATA DEL BCC---
```

Data Format:
Identical to code 'G'.

11. CODE 'O'

```
PC  ---BCC DEL 'O' ID SEQ ENQ--->  MPD
    <---ACK SEQ ID STATUS OPTIONS DEL BCC---
```

Options Format:

| | |
|---|---|
| First Bytes | B0 = Meter factor(s) not valid or not |
| calibrated | B1 = Price(s) (Cash) not valid (eg. 0) |
| | B2 = MPD is in Manager Mode |
| | B3 = MPD is in Inspector Mode |
| | B4 = Handle(s) Off Hook upon startup or return from Manager Mode |
| | B5 = 0 |
| | B6 = 1 |
| | B7 = 0 |
| Second Byte | B0 = Reserved - 0 |
| | B1 = Reserved - 0 |
| | B2 = Reserved - 0 |
| | B3 = Reserved - 0 |

-continued

| | |
|---|---|
| | B4 = Reserved - 0 |
| | B5 = 0 |
| | B6 = 1 |
| | B7 = 0 |

12. CODE 'P'

This command resets the Power-Up bit of the MPD 105 status byte which was set upon power-up/restart of the MPD 105.

```
PC  ---BCC DEL 'P' ID SEQ ENQ--->  MPD
    <---ACK SEQ ID STATUS DEL BCC---
```

Status format:
Identical to CODE 'S'

13. CODE 'V'

This command returns the MPD 105 S/W Version number.

```
PC  ---BCC DEL 'V' ID SEQ ENQ--->  MPD
    <---ACK SEQ ID DATA DEL BCC---
```

Data Format:
DATA = 'TTVVRRYYMMDD' (12 bytes)

| | |
|---|---|
| LTS Software ID: | |
| TT = Type # | [00-99] |
| VV = Version # | [00-99] |
| RR = Revision # | [00-99] |
| Date of origin: | |
| YY = Year | [00-99] |
| MM = Month | [01-12] |
| DD = Day | [01-31] |

all data is in ASCII.

14. CODE 'X'

Read Cash Totals form MPD 105 by Hose. Only valid Hose # will be replied. Otherwise a NAK message will be sent.

```
PC  ---BCC DEL 'X' ID SEQ ENQ--->  MPD
    <---ACK SEQ ID DATA DEL BCC---
```

Data Format:

| | |
|---|---|
| Cash Volume [liters] = X XXX XXX XXX.XX | 12 bytes |
| Credit Sale [Dollars] = X XXX XXX XXX.XX | 12 bytes |
| Product code to indicate Cash = 'C' | 1 byte |

CODE 'Y'

Read Credit Totals from MPD 105 by Hose. Only valid Hose # will be replied. Otherwise a NAK message will be sent.

```
PC  ---BCC DEL 'Y' ID SEQ ENQ--->  MPD
    <---ACK SEQ ID DATA DEL BCC---
```

Data Format:

| | |
|---|---|
| Credit Volume [liters] = X XXX XXX XXX.XX | 12 bytes |
| Credit Sale [Dollars] = X XXX XXX XXX.XX | 12 bytes |
| Product code to indicate Credit = 'c' | 1 byte |

Both messages: the decimal point is implied.

VIDEO CIRCUIT

Figure 3:
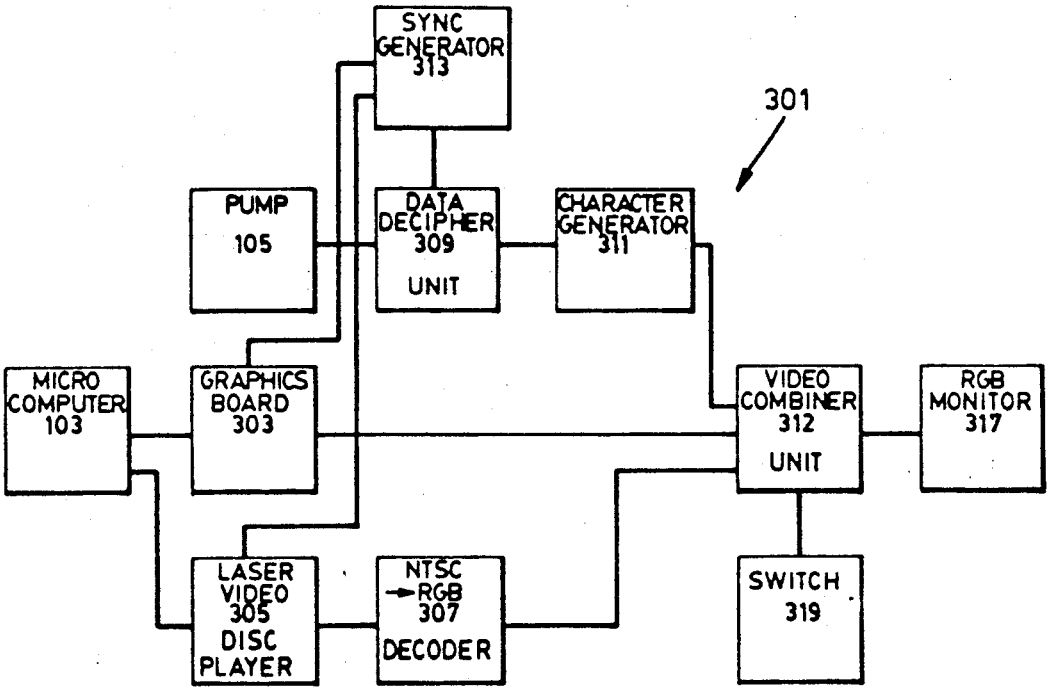
FIG. 3 is a block diagram of a video circuit employed in the pump system of FIG. 1.

Reference will now be made to FIG. 3 which depicts the video circuit 301 in detail. The microcomputer 103 controls three video sources; a graphics board 303, a laser video disc player 305, and the pump 105.

The output of the player 305 is sent to an NTSC to RGB decoder 307.

To produce a usable video signal the pump data is deciphered by a data decipher unit 309. The output of the data decipher unit 309 is connected to a character generator 311.

The output of the graphics board 303, the decoder 307, and the character generator 311 are fed into a video combiner unit 312.

The graphics board 303, player 305, data decipher unit 309, character generator 311, and video combiner unit 312 are each connected to a sync generator 313.

The output of the combiner 312 is sent to a red-green-blue monitor 317.

A switch 319 is connected to the combiner 312.

GRAPHICS BOARD

The graphics board 303 used in the preferred embodiment is an AT&T True Vision advanced raster graphics adaptor, Targa M8. The User's Guide for this adaptor dated Sep. 1986, published by AT&T Electronic Photography and Imagery Center, Indianapolis, IN., is hereby incorporated by reference. As the system software used on the PC 103 is written in the C language, as has been mentioned previously, a C language source file diskette of routines for the Targa M8 supplied by AT&T's EPICenter was used.

It is not necessary to use this particular board - any graphics equipment capable of storing frames and generating, in conjunction with the PC 103 and an external sync signal, red-green-blue video signals from the stored frames would be suitable.

The features of the graphics board 303 used in the preferred embodiment include the following:

Display Memory:

A digitized image is stored as a 512-row by 512-column array int he graphics board 305 display memory. Each pixel is saved as an 8-bit value in the 256 K bytes of display memory. The memory is dual-ported enabling the PC 103 to read and write information while the graphics board 303 maintains the display output. The graphics board 303 uses row address able random access memory (RARAM). The display memory is bank switched into a single 64 K memory segment in the PC 103 memory address space.

Input Lookup Tables:

256 input levels can be mapped to new values by eight input tables.

Output Lookup Tables:

The graphics board 303 can display 256 colours from a palette of over 64 million colours (24 bits). The output lookup tables allow the PC 103 to generate full colour RGB images. Eight tables may be selected from. The lookup tables may be written into by setting an individual colour component (i.e. red, green or blue) of a map entry.

Display Modes:

The graphics board 303 may be employed in the memory mode displaying the image stored in its display memory. In this mode captured frames or computer generated frames may be displayed. As well the border may be set to any colour.

Genlock:

The graphics board 303 can be operated in two synchronization modes. In the preferred embodiment the graphics board 303 is always operated in the above mode. In slave mode, it 303 synchronizes with an input video signal. The graphics board 303 can synchronize to a composite sync signal.

LASER DISC PLAYER

The player 305 used in the preferred embodiment was a McDonnell Douglas LFS-4400. The connection to the PC 103 is via an RS-232 series connector.

The player 305 accepts, among others, the following commands:

Acx—Audio Control:

"c" is the audio output port of the player 305 (c=1 for CH-1, c=2 for CH-2) to which the command is applied, and "x" corresponds to the following code (1 to 5) which indicates the audio source used.

0: Output channel OFF

3: Normal audio of disc channel 1 is output

4: Normal audio of disc channel 2 is output

L—Load the disc:

It may be used to reload a disc that has unloaded, provided that the disc has not been removed. If the "L" command is received when no disc is in the player 305, or if the disc has already been loaded, the load command will be discarded and the error flag will be raised. Status "N" is reported while the load operation is in progress. Status "R" is reported following successful completion.

Pxxxxx—Play up to frame number xxxxx:

By inputting a command consisting of P followed by a number of up to five digits, the disc will be played from the present frame up to the frame corresponding to the specified frame number. If the specified frame number is larger than the present frame number, forward play will take place. Conversely, if it is smaller than the specified frame number, reverse play will take place. Status "P" is returned.

Sxxxxx—Seek:

By inputting a command consisting of S followed by a number of up to five digits, you can perform a fast search operation from the present frame to the specified frame. Once the specified frame is reached, video will be muted, until the unit is commanded into the play mode using Pxxxxx.

If a seek is command to a frame outside the playable area of the disc, such as a lead-in or lead-out frame, then the player 305 will seek to the first or last playable frame, whichever is nearest to the target, and the error flag will be raised.

STATUS REPORTING

The PC 103 may determine the state of the player 305 by requesting a status report (transmitting an ASCII "?"). The player 305 will send a report only when requested to do so by the PC 103. The status report consists of eight characters. The first five characters are the present frame number, the sixth character indicates the present state of the player 305, and the seventh character is used to pass RCU keystrokes to the microcomputer 103. A carriage return ends the message.

Status Report Format

-continued

Present state of the player
(Refer to STATUS CODES)
Present frame number——08375 P L CR
RCU keystroke
(Refer to the table below)
Carriage return

| RCU keystroke | Output ASCII code |
|---|---|
| Number 0 | "0" |
| / | / |
| Number 8 | "8" |
| Number 9 | "9" |
| Clear | "A" |
| Audio/IF 1 | "B" |
| Video/IF 2 | "C" |
| Frame/Code | "D" |
| Load/Unload | "E" |
| Pause | "F" |
| Search | "G" |
| Step (forward) | "H" |
| Step (reverse) | "I" |
| Scan (forward) | "J" |
| Scan (reverse) | "K" |
| Play (forward) | "L" |
| Play (reverse) | "M" |
| Fast (forward) | "N" |
| Fast (reverse) | "O" |
| Slow (forward) | "P" |
| Slow (reverse | "Q" |
| 2nd F | "Z" |

Status Codes:
B - A command is in the command buffer awaiting execution
E - An error has occurred since the previous status request.
K - An RCU keystroke is available.
N - Load or Unload operation is in progress, player is unloaded, or current frame is on lead-in or lead-out.
O - OFF LINE
P - Play operation is in progress.
R - Disc is ready to play, no operations are in progress.
S - Seek operation is in progress.

As the output of the player 305 is an NTSC signal. It must be decoded to become a red-green-blue video signal to be used in conjunction with the graphics board 303 output signal. Thus the output of the player 305 is sent to an NTSC to RGB decoder 307.

PUMP VIDEO

A third video source, the pump 105, constantly outputs serial transaction data signals. The signals are a repeated serial string, each string being equivalent to the data contained in a pump D command without the product code information. A load pulse used to synchronize with the pump data is sent on a separate line every three strings, or 384 bits. The data is clocked out of the pump 105 by a pump clock. The data is sent in the form necessary to turn on the liquid crystal display segments as this was the original purpose of the pump 105.

Figures 8, 9:
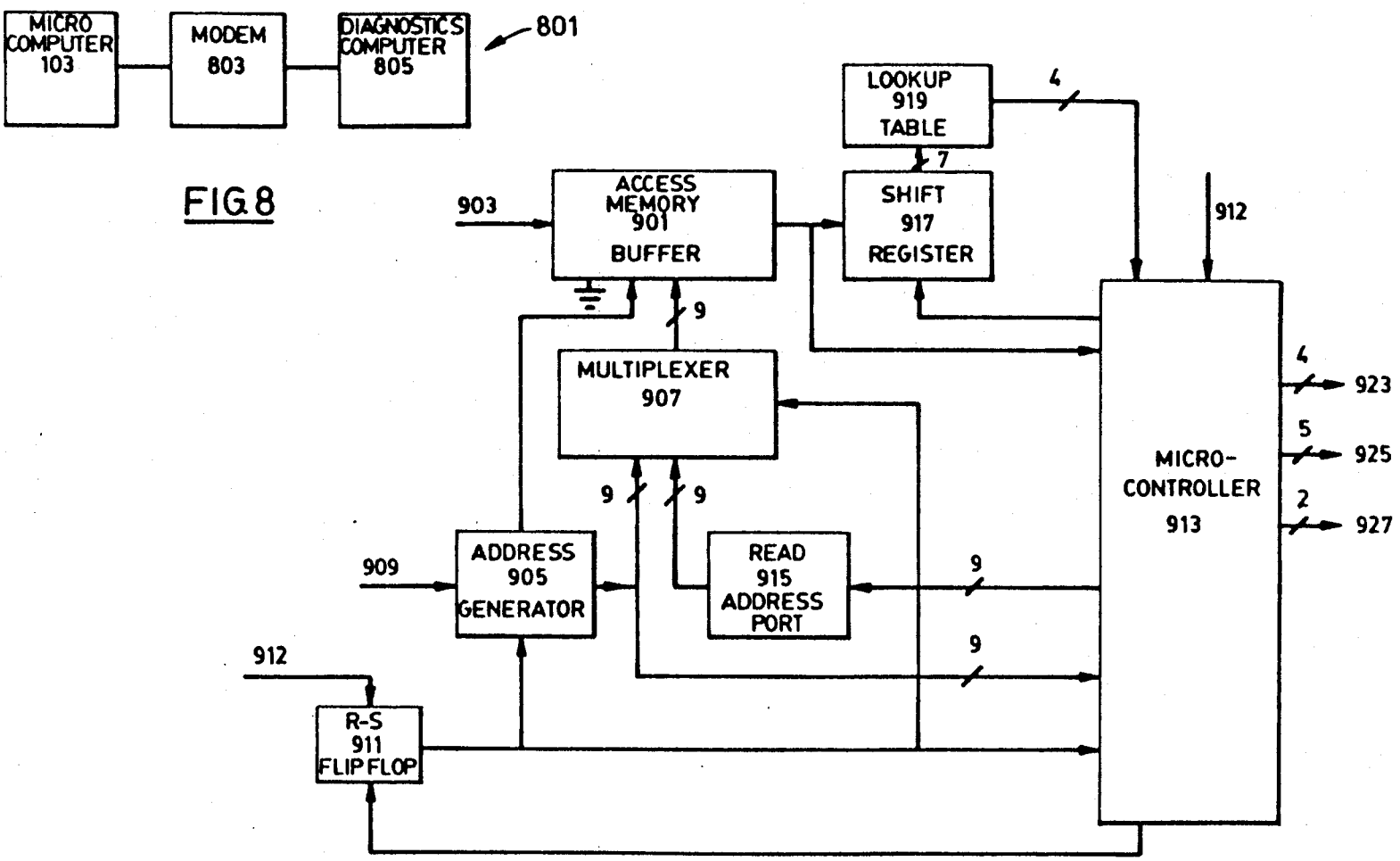
FIG. 8 is a block diagram of an external source circuit employed in the pump system of FIG. 1.
FIG. 9 is a detailed block diagram of a data decipher unit employed in the video circuit of FIG. 3.

Data Decipher Unit:

Reference will now be made to FIG. 9. The data decipher unit 309 employs a 1K by one line serial random access memory buffer 901. The data input to the buffer 901 is taken from the serial data output of the pump 105 as shown by the incoming arrow 903. The address in the buffer 901 is supplied by a write address generator 905 through one of two inputs to a two to one multiplexer 907. The input to the generator 905 is a clock pulse from the pump 105 clock as shown by the incoming arrow 909. The generator 905 begins to count clock pulses when it is enabled by the output of an R-S flip flop 911. The write enable input to the buffer 901 is connected to the generator 905 enabling data to be written into the buffer 901 while the generator 905 is correspondingly enabled.

The generator 905 is initially enabled by a signal from a microcontroller 913 to the R-S flip flop 911. After 384 bits have been sent along the data line 903 the pump 105 sends a load pulse to the flip flop 911 on a load pulse line 912. The pulse toggles the flip flop 911 disabling the generator 905 and the buffer 901.

The microcontroller 913 is made aware of the change in status by a second line connecting the microcontroller 913 to the flip flop 911. The address of the last bit of information written into the buffer 901 is provided to the microcontroller 913 on an output line directly connecting the generator 905 and microcontroller 913.

The microcontroller 913 verifies the validity of the data written into the buffer 901 by reading certain bits out of the buffer 901. The read address is sent by the microcontroller 901 to a read address port 915 which is the second input to the multiplexer 907. The select input to the multiplexer 907 is connected to the output of the flip flop 911 and would have been previously altered by the load pulse.

After validating the data the microcontroller 913 causes bits of data from the buffer 901 to move into a shift register 917. The data is shifted out of the register 917 on seven parallel lines to a lookup table 919. Shifts are caused by an input to the register 917 from the clock output of the microcontroller 913. The lookup table 919 converts the segment generating data from the register 917 to four bit ASCII numerals (0 through 9). Once all of the information in the buffer 901 is thus converted, the microcontroller 913 resets the flip flop 911. The buffer 901 and generator 905 are then free to resume accepting data from the pump 105.

A further input to the microcontroller 913 is an output field idenfication line 912. The microcontroller 913 has three further outputs; a four bit parallel data in line 923, a five bit parallel write address line 925 and a two bit parallel control line.

When the output field line 912 changes state, the microcontroller 913 sends the four bit numerals along the data line 923 to be written at the addresses given by the line 925.

Figure 10:
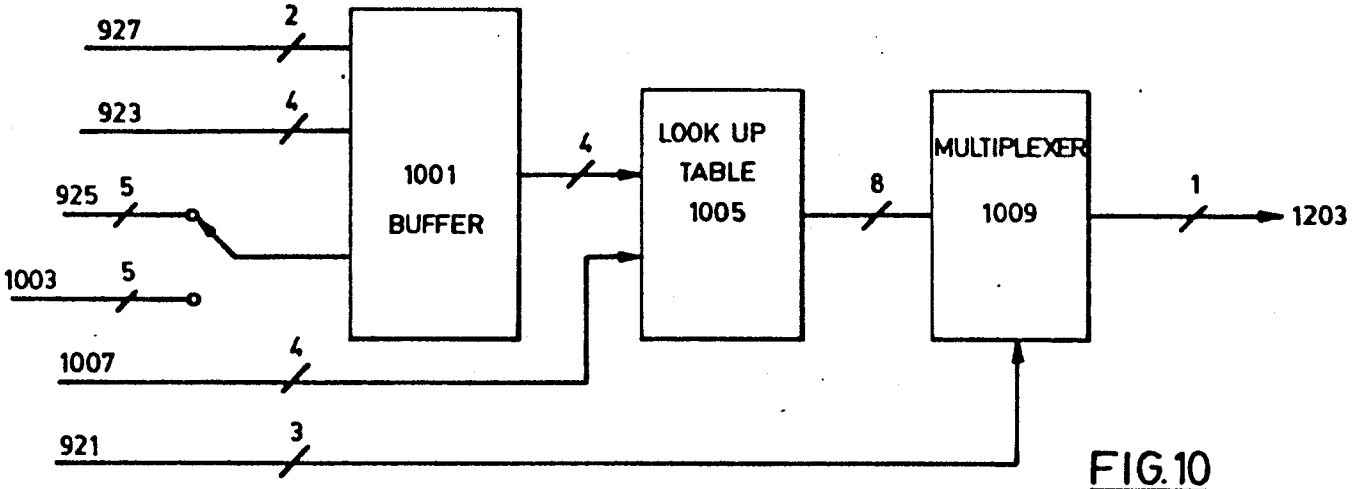
FIG. 10 is a block diagram of a character generator used in the video circuit of FIG. 3.

Character Generator:

Reference will now be made to FIG. 10. A one kilo bit by four output bits serial random access memory buffer 1001 has the control and data in lines 927, 923 as inputs and the write address line 925 as a selectable input. The addresses in the buffer 1001 for the numerals on the data in line 923 are given on the write address line 925.

The other selectable input to the bufffer 1001 is a read address line 1003. When all of the character data from the data decipher unit 309 has been written into the buffer 1001, the read address line 1003 is selected. The data in the buffer 1001 at the address given by the line 1003 is put on a four bit data out line to a lookup table 1005. The output of the buffer 1001 is used as a pointer to the addresses in the lookup table 1005. The lookup table 1005 contains the character graphics, for the line presently being read, corresponding to the data originating on the pump data line 903. The output of the lookup table 1005 is blank until the correct line is given on a four bit character line number input 1007 to the lookup table 1005. The signal 1007 dictates that characters are in fact to be generated as the correct line number on the screen has been reached. The ouput of the lookup table is an eight-bit parallel signal to an eight to one multiplexer 1009. Only one output line is necessary as the characters displayed on the screen are either white or black. The use of the multiplexor 1009 can increase the bit rate up to 14.3 MHz for improved character resolution.

VIDEO COMBINER

Figure 12:
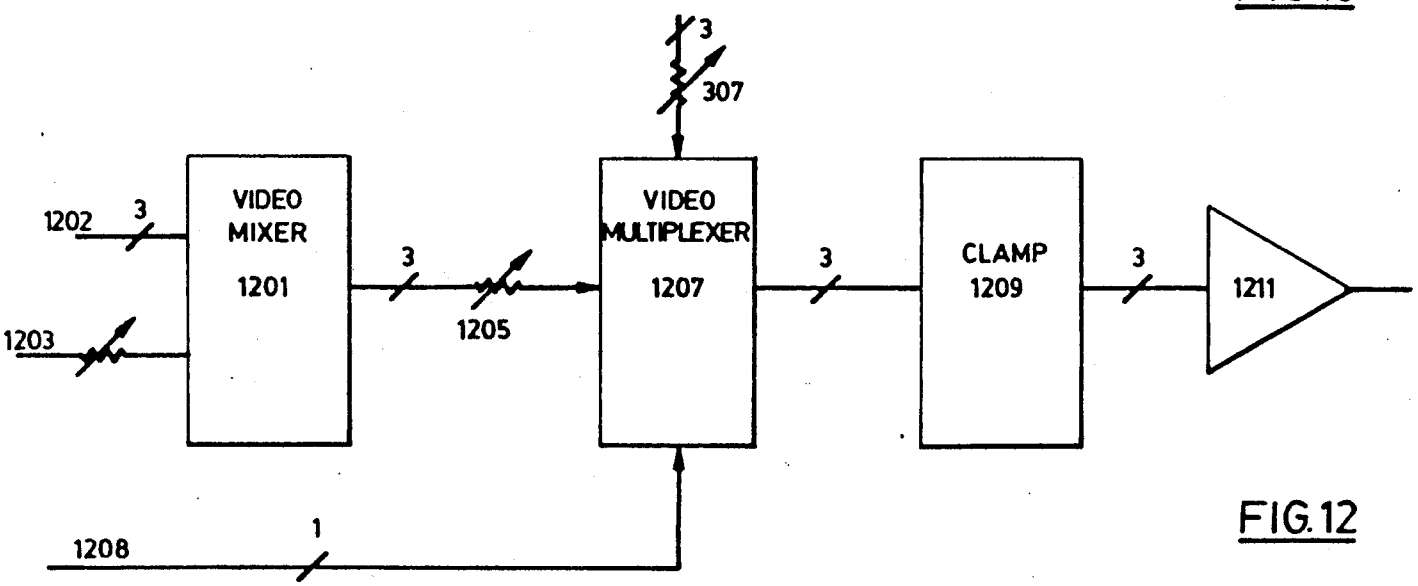
FIG. 12 is a block diagram of a video combiner used in the video circuit of FIG. 3.

Reference will now be made to FIG. 12, detailing the structure of the combiner 312. The three line red-green-blue video signal from the graphics board 303 is fed into an input 1202 of a video mixer 1201 where it is overlayed with the one bit character signal 1013 from the character generator 311. The character signal 1013 is fed through another input 1203 including a potentiometer to adjust the signal level before it enters the video mixer 1201. The output of the video mixer 1201 is a three line red-green-blue signal fed through the potentiometers 1205, only one representative potentiometer being shown, to a two to one video multiplexer 1207. The other input to the multiplexer 1207 is a three line red-green-blue signal from the output of the NTSC decoder 307. The select input of the multiplexer 1207 is a one video control signal 1208.

The output of the multiplexer 1207 is a three line red-green-blue signal which is fed to a clamp 1209. The red- green-blue outputs of the multiplexer 1207 are clamped during blanking time to make them insensitive to average picture level. The output of the clamp 1209 is a three line red-green-blue signal fed through low output impedance driving amplifiers 1211 to produce an output red-green-blue signal 1213.

SYNC GENERATOR

Figure 11:
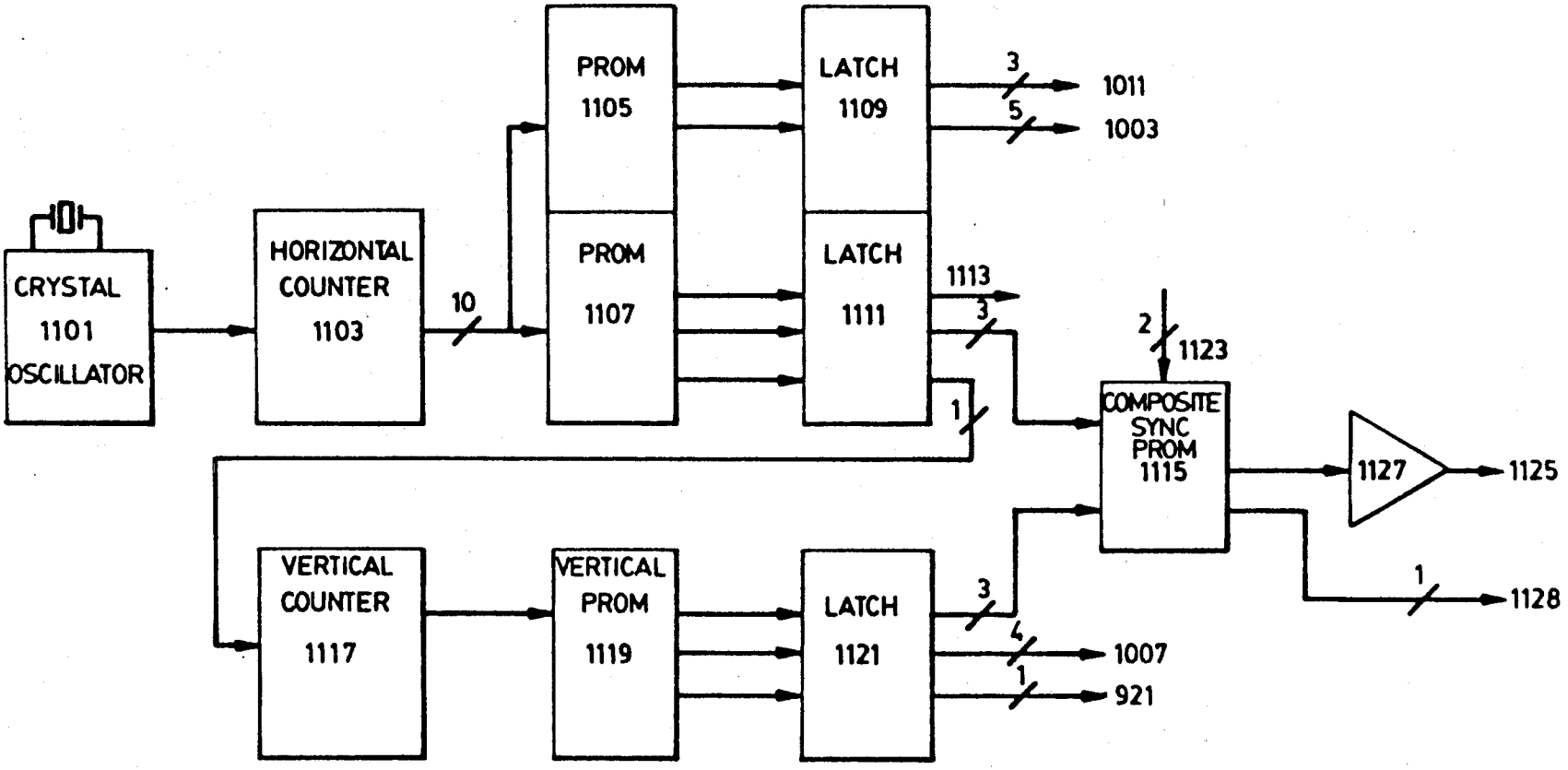
FIG. 11 is a block diagram of a sync generator used in the video circuit of FIG. 3.

Reference will now be made to FIG. 11 in detailing the sync generator 313. A free-running 14.3 MHz. crystal oscillator 110 clocks a horizontal counter 1103. The output of the horizontal counter 1103 is a ten-bit address signal connected to a pair of programmable read-only memories (PROMs) 1105, 1107. The outputs of PROM 1105 are latched by a latch 1109, whose outputs are the control line 1011 and the read address line 1003 to the character generator 311.

The three outputs of the PROM 1107 are latched by latch 1111. One of the outputs of the latch 1111 is a one bit signal 1113 to the character generator 311. The second output signal is a three-bit signal to a composite sync PROM 1115. The third output of the latch 1111 is a one bit signal to a vertical counter 1117.

The output of the vertical counter 1117 is fed to a vertical PROM 1119 which produces three outputs. The three outputs are fed through a latch 1121 producing a three-bit signal to the composite sync PROM 1115, the four bit character line number signal 1007 to the character generator 311, and the one bit output field ID signal 921 to the data decipher unit 309.

The outputs 1011, 1003, 1113 and 1007 to the character generator 311 determine the horizontal and vertical positioning of the characters from the pump 105 in a screen.

The output field ID signal 921 causes the numerals from the data decipher unit to be written to the character generator and eventually the combiner 312 at the same rate as the frame lines from the graphics board 303 are sent to the combiner. This causes the characters from the pumps 105 to be displayed on an even or odd line to eliminate flicker when they are displayed.

A third input to the PROM 1115 is a two bit split control signal 1123. This signal 1123 comes from a hardware switch 319. The hardware switch 319 has two banks, each bank having four output ports. To trigger a switch event, a bank and a data port must be selected, then a trigger pulse is sent.

The outputs of the PROM 1115 are a composite sync signal 1125 which is fed through a driving amplifier 1127, and the one bit video control signal 1208. The composite sync signal 1125 synchronizes the graphics board 303 to the rest of the video circuit 301.

The signal 1208 is controlled by the signal 1123. The signal 1208 has one of two values: video on, video off. When the signal 1123 is at a video off value the PROM 1115 selects the output of the video mixer 1201 for the time it takes a whole screen to be output from the combiner 315. When the signal 1123 is at a video on value the PROM 1115 selects the output of the player 305 for two-thirds of a screen and the output of the mixer 1201 for the other third. Thus the output of the graphics board 303 and pump 105 are always on the lower part of the screen while the upper part of the screen is selectable between the output of the board 303 and pump 105, and the output of the player 305.

RGB MONITOR

An example of the display shown at the monitor 317 is given in FIG. 15. The top portion 1501 of the display shows the output of the player 305 or the mixer 1201 depending on the value of the control signal 1208. The bottom portion 1503 of the display always shows the output of the mixer 1201.

AUDIO CIRCUIT

Figure 4:
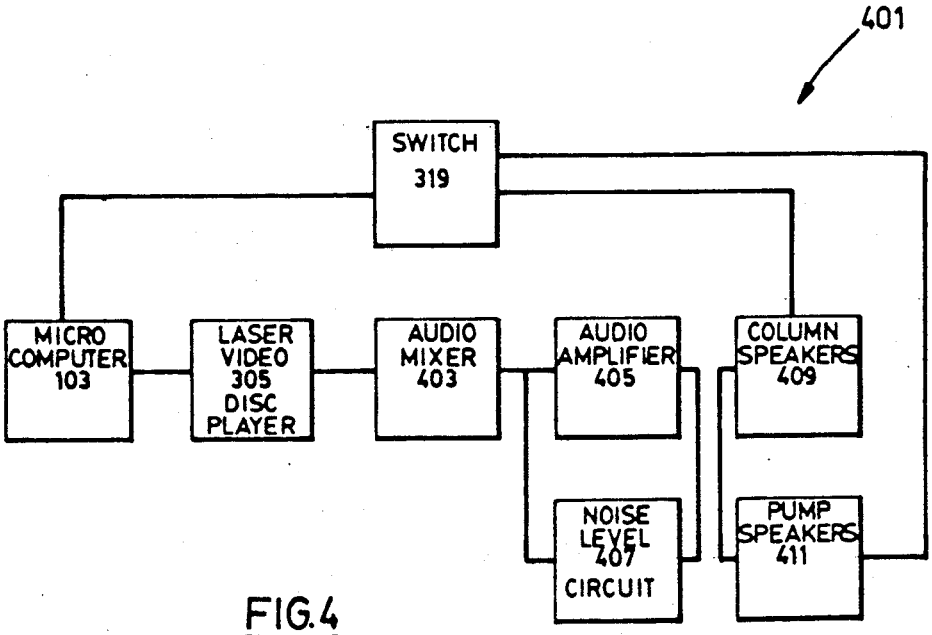
FIG. 4 is a block diagram of an audio circuit employed in the pump system of FIG. 1.

Reference will now be made to FIG. 4 in detailing the audio circuit 401. The PC 103 is connected to the player 305 as outlined in the description in the video circuit portion of this specification. The stereo outputs of the player 305 are fed to a four by two audio mixer 403. The other two inputs to the audio mixer 403 are not presently used but have the potential to accept computer generated voice and tone signals from the PC 103.

The output of the audio mixer 403 is fed into an audio amplifier 405. The output of the audio amplifier 405 is connected to an automatic ambient noise level feedback circuit 407 whose output is then fed back into the input to the audio amplifier 405. The feedback circuit adjusts the gain on the audio amplifier 405 to compensate for changing background noise levels. For instance the gain of the amplifier 405 would be low during the quiet hours of the evening, while the gain would be relatively high during the noisy levels of the day.

The stereo output of the audio amplifier 405 is also fed to column speakers 409 and pump speakers 411.

The microcomputer 103 has an output to the hardware switch 319 as discussed previously. One of the outputs of the switch is capable of turning the column speakers 409 on and off, while another output of the switch 319 is capable of turning the pump speakers 411 on and off.

TOUCH CIRCUIT

Figure 5:
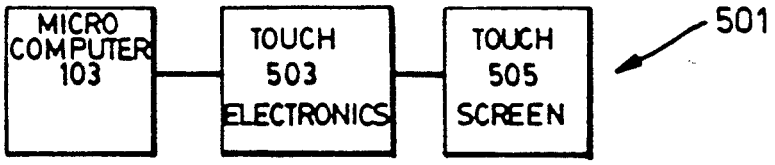
FIG 5 is a block diagram of a touch circuit employed in the pump system of FIG. 1.

Reference will now be made to FIG. 5 in detailing the structure of the touch circuit 501. An output of the PC 103 is connected to touch electronics 503 which control a touch screen 505. The particular touch screen and touch electronics 505, 503 used in the preferred embodiment are manufactured by Microtouch. The touch screen 505 is an anolog capacitive glass sheet with a conductive coating bonded into its surface. The glass surface of the screen 505 is resistent to penetration by sharp objects. The glass construction provides for improved optical clarity. The touch screen 505 is placed over the red- green-blue monitor 317.

The touch electronics 503 measure the position of a capactive coupling caused by a finger or conductive stylus touching the screen 505. The touch data, the position on the screen 505, is generated as an RS 232 signal and converted to current loop for transmission to the PC 103.

The commands, responses, command formats, and response formats for the microtouch touch screen as used in the preferred embodiment are as follows:

COMMAND/RESPONSE FORMATS

Each command is a string of ASCII characters consisting of the following: Header, Command, and Terminator. The first character (Header) in the command string is the ASCII Start-Of-Header character (ASCII 01 hex). This is followed by the command characters (capital letters, no blanks between characters). The last character (Terminator) in each command string is an ASCII carriage return (ASCII 0D hex).

CONTROLLER FIRMWARE

A command is sent to the electronics 503 from the PC 103 over the serial interface. After the electronics 503 executes a command, it returns a three character acknowledgment string to the PC 103. The string consists of a Header, the return code, and a Terminator, as follows:

<Header>Code<Terminator>

The return code is 0 (ASCII 30 hex) for successful completion or any number ranging from 1 to 9 (ASCII 31 hex) for failure. Table 1 lists command/response formats for mux/nonmultiplexed applications. Table 2 lists point formats in decimal.

TABLE 1

| COMMAND/RESPONSE FORMATS | NONMULTIPLEXED |
|---|---|
| COMMAND | |
| Header | ~A |
| Terminator | CR |
| RESPONSE | |
| Header | ~A |
| Terminator | CR |

TABLE 2

| POINT FORMATS | |
|---|---|
| POINTS | DECIMAL |
| Header | ~A |
| Delimiter | , |
| Terminator | CR |

Note: [ ] = touch status.

DATA FORMATS

The X, Y data points sent by the electronics 503 to the PC 103 can be encoded in an ASCII format that represents a decimal format. In the decimal format, each touch point is sent as a string of 9 ASCII characters. Each X and Y value is sent as three characters. A Delimiter (ASCII comma), which separates the X and Y coordinates, is place between the Header and Terminator characters, as follows:

<Header>X<Delimiter>Y<Terminator>

In decimal format, the coordinate values range from 000 to 999.

OPERATING MODES

The electronics 503 has three modes of operation in decimal formats including:

Stream Mode—In stream mode, the electronics 503 sends a continuous stream of data points to the PC 103 while a touch is held on the screen 505.

Point Mode—In point mode, the electronics 503 sends a single data point when a touch is applied to the screen 505. No data is sent while the touch is held or the screen 505.

Inactive Mode—In this mode, no data is sent to the PC 103 by the electronics 503.

COMMANDS

RESET

<H>R<T>

Set the electronics 503 operation to stream mode and the output data format to decimal; clears any points that are present in the output buffer; and runs a electronics 503 self-test routine.

FORMAT

<H>FH<T>

Selects the hexadecimal data format.

MODE

<H>MS<T>

Sets stream mode.

<H>MP<T>

Sets point mode

<H>MI<T>

Sets inactive mode.

CALIBRATION

<H>CI<T> CALIBRATE INTERACTIVE

When you issue the interactive calibration command, the electronics 503 returns <Header>0<Terminator>.

The first touch is used by the electronics 503 to identify the lower-left corner of the display area. No point is sent by the electronics 503 for this touch, instead a <H>1<T> is sent to acknowledge the touch.

The second touch is used by the electronics 503 to identify the upper-right corner of the display area. The electronics 503 returns a <H>0<T>, indicating successful completion.

After calibration, the screen is set to Inactive mode. Issue a MODE command to set the desired mode.

PAYMENT CIRCUIT

Figure 6:
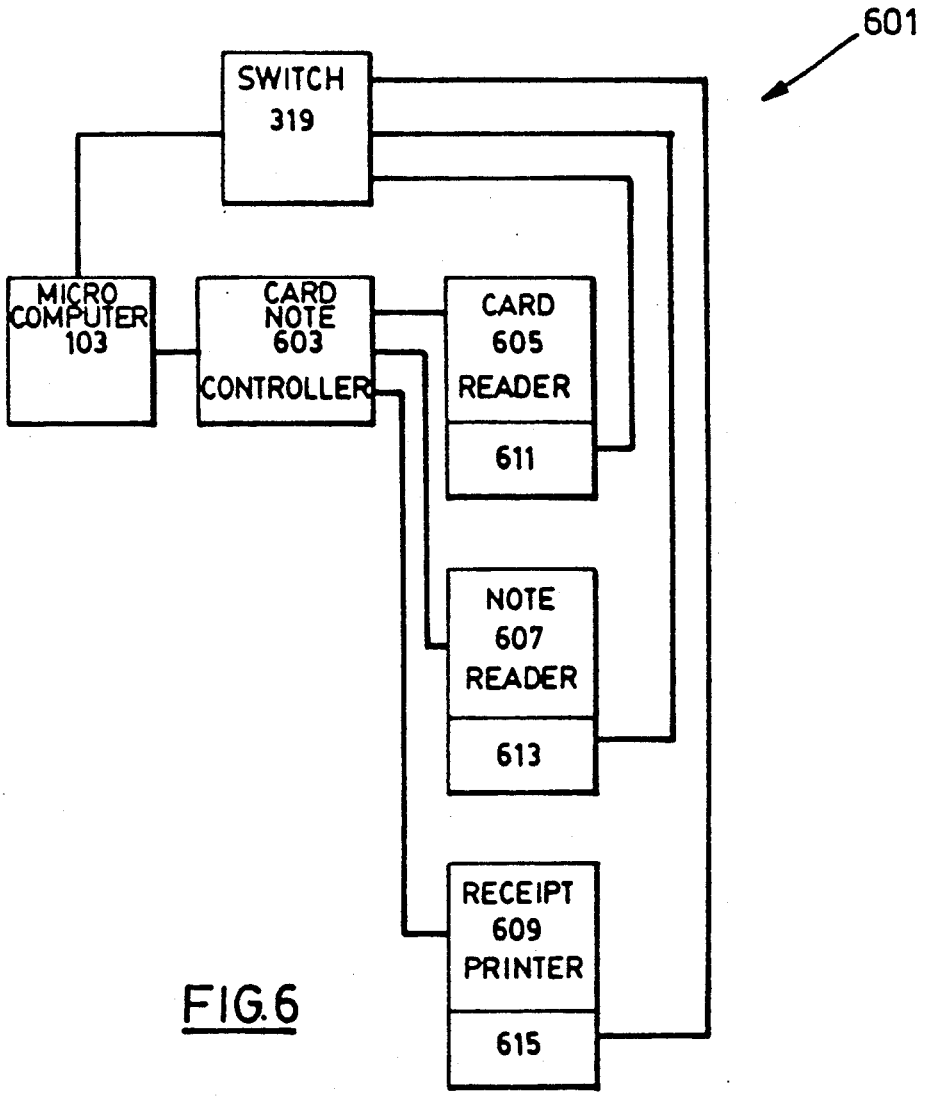
FIG. 6 is a block diagram of a payment circuit employed in the pump system of FIG. 1.

Reference will now be made to FIG. 6 in detailing the structure of the payment circuit 601.

The PC 103 has an output to a card note controller (CNT) 603. The three outputs of the CNT 603 run to a card reader 605, a note reader 607 and a receipt printer 609.

The CNT 603 processes all signals destined for the card and note readers 605, 607 and the receipt printer 609 from the PC 103. In the preferred embodiment an AutoTank CNT was employed.

The commands, responses, command formats and response formats for this particular CNT 603 include the following:

| COMMAND | DESCRIPTION |
|---|---|
| A | Note accepter control |
| B | Beep speaker |
| C | Card control |
| M | Get card data |
| N | Get note data |
| R | Print to receipt printer |

The following sections describe the fields required for each of these commands. Each field is described individually; unless otherwise specified, all fields contain ASCII characters, i.e. a one byte ASCII field described as containing a 0 is represented by '30'H. The command/response itself immediately preceeds the data fields.

NOTE ACCEPTOR CONTROL (A).

| code |
|---|

| | |
|---|---|
| code | This one byte ASCII field describes the note acceptor control action:<br>0: eject note<br>1: accept and stack note |

This command must be sent to the CNT for each bill that has been inserted into the acceptor.

BEEP SPEAKER (B)

| dur | rep |
|---|---|

| | |
|---|---|
| dur | This four byte ASCII field contains the duration of the speaker tone in 10 millisecond counts, i.e. for a 1 second tone, dur would contain 0100. |
| rep | This one byte ASCII field contains a 0 for no repetition or a 1 for a repetitive cycling of the tone. |

The beep command may be sent without any parameters, in which case default values of dur=0025 and rep=0 would be used. To turn off the beeper after a repetitive cycling has been commanded, send a duration of "0000".

CARD CONTROL (C)

| code |
|---|

| | |
|---|---|
| code | This one byte ASCII field describes the card control action:<br>0: eject card immediately |

GET CARD DATA (M)

| code |
|---|

| | |
|---|---|
| code | This one byte field will contain individual track enable information as follows:<br>0: Read track 1, data sent in the clear.<br>2: Read track 2, data sent in the clear.<br>4: Read track 3, data sent in the clear. |

Any or all tracks may be activated for any card read, however, at least one of the tracks must be enabled for the card to open the shutter. The initial condition is all tracks disabled.

The card reader 605 will be disabled after a card is read, therefore, this command must be sent to the CNT 603 each time card data can be accepted by the PC 103. If there is a card in the CNT 603 when this message is received, the specified track will be read and the data transmitted immediately; if there is no card, all card data commands received will be pending and will be executed when a card is inserted.

GET NOTE DATA (n)

The note acceptor 607 will allow all bills to be inserted after this command is received. The note acceptor 607 will be disabled after a note is inserted, therefore, this command must be sent to the CNT 603 each time note data can be accepted by the PC 103.PRINT TO RECEIPT PRINTER (R)

| text |
|---|

| | |
|---|---|
| text | This variable length field contains the ASCII text to be printed and all control characters. An automatic carriage return/line fee will be performed after each complete line (30 characters) has been printed.<br>The following control characters are supported:<br>'OA'H: line feed<br>'OB'H: cliche stamp<br>'OC'H: cut receipt<br>'OH'H: carriage return (automatic line feed)<br>'OE'H: perforate receipt |

CNT RESPONSES

| COMMAND | DESCRIPTION |
|---|---|
| A | Note accepter control response |
| B | Beep speaker response |
| M | Card data |
| N | Note data |
| R | Receipt printer response |

NOTE ACCEPTER CONTROL RESPONSE (A)

| status |
|---|

| | |
|---|---|
| status | This one byte field will contain one of the status code as follows:<br>0: Note ejected<br>1: Note accepted and stacked<br>N: No note in acceptor<br>S: Stacker failure<br>V: Receive error<br>T: Transmit Error<br>W: Connect Error<br>A: Command to short<br>L: Command too long |

BEEP SPEAKER RESPONSE

| status |
|---|

| | |
|---|---|
| status | This one byte field will contain the following status code:<br>O: Command Accepted<br>A: Command data too short<br>L: Command data too long |

-continued

| BEEP SPEAKER RESPONSE |
|---|
| status |
| E: Non-numeric data |

| CARD CONTROL RESPONSE (C) | |
|---|---|
| status | |
| status | This one byte field will contain one of the status codes as follows:<br>O: Card removed<br>A: Command too short<br>L: Command too long<br>N: No card in reader |

CARD DATA (M)

The card reader data message will be in one of the following formats:

| | |
|---|---|
| code | card data |

| | |
|---|---|
| code | This one byte field specifies the track which was read.<br>0: Track 1 data sent in the clear<br>1: Track 1 data sent encrypted<br>2: Track 2 data sent in the clear<br>3: Track 2 data sent encrypted<br>4: Track 3 data sent in the clear<br>5: Track 3 data sent encrypted<br>E: Error reading Track 1<br>F: Error reading Track 2<br>G: Error reading Track 3<br>A: Command too short<br>L: Command too long |
| code data | This field contains the data from the track specified in the code field. The length of unencrypted track 1 is 80 characters, the length of unencrypted track 2 is 40 characters and the length of unencrypted track 3 is 107 characters. |

The CNT 603 will retry to read each enabled track for a total of three attempts; after which a read error message is sent. When the data is read from track 1, a 20H is added to each character before transmission, data from tracks 2 and 3 have 30H added before transmission.

| NOTE DATA (N) | |
|---|---|
| stat | |
| stat | This one byte field contains the current status of the note acceptor/stacker. The following values are possible:<br>1: $1 bill detected<br>2: $5 bill detected<br>3: $10 bill detected<br>4: $20 bill detected<br>J: note acceptor jammed<br>W: connect error<br>T: transmit error<br>V: receive error<br>R: note rejected |

| RECEIPT PRINTER RESPONSE (R) | |
|---|---|
| status | |
| status | This field contains a receipt printer status as follows:<br>O: Print operation completed<br>A: Data field too short<br>B: Printer busy, print request ignored<br>D: Invalid data in text field<br>E: Printer error, print request ignored<br>I: Low receipt paper, print request ignored<br>L: Data field too long<br>N: Text number not defined |

FORMAT OF COMMANDS TO CNT 603:
STX CNT COMMAND CODE DATA ETX LRC
FORMAT OF RESPONSES FROM CNT 603:
STX TERMINAL NO. CNT RESPONSE CODE DATA ETX LRC

The switch 319 is also a part of the payment circuit 601. The card reader, note reader, and print reader 605, 607, 609 are provided with lights 611, 613, 615 respectively. A further three outputs of the switch 319 are connected one to each of the lights 611, 613, 615. The use of the switch 319 allows these lights 611, 613, 615 to be turned on and off by the PC 103.

KIOSK CIRCUIT

Figure 7:
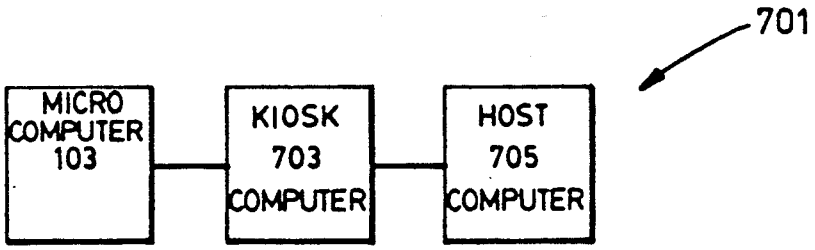
FIG. 7 is a block diagram of a kiosk computer circuit employed in the pump system of FIG. 1.

Reference will now be made to FIG. 7 in detailing the structure of the kiosk circuit 701.

The microcomputer 103 is connected by a RS-232 line to a bulloch BT-9000 kiosk computer 703. Data communication is asynchronous at a baud rate 1200. Character length is 7 data bits with 2 stop bits and one even parity bit.

The kiosk computer 703 is a further connected to a host computer 705. The host computer 705 may be connected to other kiosk computers 703 in other locations to remotely capture point of sale information form many systems. Credit cards may be credit authorized by the kiosk computer 703 over a phone line connected thereto. The computer 703 accepts and sends the following command response/request format, commands and responses/requests.

COMMAND FORMAT

There are two formats for messages. The first format is simply an emulation of a subset of the pump 105 message set. For example, if the PC 103 wants to tell the computer 703 that it has a stolen credit card in its card reader 605, then it sends the STX format message "I HAVE A HOT CARD" to the computer 703.

If a message includes data, then the data is placed after the PUMP ID field and before the DEL (message terminator).

COMMANDS

TAKE PUMP FROM ME

The PC 103 is requesting the computer 703 to take over control of the emulated pump. This is normally done prior to a kiosk authorization request or kiosk transaction payment request.

No data.

I HAVE A HOT CARD

The column is informing the computer 703 that it has a stolen card in its card reader 605. The PC 105 will not allow the card to be released until it 103 receives a "RELEASE CARD" request from the computer 703.

No data.

I NEED ATTENTION

The PC 103 is informing the computer 703 that it 103 has a system malfunction. A plain text description of the problem is sent in the data field of the message. The PC 103 will not resume processing transactions until it receives a "RESET YOURSELF PLEASE" request from the computer 703.

The data field contains the description of the problem.

GIVE ME PUMP MAP

The PC 103 is requesting the computer 703 to send it 103 a pump map. A pump map describes the association of hose numbers to grade numbers. For example, Hose 1 could be either regular or super unleaded.

No data.

HERE IS A TRANSACTION

The PC 103 is posting a PRE-PAY transaction to the computer 703.

The data field contains pump 105 D command data field appended with a 5 byte cash amount/authorization number field and a 2 byte response code field.

RESPONSES/REQUESTS

TAKE PUMP FROM ME

The computer 703 is releasing control of the emulated pump after either a kiosk authorization or the payment of a kiosk transaction.

No data.

HERE IS PUMP MAP

The computer 703 is requesting the PC 103 to update the pump map of the PC 103.

The data field contains a 3 byte pump map.

HERE IS TIMESTAMP

The computer 703 is requesting the PC 103 to update its time clock.

The data field contains a 12 byte timestamp, YYMMDDHHMMSS.

RESET YOURSELF PLEASE

The computer 703 is requesting that the pump 103 return to active service. This is normally sent subsequent to an "I NEED ATTENTION" request from the PC 103 to the computer 703.

No data.

RELEASE CARD PLEASE

The computer 703 is requesting that the PC 103 release a stolen card from the reader 605. This is normally sent some time after the PC 103 has sent a "I HAVE A HOT CARD" request to the computer 703.

No data.

CHANGE PRICES PLEASE

The computer 703 is requesting that the PC 103 commence a price change action.

No data.

HALT PUMP PLEASE

The computer 703 is requesting that the PC 103 turn the pump 105 motors off.

No data.

STATUS

The computer 703 is polling the PC 103 for status.

No data.

DISPLAY DATA

The computer 703 is requesting the current pump 105 transaction data.

No data.

AUTHORIZE

The computer 703 is requesting that the pump 105 be authorized.

No data.

SET SALE COMPLETE

The computer 703 is requesting that the "SALE COMPLETE" bit of the pump 105 status message be set.

No data.

EXTERNAL SOURCE CIRCUIT

Reference will now be made to FIG. 8 which depicts the external source circuit 801. The PC 103 has an output connected to a modem 803.

modem 803 may be connected to any external device which supports communication by way of modem. In the preferred embodiment an external diagnostics computer 805 was connected to the modem 803. This computer 805 as its name suggests is used to monitor the proper operation of the PC 103 and the system 101, and to provide system software corrections. Equally, the modem 803 may be used to telephone a centralized credit data bank to authorize credit cards for monetary amounts.

SET SALE COMPLETE

The computer 703 is requesting that the "SALE COMPLETE" bit of the pump 105 status message be set.

No data.

SYSTEM SOFTWARE

The system software mentioned previously is annexed as schedule A to this description. The software is written in the C language for the QNX operating system running on a Tandy HD3000 microcomputer 103.

Figure 13:
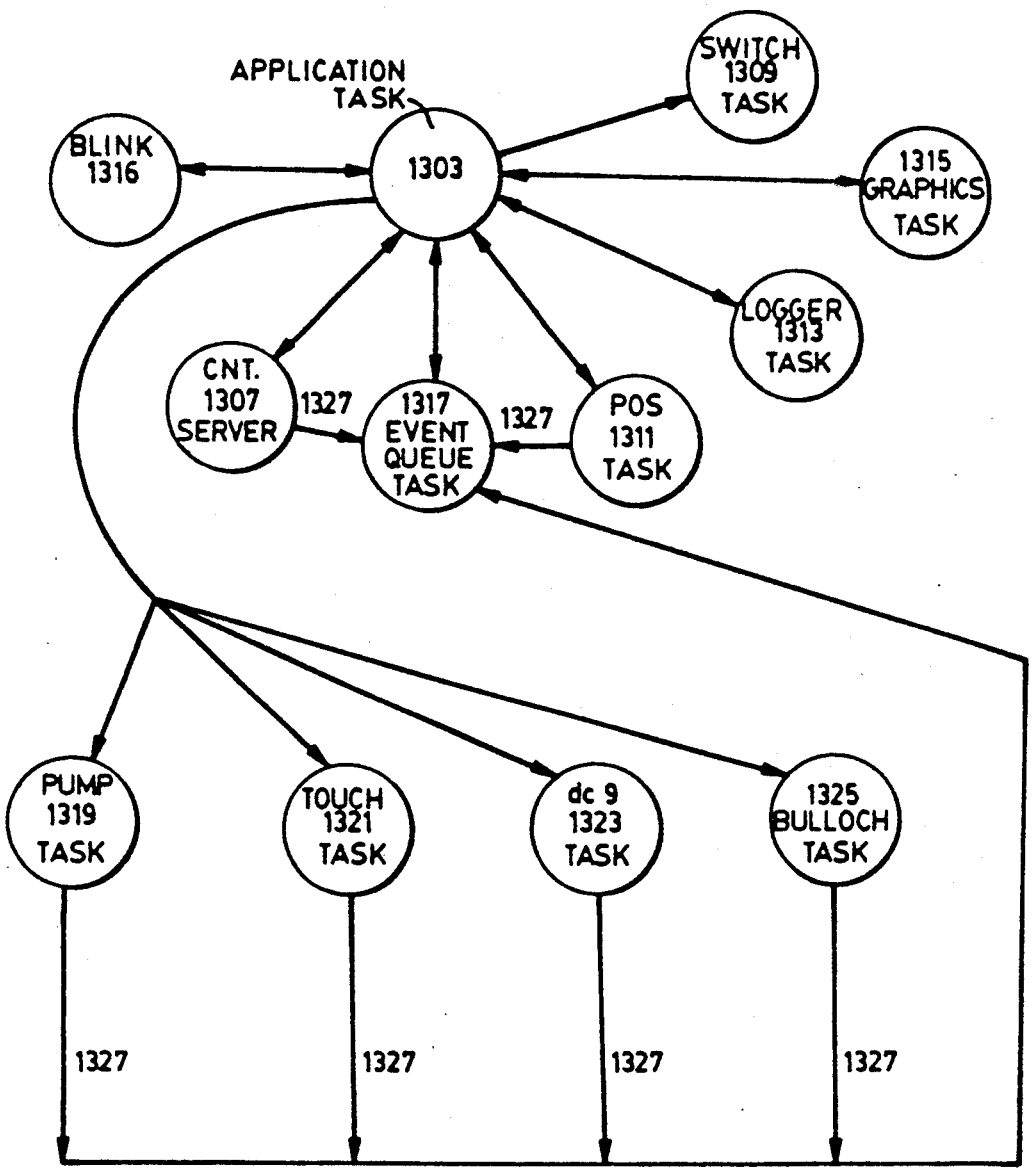
FIG. 13 is a block diagram of the task structure according to the preferred embodiment of the present invention.

Referring to FIG. 13, the software implementation of the task structure will be discussed.

This operating system and language were chosen as the system may be required to operate unattended in potentially hazardous environments. The QNX operating system running in protected mode confines most software problems to the individual tasks. As well as adding to system reliability, the ability to prevent total system failure caused by software or hardware faults allows for remote diagnosis and remote software correction of problems.

The tasks 1303 through 1325 communicate with one another to run the system. All tasks 1303 through 1325 begin operation when the PC 103 is powered up and run as long as power remains.

The tasks 1303 through 1325 fall into three categories: applications 1303, servers 1307 through 1315, workers 1316 through 1325. One application task 1303 is required to control any one system. Each PC 103 in the preferred embodiment controls two systems, therefore the PC 103 will contain two application tasks 1303.

Severs and workers 1307 through 1325 provide services and work for the application tasks 1303. Therefore, the applications 1303 are often referred to as clients in the software. The applications 1303 are also referred to as DAVEs for reasons which are unimportant.

Workers 1316 through 1325 work for only one application (client) 1303. Servers 1307 through 1315 are capable of providing their services to more than one application (client) 1303. Thus, for one PC 103 operating two systems only instance of each server 1307 through 1315 exists. Servers 1307 through 1325 provide serial access to hardware and system resources which must be accessed by more than one client 1203, but in a serial manner.

In operation the application 1303 requests an operating to take place by sending a request to a server or worker 1307 through 1325. The C language functions which accept these requests are contained in the /int sub-directory located after the main directory for each task.

WORKERS

The workers 1316 through 1325 do the following work:

BLINK:

Blink 1316 causes an introductory screen provided though the video circuit 307 to continuously switch from white to background colours and back again (blink).

EVENT QUEUE:

The event queue task 1317 provides a serialized first in first out (FIFO) event queue to its application task (client) 1303. The event requests come from CNT, POS, pump, touch, dc9, and bulloch tasks 1307, 1311, 1319, 1321, 1323, 1325 as shown by arrows 1327. The event queue allows for asynchronous transfer of communications to the application task 1303 from the servers and workers 1307 through 1325.

PUMP:

The pump task 1319 performs communications with the pump 105.

TOUCH:

The touch task 1321 performs communications with the touch electronics 503.

DC9:

The dc9 task 1323 performs communications with the laserdisk player 305.

BULLOCH:

The bulloch task 1325 performs communications with the kiosk computer 703.

SERVERS:

The server tasks 1307 through 1315 provide the following services:

CNT:

The CNT 1307 provides communication services to the CNT 603.

SWITCH:

The switch task 1398 provides serialized access to the hardware switch 319.

POS:

The POS task 1311 provides communication services to the host computer 705 via the kiosk computer 703. Sending of Point of Sale data to the centralized host computer 705.

LOGGER:

The logger task 1313 provides logging services to track the states of the various tasks 1303 through 1325.

GRAPH:

If the video is in the graphics board 303 memory, it is displayed via the graphics task 1315. If the video is in a disk of the player 305, the dc9 task 1313 is called. The transaction data from the pump 105 is always displayed via the hardward associated with the pump 105 in the video circuit 301.

APPLICATIONS

The application tasks 1303 steps through the steps of a sale transaction sending commands to the various servers and workers 1305 through 1325.

Some commands will take longer than a fraction of a second to respond to the command signal from the application task 1303 with the outcome. For the devices which take this longer period of time, their responses or requests to the application task are sent via the event queue task 1317.

This asynchronous process of comand/response frees up the application task 1303 to respond immediately to an event generated by the customer.

Servers and workers 1307 through 1325 also provide timeout functions so that a command is responded to within a given amount of time whether or not the customer performs a specified action.

OPERATION

The application task 1303 is passed a name and number, and the total number of application tasks 1303.

The application task 1303 initializes itself and then processes transactions.

Initialization:

Initialization is passed the same arguments as the application task. The task 1303 finds out which task it is from the arguments. The task 1303 calls the logger task 1313 logging the application 1303 status as start and printing the time in a log file.

The task 1303 checks to see that it is properly running within the operating system. The task 1303 sets up two records which will keep track of the current transaction and the previous transaction. The previous transaction record is important as regulatory bodies require transaction data to appear on the screen at all times and these records may be recalled to display the data. As well, the previous transactions record may be linked to determine past transaction data. A file is opened and zeroed where the transaction data will be kept track of. The previous transaction record takes data from the data file.

The event queue task 1317 is created. The number of the task 1317 is returned to the application task 1303. The task 1303 checks to see that the CNT, graphics, POS and switch tasks 1307, 1315, 1311, 1309 are running. The pump colour maps are brought in by the graphics task 1315. The touch zones are deactivated by the touch task 1321, a pump out of order screen is displayed via the graphics task 1315, and the touch zones are reactivated.

The video, card light, cash light and receipt light are turned off via the switch task 1209.

The blink task 1316 is created. The device ports for the player 305, touch electronics 503, pump 105, and kiosk computer 703 are opened. The CNT task 1303 and POS task 1311 queues are started. The CNT 603 is reset. The application task 1303 status is changed to ready by the logger task 1313.

This ends the initialization phase.

Process transactions:

The application task 1303 then processes transactions.

The task 1303 does a sale routine unless it encounters a transaction problem.

The sale routine resets all information and devices. First they cause the dc9 task 1323 to turn the player 305 show off (i.e. stop the disc presently in the player 305). Task 1303 switches the video off, both speakers off, and the column speaker back on via the switch task 1309. The current transaction record is cleared, the grade pumped is set to the previous grade pumped, English is assumed, and the transaction sequence number is updated.

The task 1303 asks the pump 105 to identify itself via the pump task 1319.

The bulloch task 1325 is checked to see if a price change has been requested. If so, it is performed by taking the prices from the kiosk computer 703 via the bulloch task 1325 and sending them to the pump task 1319.

The present prices are then read from the pump 105 to the task 1303 via the pump task 1319.

The time at which the prices were read is put into the current transaction record.

A language choice routine is then entered. The touch zones are deactivated. the language display, shown in FIG. 15, is displayed and the touch zones are reactivated. The English touch zone is that around "Touch here to start" while the French touch zone is around "Appuyez sur la touche". Other areas of the screen 505 are not touch sensitive. The transaction data of the previous transaction is displayed by the monitor 317 via the graphic task 1315. The pump task 1319 is requested to report if pump goes out of service.

The display is set to blinking by the blink task 1316 and the graphics task 1315.

The task 1303 then waits for an event. Either the screen 505 is touched, the prices are reset, or something happens to the pump 105.

If the screen 505 is touched it is determined whether the English or French section was chosen and the blinking is stopped. If one of the other events occurs an exception is processed.

Assuming a language has been chosen, a preset choices display is displayed in the chosen language and the touch zones are activated. FIG. 16 shows the preset choices display 1601 for the English language having preset sections 1603. The areas around each preset section 1603, when touched, will send a signal representative of the preset amount. If the screen 505 is touched outside the preset sections 1603 the display 1601 will change to a French display, not shown, as it is assumed the user does not understand the language. The preset routine would then be entered again.

When a preset zone 1603 touched the amount is displayed in a preset box 1605 and the task 1303 is informed of the choice made.

If the screen 505 is not touched within a required time, the task 1303 returns to the beginning of the transaction process. The task 1303 assumes the customer has walked away.

If the customer has made a preset choice, a payment routine is then entered and continues unless a problem occurs. The customer is asked whether he or she wishes to pay by cash or credit card. The display 1701 is shown is FIG. 17.

If paying by credit card the card touch section 1703 is touched. A card selection display 1801 is shown in FIG. 18. Several cards may be used as shown in the display 1801. An audio prompt via the DC9 task 1323 informs the customer of the cards that may be used and requests that the customer to touch the screen on the intended card.

On selection of a card, the display changes to motion video with audio from the DC9 task 1323 showing the user which way to insert the card in the card reader 605.

With the card correctly inserted and read by the card reader 605, the customer is informed by an audio and video display, as shown in FIG. 20, via the DC9 task 1323 that the card is being validated. The card is validated via the POS task 1311.

On validation, a motion video plus audio display, via the DC9 task 1323, requests the customer to remove the card from the card reader 605 and to proceed to fill the automobile with gas.

If the host computer 705 via the kiosk computer 703 and the POS task 1311 is unable to validate the card, the card is returned and the customer is re-offered the card cash display 1701.

During the filling process, the customer is entertained with motion video and audio display from the player 305 via the DC9 task 1323 in the upper portion 1401 of the screen 505. Simultaneously, the transaction data is continuously displayed in the lower portion of the screen 1403.

At the completion of the filling procedure, the pump 105 is asked whether its hook is down via the task 1303. If the hook is not down, a video and audio display is presented telling the customer to press the hook down. This ends the filling procedure.

A receipt request display is displayed asking the customer if he or she requires a receipt. If a receipt is required the display area is touched. A receipt is printed by the receipt printer 609 via the CNT task 1307.

Either after receipt is printed or a required amount of time has passed, a thank you video and audio display 1901, as shown in FIG. 19, are displayed. The current transaction data is sent to the next previous transaction data record and is posted to the cheque file. The transaction information is then sent to the kiosk computer 703 via the POS task 1311. The application task 1303 is then logged sale complete in the log file.

If the credit card used by the customer is not one which may be read by the card reader 605 the customer after selecting this type of credit card on the card selection screen of FIG. 18 is required to validate the card at the kiosk shown in Figure at the end of the fill procedure. The proceed to fill display is immediately shown with the additional words "please pay at the kiosk" and with an audio display advising the customer to pay at the kiosk when finished filling.

The transaction now becomes a kiosk pay routine. The pump 105 must be authorized by the kiosk computer 703 via the bulloch task 1325. The kiosk computer 703 then communicates with the pump 105 via the bulloch task 1325. When a hose is lifted from the pump 105 the kiosk computer 703 is notified. The kiosk computer 703 authorizes the pump 105. Again the motion video and audio displays entertain the customer during filling.

When the hook of the pump is pressed down the kiosk computer 703 is notified. The kiosk computer 703 takes the transaction data from the pump 105. The bulloch task 1325 notifies the application task 1303 that the fill procedure is completed and the sale is logged sale complete in the log file.

The customer is requested to pay at the kiosk by a video and audio display 1901, as shown in FIG. 19.

If the cash payment option on display 1701 was selected, the customer is shown a display on the manner in which notes may be inserted into the note reader 607. On acceptance of the first note inserted by the customer the display changes to an all cash in area 2103, and a window 2105 in which an accumulated total is displayed 2101, as shown in FIG. 21, via the graph task 1315. An audio display via the DC9 task 1323 requests the customer to touch the all cash in area when the last note has been inserted into the note reader 607. As each note is inserted the window display 2105 is updated to reflect the total number of dollars entered by the customer.

When the all cash in area 2103 is touched an audio and video display via the DC9 task 1323 requests the user to selected a hose and proceed to fill.

If the customer had preset the pump to a fixed amount at the preset choices stage, then when the cash inserted equals or exceeds the preset amount the proceed to fill display would automatically appear.

Again during the filling procedure the customer is shown a variety of video and audio displays while the transaction data is displayed on the lower portion 1403 of the screen.

When the filling procedure has been completed and the hook has been reset the receipt display is presented to the customer.

If at the completion of the transaction cash totalling an amount larger than the value of gasoline dispensed has been inserted, a receipt and refund display 2201, as shown in FIG. 22, is displayed. A window 2203 in the display 2201 shows the amount of refund due to the customer. An audio display advises the customer to obtain a receipt by touching a print receipt display area 2205 and to take the receipt to the kiosk for a refund.

The thank you display 2001 is shown after the receipt is printed or a required amount of time has passed.

The current transaction data is sent to the next previous transaction data record and is posted to the cheque file. The transaction information is then sent to the kiosk computer 703 via the POS task 1311. The application task 1303 is then logged sale complete in the log file.

COMMAND FILES

The command files which set the device terminals for communication between the hardware 101 and the software are appended to this description as schedule B. The command files determine the parameters for communication transfer and the terminal at which transfer is to occur. The command files also use the utility program Load-frame to down load the graphics specifications for the various displays to the memory of the graphics board 303.

While the present invention has been disclosed in connection with the preferred embodiment thereof it should be understood that there may be other embodiments which fall within the spirit and scope of the invention as defined by the following claims.

SCHEDULE A dave/request.h

```
#define MAX_STRING_DATA 150

typedef struct   {
        unsigned opcode;
        unsigned client;
        unsigned value1;
        unsigned value2;
        unsigned value3;
        unsigned value4;
        unsigned value5;
        unsigned value6;
        char      string_data [ MAX_STRING_DATA  ];
} request;

#define REPLY (t,b)              reply (t,b,sizeof(*b))
#define SEND (t,b)               send(t,b,b sizeof(*b)
#define RECEIVE_ANY(b)    receive (0,b,sizeof(*b))
```

```
#define RECEIVE(t,b)            receive(t,b,sizeof(*b))
#define CRECEIVE(t,b)           creceive(t,b,sizeof,(*b))
#define COPY_SAFELY(a,b)        strncpy(a,b,sizeof(a))

#define        FRENCH           1
#define   ENGLISH       0
#define   VISA_CARD             0
#define   PETRO_CARD            1
#define   MASTER_CARD           2
#define   UNKNOWN_CARD          3
#define   BAD_DATE_CARD    9000
```

DIRECTORY

```
----------- level: 3 -----------
bulloch/int/bull_int.o
     bull_cmd
     bullochs_id
     give_me_pump_map
     give_me_timestamp
     here_is_a_transaction
     i_have_a_hot_card
     i_need_attention
     kiosk_authorize
     kiosk_payment
     open_bulloch
     price_change_completed
dc9/int/audios.o
     all_cash_in_audio
     announce_audio
     bad_card_audio
     bad_note_audio
     both_readers_down_audio
     cancelled_card_audio
     cancelled_cash_audio
     card_abend_audio
     card_auth_audio
```

```
        card_choice_audio
        card_reader_down_audio
        cash_abend_audio
        declined_card_audio
        hot_card_audio
        kiosk_alerted_audio
        kiosk_halt_audio
        note_reader_down_audio
        other_card_audio
        out_of_service_audio
        pay_choice_audio
        petro_card_audio
        printer_dead_audio
        pump_money_audio
        pump_number_audio
        pump_or_else_audio
        receipt_credit_audio
        receipt_no_credit_audio
        remove_card_audio
        replace_nozzle_audio
        replace_your_card_audio
        system_down_audio
    dc9/int/videos.o
        card_auth_video
        fill_video
        goodbye_thanks_video
        insert_bill_video
        insert_card_video
        lift_and_pay_at_kiosk_video
        lift_nozzle_video
        longer_card_auth_video
        remove_card_video
    events/int/bulloch_event.o
        bulloch_event
    events/int/card_event.o
        card_event
    events/int/cnt_event.o
        cnt_event
```

```
events/int/control_event.o
        control_event
events/int/get_event.o
        get_event
events/int/note_event.o
        note_event
events/int/player_status.o
        player_status_event
events/int/pos_event.o
        pos_event
events/int/power_event.o
        power_event
events/int/price_event.o
        price-event
events/int/print event.o
        print_event
events/int/pump_event.o
        pump_event
events/int/show_over.o
        show_over_event
events/int/stack_event.o
        stack_event
events/int/touch_event.o
        touch_event
events/int/touch_status.o
        touch_status_event
events/int/vseek_event.o
        video_seek_event
logger/int/log_2260.o
        log_2260
logger/int/log_bulloch.o
        log bulloch
logger/int/log_dave.o
        log_dave
logger/int/log_eq.o
        log_eq
logger/int/log_pos.o
        log_pos
```

```
logger/int_power.o
     Log_power
logger/int/log_pump.o
     log_pump
logger/int/log_touch.o
     log_touch
logger/int/log_video.o
     log_video
logger/int/relog.o
     relog
logger/int/stop_log.o
     stop logger
newpos/int/admin_int.o
     pos_admin-cmd
     pos_delete_fit_record
     pos_die
     pos_give_me_a_fit_record
     pos_give_me_your_info
     pos_give-queue_entry
     pos_load_fit
     pos_load_info
     pos_probe
     pos_reset_stats
     pos_set_link_timeout
newpos/int/pos_int.o
     open_pos_server
     pos_active
     pos_authorize_card
     pos_capture_transaction
     pos_cmd
     pos_decode_card
     pos_server_alive
     pos_whats_cards_date
     pos_whats_header_1
switch/int/audio.o
     audio_1_on
     audio_2_on
```

```
switch/int/genlock.o
     clear_genlock_trigger
     set_genlock_trigger
switch/int/lights.o
     card_light_off
     card_light_on
     cash_light_off
     cash_light_on
     receipt_light_off
     receipt_light_on
     switch_server_alive
switch/int/speakers.o
     both_speakers_off
     both_speakers_on
     column_speaker_off
     column_speaker_on
     pump_speaker_off
     pump_speaker_on
switch/int/speakers.o
     both_speakers_off
     both_speakers_on
     column_speaker_off
     column_speaker_on
     pump_speaker_off
     pump_speaker_on
switch/int/video.o
     video_off
     video_on

----------- level:  2 ---------
blink/int/blink_int.o
     blink_off
     blink_on
     start_blinker
bulloch/int/bull1_int.o
     load_pump_total
cnt/int/cnt_int/o
```

```
        cnt_beep
        cnt_clear_timer
        cnt_cmd
        cnt_server_alive
        open_cnt
    dc9/int/intl.o
        open_video_player
        player_status_request
        prequest
        stop_video_show
    events/int/equeue_id.o
        event_queue_id
    events/int/event.o
        event
    graph/int/graph_int.o
        display_card_type
        display_cash_in
        display_cash_in_low
        display_clear_prepay
        display_credit
        display_frame
        display_grade
        display_preset
        display_preset_label
        display_prices
        display_pump_number
        display_string
        display_string_centered
        display_system_cancel_credit
        display_transaction_type
        display_user_cancel_credit
        graphics_ram_usage
        graphics_server_alive
        load_bits
        load_frame
        open_screen
        open_screen_warm
```

```
graph/int/graph_int2.o
     display_arrow
     display_init_arrow
     display_reset_arrow
logger/int/1request.o
     1request
misc/blastrow.o
     blastrow
newpos/int/power_int.o
     pos_disable_transmissions
     pos_enable_transmissions
     pos_save_data
newpos/int/power_int.o
     pos_disable_transmissions
     pos_enable_transmissions
     pos_save_data
pump/int/pump_int.o
     authorize_pump
     open_pump
     pump_change_prices
     pump_filling_data_request
     pump_go_native
     pump_go_touchcom
     pump_halt_now
     pump_hose_filled
     pump_hose_selected
     pump_hose_totals_request
     pump_id_request
     pump_is_hook_down
     pump_is_hook_down_now
     pump_preset_request
     pump_prices_request
     pump_ready_for_fill
     pump_restart_now
     pump_status_request
     quiet_pump
     report_pump_out_of_service
```

```
        set_pump_sale_complete
switch/int/int2.o
        srequest
touch/int/touch_int.o
        activate_touchscreen
        clear_touch_zones
        deactivate_touchscreen
        define_touch_zone
        open_touchscreen
        touch_status_request
-----------level:  1---------
events/int/start_queue.o
        <equeue_id>
        start_event_queue
misc/address.o
        Address_of
misc/cal.o
        -calcsecs
        calerr
        caljoin
        calmthlen
        calnow
        calnwork
        calsplit
        caltimezone
        calwkday
misc/daves_name.o
        daves_name
misc/disallow.o
        disallow
misc/dr.o
        '<dr>
misc/fatou.o
        fatol
        fatou
misc/movebytes.o
        movebytes
```

```
30      misc/movedata.o
            movedata
        misc/my_ds.o
            my_ds
        misc/my_open.o
35          my_open
        misc/print_ctrl.o   print_ctrl
                        /user/steve/tools/select.c


/* utility to generate 286 selectors */

main (argc, argv)
        int argc;
        char *argv[];
{
        unsigned segment, offset, limit, mask, selector;

        if ( argc != 5 )
                usage ();
        else
        {
          segment = atoh(argv[1]);
          offset  = atoh(argv[2]);
          limit   = atoh(argv[3]);
          mask    = atoh(argv[4]);
          selector = create_seg ( offset, segment, limit, mask );
                printf
  ( "real address %04x:%04x limit %04x mask %4x selector %x\n",
                        segment, offset, limit, mask, selector );
        }
```

```
}

usage ( )
{
        printf ( "select hi8 low16 limit mask\n" );
}
```

appl/card_pay.c

```
#include "screens.h"
#include "vars.h"
#include "exceptions.h"

#include <stdio.h>

Card_payment( )
{
    int  et;
    char *e;
    unsigned event_mask;

    if  (  pos_active( dave ) == 0 ) /*  can't validate any */
        longjmp(  post_pay_trap,  POS_INACTIVE  ); /* cards now*/

    while  ((et  = Type_of_card_choice()) == 2)/*petro reset loop*
            ;
    if ( et == 0 )
            return 0;

    card_light_on( dave );
    if ( !card_reader_armed( ) )
            arm_card_reader( 60 );
    Set_user_entry( insert_card_video( T->language ) );
```

```
event_mask    =    VIDEO_SEEK_EVENT    |    CARD_EVENT    |
                   SCREEN_TOUCHED |  SHOW_OVER;
while (et = new_event( &e, event_mask ))
{
        switch( et )
        {
        case SHOW_OVER:
                video_off( dave );
                break;
        case VIDEO_SEEK_EVENT:
                show_screen( dave, INSERT_CARD_SCREEN );
                break;
        case  SCREEN_TOUCHED: /* user has cancelled */

            video_off( dave );
            stop_video_show( );
            cnt_clear_timer( dave );
            card_light_off( dave );
            Set_user_exit( );
            return 0;
        default:        /* a CARD event */
            Set_user_exit( );
            switch( *e )
            {
            case    'C':    break;/*ignore eject responses*/
            case 'Z':
            case 'M':
                switch (e [ 1 ])
                {
```

```
                case  'Z':
                longjmp( transaction_trap, JUST_RESET_ME );
                  break;
            case '2': COPY_SAFELY( T->card_number, e + 2 );
            T-    >card_type = pos_decode_card( dave, e + 2 );
            if ( T->card_type == BAD_DATE_CARD )
            {
            T->response_code[ 0 ] = '5';
            T->response_code[ 1 ] = '4';
            }
            else if ( Card_type_is_known_to_me( T->card_type ) )
            goto captured;
            longjmp( post_pay_trap, CARD_REFUSED_POS );
            break;
        case 'F':   Card_read_failure( );
            break;
        default:    longjmp( transaction_trap, CANT_READ_CARD );
            break;

        }
      } /* end of card switch */
    } /* end of event switch */
  { /* end of while */
captured:
    display_card_type( dave, T->card_type );
    Validate_card( );
    Eject_card( );
    return 1;
}
```

```
Card_type_is_known_to_me( type )
    unsigned type;
{
    return type != UNKNOWN_CARD;
}

Card_read_failure( )
{
    char *e;
    show_screen( dave, BAD_CARD_SCREEN );
    cnt_cmd(  dave, "CO", 0 );    /* spit it  out  */
    video_off( dave );
    bad_card_audio( T->language );  /* tell the user    */
    new_event( &e, CARD_EVENT );    /* wait for removal */
    e++;
    if ( *e != 'O' && *e != 'N' )
        longjmp( transaction_trap, CANT_READ_CARD );
    arm_card_reader( 30 );          /* let user retry   */
}
Validate_card( )
{
    char     *e;
    unsigned et,
    shows_played = 0,
    card_validated = 0;
    if ( pos_authorize_card( dave, T->preset_amount,
        T->card_number ) == 0 )longjmp( post_pay_trap,
     CARD_REFUSED_POS );
show_screen( dave, STANDBY_AUTH_SCREEN );
```

```
stop_video_show( );
video_off( dave );
card_auth_audio( T->language );
while( et = new_event( &e, SHOW_OVER | POS_EVENT ) )
{
        switch( et )
        {
        case SHOW_OVER: shows_played++;

        if ( shows_played == 1 )        /* audio is over */
        card_auth_video( T->language );
        if ( shows_played == 2 )
                {
        if ( card_validated )
                return;
                 else
        longer_card_auth_video( T->language );
                }
                break;
        case POS_EVENT:
        memcpy( T->auth_number, e + 9, 5 );
        memcpy( T->response_code, e + 14, 2 );
        T->language_code = e[ 16 ];
        if ( memcmp( e, "HOTCARD", 7 ) == 0 )
        hot_card( );
        else if ( memcmp( e, "POSTPAY", 7 ) == 0 )
        longjmp( post_pay_trap, CARD_REFUSED_POS );
        else if ( memcmp( e, "VALIDATED", 9 ) == 0 )
        {
```

```
            if ( shows_played >= 2 )  /* first video is over */
            return;
            card_validated = 1;
            }
            else
            longjmp( post_pay_trap, CARD_REFUSED_POS );
            break;
            }
        }
    }

    Eject_card( )
    {
        char      *e,
                        *get_pump_event( ),
                        response;
        unsigned et,
                        card_removed = 0,
                        show_over = 0;
        cnt_cmd( dave, "CO", 0 );
        cnt_beep( dave );
        show_screen( dave, REMOVE_CARD_SCREEN );
        remove_card_video( T->language );
        while( 1 )
    {
        et = new_event( &e, CARD_EVENT | SHOW_OVER );
            response = e[ 1 ];
            if ( et == SHOW_OVER )
            {
                    show_over = 1;
```

```
                if ( card_removed )
                        return;
                else
                        video_off( dave );
        }
        else
                switch( response )
                {
                case '0': card_light_off( dave );
                  card_removed = 1;
                  pump_is_hook_down_now( );
                  if ( Equal_buffers( get_pump_event( ),
                  "HOOKUP", 6 ) )
                  return;
                  if ( show_over )
                      return;
                      break;
  default : longjmp( transaction_trap, CANT_EJECT_CARD );
          break;
}
   }
}
static unsigned reader_armed;
arm_card_reader( seconds )
unsigned seconds;
{
cnt_cmd( dave, "M2", seconds );
```

```
reader_armed = 1;
}
Disarm_card_reader( )
{
   reader_armed = 0;
}
card_reader_armed( )
{
return reader_armed;
}
```

appl/cash_pay.c

```
#include "screens.h"
#include "vars.h"
#include "exceptions.h"
#include <stdio.h>

static jmp_buf _dough,
         *too_much_dough;
static int all_cash_in_visible;

#define PETRO_LIMIT                    1
#define PRESET_AMOUNT_EXCEEDED 2

static int note_read,
         cash_in_state;

#define FIRST_NOTE    0
#define NEXT_NOTE    1
#define STACK         2
#define LAST_STACK   3
```

```
Cash_payment( )
{
        char *e;

        if ( setjmp( too_much_dough ) )     /* say something ? */
                ;
        else
        {
                T->cents_in          = 0;
                all_cash_in_visible = 0;
                cash_in_state        = FIRST_NOTE;
                cash_light_on( dave );
                insert_bill_video( T->language );
                new_event( &e, VIDEO_SEEK_EVENT );
                show_screen( dave, INSERT_BILL_SCREEN );
                if ( !note_reader_armed( ) )
                        arm_note_reader( 60 );
                more_notes( );
        }
        if (T->cents_in > 0) /* user may have cancelled  */
        {

        if  (T->preset_amount > T->cents_in)
                                /* preset for $5.00, but only  */
        T->preset_amount  = T->cents_in;  /*  put in $2.00, eg.*/
        if  (T->preset_amount == 0) /*  it's a fill ----       */
        T->preset_amount  =  T->cents_in;
        display_preset_label(dave, T->language, T->preset_amount );
        }
        cash_light_off( dave );
```

```
        return T->cents_in > 0; /* user may have cancelled      */
}

/*************************************************/
/*                                               */
/*      EVENT HANDLERS                           */
/*                                               */
/*************************************************/

nop( e )

        char *e;

{

        return 1;

}

kv( e )             /* video event handler */

        char *e;

{

        video_off( dave );

        return 1;

}

first_note( e )         /* waiting for very first note */

        char *e;

{

        char response = e[ 1 ];

        switch( response )

        {

        case  CNT_TIMEOUT:     /*  user  never  tendered     */

          longjmp( transaction_trap, JUST_RESET_ME );

          break;

        case 'R':     bad_note_error( ); /* note read and rejected */
```

```
        return 1;
        break;
      default:
       if ( !isdigit( response ) )     /* device error    */
      longjmp( transaction_trap, CANT_READ_NOTE );
        break;
       }
       note_read = response;       /* remember it          */
       cnt_cmd( dave, "A1", 30 );      /* try to stack it  */
       cash_in_state = STACK;
       return 1;
}

stack( e )          /* cnt has replied to a "stack" command */
      char *e;
{
      if ( *e == CNT_TIMEOUT )     /* device error          */
              longjmp( transaction_trap, STACKER_FAILURE );

      e++;
      switch (*e)
      {
      case  '0':    bad_note_error( ); /*stacker ejected it*/
              cash_in_state            =  NEXT_NOTE;
              return 1;
              case '1':   break;
              default:    longjmp( transaction_trap,
                                   STACKER_FAILURE );
              break;
      }
```

```
arm_note_reader( 0 );
                    /* go for another note-no timeout */
    cash_in_state = NEXT_NOTE;
    accumulate_funds( note_read );
    return 1;
}

stack_last( e )
 /* cnt has replied to the last "stack" command */
    char *e;
{
    if ( *e == CNT_TIMEOUT )     /* device error          */
            longjmp( transaction_trap, STACKER_FAILURE );

    e++;
    if ( *e == '0' )             /* stacker ejected it    */
            return 0;
    else if ( *e != '1' )        /* device error          */
            longjmp( transaction_trap, STACKER_FAILURE );

    accumulate_funds( note_read );
    return 0;                    /* all done              */
}

next_note( e )
  /* cnt has replied to the next "read note" command */
    char *e;
{
    char response = e[ 1 ];

    switch( response )
    {
```

```
        case CNT_TIMEOUT:           /* logic problem */
          longjmp( transaction_trap, CANT_READ_NOTE );

          break;
          case 'R':          bad_note_error( );
                            /* read and rejected */
          return 1;
          break;
          default:
          if (!isdigit( response ))     /* device error */
          longjmp( transaction_trap, CANT_READ_NOTE );
          break;
        }
      }

      note_read = response;                /* remember it */
      cnt_cmd( dave, "A1", 30 );      /* try to stack it */
      cash_in_state = STACK;
      return 1;
  }

touched( e )       /* screen has been touched or timed out */
      char *e;
{
      cnt_clear_timer( dave );
      switch( cash_in_state )
      {
              case STACK:
              cash_in_state = LAST_STACK;
              return 1;
```

```
                break;
                case FIRST_NOTE:
                if ( *e == 'R' )
                return 0;
                else
                longjmp( transaction_trap, JUST_RESET_ME );
                return 1;          /* to be consistent */
                break;
                case NEXT_NOTE:
                return 0;
                break;
        }
}

static PFI stable [ 4 ] [ 4 ] = {
/* Inputs Touch    Note Reader   Stacker  Video */
 touched, first_note, nop, kv, /* awaiting first note */
 touched, next_note, nop, kv, /* awaiting next note   */
 touched, nop, stack, kv, /* awaiting stack or touch */
 nop, nop, stack_last, kv /*  awaiting last stack    */
};

more_notes( )
{
        char *e;
        int  col;
        PFI      handler;
 unsigned   my_events  =  SCREEN_TOUCHED  |
            SHOW_OVER  |  NOTE_EVENT    |  STACK_EVENT;
```

```
        for (;;)
        {
                switch( new_event( &e, my_events ) )
                {
                        case SCREEN_TOUCHED:  col = 0;  break;
                        case NOTE_EVENT:      col = 1;  break;
                        case STACK_EVENT:     col = 2;  break;
                        case SHOW_OVER:       col = 3;  break;
                }
          handler = stable [ cash_in_state ] [ col ];
                if ( (*handler)(e) == 0 )
                        return;
        }
}

static unsigned note_values [] = { 100, 200, 500, 1000, 2000 };

/* call this function if and only if a note  */
/* has been successfully READ and STACKED    */

accumulate_funds( note )
        int note;
{
        T->cents_in += note_values[ note - '1' ];
        display_cash_in_low( dave, T->cents_in );

        if (T->cents_in >= MAX_CENTS_IN)
                longjmp( too_much_dough, PETRO_LIMIT );
        if (T->cents_in >= T->preset_amount && T->preset_amount != (
                longjmp( too_much_dough, PRESET_AMOUNT_EXCEEDED );
```

```
        if ( all_cash_in_visible == 0 )
        {
                video_off( dave );
                stop_video_show( );
                show_screen( dave, ALL_CASH_IN_SCREEN );
                all_cash_in_audio( T->language );
                all_cash_in_visible = 1;
                display_preset( dave, T->preset_amount, T->language
        }
        display_cash_in( dave, T->cents_in );
}

bad_note_error( )
{
        video_off( dave );
        stop_video_show( );
        show_screen( dave, BAD_NOTE_SCREEN );
        all_cash_in_visible = 0;
        bad_note_audio( T->language );
        arm_note_reader( 0 );    /* let the user retry */
}

static unsigned _reader_armed;

arm_note_reader( seconds )
        unsigned seconds;
{
        cnt_cmd( dave, "N", seconds );
        _reader_armed = 1;
}
```

```
Disarm_note_reader( )
{
        _reader_armed = 0;
}

note_reader_armed( )
{
        return _reader_armed;
}
```

appl/cfiles card_pay.c blink.c cash_pay.c checkpoint.c dave.c decode_pump.c logger.c post_pay.c price_change.c hot_card.c device_error.c disp_prev.c equal_buf.c fillerup.c send_headers.c learning.c getpumpevent.c receipt_format.c globals.c

```
delay.c
do_a_fill.c
headers.c
new_event.c
preset_choices.c
print_car.c
print_cnt.c
print_refund.c
print_docu.c
print_receipt.c
proceed_fill.c
process.c
screens.c
select_grade.c
strings.c
trim.c
type_of_card.c
type_of_pet.c
video_receipt.c
wash_choices.c
```

```
      appl/checkpoint.c
#include <stdio.h>
#include "trans.h"
#include "checkpoint.h"

static FILE *check_file;

static cpoint check;
```

```
Open_checkpoint ( dave )
     unsigned dave;
{
     char checkpoint_file_name [ 30 ];

     tsprintf(checkpoint_file_name,"/dave/dave%dcheck",
dave);
     check_file = fopen (checkpoint_file_name, "rwv");
     zero (&check, sizeof (check), check_file);
}
Store_checkpoint( dirty )
     unsigned dirty;
{
     check.c_dirty = dirty;
     tput (&check, sizeof (check), check_file);
     fflush (check file);
     fseek (check_file,OL,O):
}
Restore previous transaction( t )
     transaction *t;
{    *t =check.previous;
}
Restore_current_transaction( t )
     transaction *t;
{
     *t = check.current;
}
Close_checkpoint( )
{
     fclose(check_file);
}
Push_checkpoint( )
{
     check.previous = check-current;
     zero( &check.current, sizeof( transaction ));
     check.c_kiosk_mode = 0;
     check.c_filling    = 0;
```

```
        check.c_printing    = 0;
        Store_checkpoint ( 0 );
}
Checkpoint (t )
        transaction *t;
}
        check.current = *t;
        Store_checkpoint( 1 );
}
Dirty_checkpoint( )
{
        return check.c_dirty;
}
Checkpoint kiosk mode( t )
        transaction *t;
{
        check.c_kiosk_mode = 1;


        appl/checkpoint.e
#include <stdio.h>
#include "trans.h"
#include "checkpoint.h"

static FILE *check_file;

static cpoint check;

Open_checkpoint ( dave )
        unsigned dave;
{
        char checkpoint_file_name [ 30 ];

        tsprintf(checkpoint_file_name,"/dave/dave%dcheck",
dave);
        check_file = fopen (checkpoint_file_name, "rwv");
        zero (&check, sizeof (check));
        zero (&check, sizeof (check), check_file);
```

```
}
Store_checkpoint( dirty )
     unsigned dirty;
{
     check.c_dirty = dirty;
     tput (&check, sizeof (check), check_file);
     fflush (check file);
     fseek (check_file,OL,O):
}
Restore previous transaction( t )
     transaction *t;
{    *t =check.previous;
}
Restore_current_transaction( t )
     transaction *t;
{
     *t = check.current;
}
Close_checkpoint( )
{
     fclose(check_file);
}
Push_checkpoint( )
{
     check.previous = check-current;
     zero( &check.current, sizeof( transaction ));
     check.c_kiosk_mode = 0;
     check.c_filling    = 0;
     check.c_printing   = 0;
     Store_checkpoint ( 0 );
}
Checkpoint (t )
     transaction *t;
{
     check.current = *t;
     Store_checkpoint( 1 );
}
```

```
Dirty_checkpoint( )
{
     return check.c_dirty;
}
Checkpoint kiosk mode( t )
     transaction *t;
{
     check.c_kiosk_mode = 1;

     Checkpoint( t );
}
```

appl/checkpoint.h

```
typedef struct {
      unsigned    c_dirty,
                        c_kiosk_mode,
                        c_filling,
                        c_printing;
      transaction current,
                        previous;
} cpoint;
```

appl/dave.c

```
#include "device.h"
#include "vars.h"
#include <stdio.h>
#include "screens.h"

main( argc, argv )
      int  argc;
      char *argv[];
{
```

```
        Initialize( argc, argv );
        Process_transactions( );
}

Initialize( c, v )
        int  c;
        char *v[];
{
        unsigned my_events;
        char     *e,
                         logm [ 60 ],
                         *daves_name ();

        if ( c != 2 && c != 3 )
                usage ();

        debug_event = c == 3;

        dave = atoi(v [ 1 ]);

        if ( dave <= 0 | dave > NDAVES )
                usage ();

        log_me( "start" );

        if ( register_name( 0, daves_name( dave ), 0 ) != 0 )
        {
        tsprintf( logm, "can't register %s",  daves_name( dave ) );
                if (debug_event)
                        tfprintf( stderr, "%s\n", logm );
                log_me( logm );
                exit( 0 );
```

```
        }

        T = &_current;

        P = &_previous;

        Open_checkpoint( dave );

        Restore_previous_transaction( P );

        my_events = start_event_queue( );

        if (debug_event)

                tfprintf( stderr, "Hi dave\n" );

        Check_servers( );

        open_screen_warm( dave );

        show_screen( dave, PUMP_OUT_OF_ORDER_SCREEN );

        video_off( dave );

        card_light_off( dave );

        cash_light_off( dave );

        receipt_light_off( dave );

        start_blinker( dave );

        open_my_devices( dave, my_events );

        Reset_the_cnt( );

        log_me( "ready" );

}

Check_servers ()

{

        extern int cnt_server_alive (),

                        graphics_server_alive (),

                        pos_server_alive (),
```

```
                        switch_server_alive ();

        Check_server (cnt_server_alive, "cnt server" );
        Check_server (graphics_server_alive, "graphics server" );
        Check_server (switch_server_alive, "switch server" );
        Check_server (pos_server_alive, "pos_server");
}

Check_server (fcn, message)
        int (*fcn)();
        char *message;
{
        int  task_alive;
        char logm [ 60 ];
        if ( (task_alive = (*fcn)()) == 0 )
        {
                tsprintf( logm, "can't find %s", message);
                if (debug_event)
                        tfprintf (stderr, "%s\n", logm);
                log_me( logm );
                exit (0);
        }
}

open_my_devices( d, myqueue )
        unsigned d, myqueue;
{
        dave_device *dv;

        d--;
```

```
        dv = devices + d;
        open_video_player( dv->video_port, myqueue, d + 1, 1 );
        open_touchscreen( dv->touch_port, myqueue );
        open_pump( dv->pump_port, myqueue );
        open_bulloch( d + 1, dv->bulloch_port );
        open_cnt( d + 1 );
        open_pos_server( dave );
}

usage( )
{
        tfprintf( stderr, "dave <dave_number>  [1 or 2)] +d\n" );
        exit( 0 );
}

Reset_the_cnt( )
{
        char *e;

        cnt_cmd( dave, "H", 10 );
        new_event( &e, CNT_EVENT );
        cnt_beep( dave );
}
```

appl/dave.map

```
 .Segment:1   0000 to 7344 (29509 bytes)
 .Segment:2   0000 to 0D2E (3375 bytes)
 .Segment:3   0D2F to 186C (2878 bytes)
 .Total size is 8BB2 (35762) bytes
C01  0053  prologue
```

```
C01  005E  epilogue
C01  0067  stk_overflow
C01  007D  <exit>
C01  0083  #ucbeg
C01  0084  <Card_payment>
C01  0278  <Card_type_is_known_to_me>
C01  028F  <Card_read_failure>
C01  030F  <Validate_card>
C01  04A6  <Eject_card>
C01  05A1  <arm_card_reader>
C01  05C2  <Disarm_card_reader>
C01  05D2  <card_reader_armed>
C01  05E1  <Set_blink_on>
C01  05F4  <Set_blink_off>
C01  0607  <Blinking>
C01  0616  <Cash_payment>
C01  0722  <nop>
C01  0731  <kv>
C01  074A  <first_note>
C01  07D7  <stack>
C01  0942  <touched>
C01  09A8  <more_notes>
C01  0A22  <accumulate_funds>
C01  0B0D  <bad_note_error>
C01  0B52  <arm_note_reader>
C01  0B73  <Disarm_note_reader>
C01  0B83  <note_reader_armed>
C01  0B92  <Open_checkpoint>
```

```
C01  0BDE  <Store_checkpoint>
C01  0C20  <Restore_previous_transaction>
C01  0C3B  <Restore_current_transaction>
C01  0C56  <Close_checkpoint>
C01  0C6A  <Push_checkpoint>
C01  0CB0  <Checkpoint>
C01  0CD5  <Dirty_checkpoint>
C01  0CE4  <Checkpoint_kiosk_mode>
C01  0CFD  <main>
C01  0D16  <Initialize>
C01  0E7F  <Check_servers>
C01  0EC1  <Check_server>
C01  0F17  <open_my_devices>
C01  0F9D  <usage>
C01  0FBF  <Reset_the_cnt>
C01  0FF3  <decode_prices>
C01  105E  <decode_grade>
C01  108F  <decode_fill_data>
C01  10DA  <typed_filling_data>
C01  1155  <hose_of>
C01  1195  <Cash_price_of>
C01  11E5  <Initialize_pump_map>
C01  1277  <Device_error>
C01  135F  <display_previous_transaction>
C01  13DB  <Equal_buffers>
C01  1400  <Fill_er_up>
C01  14FE  <Reset_kiosk_halt>
C01  150E  <Kiosk_halted_us>
```

```
C01  1553  <Kiosk_restarted_us>
C01  15AA  <delay>
C01  15C5  <hot_card>
C01  1674  <log_me>
C01  169D  <Do_a_fill>
C01  168A  <Post_pay_fill_intro>
C01  17C5  <Post_pay_end_of_fill>
C01  188E  <Clear_kiosk_authorization>
C01  189E  <Set_kiosk_authorization>
C01  18AE  <Kiosk_has_authorized>
C01  18BD  <Wait_show_over_and_auth>
C01  1911  <Card_has_been_refused>
C01  1A39  <price_change>
C01  1A6C  <price_data>
C01  1A7B  <price_change_requested>
C01  1A8A  <price_change_done>
C01  1AA3  <Reset_learning_curve>
C01  1AC9  <Set_user_entry>
C01  1AF0  <Set_user_exit>
C01  1B14  <User_needs_help>
C01  1B2D  <User_speed_factor>
C01  1B66  <get_pump_event>
C01  1B9B  <set_receipt_header1>
C01  1C27  <cnt_string>
C01  1C3F  <dollars>
C01  1C7F  <cnt_text>
C01  1C9F  <set_document_language>
C01  1CAF  <format_header>
```

```
C01  1D56  <format_fill_data>
C01  1DFF  <cnts_grade>
C01  1E4C  <format_card_tender>
C01  1E77  <format_fuel>
C01  1EB4  <format_total>
C01  1EF1  <format_cash_tender>
C01  1F2E  <format_change_due>
C01  1F74  <eject_and_perforate>
C01  1F99  <eject_and_cut>
C01  206C  <get_receipt_headers>
C01  20A3  <header1>
C01  20B2  <Send_cnt_headers>
C01  2109  <Cnt_ram_reset>
C01  2119  <Set_cnt_ram_loaded>
C01  2129  <Cnt_ram_ok>
C01  2138  <new_event>
C01  221D  <process_control_event>
C01  2234  <event_success_code>
C01  2243  <Unwanted_event>
C01  229A  <Process_power_event>
C01  22C8  <Update_timestamp>
C01  22F4  <Preset_choices>
C01  23EC  <print_car_wash_voucher>
C01  23F6  <print_cnt>
C01  246B  <Print_credit_voucher>
C01  2485  <Print_documents>
C01  254F  <binauth>
C01  257E  <Print_receipt>
```

```
C01  26CA  <Proceed_to_fill>
C01  299F  <Process_transactions>
C01  29DD  <Process_exception>
C01  2A88  <Do_one_sale>
C01  2B32  <Reset_all>
C01  2C37  <Language_choice>
C01  2CEA  <Language_screen_touch>
C01  2D83  <Payment_loop>
C01  2DCC  <Pay_choices>
C01  2E76  <calculate_totals>
C01  2F13  <Make_sure_the_hook_is_down>
C01  2F76  <Pre_pay_transaction_outcomes>
C01  2FB0  <Receipt>
C01  3045  <User_cancel_receipt>
C01  30CE  <System_cancel_receipt>
C01  3165  <Receipt_graphics>
C01  31CA  <thank_you>
C01  31F9  <save_previous_transaction>
C01  3218  <post_transaction>
C01  3300  <packed_auth_language>
C01  3334  <log_transaction>
C01  3363  <Power_has_failed>
C01  33BA  <set_screen_timeout>
C01  33DE  <reactivate_language_touchzones>
C01  340A  <show_screen_alone>
C01  344C  <show_screen>
C01  3620  <select_grade>
C01  365E  <credvouchs>
```

```
C01  366D  <carvouchs>
C01  367C  <carwashs>
C01  368B  <pumps>
C01  36AC  <ampms>
C01  36EC  <grades>
C01  3727  <litres>
C01  3748  <fuels>
C01  3769  <totals>
C01  378A  <cashs>
C01  37AB  <credits>
C01  37CC  <thankyous>
C01  37ED  <card_names>
C01  3835  <receipt_card_field>
C01  387D  <credtrails>
C01  388C  <washtrails>
C01  389B  <card_formats>
C01  396C  <types_string>
C01  39B3  <First_non_blank>
C01  39EF  <Last_non_blank>
C01  3A2A  <Trim>
C01  3A75  <Type_of_card_choice>
C01  3B0C  <Type_of_petro_card>
C01  3B97  <video_receipt>
C01  3ED3  <video_dollars>
C01  3F20  <video_card>
C01  3F55  <car_wash_choices>
C01  3F5F  <i_need_attention>
C01  3F7D  <price_change_completed>
```

```
C01  3F9C  <give_me_pump_map>
C01  3FBB  <give_me_timestamp>
C01  3FDA  <kiosk_payment>
C01  3FF7  <kiosk_authorize>
C01  4016  <here_is_a_transaction>
C01  4033  <i_have_a_hot_card>
C01  4052  <open_bulloch>
C01  4078  <bullochs_id>
C01  408E  <bull_cmd>
C01  40EB  <pump_money_audio>
C01  4115  <announce_audio>
C01  413D  <pump_number_audio>
C01  4165  <card_choice_audio>
C01  418E  <all_cash_in_audio>
C01  41B7  <receipt_no_credit_audio>
C01  41E0  <receipt_credit_audio>
C01  4209  <pay_choice_audio>
C01  4232  <petro_card_audio>
C01  425B  <out_of_service_audio>
C01  4284  <bad_note_audio>
C01  42AD  <kiosk_alerted_audio>
C01  42D6  <bad_card_audio>
C01  42FF  <printer_dead_audio>
C01  4328  <pump_or_else_audio>
C01  4351  <replace_your_card_audio>
C01  437A  <other_card_audio>
C01  43A3  <cancelled_cash_audio>
C01  43CC  <cancelled_card_audio>
```

```
C01  43F5  <card_auth_audio>
C01  441E  <hot_card_audio>
C01  4447  <declined_card_audio>
C01  4470  <card_abend_audio>
C01  4499  <cash_abend_audio>
C01  44C2  <replace_nozzle_audio>
C01  44EB  <kiosk_halt_audio>
C01  4514  <system_down_audio>
C01  453D  <note_reader_down_audio>
C01  4566  <card_reader_down_audio>
C01  458F  <both_readers_down_audio>
C01  45B8  <remove_card_audio>
C01  45E1  <card_auth_video>
C01  460A  <longer_card_auth_video>
C01  4633  <goodbye_thanks_video>
C01  465C  <lift_nozzle_video>
C01  4685  <remove_card_video>
C01  46AE  <insert_card_video>
C01  46D7  <insert_bill_video>
C01  4700  <fill_video>
C01  4727  <lift_and_pay_at_kiosk_video>
C01  4750  <get_event>
C01  4799  <log_dave>
C01  47B0  <pos_active>
C01  47DA  <pos_whats_header_1>
C01  47FE  <pos_whats_cards_date>
C01  4827  <pos_decode_card>
C01  4850  <pos_authorize_card>
```

```
C01  487F  <pos_capture_transaction>
C01  48B4  <pos_server_alive>
C01  48CA  <open_pos_server>
C01  48EB  <pos_cmd>
C01  4963  <card_light_on>
C01  497A  <card_light_off>
C01  4991  <cash_light_on>
C01  49A8  <cash_light_off>
C01  49BF  <receipt_light_on>
C01  49D6  <receipt_light_off>
C01  49ED  <switch_server_alive>
C01  4A1B  <column_speaker_on>
C01  4A32  <column_speaker_off>
C01  4A49  <pump_speaker_on>
C01  4A60  <pump_speaker_off>
C01  4A77  <both_speakers_on>
C01  4A8E  <both_speakers_off>
C01  4AA5  <video_on>
C01  4ABC  <video_off>
C01  4AD3  <start_blinker>
C01  4B16  <blink_on>
C01  4B3C  <blink_off>
C01  4B62  <cnt_beep>
C01  4B79  <cnt_clear_timer>
C01  4B90  <cnt_cmd>
C01  4BBE  <cnt_server_alive>
C01  4BD4  <open_cnt>
C01  4C2B  <open_video_player>
```

| | | |
|---|---|---|
| C01 | 4C5C | <stop_video_show> |
| C01 | 4C84 | <player_status_request> |
| C01 | 4CAC | <prequest> |
| C01 | 4CF5 | <event_queue_id> |
| C01 | 4D04 | <load_frame> |
| C01 | 4D2F | <load_bits> |
| C01 | 4D49 | <graphics_ram_usage> |
| C01 | 4D63 | <display_frame> |
| C01 | 4D8B | <open_screen> |
| C01 | 4DA2 | <open_screen_warm> |
| C01 | 4DB9 | <graphics_server_alive> |
| C01 | 4DE7 | <display_prices> |
| C01 | 4E10 | <display_clear_prepay> |
| C01 | 4E27 | <display_transaction_type> |
| C01 | 4E4A | <display_cash_in> |
| C01 | 4E67 | <display_pump_number> |
| C01 | 4E84 | <display_preset_label> |
| C01 | 4EA7 | <display_grade> |
| C01 | 4ECA | <display_preset> |
| C01 | 4EED | <display_card_type> |
| C01 | 4F0A | <display_cash_in_low> |
| C01 | 4F27 | <display_user_cancel_credit> |
| C01 | 4F4A | <display_system_cancel_credit> |
| C01 | 4F6D | <display_credit> |
| C01 | 4F90 | <display_string> |
| C01 | 4FC4 | <display_string_centred> |
| C01 | 5050 | <lrequest> |
| C01 | 50A8 | <open_pump> |

```
C01  50CE  <pump_halt_now>
C01  50E2  <pump_restart_now>
C01  50F6  <pump_ready_for_fill>
C01  510A  <pump_hose_selected>
C01  511E  <quiet_pump>
C01  5132  <pump_is_hook_down_now>
C01  5146  <pump_is_hook_down>
C01  515A  <report_pump_out_of_service>
C01  516E  <pump_filling_data_request>
C01  5182  <pump_hose_totals_request>
C01  5196  <pump_hose_filled>
C01  51AA  <pump_preset_request>
C01  51C4  <pump_id_request>
C01  51D8  <authorize_pump>
C01  51F2  <set_pump_sale_complete>
C01  5206  <pump_status_request>
C01  521A  <pump_prices_request>
C01  522E  <pump_go_touchcom>
C01  5242  <pump_go_native>
C01  5256  <pump_change_prices>
C01  52A7  <srequest>
C01  530D  <open_touchscreen>
C01  5344  <define_touch_zone>
C01  536B  <clear_touch_zones>
C01  5397  <deactivate_touchscreen>
C01  53C3  <activate_touchscreen>
C01  53ED  <touch_status_request>
C01  546E  <start_event_queue>
```

```
C01  54A5  <calerr>
C01  54B4  <caljoin>
C01  56C6  <calmthlen>
C01  56F3  <calnow>
C01  57A2  <calnwork>
C01  5899  <calsplit>
C01  5B9D  <calwkday>
C01  5C08  <caltimezone>
C01  5C23  <_calcsecs>
C01  5C67  <daves_name>
C01  5C85  <fatou>
C01  5C9D  <fatol>
C01  5CCC  <shell>
C01  5D90  <chain>
C01  5DDB  <create>
C01  5E43  <rem_create>
C01  5F8C  <vc_release>
C01  5FA3  <tsscanf>
C01  65E3  <sleep>
C01  6629  <abs_sleep>
C01  664E  <set_timer>
C01  66B5  <strncpy>
C01  66EF  <strncat>
C01  6728  <strncmp>
C01  675B  <register_name>
C01  6821  <fseek>
C01  6901  <ftell>
C01  6966  <dregister_name>
```

```
C01  6B0C  <find_admin>
C01  6B76  <calloc>
C01  6B7C  <malloc>
C01  6B82  <realloc>
C01  6B88  <free>
C01  6B88  <cfree>
C01  6B8E  <fopen>
C01  6B94  <fclose>
C01  6B9A  <getc>
C01  6BA0  <putc>
C01  6BA6  <ungetc>
C01  6BAC  <fflush>
C01  6BB2  <tfprintf>
C01  6BB8  <tsprintf>
C01  6BBE  <fget>
C01  6BC4  <fput>
C01  6BCA  <fiseek>
C01  6BD0  <rewind>
C01  6BD6  <forward>
C01  6BDC  <breakable>
C01  6BE2  <strcat>
C01  6BE8  <strcmp>
C01  6BEE  <strcpy>
C01  6BF4  <strlen>
C01  6BFA  <send>
C01  6C00  <abort>
C01  6C06  <unbreakable>
C01  6C0C  <setjmp>
```

```
C01  6C71  <longjmp>
C01  6CDF  <nargs>
C01  6CF5  <memcmp>
C01  6D20  <memchr>
C01  6D4D  <memccpy>
C01  6D88  <atol>
C01  6E24  lepilogue
C01  6E2D  lmul
C01  6E7C  lmodr
C01  6E85  lmod
C01  6E8B  ldivr
C01  6E94  ldiv
C01  6F4D  <vc_send_reply>
C01  6F53  <vc_create>
C01  6F59  <vc_create2>
C01  6F5F  <vc_create3>
C01  6F65  <ker_vc_destroy>
C01  6F6B  <def_server>
C01  6F71  <set_acc_flags>
C01  6F77  <set_exception>
C01  6F7D  <escape_tty>
C01  6F83  <hold>
C01  6F89  <unhold>
C01  6F8F  <time_slice>
C01  6F95  <task_info>
C01  6F9B  <force_ready>
C01  6FA1  <set_priority>
C01  6FA7  <set_user>
```

```
C01  6FAD  <set_slice>
C01  6FB3  <modify_flags>
C01  6FB9  <set_int_mask>
C01  6FBF  <set_int_vec>
C01  6FC5  <alloc_mem>
C01  6FCB  <get_date>
C01  6FD1  <set_date>
C01  6FD7  <get_ticks>
C01  6FDD  <receive>
C01  6FE3  <reply>
C01  6FE9  <attach>
C01  6FEF  <detach>
C01  6FF5  <await>
C01  6FFB  <signal>
C01  7001  <read_msg>
C01  7007  <write_msg>
C01  700D  <read_port>
C01  7013  <csignal>
C01  7019  <relay>
C01  701F  <creceive>
C01  7025  <isalpha>
C01  7058  <isdigit>
C01  707A  <islower>
C01  709C  <isupper>
C01  70BE  <isspace>
C01  70E6  <iswhite>
C01  70FF  <ispunct>
C01  714A  <isalnum>
```

```
C01  7189  <isascii>
C01  71A2  <iscntrl>
C01  71C4  <isprint>
C01  71E6  <isxdigit>
C01  7225  <tolower>
C01  7248  <toupper>
C01  726B  <memcpy>
C01  726B  <copy>
C01  7298  <zero>
C01  72B4  <memset>
C01  72D5  <atoi>
D00  0000  <User_sp>
D00  0002  <User_ss>
D00  0004  <Exc_bits>
D00  0008  <Exc_allow>
D00  000C  <Exc_pending>
D00  0010  <Exc_fp>
D00  0012  <Exc_pc>
D00  0014  <Exc_permit>
D00  0018  <Exit_status>
D00  001A  <Error_status>
D00  001C  <My_tid>
D00  001E  <Dads_tid>
D00  0020  <Break_count>
D00  0021  <My_tty>
D00  0022  stack_base
D00  0024  <Cmd_flags>
D00  0025  <My_priority>
```

```
D00  0026  <stdin>
D00  0028  <stdout>
D00  002A  <stderr>
D00  002C  <Free_list>
D00  002E  <End_of_free>
D00  0030  <File_list>
D00  0032  <_Argc>
D00  0034  stk_limit
D00  0034  <_Argv>
D00  0036  SAVE
D00  0038  TEMP
D00  0060  <Code_flags>
D00  0061  <User_num>
D00  0062  <Group_num>
D00  0063  <Team_num>
D00  0065  <My_nid>
D00  0067  <Dads_nid>
D00  0069  <My_tty_nid>
D00  006B  <My_cd_nid>
D00  006D  <Release_num>
D00  006E  <Ndp_save_area>
D00  0070  <Fstack>
D00  0072  <Call_stack_ptr>
D00  0074  <Segment_table_ptr>
D00  0076  <Check_point_sp>
D00  0078  <User_spare>
D00  007E  <Qdb_tid>
D03  0EB7  <devices>
```

```
D03  0FDB  <debug_event>
D03  0FDD  <dave>
D03  0FDF  <_current>
D03  1076  <_previous>
D03  110D  <T>
D03  110F  <P>
D03  1111  <now>
D03  111B  <Daves_error_status>
D03  111D  <transaction_trap>
D03  111F  <post_pay_trap>
D03  157F  <equeue_id>
D03  15A3  <dr>
D03  1865  <Create_status>
D03  1867  <Create_taskid>
```

appl/decode_pump.c

```
#include "vars.h"
#define NHOSES        3

#define REGULAR        1
#define UNLEADED 2
#define PREMIUM  3

typedef struct {
      unsigned cash_price;
      unsigned credit_price;
      unsigned grade;
} hose;

static hose hoses [ 3 ] = {
```

```
        0, 0, REGULAR,
        0, 0, UNLEADED,
        0, 0, PREMIUM
};

static unsigned _map_initialized;

decode_prices( b )
        char *b;
{
        tsscanf ( b, "%4d%4d%4d%4d%4d%4d",
        &hoses[0].cash_price, &hoses[0].credit_price,
        &hoses[1].cash_price, &hoses[1].credit_price,
        &hoses[2].cash_price, &hoses[2].credit_price);
        T->regular_price  = Cash_price_of( REGULAR );
        T->unleaded_price = Cash_price_of( UNLEADED );
        T->premium_price  = Cash_price_of( PREMIUM );
}

decode_grade( ahose )
        unsigned ahose;
{
        ahose--;
        return ahose < NHOSES ? hoses [ ahose ].grade : 0;
}

static char _filling_data [ 50 ];

decode_fill_data( c )
        char *c;
{
```

```
        zero( _filling_data, sizeof( _filling_data ) );
        COPY_SAFELY( _filling_data, c );
        tsscanf(c, "%4d%6ld%6d", &T->price_pumped,
                                 &T->volume_pumped,
                                 &T->cents_pumped  );
}

char *typed_filling_data( cash, auth, response )
unsigned cash;
char *auth, *response;
{
        char *p = _filling_data + 17,
                  c = _filling_data[ 16 ];

        _filling_data[ 16 ] = toupper( c );
        switch( T->type )
        {
        case CARD_TRANSACTION:      strcpy( p, "0000000" ); break;

        case CASH_TRANSACTION:      tsprintf( p, "%07u", cash ); brea

        case POST_PAY_TRANSACTION: tsprintf
                                 ( p, "%5.5s%2.2s", auth, response ); brea
        }

        return _filling_data;
}

hose_of( agrade )
        unsigned agrade;
{
```

```
        int i;

        for ( i = 0; i < 3; i++ )
                if ( hoses[ i ].grade == agrade )
                        return i + 1;
}

Cash_price_of( agrade )
        unsigned agrade;
{
        int i;

        for ( i = 0; i < NHOSES; i++ )
                if ( hoses[ i ].grade == agrade )
                        return hoses[ i ].cash_price;

        return 0;
}

Initialize_pump_map( apump )
        unsigned apump;
{
        char    *e;
        unsigned the_grade,
                        i;

        if ( _map_initialized )
                return;
        give_me_pump_map( apump );

        do
```

```
            new_event( &e, BULLOCH_EVENT);
        while ( !Equal_buffers( e, "MAP", 3 ) );

        e += 3;
        for ( i = 0; i < 3; i++ )
        {
            the_grade = UNCHAR( *e++ ) + 1;
            if ( 1 <= the_grade && the_grade <= 3 )
                hoses [ i ].grade = the_grade;
        }

        _map_initialized = 1;
}
```

appl/delay.c

```
#include <timer.h>

delay (ticks)
        unsigned ticks;
{
        set_timer (TIMER_WAKEUP, RELATIVE, ticks);
}
```

appl/device.h

```
#define NDAVES          2

typedef struct {
```

```
        unsigned video_port;
        unsigned touch_port;
        unsigned pump_port;
        unsigned bulloch_port;
} dave_device;

dave_device devices [ NDAVES ] = {
        { 22, 23, 24, 28 },
        { 25, 26, 27, 29 }
};
```

appl/device_error.c

```
#include "vars.h"
#include "exceptions.h"
#include <stdio.h>
#include "screens.h"

Device_error( code, error_message )
        int code;
        char *error_message;
{
        char *e,
                kiosk_message [ 30 ];
        if ( debug_event )
        tfprintf( stderr, "device error %d %s\n", code,
                                        Daves_error_status );
```

```
    log_me( Daves_error_status );
    if ( code == PRINT_FAILURE )
    {
            printer_dead_audio( T->language );
            new_event( &e, SHOW_OVER );
            if ( memcmp( Daves_error_status, "RI", 2 ) == 0 )
                    error_message = "PAPER LOW";
    }
    else
    {
            show_screen( dave, SYSTEM_PROBLEM_SCREEN );
            kiosk_alerted_audio( T->language );
    }
tsprintf( kiosk_message, "%d%14s %d", dave, error_message,
          T->pump_id_pumped );
        i_need_attention( T->pump_id_pumped, kiosk_message );
    do
    {
            new_event (&e, BULLOCH_EVENT);
    } while ( memcmp( e, "RESET", 5 ) != 0 );
}
```

appl/disp_prev.c

```
#include "vars.h"

display_previous_transaction( )
{
    display_transaction_type( dave, T->language, P->type );
```

```
        if ( P->type == CARD_TRANSACTION )

                display_card_type( dave, P->card_type );

        else if ( P->type == CASH_TRANSACTION )

                        display_cash_in_low( dave, P->cents_in );

        display_preset_label( dave, T->language, P->preset_amount

}
```

appl/do_a_fill.c

```
Do_a_fill ()
{
        if ( Proceed_to_fill( ) )
        {
                Fill_er_up( );
                car_wash_choices ();
        }
        calculate_totals ();
        Send_cnt_headers ();      /* just in case cnt  reset  */
}
```

appl/equal_buf.c

```
Equal_buffers( b1, b2, len )
        char *b1, *b2;
        unsigned len;
```

```
{
        return memcmp( b1, b2, len ) == 0;
}
```

appl/exceptions.h

```
#define JUST_RESET_ME                    1
#define USER_TIMEOUT_WITH_MONEY          2
#define PRINT_FAILURE                    4
#define CANT_READ_CARD                   5
#define CANT_EJECT_CARD                  6
#define STACKER_FAILURE                  7
#define CANT_READ_NOTE                   8
#define LOST_PUMP                        9
#define POWER_FAILURE                    10

/* "cancel" exceptions */

#define CANCEL_ME_PLEASE                 10
#define CARD_REFUSED_POS                 14
#define OTHER_ACCEPTED_CARD              15
#define NON_MAG_CARD                     16
#define POS_INACTIVE                     17
```

appl/fillerup.c

```
#include "screens.h"
#include "vars.h"
#include "exceptions.h"

Fill_er_up( )  /* here because we believe fuel has flowed */
```

```
{
        unsigned et;
        char *e,
                *get_pump_event( );

        Reset_kiosk_halt( );
        fill_video( T->language, T->preset_amount,
                                        User_needs_help( ) );
        while ( et = new_event( &e, PUMP_EVENT | CONTROL_EVENT ) )
        {
                if ( et == PUMP_EVENT )
                        goto fillings_over;
                else if ( et == CONTROL_EVENT );
                {
                if ( Equal_buffers( e, "HALT PUMP", 9 ) )
                                Kiosk_halted_us( );
                else if ( Equal_buffers( e, "RESTART PUMP", 11  )

                                Kiosk_restarted_us( );
                }
        }

fillings_over:
        if ( event_success_code( ) != 0 )
                longjmp( transaction_trap, LOST_PUMP );

        if ( Equal_buffers( e, "NORMAL", 6 ) )
                T->fill_termination = NORMAL_FILL;
        else if ( Equal_buffers( e, "ABNORMAL", 8 ) )
                T->fill_termination = SYSTEM_ABEND;
        else
```

```
                T->fill_termination = SYSTEM_ABEND;
        pump_filling_data_request( );
        e = get_pump_event( );
        decode_fill_data( e );
}

static unsigned _kiosk_halt;

Reset_kiosk_halt( )
{
        _kiosk_halt = 0;
}

Kiosk_halted_us( )
{
 if (  _kiosk_halt  ==  0 )  /* in case someone gets confused */
        {
                pump_halt_now( );
                show_screen( dave, KIOSK_HALTED_SCREEN );
                stop_video_show( );
                video_off( dave );
                kiosk_halt_audio( T->language );
                _kiosk_halt = 1;
        }
}

Kiosk_restarted_us( )
{
        if ( _kiosk_halt )
        {
```

```
        stop_video_show( );      /* in case it's a short halt */
        show_screen( dave, T->type == POST_PAY_TRANSACTION ?
        +        LIFT_FOR_KIOSK_SCREEN : PROCEED_TO_FILL_SCREEN );
                 pump_restart_now( );
                 _kiosk_halt = 0;
                 fill_video( T->language, T->preset_amount, 0 );
        }
}
```

appl/getpumpevent.c

```
#include "vars.h"
#include "exceptions.h"

static char *e;

char *get_pump_event( )
{
        new_event( &e, PUMP_EVENT );
        if ( event_success_code( ) != 0 )
                longjmp( transaction_trap, LOST_PUMP );
        else
                return e;
}
```

appl/globals.c

```
#define GBLGEN
```

```
#include "vars.h"
```

appl/headers.c

```
#include "vars.h"

static char _header1[ 40 ];

get_receipt_headers( )
{
        char *pos_whats_header_1( );

        COPY_SAFELY( _header1, pos_whats_header_1( dave ) );
        Trim( _header1 );
        set_receipt_header1( _header1 );
}

char *header1( )
{
        return _header1;
}
```

appl/hot_card.c

```
#include "vars.h"
#include "exceptions.h"
#include "screens.h"

hot_card( )
{
        char *e;

        stop_video_show( );
```

```
        show_screen( dave, HOT_CARD_SCREEN );
        video_off( dave );
        hot_card_audio( T->language );

        i_have_a_hot_card( T->pump_id_pumped );
        log_me( "hot card" );

        while ( new_event( &e, BULLOCH_EVENT ) )
                if ( memcmp( e, "RELEASE CARD", 13 ) == 0 )
                        break;

        log_me( "card released" );
        cnt_cmd( dave, "CO", 0 );
        cnt_beep( dave );
        longjmp( transaction_trap, JUST_RESET_ME );
}
```

appl/makefile

```
CFLAGS  = -S
SOURCES = @cfiles
OBJECTS = @objects

dave: $(OBJECTS)
 linkobj c=dave x=objects s=2000 m=dave.map l=/user/steve/dave
 sort dave.map f=1,2 +r
 copy dave /dave/dave

globals.o: vars.h
```

appl/new_event.c

```
#include "vars.h"
#include <stdio.h>
```

```
#include "exceptions.h"

static char event [ sizeof (request) ];
static unsigned value_one;

new_event( e, event_mask )
        char **e;
        unsigned event_mask;
{
        unsigned et;

        Daves_error_status = event;

        do
        {
                et = get_event( event, &value_one );

                if ( debug_event )

                tfprintf (stderr, "er %04x %s\n", et, event);
                if ( et == CARD_EVENT && event [ 0 ] == 'M' )
                        Disarm_card_reader( );
                if ( et == NOTE_EVENT && event [ 0 ] == 'N' )
                        Disarm_note_reader( );
                if ( et == CNT_EVENT && event [ 0 ] == 'H' )
                {
                        Cnt_ram_reset( );
                        Disarm_note_reader( );
                        Disarm_card_reader( );
                }
        else if ( et == SCREEN_TOUCHED && event [ 0 ] != 'T'
```

```
)
                        cnt_beep( dave );
                else if ( et == CONTROL_EVENT )
                        process_control_event( event );
                else if ( et == PRICE_EVENT )
                        price_change( event );
                else if ( (et & event_mask) == 0 )
                        Unwanted_event( et );
        } while ( (et & event_mask) == 0 );

        *e = event;
        return (int)et;
}

process_control_event( e )
        char *e;
{
        if ( *e == 'T' )
                Update_timestamp( );
        else
                ;
}

event_success_code( )
{
        return value_one;
}

Unwanted_event( type )
        unsigned type;
```

```
{
        switch( type )
        {
        case POWER_EVENT:   Process_power_event( );   break;
        case NOTE_EVENT:    cnt_cmd( dave, "A0", 0 ); break;
        case CARD_EVENT:    if ( event [ 0 ] == 'C')
                                                return;
                                cnt_cmd( dave, "C0", 0 ); break;
        }
}

 Process_power_event( ) /*if this is a power fail,shutdown dave*/
{
        if ( Equal_buffers( event, "POWER_FAIL", 10 ) )
                longjmp( transaction_trap, POWER_FAILURE );
}

/* current format is YYMMDDHHMMSS */

Update_timestamp( )
{
  tsscanf (event + 1, "%2d%2d%2d%2d%2d",
   &now.year, &now.month, &now.day, &now.hours, &now.minutes);
 }
```

appl/objects

```
card_pay.o
blink.o
cash_pay.o
```

```
checkpoint.o
dave.o
decode_pump.o
device_error.o
disp_prev.o
equal_buf.o
fillerup.o
delay.o
hot_card.o
logger.o
do_a_fill.o
post_pay.o
price_change.o
learning.o
getpumpevent.o
receipt_format.o
globals.o
headers.o
send_headers.o
new_event.o
preset_choices.o
print_car.o
print_cnt.o
print_refund.o
print_docu.o
print_receipt.o
proceed_fill.o
process.o
```

```
screens.o
select_grade.o
strings.o
trim.o
type_of_card.o
type_of_pet.o
video_receipt.o
wash_choices.o
```

appl/post_pay.c

```
#include "vars.h"
#include "screens.h"
#include "exceptions.h"

/* comes here because            */
/* user's card declined by 3201 */
/* 3201 is down                  */
/* guy has a card we don't take */

Post_pay_fill_intro( code )
        unsigned code;
{
        char    *e,
                        *get_pump_event( );

        T->type = POST_PAY_TRANSACTION;
        stop_video_show( );
        display_transaction_type( dave, T->language, T->type );
        deactivate_touchscreen( );

        Clear_kiosk_authorization( );
```

```
kiosk_authorize( T->pump_id_pumped );

switch( code )
{
case POS_INACTIVE:
case OTHER_ACCEPTED_CARD:
    show_screen( dave, OTHER_CARD_SCREEN );
    other_card_audio( T->language );
    log_me( "other accepted card" );
    Wait_show_over_and_auth( );
    break;

case CARD_REFUSED_POS:
    Card_has_been_refused( );
    break;

case NON_MAG_CARD:
    show_screen( dave, NON_MAG_SCREEN );
    replace_your_card_audio( T->language );
    log_me( "non mag card" );
    Wait_show_over_and_auth( );
    break;
}

if ( !Kiosk_has_authorized( ) )
        new_event( &e, BULLOCH_EVENT );

pump_is_hook_down_now( );
if ( Equal_buffers( get_pump_event( ), "HOOKDOWN", 8 ) )
```

```
        {
                lift_and_pay_at_kiosk_video( T->language );
                new_event( &e, SHOW_OVER );
}

/* outcomes are:                                    */
/*     1) LTS cancelled the fill                    */
/*     2) User cancelled the fill                   */
/*     3) A Normal Fill                             */

Post_pay_end_of_fill ()
{
        char *e;

        switch( T->fill_termination )
        {
        case NORMAL_FILL:
        case USER_ABEND:
        case SYSTEM_ABEND:      break;
        }

        if ( T->cents_pumped != 0 )  /* user pays at kiosk   */
        {
        show_screen( dave, THANK_YOU_KIOSK_SCREEN );
        display_pump_number( dave, T->pump_id_pumped );
        video_off( dave );
        kiosk_payment( T->pump_id_pumped, hose_of( T->grade_pumped )
        typed_filling_data( 0, T->auth_number, T->response_code ) );
        pump_number_audio( T->language, T->pump_id_pumped );
        new_event( &e, BULLOCH_EVENT );
```

```
        }
}

static int _ka;

Clear_kiosk_authorization( )
{
        _ka = 0;
}

Set_kiosk_authorization( )
{
        _ka = 1;
}

Kiosk_has_authorized( )
{
        return _ka;
}

Wait_show_over_and_auth( )
{
        char *e;

        while( 1 )
        switch( new_event( &e, SHOW_OVER | BULLOCH_EVENT ) )
                {
  case SHOW_OVER:                return;                break;
  case BULLOCH_EVENT:  if ( memcmp( e, "KIOSK AUTHORIZED",
                                                        16 ) == 0 )
                        Set_kiosk_authorization( );
```

```
                                                    break;
            }
}
Card_has_been_refused( )
{
        char *e;
        unsigned audios_played = 0;

        show_screen( dave, CARD_REFUSED_SCREEN );
        video_off( dave );
        declined_card_audio( T->language );

        cnt_cmd( dave, "CO", 0 );
        cnt_beep( dave );
        log_me( "card declined" );

        while( 1 )
        switch( new_event( &e,
                    CARD_EVENT | BULLOCH_EVENT | SHOW_OVER ) )
                {
        case SHOW_OVER:     audios_played++;
        if ( Kiosk_has_authorized( ) && audios_played == 1 )
        {       /* early auth */
        show_screen( dave, REMOVE_CARD_SCREEN );
        remove_card_audio( T->language );
        }
        break;
        case CARD_EVENT:        if ( e [ 1 ] == '0' )
        card_light_off( dave );
        else
```

```
        longjmp( transaction_trap, CANT_EJECT_CARD );
        return;
        break;
        case BULLOCH_EVENT:
                if ( Equal_buffers( e, "KIOSK AUTHORIZED", 16 ) )
                set_kiosk_authorization( );
                if ( audios_played == 1 )  /* late auth */
        {
                show_screen( dave, REMOVE_CARD_SCREEN );
                 remove_card_audio( T->language );
        }
                break;
        }
}
```

appl/preset_choices.c

```
#include "vars.h"
#include "exceptions.h"
#include "screens.h"

Preset_choices( )
{
        char *e;

        T->preset_amount = 0;
        if (T->language == ENGLISH)
                display_clear_prepay( dave );
        show_screen( dave, PRESET_CHOICES_SCREEN );

Set_user_entry( announce_audio( T->language, T->ttime.hours ) );
```

```
        new_event( &e, SCREEN_TOUCHED );
        Set_user_exit( );

        switch (*e)
        {
                case 'R':   return 0;
 case 'T':      longjmp( transaction_trap, JUST_RESET_ME ); break;
                case 'F':       break;
                default :       if (isdigit( *e ))
                                T->preset_amount = fatou( e, 2 );
                                        break;
        }

T->preset_amount *= 100;  /* from dollars to cents, please */
 display_preset_label( dave, T->language, T->preset_amount );
/*
 Set_user_entry( preset_choice_audio( T->language,
                                        T->preset_amount ) );
*/
        return 1;
}
```

appl/price_change.c

```
#include "vars.h"
#include <stdio.h>

static char _price_data [ 50 ];
static unsigned _price_change_requested;

price_change( e )
```

```
        char *e;
{
        _price_change_requested = 1;
        zero( _price_data, sizeof( _price_data ) );
        memcpy( _price_data, e + 6, 24 );
}

char *price_data( )
{
        return _price_data;
}

price_change_requested( )
{
        return _price_change_requested;
}

price_change_done( pump )
        unsigned pump;
{
        _price_change_requested = 0;
        price_change_completed( pump );
}
```

appl/print_car.c

```
#include "vars.h"
#include <stdio.h>
#include "receipts.h"

print_car_wash_voucher ()
```

```
{
        char m [ 130 ],
                *p;
/*
        p = m + 1;
        m [ 0 ] = 'R';
        strcpy (m + 1, "\02001");
        wheader (m + 4, 0, T->trans_seq_num);
tfprintf (stdout, "%d\n", strlen (m));
        print_cnt (m);
        p = r_wash_itemizer (m + 1, T->car_wash_amount);
        p = wtrailer(p);
tfprintf (stdout, "%d\n", strlen (m));
        print_cnt (m);
*/
}
```

appl/print_docu.c

```
#include "vars.h"
#include "receipts.h"
Print_documents( )
{
        unsigned binauth( );
        char m [ 15 ],
                *print_cnt( ),
                *p = m;
```

```
        both_speakers_off( dave );
        column_speaker_on( dave );
        receipt_light_on( dave );
        set_document_language( T->language );

        zero( m, sizeof( m ) );
        *p++ = 'R';

Print_receipt( T->type == CARD_TRANSACTION ? binauth( )
                                           : T->trans_seq_num );
        if ( T->change_due != 0 )
        {
                eject_and_perforate( p );
                p = print_cnt( m );
                Print_credit_voucher( );
        }
        eject_and_cut (P);
        print_cnt( m );
        receipt_light_off( dave );
}


{
```

appl/print_cnt.c

```
#include "vars.h"
#include "exceptions.h"
#include "screens.h"

char *print_cnt (m)
```

```
        char *m;
{
        char *e;
        int  et;

        cnt_cmd (dave, m, 20);
        while (et = new_event (&e, PRINT_EVENT | SHOW_OVER))
        {
                if (et == SHOW_OVER)
                {
                        video_off (dave);
                        continue;
                }
                if ( e [1] != '0' )
                {
                show_screen (dave, PRINTER_BROKEN_SCREEN);
                longjmp (transaction_trap, PRINT_FAILURE);
                }
                else
                        return m + 1;
        }
}
```

appl/print_receipt.c

```
#include "vars.h"
#include "receipts.h"

#include <stdio.h>

print_receipt ()
```

```
{
    char m [ 130 ],
            *p;

    zero (m, sizeof (m));
    p = m;
    *p++ = 'R';

    p = format_header (p, T->trans_seq_num, T->pump_id_pumped,
                        T->ttime);
    p = format_fill_data (p, T->volume_pumped, T->grade_pumped,
                            T->price_pumped);
    if ( T->type == CARD_TRANSACTION )
            p = format_card_tender (p);

    p = format_fuel (p, T->cents_pumped);
  p = format_total (p, T->total_due);
    if ( T->type == CASH_TRANSACTION )
    {
            print_cnt (m);
            zero (m, sizeof (m));
            p = m;
            *p++ = 'R';
            p = format_cash_tender (p, T->cents_in);
            p = format_change_due (p, T->change_due);
    }

    print_cnt (m);
}
```

appl/print_refund.c

```
#include "vars.h"
#include "receipts.h"
#include <stdio.h>

print_credit_voucher ()
{
        print_receipt ();
}
```

appl/proceed_fill.c

```
#include "vars.h"
#include "screens.h"
#include "exceptions.h"

Proceed_to_fill ()
{
        char *get_pump_event (),
                *e;
        unsigned et;

        card_light_off( dave );
        cash_light_off( dave );
        deactivate_touchscreen( );
        ;
        stop_video_show( );

        if ( T->type == CASH_TRANSACTION )
        {
                lift_nozzle_video( T->language );
```

```
            new_event( &e, VIDEO_SEEK_EVENT );
            show_screen( dave, PROCEED_TO_FILL_SCREEN );
        }
        else
        {
show_screen( dave,
  T->type == POST_PAY_TRANSACTION ? LIFT_FOR_KIOSK_SCREEN  :
            PROCEED_TO_FILL_SCREEN );
        video_off( dave );
}

pump_hose_selected( );          /* get an off hook */
while( et = new_event( &e, PUMP_EVENT | SHOW_OVER ) )
{
        if ( et == SHOW_OVER )
        {
                video_off( dave );
                continue:
        }
        if ( event_success_code( ) != 0 )
                longjmp( transaction_trap, LOST_PUMP );

        if ( Equal_buffers( e, "HOSE", 4 ) )
        {
                select_grade( e[ 4 ] );
                column_speaker_off( dave );
                both_speakers_on( dave );
                goto authorize_it;
        }
```

```
        else if ( Equal_buffers( e, "TIMEOUT", 7 ) )
        {
                T->fill_termination = USER_ABEND;
                return 0;
        }
        else if ( Equal_buffers( e, "WARNING", 7 ) )
        {
                        stop_video_show( );
                        show_screen( dave, PUMP_OR_ELSE_SCREEN );
                        pump_or_else_audio( T->language );
                        cnt_beep( dave );
                }
                else
                {
                        T->fill_termination = SYSTEM_ABEND;
                        return 0;     /* bug in system */
                }
        }

authorize_it:
        authorize_pump( T->preset_amount );
        if ( !Equal_buffers( get_pump_event(), "AUTHORIZED", 10 ) )
        {
                T->fill_termination = SYSTEM_ABEND;
                return 0;
        }

        while( 1 )
        {
```

```
e = get_pump_event( );
if ( Equal_buffers( e, "WARNING", 7 ) )
{
        stop_video_show( );
        show screen( dave, PUMP_OR_ELSE_SCREEN );
        pump_or_else_audio( T->language );
        cnt_beep( dave );
}
else if ( Equal_buffers( e, "ABNORMAL", 8 ) )
{
        T->fill_termination = SYSTEM_ABEND;
        return 0;
}
else if ( Equal_buffers( e, "TIMEOUT", 7 ) )
{
        T->fill_termination = USER_ABEND;
        return 0;
}
else if ( Equal_buffers( e, "HOSE", 4 ) )
{
        select_grade( e[ 4 ] );
show_screen( dave,
   T->type == POST_PAY_TRANSACTION ? LIFT_FOR_KIOSK_SCREEN :
                        PROCEED_TO_FILL_SCREEN );
        stop_video_show( );
}
else if ( Equal_buffers( e, "FUEL FLOW", 9 ) )
        return 1;
```

```
else
{
        T->fill_termination = SYSTEM_ABEND;
        return 0;
```

appl/process.c

```
#include "screens.h"
#include "vars.h"
#include "exceptions.h"
#include <stdio.h>

static jmp_buf _ttrap,
               _ptrap;

Process_transactions( )
{
      unsigned t;

      transaction_trap = &_ttrap;
      post_pay_trap    = &_ptrap;

      while( 1 )
            if ( t = setjmp( transaction_trap ) )
                  Process_exception( t );
            else
                Do_one_sale( );
}

Process_exception( type )
      unsigned type;
```

```
{
    char *msg;

    video_off( dave );

    stop_video_show( );

    if ( type == JUST_RESET_ME )
    {
            card_light_off( dave );
            cash_light_off( dave );
            receipt_light_off( dave );
            return;
    }

    if ( type == POWER_FAILURE )
    {
            Power_has_failed( );
            return;
    }

    switch( type )
    {
    case LOST_PUMP:         msg = "U/S(PUMP)";          break;
    case CANT_READ_CARD:    msg = "U/S(CARD READER)";   break;
    case CANT_EJECT_CARD:   msg = "U/S(CARD STUCK)";    break;
    case CANT_READ_NOTE:    msg = "U/S(NOTE READER)";   break;
    case PRINT_FAILURE:     msg = "U/S(PRINTER)";       break;
    case STACKER_FAILURE:   msg = "U/S(STACKER)";       break;
    default:                msg = "OUT OF SERVICE";     break;
```

```
        }
        Device_error( type, msg );
}

Do_one_sale( )
{
        unsigned why;

        Reset_all( );
        Language_choice( );
    while( !Preset_choices( ) )  /* cancelling between A2 and A3 */
{
                if (T->language == ENGLISH)
                        T->language = FRENCH;
                else if (T->language == FRENCH)
                        T->language = ENGLISH;
        }

        if ( why = setjmp( post_pay_trap ) )
                Post_pay_fill_intro( why );
        else
                Payment_loop( );

        if ( debug_event )
        tfprintf( stderr, "USER SPEED %d\n", User_speed_factor( ) )

        Do_a_fill( );
        Make_sure_the_hook_is_down( );

        if ( T->type != POST_PAY_TRANSACTION )
        {
```

```
            post_transaction( );
            Pre_pay_transaction_outcomes( );
            thank_you( );
            save_previous_transaction( );
        }
        else
            Post_pay_end_of_fill( );
        log_transaction( );
    }

    Reset_all( )
    {
        char    *get_pump_event( ),
                    *e;

        stop_video_show( );
        video_off( dave );
        both_speakers_off( dave );
        column_speaker_on( dave );
        Reset_learning_curve( );

        zero( T, sizeof( *T ) );  /* clear current transaction *
        strcpy( T->auth_number, "00000" );
        T->response_code[ 0 ] = '9';
        T->response_code[ 1 ] = '9';
        T->grade_pumped  = P->grade_pumped;
        T->language      = ENGLISH;
        T->trans_seq_num = P->trans_seq_num + 1;
        pump_id_request( );
        e = get_pump_event( );
```

```
        T->pump_id_pumped = UNCHAR(e[6]);          /* "PUMPIDn"   */

        if ( price_change_requested( ) ) /* now is a good time */
        {
           pump_change_prices( price_data( ), bullochs_id( ) );
                e = get_pump_event( );
                price_change_done( );
        }

        Initialize_pump_map( T->pump_id_pumped );
                                    /* get plumbing straight */
        pump_prices_request( );     /* get the latest prices */
        e = get_pump_event( );
        decode_prices( e );

        give_me_timestamp( T->pump_id_pumped );
                                   /* get the current time  */
}

Language_choice ()
{
        char      *e;
        unsigned idling = 1;
        int       et;

        show_screen( dave, LANGUAGE_SCREEN );
        display previous_transaction( );
        report_pump_out_of_service( T->pump_id_pumped );

        blink_on( );

        while( idling )
```

```
        {
        et = new_event( &e,
                    SCREEN_TOUCHED | PRICE_EVENT | PUMP_EVENT );
        if ( et == SCREEN_TOUCHED )
                idling = language_screen_touch( e );
                else if ( et == PRICE_EVENT )
                {
                        quiet_pump( T->pump_id_pumped );
                        blink_off( );
                        longjmp( transaction_trap, JUST_RESET_ME );
                        break;
                }
                else if ( et == PUMP_EVENT )
                {
                        blink_off( );
                        longjmp( transaction_trap, LOST_PUMP );
                        break;
                }
        }
        quiet_pump( T->pump_id_pumped );
        blink_off( );
}
language_screen_touch( e )
        char *e;
{
        switch (*e)
        {
          case 'E':
```

```
        case 'F':  T->language = *e == 'F' ? FRENCH : ENGLISH;
                                T->ttime    = now;
                                return 0;
                                break;
        case 'T':  if ( price_change_requested( ) )
                                {
                    quiet_pump( T->pump_id_pumped );
                    blink_off( );
                    longjmp( transaction_trap,  JUST_RESET_ME )
                                }
                       give_me_timestamp( T->pump_id_pumped );
                       reactivate_language_touchzones( );
                           break;
    }
    return 1;
}

Payment_loop( )
{
    while (1)
    {
            Pay_choices( );
            switch (T->type)
            {
              case CARD_TRANSACTION:  if ( Card_payment( ) )
                                                  return;
                                          break;
              case CASH_TRANSACTION:  if ( Cash_payment( ) )
```

```
                                        return;
                                    break;
            }

        }
}

Pay_choices( )
{
        char *e;

        show_screen( dave, PAY_CHOICE_SCREEN );
        video_off( dave );
        Set_user_entry( pay_choice_audio( T->language ) );
        new_event( &e, SCREEN_TOUCHED );

        switch ( *e )
        {
        case 'T':       longjmp( transaction_trap, JUST_RESET_ME );
                                        break;

        case 'C':
        case 'P':       T->type = *e == 'P' ? CARD_TRANSACTION :
```

```
                                        CASH_TRANSACTION;
                    display_transaction_type( dave, T->language,
                    T->type );
                    break;
        default:    break;
        }
        Set_user_exit( );
}

calculate_totals( )
{
 if ( T->type == CARD_TRANSACTION)
        T->cents_in = T->cents_pumped + T->car_wash_amount;

 if ( T->preset_amount != 0 && T->cents_pumped > T->preset_amount )
    T->cents_pumped = T->preset_amount;
                                        /* my pump runneth over */
      T->total_due  = T->cents_pumped + T->car_wash_amount;
      T->change_due = T->cents_in - T->total_due;
}


Make_sure_the_hook_is_down( )
{
      char *get_pump_event( ),
               *e;

      stop_video_show( );

      pump_is_hook_down_now( );
```

```
        if ( !Equal_buffers( get_pump_event( ), "HOOKDOWN", 8 ) )
        {
                show_screen(,dave, REPLACE_NOZZLE_SCREEN );
                video_off( dave );
                replace_nozzle_audio( T->language );
                new_event( &e, SHOW_OVER );
        }
        pump_is_hook_down( );
        get_pump_event( );
}

/* outcomes are:                                    */
/*     1) LTS cancelled the fill                    */
/*     2) User cancelled the fill                   */
/*     3) A Normal Fill                             */

Pre_pay_transaction_outcomes( )
{
        switch( T->fill_termination )
        {
        case NORMAL_FILL:          Receipt( );                  break;
        case USER_ABEND:           User_cancel_receipt( );      break;
        case SYSTEM_ABEND:         System_cancel_receipt( );    break;
        }
}

Receipt( )
```

```
{
        char *e;
        int  display_credit( );

        Receipt_graphics( display_credit );

        if ( T->change_due == 0 )
                receipt_no_credit_audio( T->language );
        else
                receipt_credit_audio( T->language );

        new_event( &e, SCREEN_TOUCHED );
        stop_video_show( );
        switch ( *e )
        {
        case 'P':       goodbye_thanks_video( T->language );
                        show_screen( dave, RECEIPT_STANDBY_SCREEN );
                        print_documents( );
                        break;
        case 'T':
        default:    break;
        }
}


user_cancel_receipt( )
{
        char *e;
        int  display_user_cancel_credit ();
```

```
        Receipt_graphics( display_user_cancel_credit );

        if (T->type == CASH_TRANSACTION)
                cancelled_cash_audio (T->language);
        else if (T->type == CARD_TRANSACTION)
                cancelled_card_audio (T->language);
        else
                ;

        new_event (&e, SCREEN_TOUCHED);
        switch ( *e )
        {
                case 'P':       print_documents ();     break;
                case 'T':
                default:    break;
        }
}

system_cancel_receipt( )
{
        char *e;
        int  display_system_cancel_credit( );

        Receipt_graphics( display_system_cancel_credit );

        if ( T->type == CASH_TRANSACTION )
                cash_abend_audio( T->language );
        else if ( T->type == CARD_TRANSACTION )
```

```
            card_abend_audio( T->language );
        else
            }
        new_event( &e, SHOW_OVER );

        new_event( &e, SCREEN_TOUCHED );
        switch( *e )
        {
            case 'P':       print_documents( );     break;
            case 'T':
            default:    break;
        }
}

Receipt_graphics( credit_function )
        PFI credit_function;
{
        set_screen_timeout(  RECEIPT_BACKGROUND_SCREEN,
                             T->change_due ? 30 :  18 );
        show_screen( dave, RECEIPT_BACKGROUND_SCREEN );
        (*credit_function)(dave, T->change_due, T->language );
        video_receipt( );
        video_off( dave );
}


thank_you( )
{
        show_screen( dave, THANK_YOU_SCREEN );
```

```
        video_off( dave );
        pump_money_audio( );
        delay( FIVE_SECONDS );
}

save_previous_transaction( )
{
        *P = *T;
        Push_checkpoint( );
}

post_transaction ()
{
        char *typed_filling_data ();
        char *packed_auth_language( ),
                *al;
        unsigned cash;

        if ( T->type == CARD_TRANSACTION && T->cents_pumped != 0 )
        {
        al = packed_auth_language( T->auth_number,
                                        T->language_code );
        pos_capture_transaction( dave, T->card_number, al,
                                T->cents_pumped, T->grade_pumped,
            (unsigned)T->volume_pumped / 10, T->price_pumped );
        }

        if (T->cents_pumped != 0)
```

```
        {
        cash = T->type == CASH_TRANSACTION ? T->cents_in : 0;
        here_is_a_transaction( T->pump_id_pumped,
        hose_of( T->grade_pumped ),
        typed_filling_data( cash, T->auth_number,
        T->response_code ) );
        }

        set_pump_sale_complete( );
        get_pump_event( );
}

static char _buf[ 10 ];

char *packed_auth_language( a, l )
        char *a, l;
{
        zero( _buf, sizeof( _buf ) );
        memcpy( _buf, a, 5 );
        _buf[ 5 ] = l;

        return _buf;
}


log_transaction ()
{
        char logm [ 40 ],
                *types_string( );
```

```
        tsprintf( logm, "%s sale completed",
                                        types_string( T->type ) );
        log_me( logm );
}

Power_has_failed( )
{
        char *e;

        log_me( "power_shutdown" );
        show_screen( dave, POWER_OFF_RECEIPT_SCREEN );
        while( new_event( &e, POWER_EVENT ) )
                if ( Equal_buffers( e, "POWER_GOOD", 10 ) )
                        return;
        log_me( "power_reset" );
}
```

appl/receipt_format.c

```
#include "trans.h"

static char *hdr [] =
{
"T01          PETRO-CANADA\015",
"T02                ",
"T03          PUMP NO.",
"T04\015 REGULAR              ",
"T05\015 UNLEADED             ",
"T06\015 SUPER UNLEADED       ",
"T07 C/L\015 LITRES PUMPED        ",
"T08\015 FUEL                 $ ",
"T09\015 TOTAL                $ ",
"T10\015 CASH TENDERED        $ ",
"T11\015 CREDIT DUE           $ ",
"T12\015          THANK-YOU\015",

"T21         PETRO-CANADA\015", /* not used, here for symmetry */
"T22                ",
"T23         POMPE NO.",
"T24\015 ORDINAIRE            ",
"T25\015 SANS PLOMB           ",
"T26\015 SUPER SANS PLOMB     ",
"T27 C/L\015 QUANTITE ACHETEE     ",
"T28\015 CARBURANT            $ ",
"T29\015 MONTANT DU           $ ",
```

```
"T30\015 MONTANT REMIS      $ ",
"T31\015 CREDIT             $ ",
"T32\015              MERCI\015",
"T50\015\015\012\012\012\012\012\012",
"T51\015 PETRO#",
"T52\015 M.CARD#",
"T53\015 VISA#",
"T54\015 UNKNWN#",
0
};

static char lbuf [ 40 ];

set_receipt_header1( s )
      char *s;
{
      int length;
      char *c;

      memset( lbuf, ' ', sizeof( lbuf ) );
      strcpy( lbuf + (14 - (strlen( s ) / 2)), s );
      length  = strlen( hdr[ 0 ] ) + strlen( lbuf ) + 10;
                        /* \015 #\0 +  slop  */

      c = calloc( 1, length );
      tsprintf( c, "%s%s\015 #", hdr[ 0 ], lbuf );
      hdr[ 0 ] = c;
}
```

```
char *cnt_string( n )
        unsigned n;
{
        return hdr[ n ];
}

static unsigned l;
static char dbuf [ 15 ];

char *dollars( amount )
        unsigned amount;
{
        tsprintf( dbuf, "%3u.%02d", amount / 100, amount % 100 );
        return dbuf;
}

static char _abuf [ 15 ];

char *cnt_text( field )
        unsigned field;
{
        tsprintf( _abuf, "\020%02u", field );
        return _abuf;
}

set_document_language( _language )
        unsigned _language;
{
```

```
        l   = _language;
}

char *format_header( p, sequence, pump, t )
        char *p;
        unsigned sequence, pump;
        date_and_time t;
{
        unsigned hh = t.hours;

        p += tsprintf( p, "%s", cnt_text( 1 ) );

        if ( hh >= 13 )
            hh -= 12;
        p += tsprintf( p, "%05u%s%02d:%02d%s\015",
                        sequence, cnt_text( 1 ? 22 : 2 ),
                        hh, t.minutes, ampms( t.hours ) );

      p += tsprintf( p, " %02d-%02d-%02d%s%2d",
        t.month, t.day, t.year, cnt_text( 1 ? 23 : 3 ),
                                        pump );

        return p;
}

char *format_fill_data( p, volume, grade, price )
        char *p;
        long     volume;
        unsigned grade. price;
```

```
        p += tsprintf( p,"%s%02d.%d",
                        cnt_text( cnts_grade( grade ) ),
                              price /10, price % 10 );

        return p + tsprintf( p,"%s%31d.%021dL",
                        cnt_text( 1 ? 27 : 7 ),
                      volume / 100L, volume % 100L );
}

cnts_grade( g )
        int g;
{
        if ( g == 1 )
                return 1 ? 24 :4;
        else if (g == 2)
                return 1 ? 25 : 5;
        else
                return 1 ? 26 : 6;
}

char *format_card_tender( p )
{
        return p + tsprintf( p, "%s%s",
        cnt_text( receipt_card_field( ) ), card_formats( ) );
}

char *format_fuel( p, fuel )
```

```
        char      *p;
        unsigned fuel;
{
        return p + tsprintf( p, "%s%s", cnt_text( 1 ? 28:8 ),
                                        dollars( fuel ) );
}

char *format_total( p, total )
        char      *p;
        unsigned total;
{
        return p + tsprintf( p, "%s%s", cnt_text( 1 ?29:9 ),
                                        dollars( total ) );
}

char *format_cash_tender( p, cents_in )
        char *p;
        unsigned cents_in;
{
        return p + tsprintf( p, "%s%s", cnt_text( 1?30:10 ),
                                        dollars( cents_in ) );
}

char *format_change_due( p, change )
        char      *p;
        unsigned change;
{
        if (change != 0)
```

```
        p += tsprintf( p, "%s%s", cnt_text( 1 731:11 ),
                                        dollars( change ) );
        return p;
}

char *eject(),
        *perforate(),
        *cut ();

char *eject_and_perforate( m )
        char *m;
{
        m = eject( m );
        return perforate( m );
}

char *eject_and_cut( m )
        char *m;
{
        m = eject( m  );
        return cut( m );
}

static char *eject( m )
        char *m;
{
        m += tsprintf( m, "%s", cnt text( 1732:12 ) );
        return m + tsprintf( m, "%s", cnt_text( 50 ) );
```

```
}

static char *perforate( m )
        char *m;
{
        *m++ = 0x0e;
        *m   = '\0';
        return m;
}

static char *cut( m )
        char *m;
{
        return m + tsprintf( m, "\015\012\012\014" );
}
```

appl/receipts.h

```
extern char *format_header (),
                    *format_fill_data (),
                    *format_cash_tender (),
                    *format_card_tender (),
                    *format_fuel (),
                    *format_total (),
                    *format_change_due (),
                    *eject_and_perforate (),
                    *eject_and_cut ();
```

```
#include "screens.h"

#include "vars.h"

#include <stdio.h>

/* standard touch areas as of July 27th, "A" series screens */

/* coordinates are touchscreen coordinates. */


static TOUCH_AREA _A1 [ 3 ] = {

                49, 456, 465, 758,      "E0", /* English */

               614, 456, 988, 758,      "F0", /* French  */

                -1,  -1,  -1,  -1, ""  ,

};

static TOUCH_AREA _A2 [ 7 ] = {

               816, 946, 968, 994, "R0",        /* reset   */

                50, 690, 263, 881, "05",        /* 5 bucks */

               384, 690, 516, 881, "10",

               553, 690, 751, 881, "15",

               789, 690, 978, 881, "20",

               214, 431, 828, 640, "FI",

                -1,  -1,  -1,  -1,  ""

};

static TOUCH_AREA _A4 [ 4 ] = {

                54, 444,  321,  649, "C0",  /*  Cash  */

               739, 444,  987,  649, "P0",  /*  Card  */

                -1,  -1,  -1,  -1,   "",
```

```
};

static TOUCH_AREA _A6 [ 2 ] = {
        155, 966, 881, 1023, "RO",/* Press strip to start again */
         -1,  -1,  -1,   -1,  ""
};

static TOUCH_AREA _A8 [ 2 ] = {
                702, 577, 954, 759, "IO", /* All cash in ? */
                 -1,  -1,  -1,  -1,   ""
};

static TOUCH_AREA _A10 [ 6 ] = {
         811, 943,  961, 1002, "RO",      /* reset          */
          77, 587,  277,  765, "VO",      /* visa           */
         435, 587,  634,  765, "PO",      /* petro canada   */
         770, 587,  964,  765, "MO",      /* master card    */
          87, 422,  958,  540, "GO",      /* all else       */
          -1,  -1,   -1,   -1,  ""
};

static TOUCH_AREA _A12 [ 4 ] = {
        456, 440, 614, 495, "RO",     /* reset          */
         58, 563, 480, 997, "GO",     /* we can handle  */
        587, 563, 962, 997, "BO",     /* no mag stripe  */
         -1,  -1,  -1,  -1,  ""
};

static TOUCH_AREA _A14 [ 2 ] = {
```

```
        153, 968, 876, 1016, "RO",     /* reset          */
        -1,  -1,  -1,   -1,  ""
};

static TOUCH_AREA _A20 [ 2 ] = {
        158, 543, 423, 742, "PR",     /* Print Receipt   */
        -1,  -1,  -1,  -1, ""
};


static PICTURE A1  = {  "a1",  _A1,  30 };
static PICTURE A2  = {  "a2",  _A2,  60 };
static PICTURE A4  = {  "a4",  _A4,  30 };
static PICTURE A6  = {  "a6",  _A6,  60 };
static PICTURE A8  = {  "a8",  _A8,   0 };
static PICTURE A10 = { "a10", _A10,  60 };
static PICTURE A12 = { "a12", _A12,  60 };
static PICTURE A14 = { "a14", _A14,  60 };
static PICTURE A16 = { "a16", NULL,   0 };
static PICTURE A18 = { "a18", NULL,   0 };
static PICTURE A20 = { "a20", _A20,  10 };
static PICTURE A20C = { "a20c", NULL, 0 };
static PICTURE A22 = { "a22", NULL,   0 };
static PICTURE A22A = { "a22a", NULL, 0 };
static PICTURE A24  = { "a24", NULL,   0 };
static PICTURE SP2  = { "sp_2", NULL,  1 };
static PICTURE SP5  = { "sp_5", NULL,  1 };
static PICTURE SP6  = { "sp_6", NULL,  0 };
```

```
static PICTURE SP7  = { "sp_7", NULL,  0 };
static PICTURE SP8  = { "sp_8", NULL,  0 };
static PICTURE SP11 = { "sp_11", NULL, 0 };
static PICTURE SP13 = { "sp_13", NULL, 0 };
static PICTURE SP15 = { "sp_15", NULL, 0 };
static PICTURE SP16 = { "sp_16", NULL, 0 };
static PICTURE SP17 = { "sp_17", NULL, 1 };
static PICTURE SP21 = { "sp_21", NULL, 0 };
static PICTURE SP22 = { "sp_22", NULL, 1 };

static PICTURE A3  = {  "a3",  _A2,  60 };
static PICTURE A5  = {  "a5",  _A4,  30 };
static PICTURE A7  = {  "a7",  _A6,  60 };
static PICTURE A9  = {  "a9",  _A8,   0 };
static PICTURE A11 = { "a11", _A10,  60 };
static PICTURE A13 = { "a13", _A12,  60 };
static PICTURE A15 = { "a15", _A14,  60 };
static PICTURE A17 = { "a17", NULL,   0 };
static PICTURE A19 = { "a19", NULL,   0 };
static PICTURE A21 = { "a21", _A20,  10 };
static PICTURE A23 = { "a23", NULL,   0 };
static PICTURE A23A ={ "a23a", NULL,  0 };
static PICTURE A25 = { "a25", NULL,   0 };
static PICTURE A21C = { "a21c", NULL, 0 };

static PICTURE  E1  = {  "e1", NULL, 0 };
static PICTURE  E2  = {  "e2", NULL, 0 };
```

```
static PICTURE  E3   = {  "e3", NULL, 0 };

static PICTURE SP2F   = { "sp_2f", NULL,  1 };
static PICTURE SP5F   = { "sp_5f", NULL,  1 };
static PICTURE SP6F   = { "sp_6f", NULL,  0 };
static PICTURE SP7F   = { "sp_7f", NULL,  0 };
static PICTURE SP8F   = { "sp_8f", NULL,  0 };
static PICTURE SP11F  = { "sp_11f", NULL, 0 };
static PICTURE SP13F  = { "sp_13f", NULL, 0 };
static PICTURE SP15F  = { "sp_15f", NULL, 0 };
static PICTURE SP16F  = { "sp_16f", NULL, 0 };
static PICTURE SP17F  = { "sp_17f", NULL, 1 };
static PICTURE SP21F  = { "sp_21f", NULL, 0 };
static PICTURE SP22F  = { "sp_22f", NULL, 1 };

static PICTURE          *English [ MAXSCREENS ] = {
/* language choice      */      &A1,
/* preset choices       */      &A2,
/* pay choices          */      &A4,
/* insert bill          */      &A6,
/* all cash in ?        */      &A8,
/* card type ?          */      &A10,
/* petro card type      */      &A12,
/* insert card          */      &A14,
/* standby authori      */      &A16,
/* proceed fill         */      &A18,
/* receipt  ?           */      &A20,
```

```
/* thank you          */     &A22,
/* kiosk              */     &A24,
/* thanks kiosk       */     &A22A,
/* out of order       */     &E1,
                              &E2,
                              &SP2,
                              &SP5,
                              &SP6,
                              &SP7,
                              &SP8,
                              &SP11,
                              &SP13,
                              &SP15,
                              &SP16,
                              &SP17,
                              &SP21,
                              &SP22,
                              &A20C

};

static PICTURE        *French [ MAXSCREENS ] = {
/* language choice     */     &A1,
/* preset choices      */     &A3,
/* pay choices         */     &A5,
/* insert bill         */     &A7,
/* all cash in ?       */     &A9,
/* card type ?         */     &A11,
```

```
/* petro card type    */    &A13,
/* insert card        */    &A15,
/* standby authori    */    &A17,
/* proceed fill       */    &A19,
/* receipt  ?         */    &A21,
/* thank you          */    &A23,
/* kiosk              */    &A25,
/* kiosk thanks       */    &A23A,
/* out of order       */    &E1,
                             &E3,
                             &SP2F,
                             &SP5F,
                             &SP6F,
                             &SP7F,
                             &SP8F,
                             &SP11F,
                             &SP13F,
                             &SP15F,
                             &SP16F,
                             &SP17F,
                             &SP21F,
                             &SP22F,
                             &A21C

};

set_screen_timeout (screen, value)
        unsigned screen, value;
```

```
{
        PICTURE *p = English [ screen ];

        p ->touch_timeout = value;
}

reactivate_language_touchzones ()
{
        deactivate_touchscreen ();
        clear_touch_zones ();
        set_touchscreen(0, English[ 0 ]->touch_list,
                                English[ 0 ]->touch_timeout );
}

show_screen_alone (dn, n)
        unsigned dn, n;
{
 PICTURE *p = T->language == FRENCH ? French [ n ] : English [ n

        display_frame (dn, p ->name);
}

show_screen (dn, n)
        unsigned dn, n;
{
 PICTURE *p = T->language == FRENCH ? French [ n ] : English [ n

        deactivate_touchscreen ();
        clear_touch_zones ();
```

```
if ( memcmp( p->name, "sp", 2 ) == 0 )
display_frame( dn, p->touch_timeout ? "sp_full" : "sp_half" );

display_frame( dn, p->name );
set_touchscreen(n, p->touch_list, p->touch_timeout );

switch ( n )
{
case  LANGUAGE_SCREEN:          language_screen (dn);   break;
case  PRESET_CHOICES_SCREEN:    preset_screen (dn);     break;
}
}


static set_touchscreen( id, t, timeout )
      unsigned   id;
      TOUCH_AREA *t;
      int                     timeout;
{
      if ( t == NULL )
              return;

 for ( ; t->left != -1; t++)
 define_touch_zone( t->left, t->bottom, t->right,
 t->top, t->tname );

 activate_touchscreen( id, timeout );
}


static language_screen( dn )
```

```
        unsigned dn;
{
        display_prices( dn, T->regular_price, T->unleaded_price,
                                                T->premium_price );
        if (P->grade_pumped != 0)
                display_grade (dn, P->grade_pumped, T->language);
}

static preset_screen (dn)
        unsigned dn;
{
        display_prices (dn, T->regular_price, T->unleaded_price,
                                                T->premium_price);
        if (P->grade_pumped != 0)
                display_grade (dn, P->grade_pumped, T->language);
}
```

appl/screens.h

```
#define MAXSCREENS      30

typedef struct {
        int             left;
        int             bottom;
        int             right;
        int             top;
        char            *tname;
} TOUCH_AREA;

typedef struct {
```

```
    char            *name;
    TOUCH_AREA      *touch_list;
    int             touch_timeout;
} PICTURE;

#define LANGUAGE_SCREEN              0          /*  a1 */
#define PRESET_CHOICES_SCREEN        1          /*  a2 */
#define PAY_CHOICE_SCREEN            2          /*  a4 */
#define INSERT_BILL_SCREEN           3          /*  a6 */
#define ALL_CASH_IN_SCREEN           4          /*  a8 */
#define CARD_TYPE_SCREEN             5          /* a10 */
#define PETRO_CARD_TYPE_SCREEN       6          /* a12 */
#define INSERT_CARD_SCREEN           7          /* a14 */
#define STANDBY_AUTH_SCREEN          8          /* a16 */
#define PROCEED_TO_FILL_SCREEN       9          /* a18 */
#define RECEIPT_BACKGROUND_SCREEN   10          /* a20 */
#define THANK_YOU_SCREEN            11          /* a22 */
#define LIFT_FOR_KIOSK_SCREEN       12          /* a24 */
#define THANK_YOU_KIOSK_SCREEN      13          /* a23 */

#define PUMP_OUT_OF_ORDER_SCREEN    14          /*  e1 */
#define BAD_NOTE_SCREEN             15          /*  e2 */
#define POWER_OFF_RECEIPT_SCREEN    16          /* sp2 */
#define PRINTER_BROKEN_SCREEN       17          /* sp5 */
#define CARD_REFUSED_SCREEN         18          /* sp6 */
#define  HOT_CARD_SCREEN            19          /* sp7 */
#define PUMP_OR_ELSE_SCREEN         20          /* sp 8 */
#define NON_MAG_SCREEN              21          /* sp 11 */
#define KIOSK_HALTED_SCREEN         22          /* sp 13 */
```

```
#define BAD_CARD_SCREEN            23          /* sp 15 */
#define REMOVE_CARD_SCREEN         24          /* sp 16 */
#define REPLACE_NOZZLE_SCREEN      25          /* sp 17 */
#define OTHER_CARD_SCREEN          26          /* sp 21 */
#define SYSTEM_PROBLEM_SCREEN      27          /*  sp22 */
#define RECEIPT_STANDBY_SCREEN     28          /* a20c/a21c */
```

appl/select_grade.c

```
#include "vars.h"

select_grade (hose)
      char hose;
{
      T->grade_pumped = decode_grade (UNCHAR (hose));
      display_grade (dave, T->grade_pumped, T->language);
}
```

appl/send_headers.c

```
#include "vars.h"

static int cnt_ram_loaded;

send_cnt_headers( )
{
      int  i;
      char *e,
            *cnt_string( ),
            *h;
```

```
        if ( cnt_ram_ok( ) )
                return;

        get_receipt_headers( );
        for ( i = 0; h = cnt_string( i ); i++ )
        {
                cnt_cmd( dave, h, 10 );
                new_event( &e, CNT_EVENT );
        }
        set_cnt_ram_loaded( );
}

cnt_ram_reset( )
{
        cnt_ram_loaded = 0;
}

set_cnt_ram_loaded( )
{
        cnt_ram_loaded = 1;
}

cnt_ram_ok( )
{
        return cnt_ram_loaded;
}
```

appl/strings.c

```
#include "vars.h"

char *credvouchs ()
```

```
{
        return "STATION ID";
}

char *carvouchs ()
{
        return "";
}

char *carwashs ()
{
        return "";
}

char *pumps ()
{
 return T->language == ENGLISH ? "PUMP NO." : "POMPE NO.";
}

char *ampms (h)
        int h;
{
        if ( h >= 12 )
                return T->language == ENGLISH ? "PM" : "P";
        else
                return T->language == ENGLISH ? "AM" : "A";
}

static char *egrades [] = { "REGULAR",   "UNLEADED",
                                        "SUPER UNLEADED" };
```

```
static char *fgrades [] = { "ORDINAIRE", "SANS PLOMB",
                                        "SUPER SANS PLOMB" };

char *grades(g)
        int g;
{
        g--;
        if ( T->language == ENGLISH )
                return egrades [g];
        else
                return fgrades [g];
}

char *litres ()
{
 return T->language ==
                ENGLISH ? "LITRES PUMPED" : "QUANTITE ACHETEE";
}

char *fuels ()
{
        return T->language == ENGLISH ? "FUEL" : "CARBURANT";
}

char *totals ()
{
        return T->language == ENGLISH ? "TOTAL" : "MONTANT DU";
}

char *cashs ()
{
```

```
 return T->language == ENGLISH ? "CASH TENDERED" : "MONTANT REMIS"
}

char *credits ()
{
        return T->language == ENGLISH ? "CREDIT DUE" : "CREDIT";
}

char *thankyous ()
{
        return T->language == ENGLISH ? "THANK-YOU" : "MERCI";
}

char *card_names ()
{
        switch( T->card_type )
        {
                case PETRO_CARD:  return "PETRO#";  break;
                case VISA_CARD:   return "VISA#";   break;
                case MASTER_CARD: return "M.CARD#"; break;
                default:          return "UNKWN#"; break;
        }
}

receipt_card_field ()
{
        switch ( T->card_type )
        {
                case PETRO_CARD:  return 51; break;
                case VISA_CARD:   return 53; break;
```

```
            case MASTER_CARD: return 52; break;
            default:          return 54; break;
        }
}

char *credtrails ()
{
        return "HELLO";
}

char *washtrails ()
{
        return "";
}

static char s [ 40 ];

char *card_formats( )
{
        char *p = T->card_number;
        switch( T->card_type )
        {
                case PETRO_CARD:
                        p += 5;
                        tsprintf(s, "%3.3s-%3.3s-%3.3s-%1.1s-%4.4s",
                                p, p + 3, p + 6, p + 9, p + 10);
                                                        break;
                case VISA_CARD:
```

```
                tsprintf(s, "%4.4s-%3.3s-%3.3s-%3.3s",
                        p, p + 4, p + 7, p + 10);
                                        break;
        case MASTER_CARD: /* HACK - don't know yet */
                tsprintf(s, "%4.4s-%4.4s-%4.4s-%4.4s",
                        p, p + 4, p + 8, p + 12);
                                        break;
        default:        strncpy (s, p, 12);
                                        break;
    }
    return s;
}

char *types_string( type )
    unsigned type;
{
    char *ts;
    switch( type )
    {
    case CARD_TRANSACTION:          ts = "card";      break;
    case CASH_TRANSACTION:          ts = "cash";      break;
    case POST_PAY_TRANSACTION:      ts = "post pay"; break;
    default:                        ts = "unknown";  break;
    }
    return ts;
}
```

appl/strings.h

```
char *pumps ();
char *grades();
char *litres ();
char *fuels ();
char *totals ();
char *cashs ();
char *credits ();
char *thankyous ();
char *card_names ();
char *card_formats();
char *ampms ();
char *credvouchs ();
char *carvouchs ();
char *carwashs ();
char *credtrails ();
char *washtrails ();
```

appl/trans.h

```
typedef struct {
        unsigned        year,
                        month,
                        day,
                        hours,
                        minutes;
} date_and_time;


#define MAX_CARD_LENGTH         50
```

```
typedef struct {
        unsigned                type;
        date_and_time   ttime;
        char                    card_number [ MAX_CARD_LENGTH ],
                                auth_number [ MAX_CARD_LENGTH ];
        char                    response_code[ 2 ];
        char                    language_code;
        unsigned                card_type;
        long                    volume_pumped;  /* filling data */
        unsigned                cents_pumped,
                                price_pumped,
                                preset_amount,
                                grade_pumped,
                                pump_id_pumped;
        unsigned                fill_termination;
        unsigned                cents_in,  /* transaction data */
                                car_wash_amount,
                                trans_seq_num,
                                total_due,
                                change_due,
                                language;
        unsigned                unleaded_price,  /* prices  */
                                regular_price,
                                premium_price;
} transaction;
```

appl/trim.c

```
char *First_non_blank( s )
```

```
        char *s;
{
        char *p;
        for ( p = s; *p && *p == ' '; p++ )
                ;
        return *p ? p : s;
}

char *Last_non_blank( s )
        char *s;
{
        char *p = s + strlen( s );
        for ( --p; p > s && *p == ' '; p-- )
        ;
        return p;
}

char *Trim( s )
        char *s;
{
        char *f,
                *l;
        int  len;
        f = First_non_blank( s );
        l = Last_non_blank( s );
        len = l - f + 1;
```

```
        memcpy( s, f, len );
        s[ len ] = '\0';

        return s;
}

                                appl/type_of_card.c
#include "vars.h"
#include "screens.h"
#include "exceptions.h"

Type_of_card_choice( )
{
        char *e;

        stop_video_show( );
        show_screen( dave, CARD_TYPE_SCREEN );
        Set_user_entry( card_choice_audio( T->language ) );
        new_event( &e, SCREEN_TOUCHED );
        Set_user_exit( );
        switch( *e )
        {
        case 'R':    return 0;        break;
        case 'T':    longjmp( transaction_trap, JUST_RESET_ME ); brea
        case 'P':    return Type_of_petro_card( );
                                break;
        case 'M':
        case 'V':    return 1;
                                break;
        case 'G':          longjmp( post_pay_trap, OTHER_ACCEPTED_CARD
```

```
                    return 1;
                    break;
        }
}
```

appl/type_of_pet.c

```
#include "vars.h"
#include "screens.h"
#include "exceptions.h"

Type_of_petro_card( )
{
        char *e;

        stop_video_show( );
        show_screen( dave, PETRO_CARD_TYPE_SCREEN );
        Set_user_entry( petro_card_audio( T->language ) );
        new_event( &e, SCREEN_TOUCHED );
        Set_user_exit( );
        switch (*e)
        {
          case 'R':     return 2;
                                        break;
          case 'T':     longjmp( transaction_trap, JUST_RESET_ME );
                                        break;
          case 'G':     return 1;
                                        break;
          case 'B':     longjmp( post_pay_trap, NON_MAG_CARD );
                                        break;
        }
}
```

```
#ifndef GBLGEN
#define VARIABLE extern
#else
#define VARIABLE
#endif

#include <setjmp.h>
#include "^events/event.h"
#include "trans.h"

#define  ONE_SECOND_AND_A_HALF  30
#define  FIVE_SECONDS           100
#define  ONE_TWENTIETH                          1

#define  UNCHAR(b)     ((b)-'0')

#define UNDEFINED_TRANSACTION 0
#define CASH_TRANSACTION      1
#define CARD_TRANSACTION      2
#define POST_PAY_TRANSACTION  3

VARIABLE      unsigned debug_event;

VARIABLE      unsigned dave;

extern                char    *cards_name (),
                              *dollars();

VARIABLE      transaction     _current,
                              _previous,
```

```
                                *T,
                                *P;
VARIABLE        date_and_time   now;

#define MAX_CENTS_IN  8000              /* $80.00 limit */

VARIABLE        char            *Daves_error_status;
VARIABLE        jmp_buf         *transaction_trap,
                                *post_pay_trap;

/* receipt headers */

#define HEADER_LENGTH           40
#define HEADER_FILE             "/dave/receipt_headers"

typedef int (*PFI)();

/* filling outcomes */

#define NORMAL_FILL             1
#define SYSTEM_ABEND            2
#define USER_ABEND              3
```

appl/video_receipt.c

```
#include "vars.h"
#include "strings.h"

video_receipt ()
{
        char s [ 50 ],
                *header1 ();
        date_and_time t = T->ttime;
```

```
int  hh = t.hours;

display_string_centred( dave, header1( ), 308, 468, 329 );

tsprintf (s, "#%05u", T->trans seq_num);
;
display_string( dave, s, 318, 282 );

if ( hh >= 13 )

        hh -= 12;

tsprintf( s, "%02d:%02d%s", hh, t.minutes, ampms(t.hours) )
display_string( dave, s, 413, 282 );

tsprintf (s, "%02d-%02d-%02d", t.month, t.day, t.year);
display_string (dave, s, 318, 269);

tsprintf (s, "%s%d", pumps(), T->pump_id_pumped);
display_string (dave, s, 403, 269);

tsprintf (s, "%s", grades(T->grade_pumped));
display_string (dave, s, 318, 232);
tsprintf (s, "%2d.%d*", T->price_pumped / 10,
                                        T->price_pumped %10)
display_string (dave, s, 430, 232);

display_string (dave, litres(), 318, 217);
tsprintf (s, "%3ld.%02ldL", T->volume_pumped / 100L,
                            T->volume_pumped % 100L);
display_string (dave, s, 417, 217);

display_string (dave, fuels(), 318, 195);
video_dollars (s, T->cents_pumped, 417, 195);
```

```
    display_string (dave, totals(), 318, 181);
    video_dollars (s, T->total_due, 417, 181);

    if (T->type == CASH_TRANSACTION)
    {
            display_string (dave, cashs(), 318, 167);
            video_dollars (s, T->cents_in, 417, 167);

            if ( T->change_due != 0 )
            {
                    display_string (dave, credits(), 318, 153);
                    video_dollars (s, T->change_due, 417, 153);
            }
    }
    if (T->type == CARD_TRANSACTION)
    {
            video_card (s, 308, 468, 248);
      display_string_centred (dave, thankyous(), 308, 468, 119);
}

video_dollars (s, amount, x, y)
      char     *s;
      unsigned amount, x, y;
{
      tsprintf (s, "$ %2d.%02d", amount / 100, amount % 100);
      display_string (dave, s, x, y);
}

video_card (s, x1, x2, y)
      char    *s;
```

```
        unsigned x1, x2, y;
  {
        tsprintf (s,"%s%s", card_names(), card_formats());
        display_string_centred (dave, s, x1, x2, y);
}
```

appl/wash_choices.c

```
car_wash_choices ()
{
}
```

blink/blink.c

```
#include <timer.h>
#include <stdio.h>
#include <magic.h>
#include "blink.h"

#define HALF_SECOND      10

unsigned dave;

#define HIGHLIGHT 0
#define NORMAL    1

main (argc, argv)
      int  argc;
      char *argv [];
{
```

```
        request  r;
        unsigned task;

        initialize (argc, argv[1]);

        display_init_arrow (dave);
        while (1)
        {
        task = RECEIVE_ANY(&r);
        REPLY(task, &r);
        blink (task, &r);    /* returns when receive is true */
        display_reset_arrow (dave);
                REPLY (task, &r);
        }
}

initialize (c, dn)
        int  c;
        char *dn;
{
        dave = *dn - '0';
        if ( c != 2 )
                tfprintf (stderr, "blink dave_number\n");
}

unsigned b;

blink (task, r)
        unsigned task;
        request  *r;
{
```

```
        b = 0;
        while (CRECEIVE(task, r) == 0)
        {
                if (b == 0)
                        display_arrow (dave, 0, 0);
                if (b == 7)
                        display_reset_arrow (dave);
                set_timer (TIMER_WAKEUP, RELATIVE, HALF_SECOND);
                b++;
                if (b == 8)
                        b = 0;
        }
}
```

blink/blink.h

```
#include "/user/steve/dave/dave_request.h"

#define BLINKERS_NAME "/dave/blink"

#define BLINK     1
#define NO_BLINK 0
```

blink/blink.map

```
 .Segment:1   0000 to 06F6 (1783 bytes)
 .Segment:2   0000 to 00BA (187 bytes)
 .Segment:3   00BB to 0168 (174 bytes)
 .Total size is 0860 (2144) bytes
C01  0053  prologue
```

```
C01  005E  epilogue
C01  0067  stk_overflow
C01  007D  <exit>
C01  0083  $ucbeg
C01  0084  <main>
C01  0108  <initialize>
C01  0132  <blink>
C01  01A9  <display_arrow>
C01  01CE  <display_reset_arrow>
C01  01E7  <display_init_arrow>
C01  024F  <sleep>
C01  0295  <abs_sleep>
C01  02BA  <set_timer>
C01  0321  <dregister_name>
C01  04C7  <find_admin>
C01  0531  <calloc>
C01  0537  <malloc>
C01  053D  <realloc>
C01  0543  <free>
C01  0543  <cfree>
C01  0549  <fopen>
C01  054F  <fclose>
C01  0555  <getc>
C01  055B  <putc>
C01  0561  <ungetc>
C01  0567  <fflush>
C01  056D  <tfprintf>
C01  0573  <tsprintf>
```

```
C01  0579  <fget>
C01  057F  <fput>
C01  0585  <fiseek>
C01  058B  <rewind>
C01  0591  <forward>
C01  0597  <breakable>
C01  059D  <strcat>
C01  05A3  <strcmp>
C01  05A9  <strcpy>
C01  05AF  <strlen>
C01  05B5  <send>
C01  05BB  <abort>
C01  05C1  <unbreakable>
C01  05C7  <vc_send_reply>
C01  05CD  <vc_create>
C01  05D3  <vc_create2>
C01  05D9  <vc_create3>
C01  05DF  <ker_vc_destroy>
C01  05E5  <def_server>
C01  05EB  <set_acc_flags>
C01  05F1  <set_exception>
C01  05F7  <escape_tty>
C01  05FD  <hold>
C01  0603  <unhold>
C01  0609  <time_slice>
C01  060F  <task_info>
C01  0615  <force_ready>
C01  061B  <set_priority>
```

```
C01  0621  <set_user>
C01  0627  <set_slice>
C01  062D  <modify_flags>
C01  0633  <set_int_mask>
C01  0639  <set_int_vec>
C01  063F  <alloc_mem>
C01  0645  <receive>
C01  064B  <reply>
C01  0651  <attach>
C01  0657  <detach>
C01  065D  <await>
C01  0663  <signal>
C01  0669  <read_msg>
C01  066F  <write_msg>
C01  0675  <read_port>
C01  067B  <csignal>
C01  0681  <relay>
C01  0687  <creceive>
C01  068D  <memcpy>
C01  068D  <copy>
C01  06BA  <zero>
C01  06D6  <memset>
D00  0000  <User_sp>
D00  0002  <User_ss>
D00  0004  <Exc_bits>
D00  0008  <Exc_allow>
D00  000C  <Exc_pending>
D00  0010  <Exc_fp>
```

```
D00  0012  <Exc_pc>
D00  0014  <Exc_permit>
D00  0018  <Exit_status>
D00  001A  <Error_status>
D00  001C  <My_tid>
D00  001E  <Dads_tid>
D00  0020  <Break_count>
D00  0021  <My_tty>
D00  0022  stack_base
D00  0024  <Cmd_flags>
D00  0025  <My_priority>
D00  0026  <stdin>
D00  0028  <stdout>
D00  002A  <stderr>
D00  002C  <Free_list>
D00  002E  <End_of_free>
D00  0030  <File_list>
D00  0032  <_Argc>
D00  0034  <_Argv>
D00  0034  stk_limit
D00  0036  SAVE
D00  0038  TEMP
D00  0060  <Code_flags>
D00  0061  <User_num>
D00  0062  <Group_num>
D00  0063  <Team_num>
D00  0065  <My_nid>
D00  0067  <Dads_nid>
```

```
D00  0069  <My_tty_nid>
D00  006B  <My_cd_nid>
D00  006D  <Release_num>
D00  006E  <Ndp_save_area>
D00  0070  <Fstack>
D00  0072  <Call_stack_ptr>
D00  0074  <Segment_table_ptr>
D00  0076  <Check_point_sp>
D00  0078  <User_spare>
D00  007E  <Odb_tid>
D03  00BB  <dave>
D03  00BD  <b>
D03  00C1  <dr>
```

blink/int/blink_int.c

```
#include "^blink.h"
#include <task_msgs.h>
#include <magic.h>

static unsigned blinker;
extern request dr;

start_blinker (dave)
        unsigned dave;
{
        char daves [ 2 ];

        daves [ 0 ] = dave + '0';
        daves [ 1 ] = '\0';
```

```
        blinker = create (0, RUN_CONCURRENT, My_priority, 0, 0,
                                        BLINKERS_NAME, daves, 0);
}

blink_on ()
{
        dr.opcode = BLINK;
        SEND(blinker, &dr);
}

blink_off ()
{
        dr.opcode = NO_BLINK;
        SEND(blinker, &dr);
}
```

blink/makefile

```
CFLAGS  = -S

blink: blink.o
        linkobj blink.o c=blink  m=blink.map l=/user/steve/dave
        sort blink.map f=1,2 | copy >blink.map
        copy blink /dave/blink

blink.o: blink.c
```

bulloch/bulloch.c

```
#include "vars.h"
#include <timer.h>
#include "excepts.h"
#include "const.h"
```

```
static unsigned task;

main( argc, argv )
        int argc;
        char *argv[];
{
        request r;
        unsigned   code;
        if (code = setjmp( initial_trap ))
                initial_error( code );
        else
         initialize (argc, argv[1], argv[2], argv[3], argv[4]);

        for (;;)
        {
                task = RECEIVE_ANY( &r );
                if ( (task >> 8) == my_port )
                        Timer_fired( );
          else
                {
                        service_dave( &r );
                        REPLY( task, &r );
                }
        }
}

caller( )
{
        return task;
```

```
}

initialize (argc, device_name, port, pump_device, lets_debug)
        int  argc;
        char *device_name, *port, *pump_device, *lets_debug;
{
        if (argc != 3 && argc != 4)
                usage( );
        log_bulloch( "start" );

        my_port = atoi( port );
        if ( attach( my_port ) != 0 )
                longjmp( initial_trap, NO_TIMER );

        if (argc == 4 )
                debug = strcmp( lets_debug, "+d" ) == 0;

        disallow( );
        bulloch_in   = my_open( device_name, "rv", initial_trap,
                                                        NO_DEVICE );
        bulloch_out  = my_open( device_name, "wvu", initial_trap,
                                                        NO_DEVICE );
        Set_his_sequence( '!' );
        Set_sale_complete( );
        flush_input( bulloch_in );
        init_hose_totals( );
        log_bulloch( "ready" );

        Set_my_timer( 1 );
}
```

```
initial_error( code )
        unsigned code;
{
        char *message;
        ;
        switch (code)
        {
        case NO_TIMER:  message = "no timer port";   break;
        case NO_DEVICE: message = "no device";           break;
        }
        log_bulloch( message );
        exit( 1 );
}

usage( )
{
 tfprintf( stderr, "bulloch bulloch_device port pump_device +d\n"
        exit( 0 );
}
```

bulloch/bulloch.h

```
#include "/user/steve/dave/dave_request.h"

#define OPEN                          1000
#define CLEAR_PRICE_CHANGE_PENDING    2000
#define LOAD_TOTALS                   3000
#define KIOSK_AUTHORIZATION           4000
#define KIOSK_PAYMENT                 5000

#define GIVE_ME_TIMESTAMP             '!'  /* 0x21 */
```

```
#define GIVE_ME_PUMP_MAP                '"'  /* 0x22 */
#define I_NEED_ATTENTION                '#'  /* 0x23 */
                                         /* 0x24 '$' is OPEN */
#define I_HAVE_A_HOT_CARD               '%'  /* 0x25 */
#define TAKE_PUMP_FROM_ME               '\'' /* 0x27 */
#define RESET_YOURSELF_PLEASE           '('  /* 0x28 */
#define HERE_IS_TIMESTAMP               ')'  /* 0x29 */
#define HERE_IS_PUMP_MAP                '*'  /* 0x2a */
#define RELEASE_CARD_PLEASE             '+'  /* 0x2b */

#define CHANGE_PRICES_PLEASE     'G'
#define GIVE_CREDIT_TOTALS       'X'
#define GIVE_CASH_TOTALS         'Y'
#define HALT_PUMP_PLEASE         'F'
#define HERE_IS_A_TRANSACTION    'D'
```

bulloch/bulloch.map

```
 .Segment:1   0000 to 2573 (9588 bytes)
 .Segment:2   0000 to 0274 (629 bytes)
 .Segment:3   0275 to 0809 (1429 bytes)
 .Total size is 2D7E (11646) bytes
C01  0053  prologue
C01  005E  epilogue
C01  0067  stk_overflow
C01  007D  <exit>
C01  0083  $ucbeg
C01  0084  <main>
C01  011E  <caller>
C01  012D  <initialize>
```

```
C01  01FA  <initial_error>
C01  023F  <usage>
C01  0261  <Pushchar>
C01  0271  <Nextchar>
C01  02E5  <init_hose_totals>
C01  0345  <hose_total>
C01  0372  <seq_total>
C01  039E  <hose_no>
C01  03CC  <load_hose_total>
C01  0405  <calculate_bcc>
C01  0437  <Reset_inbound>
C01  044F  <Inbound_received>
C01  04A7  <Get_message>
C01  0571  <Clear_my_timer>
C01  0581  <Set_my_timer>
C01  05AA  <Cancel_my_timer>
C01  05DC  <Delay>
C01  05F7  <send_hose_total>
C01  062C  <send_request_to_bulloch>
C01  065C  <bulloch_packet>
C01  06F5  <transaction_packet>
C01  0771  <hose_total_packet>
C01  07EF  <Post_pump_map>
C01  081C  <Post_payment_made>
C01  0834  <Post_release>
C01  084C  <Post_authorization>
C01  0864  <Post_halt>
C01  087C  <Post_restart>
C01  0894  <post_new_prices>
```

```
C01  08BD  <Hook_down_event>
C01  0941  <Set_hose_used>
C01  0951  <Hose_number>
C01  0960  <His_sequence>
C01  0970  <Set_pump_number>
C01  0980  <Set_his_sequence>
C01  0990  <Decode_his_pump_and_sequence>
C01  09B0  <Pump_number>
C01  09BF  <Set_status_pumping>
C01  09CE  <Set_pump_hook_off>
C01  09DD  <Set_pump_sale_pending>
C01  09EC  <Set_sale_complete>
C01  09FB  <Set_pump_filling_data>
C01  0A16  <Reply_to_status_poll>
C01  0A2F  <Reply_to_poll>
C01  0AD6  <Reply_to_filling_data>
C01  0AEE  <Reply_to_authorize>
C01  0B09  <Reply_to_sale_complete>
C01  0B24  <Acknowledge_control_message>
C01  0B3D  <Acknowledge_price_prime>
C01  0BB6  <Nak_packet>
C01  0C33  <Process_price_change>
C01  0CC7  <_clear_price_change_pending>
C01  0CD7  <service_dave>
C01  0D5D  <_hot_card>
C01  0D75  <_attention>
C01  0D90  <_pump_map>
C01  0DA8  <_timestamp>
```

```
C01  0DD7  <_transaction>
C01  0E00  <Queue_request>
C01  0E2A  <_kiosk_authorization>
C01  0E4F  <_kiosk_payment>
C01  0E85  <_open>
C01  0EA1  <_load_totals>
C01  0EF3  <Update_local_time>
C01  0F44  <Post_local_time>
C01  0F8C  <Decode_system_time>
C01  1033  <Set_system_time>
C01  105C  <make_qnx_time>
C01  10DF  <get_qnx_time>
C01  10F8  <Timer_fired>
C01  1143  <Send_queued_request>
C01  1183  <Accept_control_message>
C01  11AB  <Accept_link_response>
C01  11F3  <Process_control_message>
C01  1241  <Emulate_pump>
C01  12AC  <bulloch_event>
C01  12C6  <control_event>
C01  12E0  <price_event>
C01  12FA  <log_bulloch>
C01  1311  <event>
C01  135A  <lrequest>
C01  13B2  <disallow>
C01  13D1  <my_open>
C01  1404  <tsscanf>
C01  1A44  <sleep>
C01  1A8A  <abs_sleep>
```

```
C01  1AAF  <set_timer>
C01  1B16  <strncpy>
C01  1B50  <strncat>
C01  1B89  <strncmp>
C01  1BBC  <flush_input>
C01  1C18  <dregister_name>
C01  1DC1  <find_admin>
C01  1E2B  <char_waiting>
C01  1ED4  <calloc>
C01  1EDA  <malloc>
C01  1EE0  <realloc>
C01  1EE6  <free>
C01  1EE6  <cfree>
C01  1EEC  <fopen>
C01  1EF2  <fclose>
C01  1EF8  <getc>
C01  1EFE  <putc>
C01  1F04  <ungetc>
C01  1F0A  <fflush>
C01  1F10  <tfprintf>
C01  1F16  <tsprintf>
C01  1F1C  <fget>
C01  1F22  <fput>
C01  1F28  <fiseek>
C01  1F2E  <rewind>
C01  1F34  <forward>
C01  1F3A  <breakable>
C01  1F40  <strcat>
C01  1F46  <strcmp>
```

```
C01  1F4C  <strcpy>
C01  1F52  <strlen>
C01  1F58  <send>
C01  1F5E  <abort>
C01  1F64  <unbreakable>
C01  1F6A  <setjmp>
C01  1FCF  <longjmp>
C01  203D  <nargs>
C01  2053  lepilogue
C01  205C  lmul
C01  20AB  lmodr
C01  20B4  lmod
C01  20BA  ldivr
C01  20C3  ldiv
C01  217C  <vc_send_reply>
C01  2182  <vc_create>
C01  2188  <vc_create2>
C01  218E  <vc_create3>
C01  2194  <ker_vc_destroy>
C01  219A  <def_server>
C01  21A0  <set_acc_flags>
C01  21A6  <set_exception>
C01  21AC  <escape_tty>
C01  21B2  <hold>
C01  21B8  <unhold>
C01  21BE  <time_slice>
C01  21C4  <task_info>
C01  21CA  <force_ready>
C01  21D0  <set_priority>
```

```
C01  21D6  <set_user>
C01  21DC  <set_slice>
C01  21E2  <modify_flags>
C01  21E8  <set_int_mask>
C01  21EE  <set_int_vec>
C01  21F4  <alloc_mem>
C01  21FA  <get_date>
C01  2200  <set_date>
C01  2206  <get_ticks>
C01  220C  <receive>
C01  2212  <reply>
C01  2218  <attach>
C01  221E  <detach>
C01  2224  <await>
C01  222A  <signal>
C01  2230  <read_msg>
C01  2236  <write_msg>
C01  223C  <read_port>
C01  2242  <csignal>
C01  2248  <relay>
C01  224E  <creceive>
C01  2254  <isalpha>
C01  2287  <isdigit>
C01  22A9  <islower>
C01  22CB  <isupper>
C01  22ED  <isspace>
C01  2315  <iswhite>
C01  232E  <ispunct>
```

```
C01  2379  <isalnum>
C01  23B8  <isascii>
C01  23D1  <iscntrl>
C01  23F3  <isprint>
C01  2415  <isxdigit>
C01  2454  <tolower>
C01  2477  <toupper>
C01  249A  <copy>
C01  249A  <memcpy>
C01  24C7  <zero>
C01  24E3  <memset>
C01  2504  <atoi>
D00  0000  <User_sp>
D00  0002  <User_ss>
D00  0004  <Exc_bits>
D00  0008  <Exc_allow>
D00  000C  <Exc_pending>
D00  0010  <Exc_fp>
D00  0012  <Exc_pc>
D00  0014  <Exc_permit>
D00  0018  <Exit_status>
D00  001A  <Error_status>
D00  001C  <My_tid>
D00  001E  <Dads_tid>
D00  0020  <Break_count>
D00  0021  <My_tty>
D00  0022  stack_base
```

```
D00  0024  <Cmd_flags>
D00  0025  <My_priority>
D00  0026  <stdin>
D00  0028  <stdout>
D00  002A  <stderr>
D00  002C  <Free_list>
D00  002E  <End_of_free>
D00  0030  <File_list>
D00  0032  <_Argc>
D00  0034  stk_limit
D00  0034  <_Argv>
D00  0036  SAVE
D00  0038  TEMP
D00  0060  <Code_flags>
D00  0061  <User_num>
D00  0062  <Group_num>
D00  0063  <Team_num>
D00  0065  <My_nid>
D00  0067  <Dads_nid>
D00  0069  <My_tty_nid>
D00  006B  <My_cd_nid>
D00  006D  <Release_num>
D00  006E  <Ndp_save_area>
D00  0070  <Fstack>
D00  0072  <Call_stack_ptr>
D00  0074  <Segment_table_ptr>
D00  0076  <Check_point_sp>
D00  0078  <User_spare>
D00  007E  <Qdb_tid>
```

```
D03  0279  <opened>
D03  027B  <hose_total_pending>
D03  027D  <debug>
D03  027F  <request_pending>
D03  0281  <last_request>
D03  0283  <retry_counter>
D03  0285  <my_port>
D03  0287  <my_client>
D03  0289  <bulloch_in>
D03  028B  <bulloch_out>
D03  028D  <inbound>
D03  0355  <outbound_data>
D03  041D  <initial_trap>
D03  0435  <totals>
D03  0760  <dr>
```

bulloch/cfiles

```
bulloch.c
chars_in.c
globals.c
hose_total.c
inbounds.c
my_timer.c
outbound.c
post.c
price_change.c
pump_emul.c
service_dave.c
```

system_time.c timer_fired.c bulloch/chars_in.c

```
#include "const.h"

#include "vars.h"

#define STACK_EMPTY -2

static int _stack = STACK_EMPTY;

Pushchar( c )
        int c;
{
        _stack = c;
}

Nextchar( )
{
        int t = TIMEOUT;

        if ( _stack != STACK_EMPTY )  /* try the character stack */
        {
                t = _stack;
                _stack = STACK_EMPTY;
                return t;
        }

        if ( char_waiting (bulloch_in) )  /* then try com channel *
                t = getc (bulloch_in) & 0x7f;
        else
```

```
            Delay( CHARACTER_TIMEOUT );
            if ( char_waiting (bulloch_in) )
                    t = getc (bulloch_in) & 0x7f;
        }
        return t;
}
```

bulloch/const.h

```
#define HALF_SECOND             10
#define TEN_HALF_SECONDS        10
#define FIFTH_SECOND             4

#define STATUS                  'S'     /* LTS command codes */
#define DISPLAY_DATA            'D'
#define MOTORS_ON               'N'
#define MOTORS_OFF              'F'
#define AUTHORIZE               'C'
#define SET_PRICES              'G'
#define READ_PRICES             'B'
#define OPTIONS                 'O'
#define PRE_PAYMENT             'E'
#define PRE_PAYMENT_STATUS      'R'
#define CLEAR_RESTART           'P'
#define SET_SALE_COMPLETE       'T'

#define LTS_COMMAND_LENGTH       7
#define BULLOCH_MESSAGE_LENGTH   7
#define OFF_HOOK                0x0001   /* LTS Status Bits    */
#define ON_HOOK                 (~OFF_HOOK)
#define MOTOR_ON                0x0002
#define FUEL_FLOWING            0x0004
#define MANUAL_MODE             0x0008
```

```
#define SALE_COMPLETE          0x0010
#define POWER_UP               0x0100
#define PRODUCT_ERROR          0x0200
#define TEMPERATURE_FAILURE    0x0400
#define PULSER_FAILURE         0x0800
#define LOCAL_PRICE_CHANGE     0x1000

#define LTS_TIMEOUT            0x0001      /* LTS error bits */
#define LTS_MESSAGE_LENGTH     0x0002
#define LTS_BCC                0x0003
#define LTS_SEQUENCE_RANGE     0x0004
#define LTS_SEQUENCE_MATCH     0x0005
#define LTS_ID                 0x0006
#define LTS_CONTEXT            0x0007
#define LTS_UNKNOWN            0x0008

#define LTS_AUTH_INVALID       0x0001
#define LTS_PUMP_ON_INVALID    0x0002
#define LTS_NO_PREPAY          0x0003
#define LTS_NO_PRICES          0x0004
#define LTS_BAD_DATA           0x0005
#define LTS_DATA_REJECTED      0x0006

#define TIMEOUT                -1
#define MAX_MESSAGE            80
#define ACK                    0x06
#define ENQ                    0x05
#define STX                    0x02
#define NAK                    0x15
#define DEL                    0x7f
```

```
#define CHARACTER_TIMEOUT      2
#define IDLE_INTERVAL          2        /* half second */
#define NHOSES                 3
#define LOST_PUMP              'L'
#define BAD_STATUS             'S'

#define UNCHAR(b)   ((b) - '0')
#define TOCHAR(b)   ((b) + '0')

#define IDLE_STATUS            ('D' | SALE_COMPLETE)
#define BASE_STATUS            '@'
#define I_AM_BUSY              0x20

#define IDLE_STATUS_STRING  "T@"
```

bulloch/excepts.h

```
#define NO_DEVICE              1
#define NO_TIMER               2
#define NO_STATUS              3
#define NO_PRICES              4
#define USAGE                  10

#define NO_DISPLAY_DATA        5
#define NO_PUMP                6
#define NO_PRESET              7
#define NO_AUTHORIZE           8
```

bulloch/func.h

```
unsigned lts_status (),
         lts_display_data (),
         lts_good_reply ();
```

```
char  *lts_command (),
              *lts_data ();
```

bulloch/globals.c

```
#define GBLGEN

#include "vars.h"
```

bulloch/hose_total.c

```
#include "vars.h"
#include "const.h"

typedef struct {
        char sequence;
        int  hoseid;
        char data[ 27 ];      /* 25 + eos + spare */
} total;

total totals [ NHOSES * 2 ];

init_hose_totals( )
{
        zero( totals, sizeof( totals ) );

        totals[ 0 ].sequence = 'U';
        totals[ 0 ].hoseid   = 1;
        totals[ 1 ].sequence = 'V';
        totals[ 1 ].hoseid   = 1;
        totals[ 2 ].sequence = 'W';
        totals[ 2 ].hoseid   = 2;
        totals[ 3 ].sequence = 'X';
        totals[ 3 ].hoseid   = 2;
```

```
        totals[ 4 ].sequence = 'Y';
        totals[ 4 ].hoseid   = 3;
        totals[ 5 ].sequence = 'Z';
        totals[ 5 ].hoseid   = 3;

        hose_total_pending   = 7;
}

char *hose_total( i )
        unsigned i;
{
        i--;
        return totals[ i ].data;
}
seq_total( i )
        unsigned i;
{
        i--;
        return totals[ i ].sequence;
}
hose_no( i )
        unsigned i;
{
        i--;
        return totals[ i ].hoseid;
}
load_hose_total( i, stuff )
        unsigned i;
        char     *stuff;
{
        i--;
        COPY_SAFELY( totals[ i ].data, stuff );
}
```

```
#include <timer.h>

#include "const.h"

#include "vars.h"


unsigned char calculate_bcc (m, l)

        char *m;

        int  l;

{

        register unsigned char bcc = 0;

        register char *p = m;

        for ( ; l; l-- )

                bcc ^= *p++;

        return bcc;

}

Reset_inbound( )

{

        zero( inbound, sizeof( inbound ) );

}

Inbound_received( data )

        char *data;

{

        int i,

            c;
```

```
        *data = 0;                  /* assume failure */

        for ( i = 0; i < 20; i++ )  /* look for start of message */
                switch ( c = Nextchar( ) )
                {
                        case END:
                        case ACK:
                        case NAK:
                        case STX:   return Get_message( c, data );
                                                        break;
                        default:        break;
                }
        return 0;
}

Get_message( c, data )
        int  c;
        char *data;
{
        int bcc,
                i,
                num_chars = 1;

        bcc     = c;        /* initialize  bcc  */
        *data++ = c;        /* save start character */
        for ( i = 0; i < 20 && c != DEL; )
                            /* number of timeouts allowed */
                if ( (c = Nextchar ( ) ) != TIMEOUT )
```

```
        {
        if ( num_chars >= MAX_MESSAGE ) /* don't overflow */
        return 0;                       /* message is too big */
                else
                {
        *data++ = c;                    /* just store the character */
        bcc ^= c;                       /* update bcc */
        num_chars++;        /* update chars rec'd count */
                }
        }
        else                    /* timeout and count it */
                i++;

if ( i == 20 )              /* must have timed out */
{
        Set_his_sequence( inbound[ 1 ] ? inbound[ 1 ] : '!' );
        Nak_packet( LTS_TIMEOUT | BASE_STATUS, BASE_STATUS );
        return 0;
}
else
{
        if (bcc != Nextchar())
        {
        Set_his_sequence( inbound[ 1 ] );
        Nak_packet( LTS_BCC | BASE_STATUS, BASE_STATUS );
        return 0;
}
```

```
                else
                        return 1;
        }
}
```

bulloch/makefile

```
CFLAGS  = -S
SOURCES = @cfiles
OBJECTS = @objects

bulloch: $(OBJECTS)
        linkobj c=bulloch x=objects s=2000 m=bulloch.map
                l=/user/steve/dave
        sort bulloch.map f=1,2 | copy >bulloch.map
        copy bulloch /dave/bulloch

globals.o: vars.h
```

bulloch/my_timer.c

```
#include "vars.h"
#include <timer.h>
#include "const.h"

static int timer_running;

Clear_my_timer( )
{
        timer_running = 0;
}

Set_my_timer( ticks )
        unsigned ticks;
{
```

```
        set_timer( TIMER_SIGNAL, RELATIVE,  ticks, 0, my_port );
        timer_running = 1;
}

Cancel_my_timer( )
{
        if (timer_running)
                set_timer( TIMER_CANCEL, 0, 0, 0, my_port );
        timer_running = 0;
}

Delay( ticks )
        unsigned ticks;
        set_timer( TIMER_WAKEUP, RELATIVE, ticks );
}
```

bulloch/objects

```
bulloch.o
chars_in.o
globals.o
hose_total.o
inbounds.o
my_timer.o
outbound.o
post.o
pump_emul.o
price_change.o
service_dave.o
system_time.o
timer_fired.o
```

```
#include "vars.h"
#include "const.h"

unsigned char calculate_bcc( );

send_hose_total( ht )
        unsigned ht;
{
        char *hose_total_packet( ),
                *hose_total( ),
                *p;
        int  length;

    p = hose_total_packet( hose_total( ht ), seq_total( ht ),
                                hose_no ( ht ), &length );
/*
        fput( p, length, bulloch_out );
*/
}

send_request_to_bulloch( r )
        char r;
{
        char *bulloch_packet( ),
                *p;
        int  length;
```

```
        p = bulloch_packet( r, outbound_data, &length );
        fput( p, length, bulloch_out );
}

static char _packet_buffer [ 200 ];

char *bulloch_packet( opcode, data, l )
        char opcode, *data;
        int  *l;
{
        register char *c = _packet_buffer;
        char     *transaction_packet( );

        zero( _packet_buffer, sizeof( _packet_buffer ) );

        if ( opcode == HERE_IS_A_TRANSACTION )
                return transaction_packet( data, l);
        else
        {
        *c++ = STX;                     /* start of packet   */
        *c++ = His_sequence( );         /* sequence number   */
        *c++ = TOCHAR(Pump_number( ));  /* id field - pump   */
        *c++ = TOCHAR(0);               /* id field - hose   */
        *c++ = opcode;
        while (*data)
                *c++ = *data++;
        *c++ = DEL;                     /* end of message    */
        *c++ = calculate_bcc (_packet_buffer, c - _packet_buffer);
```

```
        *l    =  c - _packet_buffer;
        return _packet_buffer;
        }
}

char *transaction_packet( data, l)
        char *data;
        int  *l;
{
        register char *c = _packet_buffer;

        *c++ = STX;                     /* start of packet  */
        *c++ = 'A';                         /* sequence number  */
        *c++ = TOCHAR(Pump_number( ));  /* id field - pump  */
        *c++ = TOCHAR(Hose_number( ));  /* id field - hose  */
        *c++ = '@';                         /* fake status      */
        *c++ = '@';                         /* fake status      */
        while (*data)
                *c++ = *data++;
      *c++ = DEL;                           /* end of message   */
        *c++ = calculate_bcc (_packet_buffer, c - _packet_buffer);
        *l    =  c - _packet_buffer;

        return _packet_buffer;
}

char *hose_total_packet( data, sequence, hose, l )
        char *data, sequence;
        int  hose, *l;
```

```
{
        register char *c = _packet_buffer;

        *c++ = STX;                     /* start of packet  */
        *c++ = sequence;                /* sequence number  */
        *c++ = TOCHAR(Pump_number( ));  /* id field - pump  */
        *c++ = TOCHAR(hose);            /* id field - hose  */
        *c++ = '@';                     /* fake status      */
        *c++ = '@';                     /* fake status      */
        while (*data)
                *c++ = *data++;
      *c++ = DEL;                       /* end of message   */
        *c++ = calculate_bcc (_packet_buffer, c - _packet_buffer);
        *l   =  c - _packet_buffer;

        return _packet_buffer;
}
```

bulloch/post.c

```
#include "vars.h"
#include "const.h"

static char _buffer [ 50 ];
Post_pump_map( s )
        char *s;
{
        tsprintf( _buffer, "MAP%3.3s", s + 5 );
        bulloch_event( my_client, _buffer );
}
Post_payment_made( )
{
```

```
        bulloch_event( my_client, "KIOSK PAYMENT MADE" );
}

Post_release( )
{
        bulloch_event( my_client, "RELEASE CARD" );
}

Post_authorization( )
{
        bulloch_event( my_client, "KIOSK AUTHORIZED" );
}

Post_halt( )
{
        control_event( my_client, "HALT PUMP" );
}

Post_restart( )
{
        control_event( my_client, "RESTART PUMP" );
}

post_new_prices( s )
        char *s;
{
        tsprintf( _buffer, "PRICES%s", s );
        price_event( my_client, _buffer );
}
```

```
#include "vars.h"
#include "excepts.h"
#include "const.h"
static unsigned _change_pending;
static char _new_prices [ 50 ];

Process_price_change( )
{
        unsigned i;
        if ( _change_pending == 0 )
        {
                Acknowledge_price_prime( );
                zero( _new_prices, sizeof( _new_prices ) );
                Reset_inbound( );
                for ( i = 0; Nextchar( ) != STX && i < 20; i++ )
                        ;
                if ( i == 20 )
                        return;
                Pushchar( STX );
                if ( Inbound_received( inbound ) )
                {
                        memcpy( _new_prices, inbound + 4, 24 );
                        post_new_prices( _new_prices );
                        _change_pending = 1;
                }
        }
        else
                Nak_packet( BASE_STATUS, BASE_STATUS );
}
```

```
_clear_price_change_pending( )
{
        _change_pending = 0;
}
```

bulloch/protocol

Touchcom - Bulloch Protocol

Draft

May 2/87

Steve Bond

Introduction

==========

Steve Bond and Pat Keeping met on Feb. 14/87 to discuss the communication between the Bulloch and Touchcom systems. This i a summary of the discussion.

There are two requirements:

a) POS (credit cards, etc.)

b) pump management

The software protocol for pump management shall be as similar as possible to the LTS protocol. The software protocol for POS shall be as similar as possible to the Petro Canada POS protocol.

Pump Management

==========

```
#define GIVE_ME_TIMESTAMP              '!'   /* 0x21 */
#define GIVE_ME_PUMP_MAP               '"'   /* 0x22 */
#define I_NEED_ATTENTION               '#'   /* 0x23 */
                                       '$'   /* 0x24 */
#define I_HAVE_A_HOT_CARD              '%'   /* 0x25 */
#define GIVE_ME_PUMP                   '&'   /* 0x26 */
#define TAKE_PUMP_FROM_ME              '\''  /* 0x27 */
#define RESET_YOURSELF_PLEASE          '('   /* 0x28 */
#define HERE_IS_TIMESTAMP              ')'   /* 0x29 */
#define HERE_IS_PUMP_MAP               '*'   /* 0x2a */
#define RELEASE_CARD_PLEASE            '+'   /* 0x2b */
#define NO_3201                        ','   /* 0x2c */
#define 3201_ON                        '-'   /* 0x2d */

#define CHANGE_PRICE_PLEASE  /* These are identical to LTS except
#define GIVE_ME_PUMP_TOTALS  /* that they start with STX        */
#define HALT_PUMP_PLEASE
```

Requests Emitted by Touchcom

GIVE_ME_TIMESTAMP

GIVE_ME_PUMP_MAP

I_NEED_ATTENTION

HERE_IS_A_TRANSACTION

I_HAVE_A_HOT_CARD

Requests Accepted by Touchcom

```
GIVE_ME_PUMP                    /* not implemented */
```

```
TAKE_PUMP_FROM_ME            /* implemented */
RESET_YOURSELF_PLEASE        /* implemented */
HERE_IS_TIMESTAMP            /* imp, on demand, not broadcast yet */
HERE_IS_PUMP_MAP             /* imp */
RELEASE_CARD_PLEASE
```

Touchcom will resend a NAKked message up to 3 times before declaring the link dead (provided the NAK is a link-type NAK, bad bcc eg.). Touchcom will resend an unanswered message up to 3 times on a 2 second timeout before declaring the link dead.

Pump Control Modes

==========

There are three modes. Normally, the Touchcom unit should spend most of its time in TOUCHCOM mode; ie., taking in dough and pumping gas. Bulloch will see no LTS pump control messages when the Touchcom unit is in Touchcom mode.

If the customer wishes to pay with a type of credit card we cannot support, we will switch to KIOSK mode. In this mode we tell the customer to "Proceed to fill and pay at kiosk". We will assert pin 5, and send LTS events (OFF HOOK/ON HOOK) as they happen. We will relay your LTS commands to the pump and vice versa. We will perform no mediation, translation, error checking services, or timings.

We stay in this mode until Bulloch sends a TAKE_PUMP_FROM_ME request.

We provide a third mode, the BULLOCH mode. This is initiated by Bulloch sending a GIVE_ME_PUMP request to Touchcom. In this mode, the Touchcom unit relinquishes control of the pump as it does in KIOSK mode. This mode is provided so that Bulloch can change prices, allocation limits, get shift reports, etc. without causing confusion in the Touchcom software.

It might also be used if (God forbid) some of the Touchcom I/O devices are broken and the station wishes to continue pumping.

GIVE_ME_TIMESTAMP

========== opcode '!' (0x21)

Touchcom is requesting that Bulloch send a HERE_IS_TIMESTAMP message.

GIVE_ME_PUMP_MAP

========== opcode '"' (0x22)

Touchcom is requesting that Bulloch send a HERE_IS_PUMP_MAP message.

I_NEED_ATTENTION

========== opcode '#' (0x23)

Touchcom has a problem -- printer out of paper, note jam, eg.

Touchcom is requesting that Bulloch present the message to the human, and eventually send a RESET_YOURSELF_PLEASE message.

The Touchcom unit will remain blocked until the RESET_YOURSELF_PLEASE message is received.

The message is contained in a 20 character data field between the ID field and the DEL. The message is sent "in the clear".

HERE_IS_A_TRANSACTION

==========

It's an LTS message consisting of the response to an LTS 'D' command starting with an STX and a sequence byte between A and S (inclusive).

opcode '$' (0x24)

Touchcom has completed a transaction and is posting Bulloch with the filling data and refund data. No reply message is expected by Touchcom. The data are contained in a field between the ID field and the DEL. This field consists of a 6 character right justified zero filled cents amount followed immediately by the raw LTS filling data.

The refund data are provided so that the human will not be surprised when the customer walks in with a credit slip.

I_HAVE_A_HOT_CARD

========== opcode '%' (0x25)

POS processing has determined that the card currently in the card reader is HOT. The Touchcom unit will retain the card until the Bulloch system sends a RELEASE_CARD_PLEASE request.

GIVE_ME_PUMP

========== opcode '&' (0x26)

Bulloch is requesting control of the pump from Touchcom. The request willbe honoured if a transaction is not in progress. If the request cannotbe satisfied, the 0x20 bit in the first status byte of the NAK will be set.
This means I_AM_BUSY.

THIS IS A MODE CHANGE REQUEST. If the request is ACKked, Touchcom originated transactions can no longer be made.

TAKE_PUMP_FROM_ME

========== opcode ''' (0x27)

Bulloch is requesting that Touchcom take over control of the pump.
THIS IS A MODE CHANGE REQUEST.

RESET_YOURSELF_PLEASE

========== opcode '(' (0x28)

Bulloch is requesting that Touchcom go into "transaction" state from "error" state.

HERE_IS_TIMESTAMP
========== opcode ')' (0x29)

Bulloch is requesting that Touchcom use the supplied timestamp for all further transactions. The timestamp is in YYMMDDHHMM form, and the field lies between the ID field and the DEL. HHMM is 24 hour.

HERE_IS_PUMP_MAP
========== opcode '*' (0x2a)

Bulloch is requesting that Touchcom use the supplied map in order to determine which hose is associated with which grade on the specified pump.

The map is supplied in a 3 character data field between the ID field and the DEL. The grade number associated with a physical hose is supplied at the relative byte number of the hose in the field. This is a complicated way of saying the map will either be "123" or "321".

RELEASE_CARD_PLEASE

========== opcode '+' (0x2b)

Bulloch is requesting that Touchcom eject the credit card currently held in the card reader. This request follows a Touchcom I_HAVE_A_HOT_CARD message, after the customer has been shot, stoned, exiled, or whatever.

POS

===

Touchcom will generate Petro Canada 222 and 100 messages for credit card authorization and transaction settlement. Bulloch will fill in all fields which Touchcom does not have access to -- Touchcom will field such fields with blank characters (0x20).

Touchcom will not timeout on these requests.

```
#include "/user/steve/dave/dave_request.h"

#define        SEND_IT                    1
#define GIVE_HIM_THE_PUMP                 2
#define REFUSE_HIM_THE_PUMP               3
#define        OPEN                       4
#define ENABLE_BULLOCH_MODE               5
#define ENABLE_TOUCHCOM_MODE              6
```

bulloch/pump_emul.c

```
#include "vars.h"

#include "const.h"

#define HOOK_OFF_STATUS       'U'

#define AUTHORIZED_STATUS     'W'

#define DISPLAY_STATUS        'D'

#define SALE_COMPLETE_STATUS  'T'

#define PUMPING_STATUS        'C'

#define HOOK_DOWN_WITH_SALE   'B'

static char filling_data[ 100 ],
                    _packet[ 200 ],
                     _his_pump,
                 _his_sequence,
             _status;

static unsigned _hose_number,
                              _pump_number;


Hook_down_event( )
{
      register char *c = _packet;

      zero( _packet, sizeof( _packet ) );
      *c++ = ENQ;
      *c++ = _his_sequence;
      *c++ = Pump_number( ) ? TOCHAR(Pump_number( ) ) : _his_pump;
      *c++ = TOCHAR(Hose_number( ) );
```

```
#include "vars.h"

#include "const.h"

#define HOOK_OFF_STATUS        'U'

#define AUTHORIZED_STATUS      'W'

#define DISPLAY_STATUS         'D'

#define SALE_COMPLETE_STATUS   'T'

#define PUMPING_STATUS         'C'

#define HOOK_DOWN_WITH_SALE    'B'

static char filling_data[ 100 ],
                    _packet[ 200 ],
                    _his_pump,
                _his_sequence,
            _status;

static unsigned _hose_number,
                                _pump_number;

Hook_down_event( )
{
        register char *c = _packet;

        zero( _packet, sizeof( _packet ) );
        *c++ = ENQ;
        *c++ = _his_sequence;
        *c++ = Pump_number( ) ? TOCHAR(Pump_number( ) ) : _his_pump;
        *c++ = TOCHAR(Hose_number( ) );
```

```
        *c++ = HOOK_DOWN_WITH_SALE;
        *c++ = BASE_STATUS;
        *c++ = DEL;
        *c++ = calculate_bcc( _packet, 7 );
        fput( _packet, 8, bulloch_out );
}

Set_hose_used( h )
        unsigned h;
{
        _hose_number = h;
}

Hose_number( )
{
        return _hose_number;
}

char His_sequence( )
{
        return _his_sequence;
}

Set_pump_number( p )
        unsigned p;
{
        _pump_number = p;
}
```

```
Set_his_sequence( asequence )
        char asequence;
{
        _his_sequence = asequence;
}

Decode_his_pump_and_sequence( message )
        char *message;
{
        _his_sequence = message[ 1 ];
        _his_pump     = message[ 2 ];
}

Pump_number( )
{
        return _pump_number;
}

Set_status_pumping( )
{
        _status = PUMPING_STATUS;
}

Set_pump_hook_off( )
{
        _status = HOOK_OFF_STATUS;
}

Set_pump_sale_pending( )
```

```
{
        _status = DISPLAY_STATUS;
}

Set_sale_complete( )
{
        _status = SALE_COMPLETE_STATUS;
}

Set_pump_filling_data( s )
        char *s;
{
        COPY_SAFELY( filling_data, s );
}

Reply_to_status_poll( )
{
        Reply_to_poll( _status, "" );
}

Reply_to_poll( status, data )
        char status, *data;
{
        register char *c = _packet;
        unsigned length;

        zero( _packet, sizeof( _packet ) );
        *c++ = ACK;
        *c++ = _his_sequence;
```

```
        *c++ = Pump_number( ) ? TOCHAR(Pump_number( ) ) : _his_pump;
        *c++ = TOCHAR(Hose_number( ) );
        *c++ = status;
        *c++ = BASE_STATUS;
        while ( *data )
                *c++ = *data++;
        *c++ = DEL;
        length = c - _packet;
        *c++ = calculate_bcc( _packet, length );
        fput( _packet, length + 1, bulloch_out );
}

Reply_to_filling_data( )
{
        Reply_to_poll( DISPLAY_STATUS, filling_data );
}

Reply_to_authorize( )
{
        Reply_to_poll( AUTHORIZED_STATUS, "" );
        Set_status_pumping( );
}

Reply_to_sale_complete( )
{
        Set_sale_complete( );
        Reply_to_poll( SALE_COMPLETE_STATUS, "" );
}
```

```
Acknowledge_control_message( )
{
        Reply_to_poll( _status, "" );
}

Acknowledge_price_prime( )
{
        register char *c = _packet;

        zero( _packet, sizeof( _packet ) );
        *c++ = ACK;
        *c++ = _his_sequence;
        *c++ = Pump_number( ) ? TOCHAR(Pump_number( ) ) : _his_pump
        *c++ = 'O';
        *c++ = 'K';
        *c++ = DEL;
        *c++ = calculate_bcc( _packet, 7 );
        fput(_packet, 8, bulloch_out);
}
Nak_packet( status1, status2 )
        char status1, status2;
{
        register char *c = _packet;
        zero( _packet, sizeof( _packet ) );
        *c++ = ACK;
        *c++ = _his_sequence;
*c++ = Pump_number( ) ? TOCHAR(Pump_number( ) ) : _his_pump;
*c++ = status1;
*c++ = status2;
*c++ = DEL;
```

```
*c++ = calculate_bcc( _packet, 7 );
fput(_packet, 8, bulloch_out);
}
```

bulloch/service_dave.c

```
#include "vars.h"
#include "const.h"

service_dave( r )
        request *r;
{
        Set_pump_number( r->value2 );
        switch( r->opcode )
        {
        case OPEN:                      _open( r->client );             break;
        case I_NEED_ATTENTION:          _attention( r );                break;
        case GIVE_ME_PUMP_MAP:          _pump_map( );                   break;
        case GIVE_ME_TIMESTAMP:         _timestamp( );                  break;
        case HERE_IS_A_TRANSACTION:_transaction( r );                   break;
        case I_HAVE_A_HOT_CARD:         _hot_card( );                   break;
        case KIOSK_AUTHORIZATION:       _kiosk_authorization( );        break;
        case KIOSK_PAYMENT:             _kiosk_payment( r );            break;
        case CLEAR_PRICE_CHANGE_PENDING:
                                _clear_price_change_pending( ); break;
        case LOAD_TOTALS:               _load_totals( r );              break;
        }
}
_hot_card( )
{
        Queue_request( I_HAVE_A_HOT_CARD, "" );
```

```
}

_attention( r )
        request *r;
{
        Queue_request( I_NEED_ATTENTION, r->string_data );
}

_pump_map( )
{
        Queue_request( GIVE_ME_PUMP_MAP, "" );
}

static unsigned _poll_counter = 9;

_timestamp( )
{
        _poll_counter++;
        if ( _poll_counter >= 10 )
        {
                Queue_request( GIVE_ME_TIMESTAMP, "" );
                _poll_counter = 0;
        }
        Post_local_time( );
}

_transaction( r )
        request *r;
{
```

```
        Set_hose_used( r->value3 );
        Queue_request( HERE_IS_A_TRANSACTION, r->string_data );
}


Queue_request( opcode, data )
        char opcode, *data;
{
        request_pending = opcode;
        retry_counter   = 10;
        COPY_SAFELY( outbound_data, data );
}

_kiosk_authorization( )
{
        Set_hose_used( 1 );
        Set_pump_hook_off( );
        Queue_request( TAKE_PUMP_FROM_ME, "" );
}

_kiosk_payment( r )
        request *r;
{
        Set_hose_used( r->value3 );
        Set_pump_sale_pending( );
        Set_pump_filling_data( r->string_data );
        Queue_request( TAKE_PUMP_FROM_ME, "" );
/*
        Hook_down_event( );
```

```
*/}

_open( userid )
        unsigned userid;
{
    my_client          = userid;
        opened             = 1;
        request_pending    = 0;
}

_load_totals( r )
        request *r;
{
        do
        {
                load_hose_total( r->value3, r->string_data );
                REPLY( caller( ), r );
                RECEIVE( caller( ), r );
        } while ( r->value3 != 0 );
        hose_total_pending = 1;
}
```

```
#include "vars.h"

static unsigned year,
                                month,
                                day,
                                hour,
                                min,
                                sec;

Update_local_time( time_message )
        char *time_message;
{
        tsscanf( time_message + 5, "%02d%02d%02d%02d%02d%02d",
                        &year, &month, &day, &hour, &min, &sec );

        Set_system_time( year, month, day, hour, min, sec );
}

Post_local_time( )
{
        unsigned *get_qnx_time( );
        char buffer [ 15 ];

        Decode_system_time ( get_qnx_time( ) );

        tsprintf( buffer, "T%02d%02d%02d%02d%02d%02d",
                        year,  month, day, hour, min,  sec
);
```

```
        control_event( my_client, buffer );
}

Decode_system_time( date )
        unsigned *date;
{
        unsigned am_pm;

        day   = (date[ 0 ]>>1) & 0x3f;
        month = (date[ 0 ]>>8) & 0xf;
        year  = date[ 0 ] >> 12;
        year  += 80;
        hour  = date[ 1 ] / 3600;
        min   = (date[ 1 ] % 3600) / 60;
        sec   = date[ 1 ] % 60;
        am_pm = date[ 0 ] & 0x1;
        if ( am_pm )
                hour += 12;
}

Set_system_time( y, m, d, h, mn, s )
        unsigned y, m, d, h, mn, s;
{
        unsigned *make_qnx_time( );

        set_date( make_qnx_time( y, m, d, h, mn, s ) );
}
```

```
static unsigned _date [ 2 ];

unsigned *make_qnx_time( y, m, d, h, mn, s )
{
        unsigned pm = 0;

        y -= 80;
        if ( h >= 12 )
        {
                pm = 1;
                h -= 12;
        }
        s += h * 3600 + mn * 60;

        zero( _date, sizeof( _date ) );
        _date[ 0 ] |= (d << 1);
        _date[ 0 ] |= (m << 8);
        _date[ 0 ] |= (y << 12);
        _date[ 0 ] |= pm;
        _date[ 1 ] = s;

        return _date;
}

unsigned *get_qnx_time( )
{
        get_date( _date );
        return _date;
}
```

```
#include "vars.h"
#include "excepts.h"
#include "const.h"

Timer_fired ()
{
        int c;

        Clear_my_timer( );
        switch( c = Nextchar( ) )
        {
        case TIMEOUT:   Send_queued_request( );         break;
        case STX:       Accept_control_message( );      break;
        case ENQ:       Emulate_pump( );                break;
        case ACK:
        case NAK:       Accept_link_response( c );      break;
        }
        Set_my_timer( HALF_SECOND );
}

Send_queued_request( )
{
        if (request_pending)
        {
                send_request_to_bulloch( request_pending );
                last_request = request_pending;
                request_pending = 0;
```

```
        }

        if (hose_total_pending <= 6)
        {
                send_hose_total( hose_total_pending );
                hose_total_pending++;
        }
}

Accept_control_message( )
{
        Pushchar( STX );
        if ( Inbound_received( inbound ) )
        {
                Process_control_message( );
                Reset_inbound( );
        }
}

Accept_link_response( c )
        char c;
{
        Pushchar( c );
        if ( Inbound_received( inbound ) )
        {
                if ( last_request == GIVE_ME_PUMP_MAP )
                        Post_pump_map( inbound );
                if ( last_request == GIVE_ME_TIMESTAMP )
```

```
                Update_local_time( inbound );
            Reset_inbound( );
        }
}

Process_control_message( )
{
        Set_his_sequence( inbound[ 1 ] );
        switch( inbound [ 4 ] )
        {
        case TAKE_PUMP_FROM_ME:  break;
        case RESET_YOURSELF_PLEASE:
                bulloch_event( my_client, "RESET" );   break;
        case CHANGE_PRICES_PLEASE:  Process_price_change( );
                                                        return;
                                                        break;
        case GIVE_CASH_TOTALS:
        case GIVE_CREDIT_TOTALS:
        case RELEASE_CARD_PLEASE:   Post_release( ); break;
        }
        Acknowledge_control_message( );
}

Emulate_pump( )
{
        Pushchar( ENQ );
```

```
if (Inbound_received( inbound ))
{
        Decode_his_pump_and_sequence( inbound );
        switch( inbound[ 4 ] )
        {
case STATUS:            Reply_to_status_poll( );     break;
case DISPLAY_DATA:      Reply_to_filling_data( );    break;
case AUTHORIZE:               Reply_to_authorize( );
                              Post_authorization( ); break;
case MOTORS_OFF:              Post_halt( );          break;
case MOTORS_ON:               Post_restart( );       break;
case SET_SALE_COMPLETE:       Reply_to_sale_complete( );
                              Post_payment_made( );  break;
        }
}

Reset_inbound( );
}
```

```
#include <stdio.h>
#include <setjmp.h>
#include "bulloch.h"

#ifdef GBLGEN
#define VARIABLE
#else
#define VARIABLE extern
#endif

VARIABLE unsigned     opened,
                                        hose_total_pending,
                                        debug,
                                        request_pending,
                                        last_request,
                                        retry_counter,
                                        my_port,
                                        my_client;

VARIABLE FILE                           *bulloch_in,
                                        *bulloch_out;

VARIABLE char                           inbound  [ 200 ];
VARIABLE char                           outbound_data [ 200 ];

VARIABLE jmp_buf                        initial_trap;
```

```
/* stub for pump task only */

#include "^bulloch.h"

extern request dr;

load_pump_total( task, pump, total_data, total_no )
      unsigned task, pump;
      char    *total_data;
      unsigned total_no;
{
      dr.opcode = LOAD_TOTALS;
      dr.value1 = 0;
      dr.client = 0;
      dr.value2 = pump;
      dr.value3 = total_no;
      COPY_SAFELY( dr.string_data, total_data );
      SEND( task, &dr );
}
```

```
/* dave's interface to the BULLOCH POS */

#include "^bulloch.h"
#include <magic.h>

extern request dr;
static unsigned    bulloch,
                   bullochs_port;

i_need_attention( pump, message )
      unsigned pump;
      char     *message;
{
      bull_cmd( I_NEED_ATTENTION, message, pump, 0 );
}

price_change_completed( pump )
      unsigned pump;
{
      bull_cmd( CLEAR_PRICE_CHANGE_PENDING, "", pump, 0 );
}

give_me_pump_map( pump )
      unsigned pump;
{
      bull_cmd( GIVE_ME_PUMP_MAP, "", pump, 0 );
}
```

```
give_me_timestamp( pump )
        unsigned pump;
{
        bull_cmd( GIVE_ME_TIMESTAMP, "", pump, 0 );
}

kiosk_payment( pump, hose, data )
        unsigned pump, hose;
        char     *data;
{
        bull_cmd( KIOSK_PAYMENT, data, pump, hose );
}

kiosk_authorize( pump )
        unsigned pump;
{
        bull_cmd( KIOSK_AUTHORIZATION, "", pump, 0 );
}

here_is_a_transaction( pump, hose, data )
        unsigned pump, hose;
        char     *data;
{
        bull_cmd( HERE_IS_A_TRANSACTION, data, pump, hose );
}

i_have_a_hot_card( pump )
        unsigned pump;
{
```

```
        bull_cmd( I_HAVE_A_HOT_CARD, "", pump, 0 );
}

open_bulloch( dave, port )
        unsigned dave, port;
{
        bullochs_port = port;
        bull_cmd( OPEN, "", 0, 0 );
}

bullochs_id( )
{
        return detach( bullochs_port );
}

bull_cmd( opcode, string, pump, hose )
        unsigned opcode;
        char     *string;
        unsigned pump, hose;
{
        if (bulloch == 0)
                bulloch = detach( bullochs_port );
        dr.opcode = opcode;
        dr.client = event_queue_id( );
        dr.value2 = pump;
        dr.value3 = hose;
        COPY_SAFELY( dr.string_data, string );
        SEND( bulloch, &dr );        }
```

bulloch/int/cfiles

```
bull1_int.c

bull_int.c
```

bulloch/int/makefile

```
CFLAGS  = -S +Wc,+u

SOURCES = @cfiles

OBJECTS = @objects

^^directory: $(OBJECTS)
        type all done
```

bulloch/int/objects

```
bull1_int.o

bull_int.o
```

```
#include "vars.h"

#include <timer.h>

#include <setjmp.h>

char    computed_bcc;

char    selector [ 4 ]  = { EOT, ' ', ' ', '@', '\0' };

char    poller [ 4 ]    = { EOT, ' ', ' ', ' ', '\0' };

FILE    *input;

FILE    *output;

jmp_buf         initial_trap;

main (argc, argv)

        int argc;

        char *argv[];

{

        request r;

        unsigned    task,

                    code;

        if (code = setjmp(initial_trap))

                initial_error (code);

        else

                initialize (argv[1], argv[2], argv[3]);

        for (;;)

        {

                task = RECEIVE_ANY(&r);
```

```
            if ( (task >> 8) == CNT_PORT )
                    timer_fired ();
            else
                    process_request (&r);
            REPLY(task, &r);
        }
}

initialize (device_name, address1, address2)
        char *device_name, *address1, *address2;
{
        log_2260 ("start");
        Cnts [ 0 ].opened = 0;
        Cnts [ 1 ].opened = 0;
        Cnts [ 0 ].alive  = 0;
        Cnts [ 1 ].alive  = 0;

        strncpy (Cnts [ 0 ].address, address1, 2);
        strncpy (Cnts [ 1 ].address, address2, 2);
        if ( attach (CNT_PORT) != 0 )
                longjmp (initial_trap, NO_TIMER);

        disallow ();
        input  = my_open (device_name, "rv", initial_trap,
                                                        NO_DEVICE);
        output = my_open (device_name, "wvu", initial_trap,
                                                        NO_DEVICE);
        flush_input (input);
```

```
        log_2260 ("ready");

        set_timer   (TIMER_SIGNAL,  RELATIVE,   SERVICE_INTERVAL,   0
                                                                CNT_PORT);
}

initial_error (code)
        unsigned code;
{
        char *message;

        switch (code)
        {
                case NO_TIMER:  message = "no timer port";   break;
                case NO_DEVICE: message = "no device";       break;
        }
        log_2260 (message);
        exit (1);
}

timer_fired ()
{
        int i;

        for ( i = 0; i < NCNTS; i++)
                select_cnt (Cnts + i);
        for ( i = 0; i < NCNTS; i++ )
                poll_cnt (Cnts + i);
        for ( i = 0; i < NCNTS; i++ )
```

```
            check_timer (Cnts + i);

        set_timer (TIMER_SIGNAL, RELATIVE, SERVICE_INTERVAL, 0,
                                                        CNT_PORT);

}

poll_cnt (c)
        cnt *c;
{
        char      *msg = c ->response + 1;
        unsigned dave = c ->user;

        if ( poll (c, c ->response, sizeof (c ->response)) )
        {
                if ( *msg == BEEP || c ->opened == 0 )
                        return;
                c ->timeout       = 0;
                c ->timer_running = 0;
                switch ( *msg )
                {
                        case STACK: stack_event (dave, msg); break;
                        case NOTE:  note_event (dave, msg);  break;
                        case EJECT:
                        case CARD:  card_event (dave, msg);  break;
                        case PRINT: print_event (dave, msg); break;
                        default:    cnt_event (dave, msg);   break;
                }
        }
```

```
}

select_cnt (c)
        cnt *c;
{
        if ( c ->opened == 0 )
                ;
        else if ( c ->beep_pending )
                c ->beep_pending = !select (c, BEEP_PLEASE);
        else if ( c ->request_pending == 0 )
                ;
        else
                c ->request_pending = !select (c, c ->command);
}

check_timer (c)
        cnt *c;
{
        if ( c ->opened && c ->timer_running )
                if ( timer_elapsed (c) )
                {
                        switch (c ->command[0])
                        {
                case STACK:  stack_event (c ->user, "ZZ"); break;
                case NOTE:   note_event  (c ->user, "ZZ"); break;
                case EJECT:
                case CARD:   card_event  (c ->user, "ZZ"); break;
                case PRINT:  print_event (c ->user, "ZZ"); break;
```

```
            default:     cnt_event (c ->user, "ZZ");   break;
        }
        c ->timer_running = 0;
        c ->timeout       = 0;
    }
}

set_cnt_timer (c, seconds)
        cnt      *c;
        unsigned seconds;
{
        unsigned date [ 2 ];

        if ( seconds == 0 )
        {
                c ->timeout       = 0;
                c ->timer_running = 0;
                return;
        }

        get_date (date);
        c ->timeout = date [ 1 ] + seconds;
        if ( c ->timeout > SECONDS_PER_HALF_DAY )
        {
                c ->timeout -= SECONDS_PER_HALF_DAY;  /* wrap it */
                c ->am_pm = !date [ 0 ] & 0x1;
        }
        else
```

```
            c ->am_pm = date [ 0 ] & 0x1;

        c ->timer_running = 1;

}

timer_elapsed (c)

        cnt *c;

{

        unsigned date [ 2 ];

        get_date (date);

        return (c ->timeout <= date [ 1 ]) && (c ->am_pm ==
                                                (date [ 0 ] & 0x1));

}


poll (c, buffer, buflen)

        cnt       *c;

        char      *buffer;

        unsigned buflen;

{

        int  received = 0;

        c ->alive  = 0;

        memcpy (poller + 1, c ->address, 2);

        *buffer = '\0';

        string_out (poller);

        switch ( nextchar ( ) )
```

```
        {
          case TIMEOUT:   log_cnt_failure( c,
                                          "not answering poll" );
                          break;
          case EOT:       c ->alive = 1;
                                  /* CNT has nothing to say */
                          clear_cnt_failure( c );
                          break;
          case STX:     received = receive_message (buffer, buflen);
                          c ->alive = 1;
                          clear_cnt_failure( c );
                          break;
          default:        break;     /* ignore junk     */
        }
    return received;
}

static int cnt_has_failed;

log_cnt_failure( c, m )
        cnt  *c;
        char *m;
{
        char logm[ 40 ];

        if ( cnt_has_failed == 0 && c->opened )
        {
                tsprintf( logm, "%.2s %s", c ->address, m );
```

```
                log_2260( logm );
                cnt_has_failed = 1;
        }
}

clear_cnt_failure( c )
        cnt *c;
{
        char logm[ 40 ];

        if ( c->opened && cnt_has_failed == 1 )
        {
          tsprintf( logm, "%.2s %s", c->address, "link restored" );
          log_2260( logm );
        }
        cnt_has_failed = 0;
}

select (c, cmd)
        cnt  *c;
        char *cmd;
{
        int     ret = 0;

        memcpy( selector + 1, c->address, 2 );
        string_out( selector );
        switch ( nextchar( ) )
        {
```

```
            case ACK:           ret = send_message( cmd );
                                if ( ret )
                                clear_cnt_failure( c );
                                break;
            case TIMEOUT:       log_cnt_failure( c,
                                        "not answering select" );
                                break;
            default:            break;
        }
        return ret;
}

send_message (message)
        char *message;
{
        int  i   = NUMBER_OF_RETRIES,
             bcc = calculate_bcc (message);

        for ( ; i; i-- )
        {
            char_out (STX);
            string_out (message);
            char_out (ETX);
            char_out (bcc);
            if ( acknowledged ( ) )
                return 1;
        }
        return 0;
```

```
}

calculate_bcc (m)
        char *m;
{
        int bcc = 0;

        while (*m)
                bcc ^= *m++;
        bcc ^= ETX;

        return bcc;
}

acknowledged ()
{
        switch ( nextchar () )
        {
                case ACK:       char_out( EOT );
                                return 1;
                                break;
                case NAK:
                default:
                                return 0;
                                break;
        }
}

receive_message( buffer, buflen )
```

```
char *buffer;
unsigned buflen;
{
int     i,
        t;
unsigned x;
char    *b;

pushchar (STX);
for ( i = 0; i < NUMBER_OF_RETRIES; i++ )
{
        x = 0;
        b = buffer;
        t = TIMEOUT;
        while ( (t=nextchar ( )) != STX )
                        /* wait for beginning of message */
        if ( t==TIMEOUT ) return 0;
                        /* it never came, so give up     */

        computed_bcc = 0;
        while ( t != ETX )
        {
        if ( (t = nextchar ( )) == TIMEOUT)
                        /* characters stopped coming */
            return 0;           /* so give up     */
          computed_bcc ^= t;
          if ( t == ETX )     /* checksum follows */
```

```
                {
                if ( (t = nextchar())==TIMEOUT )
                        return 0;
                if ( t == computed_bcc )
                {
                        *b = '\0';
                        return sign_off ( );
                }
                else
                        char_out (NAK);
            }
            else
                if ( ++x < buflen )
                    *b++ = t;           /* store message     */
            else                       /* message too big    */
                    goto out;           /* so give up        */
        }
    }
out:
        char_out (EOT);             /* too many retries, send EOT */
        return 0;
}

sign_off ( )
{
        char_out (ACK);
        return nextchar ( ) == EOT;
```

```
}

int char_stack = -1;

pushchar (c)
        int c;
{
        char_stack = c;
}

nextchar ()
{
        int t;

        if ( char_stack >= 0 )      /* try stack first */
        {
                t = char_stack;
                char_stack = -1;
        }
        else                        /* try com line    */
        {
                if ( !char_waiting (input) )
                set_timer (TIMER_WAKEUP, RELATIVE,
                                        CHARACTER_TIMEOUT, 0);

                if ( char_waiting (input) )
                {
                        t = getc ( input );
                        t &= 0x7f;      /* toss the 8th bit */
```

```
            }
            else
                    t = TIMEOUT;
        }
        return t;
}

string_out (s)
        char *s;
{
        fput (s, strlen(s), output);
}

char_out (c)
        char c;
{
        fput (&c, 1, output);
}
```

```
.Segment:1   0000 to 1427 (5160 bytes)
.Segment:2   0000 to 01BE (447 bytes)
.Segment:3   01BF to 0515 (855 bytes)
.Total size is 193E (6462) bytes
C01  0053  prologue
C01  005E  epilogue
C01  0067  stk_overflow
C01  007D  <exit>
C01  0083  $ucbeg
C01  0084  <main>
C01  0114  <initialize>
C01  01E0  <initial_error>
C01  0225  <timer_fired>
C01  02C4  <poll_cnt>
C01  0385  <select_cnt>
C01  03F4  <check_timer>
C01  04B2  <set_cnt_timer>
C01  0548  <timer_elapsed>
C01  0585  <poll>
C01  062E  <log_cnt_failure>
C01  0672  <clear_cnt_failure>
C01  06B7  <select>
C01  0732  <send_message>
C01  0795  <calculate_bcc>
C01  07C4  <acknowledged>
```

```
C01  07FF  <receive_message>
C01  08DA  <sign_off>
C01  08FD  <pushchar>
C01  090D  <nextchar>
C01  097D  <string_out>
C01  099E  <char_out>
C01  09BA  <process_request>
C01  0A1C  <beep_cnt>
C01  0A31  <clear_timer>
C01  0A46  <queue_request>
C01  0A9D  <isalive>
C01  0ACD  <open>
C01  0B0C  <valid_cnt>
C01  0B4B  <card_event>
C01  0B65  <cnt_event>
C01  0B7F  <note_event>
C01  0B99  <print_event>
C01  0BB3  <stack_event>
C01  0BCD  <log_2260>
C01  0BE4  <event>
C01  0C2D  <lrequest>
C01  0C85  <disallow>
C01  0CA4  <my_open>
C01  0CD7  <sleep>
C01  0D1D  <abs_sleep>
C01  0D42  <set_timer>
C01  0DA9  <strncpy>
```

```
C01  0DE3  <strncat>
C01  0E1C  <strncmp>
C01  0E4F  <flush_input>
C01  0EAE  <dregister_name>
C01  1054  <find_admin>
C01  10BE  <char_waiting>
C01  1167  <calloc>
C01  116D  <malloc>
C01  1173  <realloc>
C01  1179  <free>
C01  1179  <cfree>
C01  117F  <fopen>
C01  1185  <fclose>
C01  118B  <getc>
C01  1191  <putc>
C01  1197  <ungetc>
C01  119D  <fflush>
C01  11A3  <tfprintf>
C01  11A9  <tsprintf>
C01  11AF  <fget>
C01  11B5  <fput>
C01  11BB  <fiseek>
C01  11C1  <rewind>
C01  11C7  <forward>
C01  11CD  <breakable>
C01  11D3  <strcat>
```

```
C01  11D9  <strcmp>
C01  11DF  <strcpy>
C01  11E5  <strlen>
C01  11EB  <send>
C01  11F1  <abort>
C01  11F7  <unbreakable>
C01  11FD  <setjmp>
C01  1262  <longjmp>
C01  12D0  <nargs>
C01  12E6  <vc_send_reply>
C01  12EC  <vc_create>
C01  12F2  <vc_create2>
C01  12F8  <vc_create3>
C01  12FE  <ker_vc_destroy>
C01  1304  <def_server>
C01  130A  <set_acc_flags>
C01  1310  <set_exception>
C01  1316  <escape_tty>
C01  131C  <hold>
C01  1322  <unhold>
C01  1328  <time_slice>
C01  132E  <task_info>
C01  1334  <force_ready>
C01  133A  <set_priority>
C01  1340  <set_user>
C01  1346  <set_slice>
C01  134C  <modify_flags>
```

```
C01  1352  <set_int_mask>
C01  1358  <set_int_vec>
C01  135E  <alloc_mem>
C01  1364  <get_date>
C01  136A  <set_date>
C01  1370  <get_ticks>
C01  1376  <receive>
C01  137C  <reply>
C01  1382  <attach>
C01  1388  <detach>
C01  138E  <await>
C01  1394  <signal>
C01  139A  <read_msg>
C01  13A0  <write_msg>
C01  13A6  <read_port>
C01  13AC  <csignal>
C01  13B2  <relay>
C01  13B8  <creceive>
C01  13BE  <memcpy>
C01  13BE  <copy>
C01  13EB  <zero>
C01  1407  <memset>
D00  0000  <User_sp>
D00  0002  <User_ss>
D00  0004  <Exc_bits>
D00  0008  <Exc_allow>
```

```
D00  000C  <Exc_pending>
D00  0010  <Exc_fp>
D00  0012  <Exc_pc>
D00  0014  <Exc_permit>
D00  0018  <Exit_status>
D00  001A  <Error_status>
D00  001C  <My_tid>
D00  001E  <Dads_tid>
D00  0020  <Break_count>
D00  0021  <My_tty>
D00  0022  stack_base
D00  0024  <Cmd_flags>
D00  0025  <My_priority>
D00  0026  <stdin>
D00  0028  <stdout>
D00  002A  <stderr>
D00  002C  <Free_list>
D00  002E  <End_of_free>
D00  0030  <File_list>
D00  0032  <_Argc>
D00  0034  <_Argv>
D00  0034  stk_limit
D00  0036  SAVE
D00  0038  TEMP
D00  0060  <Code_flags>
D00  0061  <User_num>
D00  0062  <Group_num>
```

```
D00  0063  <Team_num>
D00  0065  <My_nid>
D00  0067  <Dads_nid>
D00  0069  <My_tty_nid>
D00  006B  <My_cd_nid>
D00  006D  <Release_num>
D00  006E  <Ndp_save_area>
D00  0070  <Fstack>
D00  0072  <Call_stack_ptr>
D00  0074  <Segment_table_ptr>
D00  0076  <Check_point_sp>
D00  0078  <User_spare>
D00  007E  <Qdb_tid>
D03  01BF  <computed_bcc>
D03  01C0  <selector>
D03  01C5  <poller>
D03  01CA  <input>
D03  01CC  <output>
D03  01CE  <initial_trap>
D03  01E8  <char_stack>
D03  01EA  <Cnts>
D03  046E  <dr>
```

cnt/cfiles

```
2260.c
globals.c
service_dave.c
```

```
#include "/user/steve/dave/dave_request.h"

#define MAX_CNT_COMMAND_LENGTH          150
#define NCNTS                             2

#define SEND_IT                           1
#define ALIVE                             2
#define OPEN                              3
#define BEEP_CNT                          4
#define CLEAR_TIMER                       5


#define CNT_PORT                         21

typedef struct {
            unsigned user;
            unsigned opened;
            unsigned beep_pending;
            unsigned alive;
            unsigned retries;
            unsigned timer_running;
            unsigned timeout;
            unsigned am_pm;
            unsigned request_pending;
            char     command [ MAX_CNT_COMMAND_LENGTH ];
            char     response [ MAX_CNT_COMMAND_LENGTH ];
            char     address [ 2 ];
} cnt;
```

cnt/const.h

```
#define NUMBER_OF_RETRIES       3

#define TIMEOUT                 -1

#define STACK_EMPTY             -2

#define STX                     0x02    /* 2260 ascii control codes
#define ETX                     0x03

#define EOT                     0x04

#define ACK                     0x06

#define NAK                     0x15

#define SERVICE_INTERVAL        2   /* ticks == 100 millisec */

#define CHARACTER_TIMEOUT       2       /* ticks  -100 millisec  */

#define SECONDS_PER_HALF_DAY    43200

#define BEEP_PLEASE             "B00050"

#define BEEP            'B'

#define CARD            'M'

#define NOTE            'N'

#define STACK           'A'

#define PRINT           'R'

#define EJECT           'C'

#define NO_TIMER            1       /* initialization exceptions */

#define NO_DEVICE           2
```

cnt/globals.c

```
#define GBLGEN
#include "vars.h"
```

cnt/makefile

```
CFLAGS  = -S +Wc,+u
SOURCES = @cfiles
OBJECTS = @objects

2260: $(OBJECTS)
      linkobj c=2260 x=objects m=2260.map l=/user/steve/dave
      sort 2260.map f=1,2 +r
      copy 2260 /dave/2260

globals.o: vars.h
```

cnt/objects

```
2260.o
globals.o
service_dave.o
```

```
#include "vars.h"

static cnt *C;

process_request (r)
      request *r;
{
      if ( valid_cnt (r ->value1) )
         switch ( r ->opcode )
         {
              case ALIVE:        isalive ();          break;
              case OPEN:         open (r ->client);   break;
              case SEND_IT:      queue_request(r);    break;
              case CLEAR_TIMER:  clear_timer()        break;
              case BEEP_CNT:     beep_cnt();          break;
         }
}

beep_cnt ()
{
      C ->beep_pending = 1;
}

clear_timer ()
{
      C ->timer_running = 0;
}
```

```
queue_request (r)
        request *r;
{
        if ( C ->opened && C ->request_pending == 0 )
        {
                COPY_SAFELY(C->command, r->string_data);
                C ->request_pending = 1;
                set_cnt_timer (C, r->value2);
        }
}

isalive ()
{
        char *m = C ->alive ? "ALIVE" : "DEAD";

        cnt_event (C ->user, m);
}

open (userid)
        unsigned userid;
{
      C ->user                = userid;
        C ->opened              = 1;
        C ->request_pending     = 0;
        C ->timer_running       = 0;
        C ->timeout             = 0;
}

valid_cnt (i)
```

```
    int i;
{
    i--;
    C = ( 0 <= i && i < NCNTS ) ? Cnts + i : NULL;
    return C != NULL;
}
```

cnt/vars.h

```
#include "cnt.h"
#include "const.h"
#include <stdio.h>

#ifdef GBLGEN
#define VARIABLE
#else
#define VARIABLE    extern
#endif

VARIABLE  cnt          Cnts [ NCNTS ];
```

```
#include "^cnt.h"

static unsigned cnt_task;
extern request dr;

cnt_beep (dave)
        unsigned dave;
{
        cnt_api_cmd (dave, BEEP_CNT);
}

cnt_clear_timer (dave)
        unsigned dave;
{
        cnt_api_cmd (dave, CLEAR_TIMER);
}

cnt_cmd (dave, message, timeout)
        unsigned dave;
        char     *message;
        unsigned timeout;
{
        COPY_SAFELY(dr.string_data, message);
        dr.value2 = timeout;
        cnt_api_cmd (dave, SEND_IT);
}

cnt_server_alive ()
```

```
{
        return detach (CNT_PORT);
}

open_cnt (dave)
        unsigned dave;
{
        cnt_api_cmd (dave, OPEN);
}

static cnt_api_cmd (dave, opcode)
        unsigned dave, opcode;
{
        if (cnt_task == 0)
                cnt_task = detach (CNT_PORT);

        dr.opcode = opcode;
        dr.value1 = dave;
        SEND(cnt_task, &dr);
}
```

dc9/audio.c

```
#include "dc9.h"
#include "vars.h"
#include "disk.h"

                        /* English  --  French    */

Clip fanfare        [ 2 ] = { 22614L,  22904L,  22614L,  22904L };
Clip good_morning   [ 2 ] = {    15L,    710L,  52315L,  53004L };
Clip good_after     [ 2 ] = {   820L,   1600L,  52315L,  53004L };
Clip good_evening   [ 2 ] = {  1718L,   2427L,  53101L,  53804L };
Clip pay_choice     [ 2 ] = {  2614L,   3027L,  53825L,  54428L };
```

```
Clip card_choice     [ 2 ] = { 5312L,  10200L,  61225L,  62300L };
Clip petro_choice    [ 2 ] = { 10310L, 10900L,  62325L,  63126L };
Clip card_auth       [ 2 ] = { 11616L, 11918L,  64205L,  64420L };
Clip all_cash_in     [ 2 ] = { 4226L,  4700L,   60005L,  60508L };
Clip want_receipt    [ 2 ] = { 12807L, 13220L,  65403L,  65904L };
Clip credit_receipt  [ 2 ] = { 44000L, 44715L, 102325L, 103213L };
Clip replace_nozzle  [ 2 ] = { 43509L, 43828L, 101907L, 102212L };

Clip remove_your_card[2 ] = { 113121L, 113520L, 113121L, 113520L };
Clip out_of_service  [ 2 ] = { 22222L, 22502L,  75901L,  80202L };
Clip kiosk_told      [ 2 ] = { 51600L, 52214L, 105901L, 110728L };
Clip bad_note        [ 2 ] = { 40906L, 41604L,  95319L, 100002L };
Clip bad_card        [ 2 ] = { 41723L, 42914L, 100123L, 101310L };
Clip fill_warn       [ 2 ] = { 31607L, 32126L,  85715L,  90306L };
Clip no_mag_card     [ 2 ] = { 34316L, 35411L,  92611L,  93804L };
Clip other_card      [ 2 ] = { 50805L, 51320L, 105323L, 105810L };
/* user cancels */
Clip cash_cancel     [ 2 ] = { 32314L, 33111L,  90507L, 91416L };
Clip card_cancel     [ 2 ] = { 33300L, 34203L,  91615L, 92522L };

/* system cancels */
Clip cash_abend      [ 2 ] = { 45710L, 50618L, 104119L, 105204L };
Clip card_abend      [ 2 ] = { 44812L, 45510L, 103317L, 104008L };

/* kiosk cancels */
Clip kiosk_halt      [ 2 ] = { 40326L, 40722L,  94809L,  95223L };
Clip sys_down        [ 2 ] = { 22620L, 23614L,  80323L,  81504L };

/* "bad" card outcomes */
Clip hot_card        [ 2 ] = { 30914L, 31412L, 84923L, 85508L };
Clip declined_card   [ 2 ] = { 30206L, 30727L, 84205L, 84810L };
```

```
/* devices */

Clip notes_down    [ 2 ] = { 23816L, 24416L,  81611L,  82306L };
Clip cards_down    [ 2 ] = { 24700L, 25225L,  82427L,  83112L };
Clip printer_dead  [ 2 ] = { 25400L, 30006L,  83311L,  84018L };
Clip both_down     [ 2 ] = { 35616L, 40206L,  94003L,  94624L };


/* your pump number */

Clip pump_number1  [ 2 ] = { 14004L, 14316L,  70825L, 71312L };
Clip pump_number2  [ 2 ] = { 14422L, 14820L,  71425L, 71918L };
Clip pump_number3  [ 2 ] = { 14916L, 15306L,  72025L, 72521L };
Clip pump_number4  [ 2 ] = { 15428L, 15818L,  72705L, 73126L };
Clip pump_number5  [ 2 ] = { 20016L, 20410L,  73315L, 73816L };
Clip pump_number6  [ 2 ] = { 20600L, 20928L,  74001L, 71488L };
Clip pump_number7  [ 2 ] = { 21202L, 21528L,  74615L, 75110L };
Clip pump_number8  [ 2 ] = { 21710L, 22106L,  75225L, 75720L };


Make_audio_show( program )
      int       program;
{
      Clip *c = NULL,
               *pump_number( ),
               *say_hello( );

      char      *p = new_command;

      switch( program )
      {
      case A_PUMP_MONEY:        c = fanfare;          break;
      case A_ANNOUNCE:          c = say_hello( );     break;
      case A_PUMP_NUMBER:       c = pump_number( );   break;
      case A_CARD_CHOICE:       c = card_choice;      break;
      case A_CASH_IN:           c = all_cash_in;      break;
```

```
case A_RECEIPT_NO_CREDIT:   c = want_receipt;      break;
case A_RECEIPT_CREDIT_DUE:  c = credit_receipt;    break;
case A_CASH_OR_CARD:        c = pay_choice;        break;
case A_PETRO_CARD:          c = petro_choice;      break;
case A_OUT_OF_SERVICE:      c = out_of_service;    break;
case A_BAD_NOTE:            c = bad_note;          break;
case A_KIOSK_ALERTED:       c = kiosk_told;        break;
case A_BAD_CARD:            c = bad_card;          break;
case A_PRINTER_DEAD:        c = printer_dead;      break;
case A_FILL_START_TIMEOUT:  c = fill_warn;         break;
case A_CARD_REPLACEMENT:    c = no_mag_card;       break;
case A_SOME_OTHER_CARD:     c = other_card;        break;
case A_CANCEL_CASH:         c = cash_cancel;       break;
case A_CANCEL_CARD:         c = card_cancel;       break;
case A_CARD_AUTH_WAIT:      c = card_auth;         break;
case A_HOT_CARD:            c = hot_card;          break;
case A_DECLINED_CARD:       c = declined_card;     break;
case A_CARD_ABEND:          c = card_abend;        break;
case A_CASH_ABEND:          c = cash_abend;        break;
case A_REPLACE_NOZZLE:      c = replace_nozzle;    break;
case A_KIOSK_HALT:          c = kiosk_halt;        break;
case A_SYSTEM_DOWN:         c = sys_down;          break;
case A_NOTES_DOWN:          c = notes_down;        break;
case A_CARDS_DOWN:          c = cards_down;        break;
case A_BOTH_DOWN:           c = both_down;         break;
case A_REMOVE_CARD:         c = remove_your_card;  break;
}

if ( c )
{
```

```
            Set_new_show_audio( 2 );          /* default */
            if ( c == fanfare )
                    Set_new_show_audio( 1 );
            else if ( c == remove_your_card )
                    Set_new_show_audio( language ? 2 : 1 );
            c += language;
            one_clip( c->start, c->stop, p, AUDIO_ORIGIN );
        }

        return c != NULL;
}

Clip *say_hello( )
{
        Clip *c;

        if ( 0 <= hour && hour < 12 )    /* figure out time of day */
                c = good_morning;
        else if ( 12 <= hour && hour < 17 )
                c = good_after;
        else
                c = good_evening;

        return c;
}


Clip *pump_number( )
{
        Clip *c;

        switch( His_pump_number( ) )
        {
        case 1:     c = pump_number1;  break;
```

```
case 2:     c = pump_number2;  break;
case 3:     c = pump_number3;  break;
case 4:     c = pump_number4;  break;
case 5:     c = pump_number5;  break;
case 6:     c = pump_number6;  break;
case 7:     c = pump_number7;  break;
case 8:
default:    c = pump_number8;  break;
}

return c;
}
```

dc9/cfiles

```
audio.c
dc9.c
globals.c
one_clip.c
my_timer.c
player.c
prime_for.c
service_dave.c
video.c
```

dc9/dc9.c

```
#include "dc9.h"
#include "vars.h"

main (argc, argv)
      int  argc;
      char *argv[];
{
```

```
        unsigned task,
                        code;

        request r;

        if (code = setjmp(initial_trap))
                initial_error (code);
        else
                initialize (argc, argv);

        for ( ;; )
        {
                task = RECEIVE_ANY(&r);
                if ( (task >> 8) == timer_port )
                        timer_fired ();
          else
                        service_dave (task, &r);
        }
}

initialize (pc, parms)

        int  pc;
        char *parms[];
{
        if (pc != 3)
                longjmp (initial_trap, USAGE);

        log_video ("start");
        timer_port = atoi (parms [ 1 ]);
        disallow ();
```

```
        player_in  = my_open (parms [ 2 ], "rv", initial_trap,
                                                        NO_DEVICE);
        player_out = my_open (parms [ 2 ], "wvu", initial_trap,
                                                        NO_DEVICE);
        flush_input (player_in);

        if ( attach (timer_port) )
                longjmp (initial_trap, NO_TIMER);

        initialize_clips ();
        log_video ("ready");
        check_for_loaded_disk ();
}

initial_error (code)
        unsigned code;
{
        char *message;

        switch (code)
        {
                case NO_TIMER:  message = "no timer";  break;
                case NO_DEVICE: message = "no device"; break;
                case USAGE:     usage ();              break;
        }

        log_video (message);
        exit (1);
}

usage ()
{
```

```
        tfprintf (stderr, "dc9 timer_port device\n");
        exit (1);
}
```

dc9/dc9.h

```
#include "/user/steve/dave/dave_request.h"

#define PLAYER_STATUS          1
#define PLAY_SHOW              2
#define STOP_SHOW              3
#define OPEN                   4

#define VIDEO          0
#define AUDIO          1

#define A_PUMP_MONEY                  1
#define A_ANNOUNCE                    2
#define A_PUMP_NUMBER                 3
#define A_CARD_CHOICE                 4
#define A_CASH_IN                     5
#define A_RECEIPT_NO_CREDIT           6
#define A_RECEIPT_CREDIT_DUE          7
#define A_CASH_OR_CARD                8
#define A_PETRO_CARD                  9
#define A_OUT_OF_SERVICE             11
#define A_BAD_NOTE                   12
#define A_KIOSK_ALERTED              13
#define A_BAD_CARD                   14
#define A_PRINTER_DEAD               15
#define A_FILL_START_TIMEOUT         16
#define A_CARD_REPLACEMENT           17
```

```
#define A_SOME_OTHER_CARD        18
#define A_CANCEL_CASH            19
#define A_CANCEL_CARD            20
#define A_CARD_AUTH_WAIT         21
#define A_HOT_CARD               22
#define A_DECLINED_CARD          23
#define A_CARD_ABEND             24
#define A_CASH_ABEND             25
#define A_REMOVE_CARD            26
#define A_REPLACE_NOZZLE         27
#define A_KIOSK_HALT             28
#define A_SYSTEM_DOWN            29
#define A_NOTES_DOWN             30
#define A_CARDS_DOWN             31
#define A_BOTH_DOWN              32


#define V_CARD_WAIT              0
#define V_FILL                   1
#define V_GOODBYE_THANK_YOU      2
#define V_LIFT_NOZZLE            3
#define V_INSERT_CARD            4
#define V_REMOVE_CARD            5
#define V_INSERT_NOTE            6
#define V_PAY_KIOSK              7
#define V_LONGER_CARD_WAIT       8
```

```
.Segment:1   0000 to 1D11 (7442 bytes)
.Segment:2   0000 to 021D (542 bytes)
.Segment:3   021E to 08D5 (1720 bytes)
.Total size is 25E8 (9704) bytes
C01  0053  prologue
C01  005E  epilogue
C01  0067  stk_overflow
C01  007D  <exit>
C01  0083  $ucbeg
C01  0084  <Make_audio_show>
C01  0217  <say_hello>
C01  0255  <pump_number>
C01  02B8  <main>
C01  0323  <initialize>
C01  03CF  <initial_error>
C01  0419  <usage>
C01  043B  <set_my_timer>
C01  0464  <my_timer_expired>
C01  0474  <cancel_my_timer>
C01  049E  <timer_running>
C01  04AD  <delay>
C01  04C8  <one_clip>
C01  0526  <Timecode2frames>
C01  05C0  <Shows_length>
C01  05DF  <Reset_new_show>
```

```
C01  0603  <Set_new_show_audio>
C01  0613  <New_show_audio_channel>
C01  0622  <start_player>
C01  0657  <stop_player>
C01  068C  <timer_fired>
C01  06F2  <seek_timer_expired>
C01  072D  <seek_complete>
C01  0764  <select_audio>
C01  07C4  <show_over>
C01  07E0  <next_cmd>
C01  084A  <play>
C01  08DC  <seek>
C01  0927  <Calculate_timer_interval>
C01  09CC  <player_status>
C01  0A55  <check_for_loaded_disk>
C01  0A98  <check_for_load_complete>
C01  0AE6  <load_the_disk>
C01  0B18  <prime_for_video_on>
C01  0B28  <cancel_video_on_primed>
C01  0B38  <video_on_primed>
C01  0B47  <service_dave>
C01  0C4F  <His_pump_number>
C01  0C5E  <open_player>
C01  0C89  <Play_a_show>
C01  0CF8  <Make_video_show>
C01  0E48  <Select_show>
C01  0EE7  <Make_fill_help_show>
```

```
C01  0F8D  <Make_card_wait_video>
C01  0FCB  <Make_show>
C01  1054  <queue_clip>
C01  107C  <find_clip>
C01  10CC  <rotate_clip>
C01  10FF  <initialize_clips>
C01  1137  <show_over_event>
C01  1152  <video_seek_event>
C01  116D  <log_video>
C01  1184  <video_on>
C01  119B  <video_off>
C01  11B2  <event>
C01  11FB  <lrequest>
C01  1253  <srequest>
C01  12B9  <disallow>
C01  12D8  <my_open>
C01  130B  <sleep>
C01  1351  <abs_sleep>
C01  1376  <set_timer>
C01  13DD  <strncpy>
C01  1417  <strncat>
C01  1450  <strncmp>
C01  1483  <flush_input>
C01  14E2  <dregister_name>
C01  1688  <find_admin>
C01  16F2  <char_waiting>
```

```
C01  179B  <calloc>
C01  17A1  <malloc>
C01  17A7  <realloc>
C01  17AD  <free>
C01  17AD  <cfree>
C01  17B3  <fopen>
C01  17B9  <fclose>
C01  17BF  <getc>
C01  17C5  <putc>
C01  17CB  <ungetc>
C01  17D1  <fflush>
C01  17D7  <tfprintf>
C01  17DD  <tsprintf>
C01  17E3  <fget>
C01  17E9  <fput>
C01  17EF  <fiseek>
C01  17F5  <rewind>
C01  17FB  <forward>
C01  1801  <breakable>
C01  1807  <strcat>
C01  180D  <strcmp>
C01  1813  <strcpy>
C01  1819  <strlen>
C01  181F  <send>
C01  1825  <abort>
C01  182B  <unbreakable>
C01  1831  <setjmp>
```

```
C01  1896  <longjmp>
C01  1904  <nargs>
C01  191A  <memcmp>
C01  1945  <memchr>
C01  1972  <memccpy>
C01  19AD  <atol>
C01  1A49  lepilogue
C01  1A52  lmul
C01  1AA1  lmodr
C01  1AAA  lmod
C01  1AB0  ldivr
C01  1AB9  ldiv
C01  1B72  <vc_send_reply>
C01  1B78  <vc_create>
C01  1B7E  <vc_create2>
C01  1B84  <vc_create3>
C01  1B8A  <ker_vc_destroy>
C01  1B90  <def_server>
C01  1B96  <set_acc_flags>
C01  1B9C  <set_exception>
C01  1BA2  <escape_tty>
C01  1BA8  <hold>
C01  1BAE  <unhold>
C01  1BB4  <time_slice>
C01  1BBA  <task_info>
C01  1BC0  <force_ready>
```

```
C01  1BC6  <set_priority>
C01  1BCC  <set_user>
C01  1BD2  <set_slice>
C01  1BD8  <modify_flags>
C01  1BDE  <set_int_mask>
C01  1BE4  <set_int_vec>
C01  1BEA  <alloc_mem>
C01  1BF0  <receive>
C01  1BF6  <reply>
C01  1BFC  <attach>
C01  1C02  <detach>
C01  1C08  <await>
C01  1C0E  <signal>
C01  1C14  <read_msg>
C01  1C1A  <write_msg>
C01  1C20  <read_port>
C01  1C26  <csignal>
C01  1C2C  <relay>
C01  1C32  <creceive>
C01  1C38  <copy>
C01  1C38  <memcpy>
C01  1C65  <zero>
C01  1C81  <memset>
C01  1CA2  <atoi>
D00  0000  <User_sp>
D00  0002  <User_ss>
D00  0004  <Exc_bits>
```

```
D00  0008  <Exc_allow>
D00  000C  <Exc_pending>
D00  0010  <Exc_fp>
D00  0012  <Exc_pc>
D00  0014  <Exc_permit>
D00  0018  <Exit_status>
D00  001A  <Error_status>
D00  001C  <My_tid>
D00  001E  <Dads_tid>
D00  0020  <Break_count>
D00  0021  <My_tty>
D00  0022  stack_base
D00  0024  <Cmd_flags>
D00  0025  <My_priority>
D00  0026  <stdin>
D00  0028  <stdout>
D00  002A  <stderr>
D00  002C  <Free_list>
D00  002E  <End_of_free>
D00  0030  <File_list>
D00  0032  <_Argc>
D00  0034  stk_limit
D00  0034  <_Argv>
D00  0036  SAVE
D00  0038  TEMP
D00  0060  <Code_flags>
```

```
D00  0061  <User_num>
D00  0062  <Group_num>
D00  0063  <Team_num>
D00  0065  <My_nid>
D00  0067  <Dads_nid>
D00  0069  <My_tty_nid>
D00  006B  <My_cd_nid>
D00  006D  <Release_num>
D00  006E  <Ndp_save_area>
D00  0070  <Fstack>
D00  0072  <Call_stack_ptr>
D00  0074  <Segment_table_ptr>
D00  0076  <Check_point_sp>
D00  0078  <User_spare>
D00  007E  <Qdb_tid>
D03  021E  <fanfare>
D03  022E  <good_morning>
D03  023E  <good_after>
D03  024E  <good_evening>
D03  025E  <pay_choice>
D03  026E  <card_choice>
D03  027E  <petro_choice>
D03  028E  <card_auth>
D03  029E  <all_cash_in>
D03  02AE  <want_receipt>
D03  02BE  <credit_receipt>
D03  02CE  <replace_nozzle>
```

```
D03  02DE  <remove_your_card>
D03  02EE  <out_of_service>
D03  02FE  <kiosk_told>
D03  030E  <bad_note>
D03  031E  <bad_card>
D03  032E  <fill_warn>
D03  033E  <no_mag_card>
D03  034E  <other_card>
D03  035E  <cash_cancel>
D03  036E  <card_cancel>
D03  037E  <cash_abend>
D03  038E  <card_abend>
D03  039E  <kiosk_halt>
D03  03AE  <sys_down>
D03  03BE  <hot_card>
D03  03CE  <declined_card>
D03  03DE  <notes_down>
D03  03EE  <cards_down>
D03  03FE  <printer_dead>
D03  040E  <both_down>
D03  041E  <pump_number1>
D03  042E  <pump_number2>
D03  043E  <pump_number3>
D03  044E  <pump_number4>
D03  045E  <pump_number5>
D03  046E  <pump_number6>
```

```
D03  047E  <pump_number7>
D03  048E  <pump_number8>
D03  049E  <language>
D03  04A0  <deposit_amount>
D03  04A2  <hour>
D03  04A4  <fill_with_help>
D03  04A6  <preset_amount>
D03  04A8  <cueing_time>
D03  04AA  <timer_port>
D03  04AC  <disk_is_loading>
D03  04AE  <send_events>
D03  04B0  <dave>
D03  04B2  <my_client>
D03  04B4  <current_frame>
D03  04B8  <player_in>
D03  04BA  <player_out>
D03  04BC  <next_command>
D03  04BE  <current_command>
D03  0554  <new_command>
D03  05EA  <initial_trap>
D03  061C  <c5_show>
D03  0622  <c10_show>
D03  062C  <c15_show>
D03  0636  <c20_show>
D03  0640  <c25_show>
D03  064C  <c30_show>
D03  065C  <c35_show>
```

```
D03  066C  <c40_show>
D03  067C  <fill_show>
D03  068E  <fill_help>
D03  069E  <_clips>
D03  079A  <firstclip>
D03  079C  <lastclip>
D03  081E  <longer_card_wait>
D03  082E  <dr>
```

dc9/disk.h

```
#define VIDEO_ORIGIN        90
#define AUDIO_ORIGIN        90

typedef struct _clip {
        struct _clip *next;
        long     start;
        long     stop;
        unsigned        timing;
} Video_clip;

typedef struct {
    long start;
    long stop;
} Clip;
```

dc9/globals.c

```
#define GBLGEN
#include "dc9.h"
#include "vars.h"
```

dc9/makefile

```
CFLAGS  = -S +Wc,+u
SOURCES = @cfiles
OBJECTS = @objects

dc9: $(OBJECTS)
        linkobj c=dc9 x=objects m=dc9.map l=/user/steve/dave
        sort dc9.map f=1,2 +r
        copy dc9 /dave/dc9

globals.o: vars.h
video.o : disk.h
audio.o : disk.h
```

dc9/my_timer.c

```
#include "dc9.h"
#include "vars.h"
#include <timer.h>

static unsigned _my_timer_running;

set_my_timer( ticks )
        unsigned ticks;
{
        set_timer( TIMER_SIGNAL, RELATIVE, ticks, 0, timer_port );
        _my_timer_running = 1;
}

my_timer_expired ()
{
```

```
        _my_timer_running = 0;
}

cancel_my_timer ()
{
        set_timer (TIMER_CANCEL, RELATIVE, 0, 0, timer_port);
        _my_timer_running = 0;
}

timer_running ()
{
        return _my_timer_running;
}

delay( ticks )
        unsigned ticks;
{
        set_timer( TIMER_WAKEUP, RELATIVE, ticks );
}
```

dc9/objects

```
audio.o
dc9.o
globals.o
my_timer.o
one_clip.o
player.o
prime_for.o
service_dave.o
video.o
```

```
#include "vars.h"

static unsigned _show_time;
static char *command_buffer_end;

unsigned Timecode2frames ( );

char *one_clip( start_timecode, end_timecode, b, origin )
        long     start_timecode, end_timecode;
        char     *b;
        unsigned origin;
{
        unsigned start = Timecode2frames( start_timecode ),
                         end   = Timecode2frames( end_timecode );

        if ( b <= command_buffer_end )
          b += tsprintf( b, "S%u:F%u:", start + origin, end + origin

        _show_time += ( end - start );
        return b;
}

unsigned Timecode2frames( acode )
        long acode;
{
        unsigned minutes,
                         minsecs,
```

```
                seconds,
                frames;

        minutes = acode / 10000L; /* 223344  */
        minsecs = acode % 10000L; /*   3344  */
        seconds = minsecs / 100L; /*   33    */
        frames  = minsecs % 100L; /*     44  */

        return minutes * 1800 + seconds * 30 + frames;
}

Shows_length( )
{
        return ( _show_time + 15 ) / 30;
}

Reset_new_show( )
{
        command_buffer_end = new_command + sizeof( new_command ) - 20;
        zero( new_command, sizeof( new_command ) );
        _show_time = 0;
}

static unsigned _channel;

Set_new_show_audio( i )
        unsigned i;
{
        _channel = i;
}

New_show_audio_channel( )
{
```

```
        return _channel;
}
```

dc9/player.c

```
#include "dc9.h"
#include "vars.h"

static int seeking,
          seek_time;   /* counts ticks required to perform a seek

static char *previous_command;

start_player( command )
        char *command;
{
        select_audio( New_show_audio_channel( ) );
        COPY_SAFELY( current_command, command );
        next_command = current_command;
        set_my_timer( 1 );
}

stop_player ()
{
        if (timer_running( ))
        {
                cancel_my_timer( );
                fput ("X\015", 2, player_out);
        }
        seeking      = 0;
        next_command = NULL;
        cancel_video_on_primed ();
}
```

```
timer_fired ()
{
        char cmd [ 30 ];

        my_timer_expired ();
        if (seeking)
                seek_timer_expired ();
        else if (disk_is_loading)
                        check_for_load_complete ();
        else
                switch ( next_cmd(cmd, sizeof(cmd)))
                {
                        case 'P':   play (cmd);         break;
                        case 'S':   seek (cmd);         break;
                        case 0:     show_over ();       break;
                }
}

seek_timer_expired ()
  /* we either wait a bit longer, or terminate the seek */
{
        unsigned next_interval;

  if ( seek_complete () || seek_time >= THREE_AND_A_HALF_SECONDS )
        {
                seeking       = 0;
                next_interval = 1;
```

```
        }
        else
                next_interval = QUARTER_SECOND;
        seek_time += next_interval;
        set_my_timer (next_interval);
}

seek_complete () /*if an error occurs the seek will never make it*
{
        char pstat [ 15 ];
        if ( player_status (pstat) )
                return (pstat [ 5 ] == 'R') || (pstat [ 5 ] == 'E');
        else
                return 0;
}

static unsigned _current_chan = 0xffff;
static char *c1 = "A13\015",
                        *c2 = "A14\015";

select_audio( chan )
        unsigned chan;
{
        char *c;
        if ( chan == _current_chan )
                return;
```

```
        switch( chan )
        {
        case 1:     c = c1; break;
        case 2:     c = c2; break;
        default:    c = c1; break;
        }
        _current_chan = chan;
        fput( c, 4, player_out );
}

show_over( )
{
        if (send_events)
                show_over_event( my_client );
}

next_cmd( b, l )
        char *b;
        int  l;
{
        int  c;
        char *cs = b;

        c = *next_command;
        previous_command = next_command;
                                /* in case we decide not to do it */
        while ( *next_command && *next_command != ':' )
                *cs++ = *next_command++;
```

```
        *cs++ = '\015';
        *cs =   '\0';
        if ( *next_command == ';' )
                next_command++;

        return c;
}

play( p )
        char *p;
{
        unsigned ticks,
                        Calculate_timer_interval( );
        extern long atol();

        if ( seek_time < cueing_time ) /*let's delay a bit longer*/
        {
                next_command  = previous_command;
                                /* re-process this command    */
        set_my_timer (QUARTER_SECOND); /* after this timer expires */
                seek_time += QUARTER_SECOND;
                return;
        }

        cueing_time = 0;   /* only "cue" the first clip     */
        ticks = Calculate_timer_interval( p + 1 );
        fput( p, strlen( p ), player_out );
        if  (video_on_primed( )) /* so you don't see dirt before */
```

```
        {                           /* the initial "play" command */
                video_on( dave );
                video_seek_event( my_client );
                cancel_video_on_primed( );
        }
        current_frame = atol( p + 1 );
        set_my_timer( ticks );
}

seek (p)
        char *p;
{
        extern long atol();

        fput (p, strlen(p), player_out);
        current_frame = atol(p + 1);
        seeking     = 1;
        seek_time   = HALF_SECOND;
        set_my_timer (HALF_SECOND);
}

unsigned Calculate_timer_interval (s)
        char *s;
{
        extern long atol();
        long   frames;
        frames = atol(s) - current_frame;
                                /* distance from current frame */
```

```
        if ( frames < 0 ) frames *= -1L;  /* absolute        */
        frames *= 2L;                     /* times ticks per second */
        frames  /=  3L;                   /* divided frames per second */
        frames += 2L;                     /* round up  */
        return (unsigned)frames;
}

#define ONE_TWENTIETH  1

player_status (s)
        char *s;
{
        int  i,
                timeouts = 0;

        zero (s, 8);
        flush_input (player_in);
        fput ("?", 1, player_out);
        for (i = 0; i < 8;)
        {
                if ( char_waiting (player_in) )
                        s [ i++ ] = getc (player_in);
                else
                {
                        delay( ONE_TWENTIETH );
                        if ( ++timeouts >= 20 )
                                return 0;
                }
```

```
        }
        return 1;
}

check_for_loaded_disk ()
{
        char status [ 10 ];

        if (player_status (status))
                if ( memcmp(status, "00000N", 6) == 0 )
                {
                        load_the_disk ();
                        return 0;
                }
                else
                        return 1;
        return 0;
}

static int load_tries;

check_for_load_complete ()
{
        char status [ 10 ];

        if (load_tries > 60)
                        /* should not take a minute to load a disk. */
        {                       /* something else must be wrong.  */
```

```
                disk_is_loading = 0;
                return;
        }

        if (player_status (status))
        {
                if ( status [ 5 ] == 'R' )
                        disk_is_loading = 0;    /* all done */
                else
                {
                        load_tries++;
                        set_my_timer (ONE_SECOND);
                }
        }
        else
                disk_is_loading = 0;            /* pack it in */
}

load_the_disk ()
{
        disk_is_loading = 1;

        fput ("L\015", 2, player_out);
        set_my_timer (ONE_SECOND);
        load_tries = 0;
}
```

dc9/prime_for.c

```
#include "vars.h"

static int prime_video;

prime_for_video_on ()
{
        prime_video = 1;
}

cancel_video_on_primed ()
{
        prime_video = 0;
}

video_on_primed ()
{
        return prime_video;
}
```

```
#include "dc9.h"
#include "vars.h"

static int pump;

service_dave( dave, r )
        unsigned dave;
        request *r;
{
        language        = r->value3;
        deposit_amount  = r->value4;
        hour            = r->value4;
        preset_amount   = r->value4;
        pump            = r->value4;
        cueing_time     = r->value5 * 2;  /* from tenths to ticks */
        fill_with_help  = r->value5;

        if ( r->opcode == PLAY_SHOW )
        {
                Reset_new_show( );
                if ( r->value1 == VIDEO )
                        Make_video_show( r->value2 );
                else if ( r->value1 == AUDIO )
                        Make_audio_show( r->value2 );
                r->value2 = Shows_length( );
        }
```

```
        else
                r->value6 = 0;

        REPLY( dave, r );

        if ( disk_is_loading )
                show_over( );
        else
                switch( r->opcode )
                {
                case PLAYER_STATUS:  player_status( );        break;
                case STOP_SHOW:      stop_player( );          break;
                case PLAY_SHOW:      Play_a_show( r );        break;
                case OPEN:           open_player( r );        break;
                }
}

His_pump_number( )
{
        return pump;
}

open_player( r )
        request *r;
{
        my_client   = r->value1;
        dave        = r->value2;
        send_events = r->value3;
```

```
}

Play_a_show( r )
        request *r;
{
        char status [ 10 ];

        player_status( status );
        if ( check_for_loaded_disk( ) == 0 )
        {
                show_over( );
                return;
        }
        switch( r->value1 )
        {
                case VIDEO:     stop_player( );
                                        if ( new_command[ 0 ] )
                                        {
                                        start_player( new_command );
                                        prime_for_video_on( );
                                }
                                        break;
                case AUDIO:     stop_player( );
                                        if ( new_command[ 0 ] )
                                        start_player( new_command );
                                        break;
        }
}
```

```
#ifdef GBLGEN
#define VARIABLE
#else
#define VARIABLE extern
#endif

#include <stdio.h>
#include <setjmp.h>

VARIABLE   unsigned  language,
                                        deposit_amount,
                                        hour,
                                        fill_with_help,
                                        preset_amount,
                                        cueing_time,
                                        timer_port,
                                        disk_is_loading,
                                        send_events,
                                        dave,
                                        my_client;

VARIABLE long  current_frame;

VARIABLE FILE *player_in,
                                *player_out;

#define VIDEO_COMMAND_LENGTH  150

VARIABLE char *next_command,
                                current_command[  VIDEO_COMMAND_LENGTH ];
```

```
new_command[ VIDEO_COMMAND_LENGTH ];

#define HALF_SECOND        10
#define ONE_SECOND         20
#define QUARTER_SECOND      5
#define THREE_AND_A_HALF_SECONDS      70

#define NO_TIMER            1  /* initialization exceptions */
#define NO_DEVICE           2
#define USAGE               3

VARIABLE jmp_buf      initial_trap;
```

```
#include "dc9.h"

#include "vars.h"

#include "disk.h"


unsigned c5_show  [] = { 15,  10,  0 };

unsigned c10_show [] = { 15,  5, 15,  5,  0 };

unsigned c15_show [] = { 30,  5, 15,  5,  0 };

unsigned c20_show [] = { 30, 15, 30,  10,  0 };

unsigned c25_show [] = { 45, 15, 30,  5,  5,  0 };

unsigned c30_show [] = { 45, 30,  5, 30,  5, 15, 30, 0 };

unsigned c35_show [] = { 15, 45,  5, 45,  5, 30, 15, 0 };

unsigned c40_show [] = { 15, 45,  5, 45, 30, 15,  5, 0 };

unsigned fill_show []   = { 15, 30,  5, 30, 15,  5, 45, 10, 0 };

unsigned fill_help []   = { 15,  5, 30, 15,  5, 45, 10, 0 };

Video_clip _clips [] = {

                NULL,     0L,     0L,  0,  /*  "top"      */

                NULL,    12L,  5018L, 45,  /* torch 1     */

                NULL,  5110L,  5902L, 10,  /* bobsled 1   */

                NULL,  5909L,  12908L, 30, /* baseball 1 */

                NULL,  12927L, 14605L, 15, /* horses 1    */

                NULL,  14608L, 21519L, 30, /* bluenose 1 */

                NULL,  21700L, 22904L, 10, /* glass       */

                NULL,  23004L, 24308L, 15, /* torch 2     */

                NULL,  24310L, 31319L, 30, /* horses      */
```

```
NULL,  31407L, 31807L,  5, /* baseball   */
NULL,  31809L, 40325L, 45, /* bobsled    */
NULL,  40504L, 40914L, 5,  /* pump       */
NULL,  40925L, 44002L, 30, /* torch      */
NULL,  44016L, 52712L, 45, /* bluenose   */
NULL,  52804L, 53224L, 5,  /* helmet     */
NULL, 53308L, 60308L. 30,  /* torch glass*/
NULL, 60327L, 64911L, 45,  /* baseball   */
NULL, 65003L, 70312L, 15,  /* torch      */
NULL, 70405L, 73306L, 30,  /* bobsled    */
NULL, 73420L, 82504L, 45,  /* montage    */
NULL, 82423L, 83000L, 5    /* bluenose   */
                    };

Video_clip *firstclip = _clips;
Video_clip *lastclip  = _clips;

static Clip help[ 2 ] = { 85015L, 90515L, 90615L, 92217L };

                        /*   English  --  French    */

static Clip card_wait  [ 2 ] =
                    { 83001L,  84001L,  84002L,   85000L };
static Clip lift_nozzle[ 2 ] =
                    { 111704L, 112127L, 111704L,  112127L };
static Clip insert_card[ 2 ] =
                    { 112306L, 113010L, 112306L,  113010L };
static Clip remove_card[ 2 ] =
                    { 110826L, 111527L, 110826L, 111527L };
```

```
static Clip insert_note[ 2 ] =
                        { 92418L,  93402L,  93512L,  94803L };
static Clip goodbye    [ 2 ] =
                        { 121117L, 122100L, 122200L, 123408L };
static Clip pay_kiosk  [ 2 ] =
                        { 123510L, 124118L, 123510L, 124118L };


unsigned longer_card_wait [ ] = { 5, 10, 5, 30, 15, 0 };

Make_video_show( program )
      int  program;
{
      Clip     *c;
      unsigned *Select_show( ),
                        bucks = deposit_amount / 100;

      char     *p = new_command;

      if ( program == V_FILL )
      {
              Set_new_show_audio( 1 );
              if ( fill_with_help )
              Make_fill_help_show( p, VIDEO_ORIGIN );
          else
              Make_show( Select_show( bucks ), p, VIDEO_ORIGIN );
          return 1;
      }
```

```
if ( program == V_LONGER_CARD_WAIT )
{
        Set_new_show_audio( 1 );
  Make_show( longer_card_wait, p, VIDEO_ORIGIN );
        return 1;
}

switch( program )
{
        case V_CARD_WAIT:           c = card_wait;   break;
        case V_LIFT_NOZZLE:         c = lift_nozzle; break;
        case V_INSERT_CARD:         c = insert_card; break;
        case V_REMOVE_CARD:         c = remove_card; break;
        case V_INSERT_NOTE:         c = insert_note; break;
        case V_GOODBYE_THANK_YOU:   c = goodbye;     break;
        case V_PAY_KIOSK:           c = pay_kiosk;   break;
        default:                    return 0;        break;
}

switch( program )
{
case V_GOODBYE_THANK_YOU:
case V_INSERT_NOTE:
case   V_CARD_WAIT:     Set_new_show_audio( 1 ); break;
default:        Set_new_show_audio( language ? 2 : 1 );
                                                  break;
}
```

```
        c += language;
        one_clip( c->start, c->stop, p, VIDEO_ORIGIN );

        return 1;
}

unsigned *Select_show( bucks )
        unsigned bucks;
{
        unsigned *s,
                        type;

        type = bucks / 5;
        if ( bucks % 5 != 0 ) type++;
        type *= 5;

        switch( type )
        {
                case  0: s = fill_show;     break;
                case  5: s = c5_show;       break;
                case 10: s = c10_show;      break;
                case 15: s = c15_show;      break;
                case 20: s = c20_show;      break;
                case 25: s = c25_show;      break;
                case 30: s = c30_show;      break;
                case 35: s = c35_show;      break;
                case 40:
                default: s = c40_show;      break;
```

```
        }
        return s;
}

Make_fill_help_show( buf, origin )
        char *buf;
        unsigned origin;
{
        char      *one_clip( );
        Video_clip  *father,
                            *c,
                            *find_clip( );
        Clip *ch = help;

        if ( ( father = find_clip( 5 ) ) == NULL )
                return 0;
        c = father->next;
        buf = one_clip( c->start, c->stop, buf, origin);
        rotate_clip( father );
        ch  = language ? ch + 1 : ch;
        buf = one_clip(  ch->start, ch->stop, buf, origin );

        return Make_show( fill_help, buf, origin );
}

Make_card_wait_video( wc, buf, origin )
        Clip *wc;
       char *buf;
        int  origin;
{
        buf = one_clip( wc->start, wc->stop, buf, origin );
```

```
        return Make_show( longer_card_wait, buf, origin );'
}


Make_show( show, buf, origin )
        unsigned show [];
        char *buf;
        unsigned origin;
{
        unsigned i;
        char     *one_clip( );
        Video_clip  *father,
                            *c,
                            *find_clip( );
        for ( i = 0; show[ i ]; i++ )
        {
                if ( (father = find_clip (show [ i ])) == NULL )
                        return 0;
                c    = father->next;
                buf = one_clip( c->start, c->stop, buf, origin);
                rotate_clip( father );
        }
        *buf = '\0';
        return 1;
}

queue_clip( c )
        Video_clip *c;
{
        if ( c == NULL )          /* bug */
```

```
            return;
        lastclip->next = c;
        lastclip = c;
        c->next = NULL;
}

Video_clip *find_clip( seconds )  /* find clip, return father */
        unsigned seconds;
{
        Video_clip *c,
                           *father;

        father = firstclip;
        for ( c = father->next; c; c = c->next )
        {
                if ( c->timing == seconds )
                        break;
                father = c;
        }
        return c == NULL ? NULL : father;
}

rotate_clip( p )
  /* unlink a clip's son and put it at the back of the list. */
        Video_clip *p;
{
        Video_clip *newlast;

        if ( p == NULL ||                    /* bug  */
          (newlast = p->next) == lastclip )  /* already there */
```

```
            return;

        p->next = newlast->next;
        queue_clip( newlast );
}

initialize_clips( )
{
        int i;

 for ( i = 1; i < sizeof( _clips ) / sizeof( Video_clip ); i++ )
                queue_clip( _clips + i );
}

#ifdef CLIP_DEBUG

Dump_clips ( )
{
        int i;

        printf ( "First = %04x  Last = %04x\n\n", firstclip,
                                                        lastclip );
        for ( i = 0; i < sizeof (_clips) / sizeof (Video_clip); i++ )
                Dump_clip ( _clips + i );
}

Dump_clip ( c )
        Video_clip *c;
{
        printf
          ( "Address %04x  Next %04x Start %5d End %5d Time %5d\n",
```

```
                c, c ->next, c ->start, c ->stop, c ->timing );
}

#endif
```

dc9/int/audios.c

```
#include "^dc9.h"

pump_money_audio( )
{
        return prequest( PLAY_SHOW, AUDIO, A_PUMP_MONEY, 0, 0, 0 );
}

announce_audio( language, hour )
        unsigned language, hour;
{
        return prequest( PLAY_SHOW, AUDIO, A_ANNOUNCE, language,
                                                        hour, 0 );
}

pump_number_audio( language, pump_number )
        unsigned language, pump_number;
{
        return prequest( PLAY_SHOW, AUDIO, A_PUMP_NUMBER, language,
                                pump_number, 0 );
}

card_choice_audio( language )
        unsigned language;
```

```
{
        return prequest( PLAY_SHOW, AUDIO, A_CARD_CHOICE, language,
}
                                                        0, 8 );

all_cash_in_audio( language )
        unsigned language;
{
        return  prequest( PLAY_SHOW, AUDIO, A_CASH_IN, language,
                                                        0, 8 );
}

receipt_no_credit_audio( language )
        unsigned language;
{
        return prequest( PLAY_SHOW, AUDIO, A_RECEIPT_NO_CREDIT,
                                        language, 0, 8 );
}

receipt_credit_audio( language )
        unsigned language;
{
        return prequest( PLAY_SHOW, AUDIO, A_RECEIPT_CREDIT_DUE,
                                        language, 0, 8 );
}

pay_choice_audio( language )
        unsigned language;
{
        return prequest( PLAY_SHOW, AUDIO, A_CASH_OR_CARD, language,
                                                        0, 8 );
}
```

```
petro_card_audio( language )
        unsigned language;
{
        return prequest( PLAY_SHOW, AUDIO, A_PETRO_CARD, language,
                                                        0, 8 );
}

out_of_service_audio( language )
        unsigned language;
{
        return prequest( PLAY_SHOW, AUDIO, A_OUT_OF_SERVICE,
                                                language, 0, 0 );
}

bad_note_audio( language )
        unsigned language;
{
        return prequest( PLAY_SHOW, AUDIO, A_BAD_NOTE, language,
                                                        0, 0 );
}

kiosk_alerted_audio( language )
        unsigned language;
{
        return prequest( PLAY_SHOW, AUDIO, A_KIOSK_ALERTED,
                                                language, 0, 0 );
}

bad_card_audio( language )
        unsigned language;
```

```
{
        return prequest( PLAY_SHOW, AUDIO, A_BAD_CARD, language,
                                                        0, 0 );
}

printer_dead_audio( language )
        unsigned language;
{
        return prequest( PLAY_SHOW, AUDIO, A_PRINTER_DEAD, language,
                                                        0, 0 );
}

pump_or_else_audio( language )
        unsigned language;
{
        return prequest( PLAY_SHOW, AUDIO, A_FILL_START_TIMEOUT,
                                                language, 0, 0 );
}

replace_your_card_audio( language )
        unsigned language;
{
        return prequest( PLAY_SHOW, AUDIO, A_CARD_REPLACEMENT,
                                                language, 0, 0 );
}

other_card_audio( language )
        unsigned language;
{
        return prequest( PLAY_SHOW, AUDIO, A_SOME_OTHER_CARD,
                                                language, 0, 0 );
```

```
}

cancelled_cash_audio( language )
        unsigned language;
{
        return prequest( PLAY_SHOW, AUDIO, A_CANCEL_CASH,
                                                language, 0, 8 );
}

cancelled_card_audio( language )
        unsigned language;
{
        return prequest( PLAY_SHOW, AUDIO, A_CANCEL_CARD,
                                                language, 0, 8 );
}

card_auth_audio( language )
        unsigned language;
{
        return prequest( PLAY_SHOW, AUDIO, A_CARD_AUTH_WAIT,
                                                language, 0, 0 );
}

hot_card_audio( language )
        unsigned language;
{
        return prequest( PLAY_SHOW, AUDIO, A_HOT_CARD, language,
                                                        0, 0 );
}

declined_card_audio( language )
```

```
        unsigned language;
{
        return prequest( PLAY_SHOW, AUDIO, A_DECLINED_CARD, language,
                                                        0, 0 );
}

card_abend_audio( language )
        unsigned language;
{
        return prequest( PLAY_SHOW, AUDIO, A_CARD_ABEND,
                                                language, 0, 0 );
}

cash_abend_audio( language )
        unsigned language;
{
        return prequest( PLAY_SHOW, AUDIO, A_CASH_ABEND,
                                                language, 0, 0 );
}

replace_nozzle_audio( language )
        unsigned language;
{
        return prequest( PLAY_SHOW, AUDIO, A_REPLACE_NOZZLE,
                                                language, 0, 0 );
}

kiosk_halt_audio( language )
        unsigned language;
```

```
{
        return prequest( PLAY_SHOW, AUDIO, A_KIOSK_HALT,
                                                language, 0, 0 );
}

system_down_audio( language )
        unsigned language;
{
        return prequest( PLAY_SHOW, AUDIO, A_SYSTEM_DOWN,
                                                language, 0, 0 );
}

note_reader_down_audio( language )
        unsigned language;
{
        return prequest( PLAY_SHOW, AUDIO, A_NOTES_DOWN,
                                                language, 0, 0 );
}

card_reader_down_audio( language )
        unsigned language;
{
        return prequest( PLAY_SHOW, AUDIO, A_CARDS_DOWN,
                                                language, 0, 0 );
}

both_readers_down_audio( language )
        unsigned language;
{
        return prequest( PLAY_SHOW, AUDIO, A_CARDS_DOWN,
                                                language, 0, 0 );
```

```
}

remove_card_audio( language )
        unsigned language;
{
        return prequest( PLAY_SHOW, AUDIO, A_REMOVE_CARD,
                                                language, 0, 0 );
}
```

dc9/int/cfiles

```
audios.c
int1.c
videos.c
```

dc9/int/int1.c

```
#include "^dc9.h"

static unsigned dc9;
extern request dr;

open_video_player (port, client, dave, event_mode)
        unsigned port, client, dave, event_mode;
{
        dc9 = detach (port);
        prequest (OPEN, client, dave, event_mode, 0, 0);
}

stop_video_show ()
{
        prequest (STOP_SHOW, 0, 0, 0, 0, 0);
```

```
}

player_status_request ()
{
        prequest (PLAYER_STATUS, 0, 0, 0, 0, 0);
}
. . .
prequest( opcode, type, show, language, dough, cueing_tenths )
        unsigned opcode, type, show, language, dough, cueing_tenths;
{
        dr.opcode = opcode;
        dr.value1 = type;
        dr.value2 = show;
        dr.value3 = language;
        dr.value4 = dough;
        dr.value5 = cueing_tenths;
        SEND( dc9, &dr );
        return dr.value6;
}
```

dc9/int/makefile

```
CFLAGS  = -S +Wc,+u
SOURCES = @cfiles
OBJECTS = @objects

^^directory: $(OBJECTS)
        type all dcnw
```

dc9/int/new_audios.c

```
#include "^new_dc9.h"
```

```
pump_money_audio( )
{
        return prequest( PLAY_SHOW, AUDIO, A_PUMP_MONEY, 0, 0, 0 );
}

announce_audio( language, hour )
        unsigned language, hour;
{
        return prequest( PLAY_SHOW, AUDIO, A_ANNOUNCE, language,
                                                        hour, 0 );
}

pump_number_audio( language, pump_number )
        unsigned language, pump_number;
{
        return prequest( PLAY_SHOW, AUDIO, A_PUMP_NUMBER, language,
                                pump_number, 0 );
}

card_choice_audio( language )
        unsigned language;
{
        return prequest( PLAY_SHOW, AUDIO, A_CARD_CHOICE, language,
                                                        0, 15 );
}

all_cash_in_audio( language )
        unsigned language;
{
        return prequest( PLAY_SHOW, AUDIO, A_CASH_IN, language,
                                                        0, 15 );
```

```
}

receipt_no_credit_audio( language )
        unsigned language;
{
        return prequest( PLAY_SHOW, AUDIO, A_RECEIPT_NO_CREDIT,
                                        language, 0, 15 );
}

receipt_credit_audio( language )
        unsigned language;
{
        return prequest( PLAY_SHOW, AUDIO, A_RECEIPT_CREDIT_DUE,
                                        language, 0, 15 );
}

pay_choice_audio( language )
        unsigned language;
{
        return prequest( PLAY_SHOW, AUDIO, A_CASH_OR_CARD,
                                        language, 0, 15 );
}

petro_card_audio( language )
        unsigned language;
{
        return prequest( PLAY_SHOW, AUDIO, A_PETRO_CARD,
                                        language, 0, 15 );

}

pay_at_kiosk_audio( language )
```

```
        unsigned language;
{
        return prequest( PLAY_SHOW, AUDIO, A_KIOSK_SALE,
                                                language, 0, 0 );
}

out_of_service_audio( language )
        unsigned language;
{
        return prequest( PLAY_SHOW, AUDIO, A_OUT_OF_SERVICE,
                                                language, 0, 0 );
}

bad_note_audio( language )
        unsigned language;
{
        return prequest( PLAY_SHOW, AUDIO, A_BAD_NOTE,
                                                language, 0, 0 );
}

kiosk_alerted_audio( language )
        unsigned language;
{
        return prequest( PLAY_SHOW, AUDIO, A_KIOSK_ALERTED,
                                                language, 0, 0 );
}

bad_card_audio( language )
        unsigned language;
```

```
{
        return prequest( PLAY_SHOW, AUDIO, A_BAD_CARD,
                                                language, 0, 0 );
}

printer_dead_audio( language )
        unsigned language;
{
        return prequest( PLAY_SHOW, AUDIO, A_PRINTER_DEAD,
                                                language, 0, 0 );
}

pump_or_else_audio( language )
        unsigned language;
{
        return prequest( PLAY_SHOW, AUDIO, A_FILL_START_TIMEOUT,
                                                language, 0, 0 );
}

replace_your_card_audio( language )
        unsigned language;
{
        return prequest( PLAY_SHOW, AUDIO, A_CARD_REPLACEMENT,
                                                language, 0, 0 );
}

other_card_audio( language )
        unsigned language;
{
        return prequest( PLAY_SHOW, AUDIO, A_SOME_OTHER_CARD,
                                                language, 0, 0 );
```

```
}

cancelled_cash_audio( language )
        unsigned language;
{
        return prequest( PLAY_SHOW, AUDIO, A_CANCEL_CASH,
                                                language, 0, 15 );
}

cancelled_card_audio( language )
        unsigned language;
{
        return prequest( PLAY_SHOW, AUDIO, A_CANCEL_CARD,
                                                language, 0, 15 );
}

card_auth_audio( language )
        unsigned language;
{
        return prequest( PLAY_SHOW, AUDIO, A_CARD_AUTH_WAIT,
                                                language, 0, 0 );
}

hot_card_audio( language )
        unsigned language;
{
        return prequest( PLAY_SHOW, AUDIO, A_HOT_CARD,
                                                language, 0, 0 );
}

declined_card_audio( language )
        unsigned language;
```

```
{
        return prequest( PLAY_SHOW, AUDIO, A_DECLINED_CARD,
                                                language, 0, 0 );
}

card_abend_audio( language )
        unsigned language;
{
        return prequest( PLAY_SHOW, AUDIO, A_CARD_ABEND,
                                                language, 0, 0 );
}

cash_abend_audio( language )
        unsigned language;
{
        return prequest( PLAY_SHOW, AUDIO, A_CASH_ABEND,
                                                language, 0, 0 );
}

remove_card_audio( language )
        unsigned language;
{
        return prequest( PLAY_SHOW, AUDIO, A_REMOVE_CARD,
                                                language, 0, 0 );
}

replace_nozzle_audio( language )
        unsigned language;
{
        return prequest( PLAY_SHOW, AUDIO, A_REPLACE_NOZZLE,
                                                language, 0, 0 );
```

```
}

kiosk_halt_audio( language )
        unsigned language;
{
        return prequest( PLAY_SHOW, AUDIO, A_KIOSK_HALT,
                                                language, 0, 0 );
}

system_down_audio( language )
        unsigned language;
{
        return prequest( PLAY_SHOW, AUDIO, A_SYSTEM_DOWN,
                                                language, 0, 0 );
}

note_reader_down_audio( language )
        unsigned language;
{
        return prequest( PLAY_SHOW, AUDIO, A_NOTES_DOWN,
                                                language, 0, 0 );
}

card_reader_down_audio( language )
        unsigned language;
{
        return prequest( PLAY_SHOW, AUDIO, A_CARDS_DOWN,
                                                language, 0, 0 );
}

both_readers_down_audio( language )
```

```
        unsigned language;
{
        return prequest( PLAY_SHOW, AUDIO, A_CARDS_DOWN,
                                                language, 0, 0 );
}
```

dc9/int/objects

```
audios.o
int1.o
videos.o
```

dc9/int/videos.c

```
#include "^dc9.h"

card_auth_video( language )
        unsigned language;
{
        return prequest( PLAY_SHOW, VIDEO, V_CARD_WAIT, language,
                                                0, 0 );
}

longer_card_auth_video( language )
        unsigned language;
{
        return prequest( PLAY_SHOW, VIDEO, V_LONGER_CARD_WAIT,
                                                language, 0, 0 );
}

goodbye_thanks_video( language )
        unsigned language;
```

```
{
        return  prequest( PLAY_SHOW, VIDEO, V_GOODBYE_THANK_YOU,
                                                language, 0, 0 );
}

lift_nozzle_video (language)
        unsigned language;
{
        return prequest( PLAY_SHOW, VIDEO, V_LIFT_NOZZLE,
                                                language, 0, 0 );
}

remove_card_video( language )
        unsigned language;
{
        return prequest( PLAY_SHOW, VIDEO, V_REMOVE_CARD,
                                                language, 0, 0 );
}

insert_card_video( language )
        unsigned language;
{
        return prequest( PLAY_SHOW, VIDEO, V_INSERT_CARD,
                                                language, 0, 0 );
}

insert_bill_video( language )
        unsigned language;
{
        return prequest( PLAY_SHOW, VIDEO, V_INSERT_NOTE,
                                                language, 0, 0 );
```

```
}

fill_video( language, cents, with_help )
        unsigned language, cents, with_help;
{
        return prequest( PLAY_SHOW, VIDEO, V_FILL, language, cents,
                        with_help );
}

lift_and_pay_at_kiosk_video( language )
        unsigned language;
{
        return prequest( PLAY_SHOW, VIDEO, V_PAY_KIOSK,
                                        language, 0, 0 );
}
```

events/equeue.c

```
#include "event.h"
#include <task_msgs.h>
#include <stdio.h>
#include <magic.h>

#define QUEUE_SIZE 15

char    *queue [ QUEUE_SIZE ];
unsigned put_in,
                take_out;

unsigned dave,
                request_pending;
```

```
main (argc, argv)
        int argc;
        char *argv[];
{
        request r;
        unsigned   requestor;
        initialize ( );
        for (;;)
        {
                requestor = RECEIVE_ANY(&r);
                switch ( r.opcode )
                {
                case GIVE_ME_EVENT: give_me_event (requestor, &r);
                                                        break;
                default:            event_arrived (requestor, &r);
                                                        break;
                }
        }
}

initialize ( )
{
        int i;
        char *calloc ( );
        log_eq ("start");
        for ( i = 0; i < QUEUE_SIZE; i++ )
                queue [ i ] = calloc (1, sizeof ( request ));
```

```
        put_in = take_out = 0;
        log_eq ("ready");
}


event_arrived (producer, r)
        unsigned producer;
        request *r;
{
        if ( request_pending ) /* dave is waiting for an event */
        {
                REPLY(dave, r);         /* so send it to him    */
                request_pending = 0;     /* he's not waiting now */
        }
        else
                enqueue_event (producer, r); /* save it for dave */
        REPLY(producer, r);
}


give_me_event (requestor, r)
        unsigned   requestor;
        request    *r;
{
        if ( !queue_empty() )
                /* then there is an event ready to go */
        {
                dequeue_event (r);   /* get the first event */
                REPLY(requestor, r); /* tell dave all about it */
        }
        else
```

```
        {
                request_pending = 1;
                    /* say that dave is waiting (blocked) */
                dave            = requestor; /* remember his tid */
        }
}

enqueue_event (producer, r)
        unsigned producer;
        request  *r;
{
        if ( queue_full ( ) )
                log_eq ("overflow");
        else
        {
                memcpy (queue [put_in], r, sizeof (request));
                put_in++;
                if ( put_in >= QUEUE_SIZE )
                        put_in = 0;
        }
}

dequeue_event (r)
        request *r;
{
        memcpy (r, queue [ take_out ], sizeof (request));
        take_out++;
        if ( take_out >= QUEUE_SIZE )
                take_out = 0;
```

```
}

queue_full ( )
{
        unsigned new_put_in;

        new_put_in = put_in + 1;

        if ( new_put_in >= QUEUE_SIZE )
                new_put_in = 0;

        return new_put_in == take_out;
}

queue_empty ( )
{
        return take_out == put_in;
}
```

events/equeue.map

```
 .Segment:1   0000 to 0775 (1910 bytes)
 .Segment:2   0000 to 00A5 (166 bytes)
 .Segment:3   00A6 to 0173 (206 bytes)
 .Total size is 08EA (2282) bytes
C01  0053  prologue
C01  005E  epilogue
C01  0067  stk_overflow
C01  007D  <exit>
C01  0083  $ucbeg
C01  0084  <main>
C01  00E9  <initialize>
```

```
C01  0142  <event_arrived>
C01  0189  <give_me_event>
C01  01C2  <enqueue_event>
C01  020C  <dequeue_event>
C01  0243  <queue_full>
C01  0271  <queue_empty>
C01  028B  <log_eq>
C01  02A2  <lrequest>
C01  02FA  <strncpy>
C01  0334  <strncat>
C01  036D  <strncmp>
C01  03A0  <dregister_name>
C01  0546  <find_admin>
C01  05B0  <calloc>
C01  05B6  <malloc>
C01  05BC  <realloc>
C01  05C2  <cfree>
C01  05C2  <free>
C01  05C8  <fopen>
C01  05CE  <fclose>
C01  05D4  <getc>
C01  05DA  <putc>
C01  05E0  <ungetc>
C01  05E6  <fflush>
C01  05EC  <tfprintf>
C01  05F2  <tsprintf>
C01  05F8  <fget>
C01  05FE  <fput>
C01  0604  <fiseek>
```

```
C01  060A  <rewind>
C01  0610  <forward>
C01  0616  <breakable>
C01  061C  <strcat>
C01  0622  <strcmp>
C01  0628  <strcpy>
C01  062E  <strlen>
C01  0634  <send>
C01  063A  <abort>
C01  0640  <unbreakable>
C01  0646  <vc_send_reply>
C01  064C  <vc_create>
C01  0652  <vc_create2>
C01  0658  <vc_create3>
C01  065E  <ker_vc_destroy>
C01  0664  <def_server>
C01  066A  <set_acc_flags>
C01  0670  <set_exception>
C01  0676  <escape_tty>
C01  067C  <hold>
C01  0682  <unhold>
C01  0688  <time_slice>
C01  068E  <task_info>
C01  0694  <force_ready>
C01  069A  <set_priority>
C01  06A0  <set_user>
C01  06A6  <set_slice>
C01  06AC  <modify_flags>
C01  06B2  <set_int_mask>
```

```
C01  06B8  <set_int_vec>
C01  06BE  <alloc_mem>
C01  06C4  <receive>
C01  06CA  <reply>
C01  06D0  <attach>
C01  06D6  <detach>
C01  06DC  <await>
C01  06E2  <signal>
C01  06E8  <read_msg>
C01  06EE  <write_msg>
C01  06F4  <read_port>
C01  06FA  <csignal>
C01  0700  <relay>
C01  0706  <creceive>
C01  070C  <copy>
C01  070C  <memcpy>
C01  0739  <zero>
C01  0755  <memset>
D00  0000  <User_sp>
D00  0002  <User_ss>
D00  0004  <Exc_bits>
D00  0008  <Exc_allow>
D00  000C  <Exc_pending>
D00  0010  <Exc_fp>
D00  0012  <Exc_pc>
D00  0014  <Exc_permit>
D00  0018  <Exit_status>
D00  001A  <Error_status>
D00  001C  <My_tid>
```

```
D00  001E  <Dads_tid>
D00  0020  <Break_count>
D00  0021  <My_tty>
D00  0022  stack_base
D00  0024  <Cmd_flags>
D00  0025  <My_priority>
D00  0026  <stdin>
D00  0028  <stdout>
D00  002A  <stderr>
D00  002C  <Free_list>
D00  002E  <End_of_free>
D00  0030  <File_list>
D00  0032  <_Argc>
D00  0034  stk_limit
D00  0034  <_Argv>
D00  0036  SAVE
D00  0038  TEMP
D00  0060  <Code_flags>
D00  0061  <User_num>
D00  0062  <Group_num>
D00  0063  <Team_num>
D00  0065  <My_nid>
D00  0067  <Dads_nid>
D00  0069  <My_tty_nid>
D00  006B  <My_cd_nid>
D00  006D  <Release_num>
D00  006E  <Ndp_save_area>
D00  0070  <Fstack>
D00  0072  <Call_stack_ptr>
```

```
D00  0074  <Segment_table_ptr>
D00  0076  <Check_point_sp>
D00  0078  <User_spare>
D00  007E  <Qdb_tid>
D03  00A6  <queue>
D03  00C4  <put_in>
D03  00C6  <take_out>
D03  00C8  <dave>
D03  00CA  <request_pending>
D03  00CE  <dr>
```

events/event.h

```
#include "/user/steve/dave/dave_request.h"

#define GIVE_ME_EVENT          0

#define CNT_EVENT              0x0001
#define PLAYER_STATUS          0x0002
#define SHOW_OVER              0x0004
#define SCREEN_TOUCHED         0x0008
#define TOUCH_STATUS           0x0010
#define PUMP_EVENT             0x0020
#define BULLOCH_EVENT          0x0040
#define NOTE_EVENT             0x0080
#define CARD_EVENT             0x0100
#define STACK_EVENT            0x0200
#define PRINT_EVENT            0x0400
#define POS_EVENT              0x0800
#define CONTROL_EVENT          0x1000
#define PRICE_EVENT            0x2000
```

```
#define VIDEO_SEEK_EVENT        0x4000

#define POWER_EVENT             0x8000


#define CNT_TIMEOUT             'Z'

#define EVENT_QUEUE             "/dave/equeue"

CFLAGS  = -S

equeue: equeue.o
        linkobj equeue.o c=equeue m=equeue.map l=/user/steve/dave
        sort equeue.map f=1,2 | copy >equeue.map
        copy equeue /dave/equeue

equeue.o: equeue.c
```

events/int/bulloch_event.c

```
#include "^event.h"

bulloch_event ( task, s )
        int  task;
        char *s;
{
        event ( task, BULLOCH_EVENT, s );
}
```

events/int/card_event.c

```
#include "^event.h"

card_event (task, s)
```

```
        unsigned task;
        char *s;
{
        event.(task, CARD_EVENT, s);
}
```

events/int/cfiles bulloch_event.c card_event.c cnt_event.c control_event.c equeue_id.c event.c get_event.c note_event.c player_status.c pos_event.c power_event.c price_event.c print_event.c pump_event.c show_over.c stack_event.c start_queue.c touch_event.c touch_status.c vseek_event.c events/int/cnt_event.c

```
#include "^event.h"

cnt_event (task, s)
        unsigned task;
        char *s;
{
        event (task, CNT_EVENT, s);
}
```

events/int/control_event.c

```
#include "^event.h"

control_event ( task, s )
        int  task;
        char *s;
{
        event ( task, CONTROL_EVENT, s );
}
```

events/int/equeue_id.c

```
extern unsigned equeue_id;

event_queue_id ( )
{
        return equeue_id;
}
```

events/int/event.c

```
#include "^event.h"

event (task, source, msg, _code)
        unsigned task, source;
        char *msg;
        unsigned _code;
{
        extern request dr;

        dr.value1 = nargs () > 3 ? _code : 0;
        dr.opcode = source;
        COPY_SAFELY(dr.string_data, msg);
        SEND(task, &dr);
```

events/int/get_event.c

```
#include "^event.h"

get_event (msg, status)
        char        *msg;
        unsigned *status;
{
        extern request dr;

        dr.opcode = GIVE_ME_EVENT;
        dr.string_data [ 0 ] = '\0';
        SEND(event_queue_id(), &dr);
```

```
        strncpy (msg, dr.string_data, sizeof (dr.string_data));
        *status = dr.value1;
        return dr.opcode;
}
```

events/int/makefile

```
CFLAGS  = -S +Wc,+u
SOURCES = @cfiles
OBJECTS = @objects

^^directory: $(OBJECTS)
        type all done
```

events/int/note_event.c

```
#include "^event.h"

note_event (task, s)
        unsigned task;
        char *s;
{
        event (task, NOTE_EVENT, s);
}
```

events/int/objects

```
bulloch_event.o
card_event.o
```

```
cnt_event.o
control_event.o
equeue_id.o
event.o
get_event.o
note_event.o
player_status.o
pos_event.o
power_event.o
price_event.o
print_event.o
pump_event.o
show_over.o
stack_event.o
start_queue.o
touch_event.o
touch_status.o
vseek_event.o
```

events/int/player_status.c

```
#include "^event.h"

player_status_event ( task, s )
        int  task;
        char *s;
{
        event ( task, PLAYER_STATUS, s );
}
```

events/int/pos_event.c

```
#include "^event.h"

pos_event (task, s)
        unsigned task;
        char *s;
{
        event (task, POS_EVENT, s);
}
```

events/int/power_event.c

```
#include "^event.h"

power_event( task, s )
        int task;
        char *s;
{
        event( task, POWER_EVENT, s );
}
```

events/int/price_event.c

```
#include "^event.h"

price_event( task, s )
        unsigned task;
        char *s;
{
```

```
        event( task, PRICE_EVENT, s );
}
```

events/int/print_event.c

```
#include "^event.h"

print_event (task, s)
        unsigned task;
        char *s;
{
        event (task, PRINT_EVENT, s);
}
```

events/int/pump_event.c

```
#include "^event.h"

pump_event ( task, s, code )
        int  task;
        char *s;
        int  code;
{
        event ( task, PUMP_EVENT, s, code );
}
```

events/int/show_over.c

```
#include "^event.h"
```

```
show_over_event ( task )
        int task;
{
        event ( task, SHOW_OVER, "" );
}
```

events/int/stack_event.c

```
#include "^event.h"

stack_event (task, s)
        unsigned task;
        char *s;
{
        event (task, STACK_EVENT, s);
}
```

events/int/start_queue.c

```
#include "^event.h"
#include <task_msgs.h>
#include <magic.h>

unsigned equeue_id;

start_event_queue ( )
{
        equeue_id  = create ( 0, RUN_CONCURRENT, My_priority,
                                0, 0, EVENT_QUEUE, 0 );
        return equeue_id;
}
```

events/int/touch_event.c

```
#include "^event.h"

touch_event ( task, s )
        int  task;
        char *s;
{
        event ( task, SCREEN_TOUCHED, s );
}
```

events/int/touch_status.c

```
#include "^event.h"

touch_status_event ( task, s )
        int  task;
        char *s;
{
        event (task, TOUCH_STATUS, s);
}
```

events/int/vseek_event.c

```
#include "^event.h"

video_seek_event( task )
        int task;
{
        event( task, VIDEO_SEEK_EVENT, "VIDEO SEEK COMPLETE" );
}
```

```
#include "vars.h"

#include <stdio.h>

#define PUT_ENTRY(a,b)                io_out(a,b)

#define GET_ENTRY(a)                  io_in(a)

static unsigned ared, ablue, agreen,
                                bred, bblue, bgreen;


draw_init_arrow ()
{
        read_entry (4, &ared, &ablue, &agreen);
        read_entry (8, &bred, &bblue, &bgreen);
}

draw_arrow (k, color)
        unsigned k, color;
{
        write_entry (4, 255, 255, 255);
        write_entry (8,   0,   0,   0);
}

draw_reset_arrow ()
{
        write_entry (4, ared, ablue, agreen);
        write_entry (8, bred, bblue, bgreen);
}

write_entry (i, r, g, b)
```

```
        unsigned i, r, g, b;
{
        int tempMap;

        SetM8Index(i);              /*  Select the starting index   */
        SetM8Function(11);          /*  access the input lookup table (*

        tempMap  = m8->inMap;
        VWait();                    /*  wait for vertical blanking */
        SetM8OutMap(m8->outMap); /*  select the desired map      */

        SetM8Function(8);
        PUT_ENTRY(targa->iobase+M8WRITE, r);

        SetM8Index(i);              /*  Select the starting index   */
        SetM8Function(9);
        PUT_ENTRY(targa->iobase+M8WRITE, g);

        SetM8Index(i);              /*  Select the starting index   */
        SetM8Function(10);
        PUT_ENTRY(targa->iobase+M8WRITE, b);

        SetM8InMap(tempMap);  /* restore the original input map */
}

read_entry (i, r, g, b)
        unsigned i, *r, *g, *b;
{
        int     tempMap;

        SetM8Index(i);          /*  Select the starting index   */
        SetM8Function(11);      /*  access the input lookup table (*/
```

BEST AVAILABLE COPY

```
        tempMap  = m8->inMap;

        VWait();                    /*  wait for vertical blar

        SetM8OutMap(m8->outMap);    /*  select the desired o

        SetM8Function(8);

        *r = GET_ENTRY(targa->iobase+M8READ);

        SetM8Index(i);              /*  Select the starting in

        SetM8Function(9);

        *g = GET_ENTRY(targa->iobase+M8READ);

        SetM8Index(i);              /*  Select the starting in

        SetM8Function(10);

        *b = GET_ENTRY(targa->iobase+M8READ);

        /* restore the original input map          */

        SetM8InMap(tempMap);

}
```

graph/cfiles

```
display.c
find_frame.c
arrows.c
globals.c
graph.c
draw.c
load_frame.c
memory.c
m8init.c
pump_disk.c
```

service_dave.c unpack_map.c pump_pix.c graph/display.c

```
#include "vars.h"
#include <stdio.h>

_display_frame (r)
        request *r;

        frame *f;

        if ( (f = find_frame (r ->string_data, 1)) == NULL)
        {
                tfprintf (stderr, "DF: can't find frame %s\n",
                                                r ->string_data);
                return;
        }
        if ( f ->first_chunk != NULL )
        {
                if ( f ->has_map == 1 )
                  pump_colour_maps (f->red_map, f ->green_map,
                                                f ->blue_map);
                pump_pixels (f);
        }
        else
                pump_from_disk (f);
}

pump_colour_maps (red, green, blue)
```

```
    unsigned char *red, *green, *blue;
{
    int tempMap;

    SetM8Index(0);              /*  Select the starting index   */
    SetM8Function(11);  /*  access the input lookup table (*/

    tempMap   = m8->inMap;
    VWait();                    /* wait for vertical blanking */
    SetM8OutMap(m8->outMap); /*  select the desired map      */

    SetM8Function(8);
    putmap(targa->iobase+M8WRITE,COLOUR_MAP_LENGTH, red);

    SetM8Index(0);              /*  Select the starting index   */
    SetM8Function(9);
    putmap(targa->iobase+M8WRITE,COLOUR_MAP_LENGTH, green);

    SetM8Index(0);              /*  Select the starting index   */
    SetM8Function(10);
    putmap(targa->iobase+M8WRITE,COLOUR_MAP_LENGTH, blue);

    SetM8InMap(tempMap);     /* restore the original input map */
}
```

graph/draw.c

```
#include "vars.h"
#include <stdio.h>

typedef struct {
      bitmap      *fontbits;            /* font bits      */
      unsigned        fwidth;           /* cell pixel width */
      unsigned        fheight;          /* cell pixel height */
```

```
} font;

typedef struct {
        char    value;
        int             dx;
        int             dy;
        int     offset;
} cell;

cell receipt_cells [] =
{
  'A', 6, 9, 0,         'B', 6, 9, 0,         'C', 6, 9, 0,
  'D', 6, 9, 0,         'E', 6, 9, 0,         'F', 6, 9, 0,
  'G', 6, 9, 0,         'H', 6, 9, 0,         'I', 5, 9, 0,
  'J', 6, 9, 0,         'K', 6, 9, 0,         'L', 6, 9, 0,
  'M', 7, 9, 0,         'N', 6, 9, 0,         'O', 7, 9, 0,
  'P', 6, 9, 0,         'Q', 7, 9, 0,         'R', 6, 9, 0,
  'S', 7, 9, 0,         'T', 6, 9, 0,         'U', 7, 9, 0,
  'V', 7, 9, 0,         'W', 7, 9, 0,         'X', 7, 9, 0,
  'Y', 7, 9, 0,         'Z', 7, 9, 0,         ',', 4, 9, 0,
  '.', 3, 9, 0,         '?', 7, 9, 0,         '-', 6, 9, 0,
  '@', 7, 9, 0,         '#', 7, 9, 0,         '&', 7, 9, 0,
  '1', 4, 9, 0,         '2', 6, 9, 0,         '3', 6, 9, 0,
  '4', 6, 9, 0,         '5', 6, 9, 0,         '6', 6, 9, 0,
  '7', 6, 9, 0,         '8', 6, 9, 0,         '9', 6, 9, 0,
  '0', 6, 9, 0,         '\\', 7, 9, 0,        '$', 7, 9, 0,
  '\'', 4, 9, 0,        '*', 6, 9, 0,         '/', 3, 9, 0,
  ':', 3, 9, 0,         '\0', 0, 0, 0
};
```

```
bitmap          a20a,          /* credit due windows for receipts */
                a20b,
                a21a,
                a21b,
                cash_bits,
                price_bits,
                receipt_bits,
                unleaded_bits,    /* english */
                regular_bits,
                super_bits,
                sansplmb,         /* french  */
                ordinair,
                superspl;

bitmap          e12,
                e13,
                e18,
                e19;

bitmap  insere,                   /* preset / deposit gizmos */
                cashdept,
                card,
                carte,
                fill,
                plein,
                ptrocard,
                visacard,
                mstrcard,
                kiosk,
                kiosque,
```

```
        newnos,
        topbox,
        lowbox,
        accrset;

font cash_in_font = { &cash_bits,    47, 98 };
font price_font   = { &price_bits,   17, 35 };
font acc_font     = { &newnos,       17, 22 };

draw_preset_label (language, amount)
    unsigned language, amount;
{
    bitmap *b;
    char cents [ 5 ],
            *c = cents;

    copy_bitmap (&lowbox, lowbox.x_origin, lowbox.y_origin);

    if ( amount == 0 )
    {
        b = language ? &plein : &vill;
        copy_bitmap (b, b ->x_origin, b ->y_origin);
    }
    else
    {
        tsprintf (cents, "%04d", amount);
        if ( *c != '0' )
            draw_char (*c, &acc_font, 273, 3);
        c++;
        draw_char (*c++, &acc_font, 293, 3);
```

```
            draw_char (*c++, &acc_font, 320, 3);
            draw_char (*c,   &acc_font, 339, 3);
        }
}

draw_cash_in_low (amount)
        unsigned amount;
{
        char cents [ 5 ],
                *c = cents;
        copy_bitmap (&topbox, topbox.x_origin, topbox.y_origin);
        tsprintf (cents, "%04d", amount);
        if ( *c != '0' )
                draw_char (*c, &acc_font, 273, 43);
        c++;
        draw_char (*c++, &acc_font, 293, 43);
        draw_char (*c++, &acc_font, 320, 43);
        draw_char (*c,   &acc_font, 339, 43);
}

draw_clear_prepay ()
{
        copy_bitmap (&accrset, accrset.x_origin, accrset.y_origin);
}

draw_card_type (type)
        unsigned type;
{
        bitmap *b;
```

```
        switch (type)
        {
                case 0:  b = &visacard; break;
                case 1:  b = &ptrocard; break;
                case 2:  b = &mstrcard; break;
                default: b = 0;         break;
        if (b)
                copy_bitmap (b, b ->x_origin, b ->y_origin);
}

draw_transaction_type (language, type)
        unsigned language, type;
{
        bitmap *plastic = language ? &carte   : &card,
                   *green   = language ? &insere  : &cashdept,
                   *hole    = language ? &kiosque : &kiosk;
    bitmap *btype;

        switch (type)
        {
                case 1:   btype = green;     break;
                case 2:   btype = plastic;   break;
                default:  btype = hole;      break;
        }
        copy_bitmap (btype, btype ->x_origin, btype ->y_origin);
}

draw_selected_grade (value, language)
        unsigned value, language;
```

```
{
    bitmap *b = 0;

    switch (value)
    {
    case 1:  b = language ? &ordinair : &regular_bits;     break;
    case 2:  b = language ? &sansplmb : &unleaded_bits;    break;
    case 3:  b = language ? &superspl : &super_bits;       break;
    }
    if (b != 0)
            copy_bitmap (b, b ->x_origin, b ->y_origin);
}

draw_pump_number( number )
        unsigned number;
{
        if ( number > 9 )
                number = 9;
        draw_char( number + '0', &cash_in_font,  359, 92 );
}

draw_cash_in (cents)
        unsigned cents;
{
        unsigned digit;

        cents /= 100;  /* to dollars */

        digit = cents / 10;
        if ( digit != 0 )
                draw_char (digit + '0', &cash_in_font,  41, 172);
        digit = cents % 10;
```

```
        draw_char (digit + '0', &cash_in_font, 88, 172);
}

draw_prices (regular, unleaded, super)
        unsigned regular, unleaded, super;
{
        draw_price (regular,   92, 95, 130);
        draw_price (unleaded, 259, 95, 297);
        draw_price (super,    428, 95, 467);
}

draw_price (price_in_tenths, x1, y, x2)
        unsigned price_in_tenths, x1, y, x2;
{
        char cents [ 4 ],
                *c = cents;

        tsprintf (cents, "%03d", price_in_tenths);
        draw_char (*c++, &price_font, x1, y);
        draw_char (*c++, &price_font, x1 + price_font.fwidth, y);
        draw_char (*c,   &price_font, x2, y);
}

draw_credit (credit, language)
        unsigned credit, language;
{
        bitmap   *b1      = language ? &a21a : &a20a,
                  *b2      = language ? &a21b : &a20b;
        unsigned dollars = credit / 100,
                  cents    = credit % 100;
```

```
font    *f      = &orice_font;

if ( credit != 0 )
{
        copy_bitmap (b1, b1 ->x_origin, b1 ->y_origin);
        copy_bitmap (b2, b2 ->x_origin, b2 ->y_origin);

        if ( dollars / 10 != 0 )
        draw_char (dollars / 10 + '0', f,  92, 285);
        draw_char (dollars % 10 + '0', f,  109, 285);
        draw_char (cents / 10 + '0', f, 133, 285);
        draw_char (cents % 10 + '0', f, 151, 285);
}
}

draw_cancel (credit, language)
    unsigned credit, language;
{
    bitmap   *b1     = language ? &e13 : &e12,
                     *b2     = language ? &a21b : &a20b;

    copy_bitmap (b1, b1 ->x_origin, b1 ->y_origin);
    if ( credit != 0 )
            copy_bitmap (b2, b2 ->x_origin,  b2 ->y_origin);
                                        /* go to kiosk */
}

draw_system_cancel (credit, language)
    unsigned credit, language;
{
    bitmap   *b1     = language ? &e19 : &e18,
```

```
                    *b2      = language ? &a21b : &a20b;

        copy_bitmap (b1, b1 ->x_origin, b1 ->y_origin);
        if (credit != 0 )
                copy_bitmap (b2, b2 ->x_origin, b2 ->y_origin);
                                                    /* go to kiosk */
}

draw_receipt_string (s, x, y)
        char *s;
        int  x, y;
{
        draw_string (&receipt_bits, receipt_cells, s, x, y, 7);
}

draw_receipt_centred (s, x1, x2, y)
        char *s;
        unsigned x1, x2, y;
{
        unsigned field_width = x2 - x1,
                        field_centre,
                        string_offset,
                        dpx;

 field_centre  = x1 + field_width / 2;
 string_offset = string_pixel_length (receipt_cells, s, 7) / 2;
 dpx           = field_centre - string_offset;
 draw_string (&receipt_bits, receipt_cells, s, dpx, y, 7);
}

string_pixel_length (sc, s, blank_dx)
```

```
        cell    *sc;
        char    *s;
        unsigned blank_dx;
{
        cell    *find_chars_cell (),
                        *c;
    int     pixel_length = 0;
        for ( ; *s; s++ )
        {
                if ( *s == ' ')
                        pixel_length += blank_dx;
                else
                {
                        c = find_chars_cell (sc, *s);
                        pixel_length += c->dx;
                }
        }
        return pixel_length;
}


draw_string (b, sc, s, ox, oy, blank_dx)
        bitmap  *b;
        cell    *sc;
        char    *s;
        int             ox, oy, blank_dx;
{
        cell    *find_chars_cell (),
                        *c;
```

```
        int             dpx   = ox,
                        dpy   = oy; /* initialize the drawing point */

        for ( ; *s; s++ )
        {
                if ( *s == ' ')
                        dpx += blank_dx;
                else
                {
                        c = find_chars_cell (sc, *s);
                        copy_char (b, c, dpx, dpy);
                        dpx += c ->dx;
                }
        }
}

cell *find_chars_cell (c, achar)
        cell *c;
        char achar;
{
        cell *r = c;

        for ( ; r ->value != '\0'; r++ )
                if ( r ->value == achar )
                        return r;

        return c;
}

copy_char (b, c, x, y)
        bitmap *b;
```

```
        cell    *c;
        int     x, y;
{
        unsigned offset,
                        i;

        offset = c ->offset + b ->offset;
        for ( i = 0; i < c ->dy; i++ )
        {
         movebytes (b ->segment, offset, my_ds(), work_buf, c ->dx);
         blastrow (work_buf, x, x + c ->dx - 1, y + i);
         offset += b ->row_length;
        }
}

draw_char (c, f, x, y)
        char c;
        font *f;
        int     x, y;
{
        unsigned offset,
                        i;
        bitmap  *b = f ->fontbits;

        offset = b ->offset + (( c - '0' ) * f ->fwidth);
        for ( i = 0; i < f ->fheight; i++ )
        {
                movebytes (b ->segment, offset, my_ds(),
                                work_buf, f ->fwidth);
                blastrow (work_buf, x, x + f ->fwidth - 1, y + i);
```

```
            offset += b ->row_length;
        }
}

copy_bitmap (b, x, y)
        bitmap *b;
        int  x, y;
{
        unsigned i,
                    offset = b ->offset;

        for ( i = 0; i < b ->nrows; i++ )
        {
            movebytes (b ->segment, offset, my_ds(), work_buf,
                                                b ->row_length);
            blastrow (work_buf, x, x + b ->row_length - 1, y + i);
            offset += b ->row_length;
        }
}

typedef struct {
        bitmap *amap;
        char   *file;
} bmap;

bmap bmaps [] =
{
        &cash_bits,       "depno",
        &price_bits,      "gradeno",
        &unleaded_bits,   "unlead",
        &regular_bits,    "regular",
```

```
&super_bits,      "super",
&sansplmb,        "sansplmb",
&ordinair,        "ordinair",
&superspl,        "superspl",
&a20a,            "a20a",
&a20b,            "a20b",
&a21a,            "a21a",
&a21b,            "a21b",
&receipt_bits,    "rctlettr",
&e12,             "e12",
&e13,             "e13",
&e18,                     "e18",
&e19,                     "e19",
&insere,                  "insere",
&cashdept,        "cashdept",
&card,            "card",
&carte,           "carte",
&fill,            "fill",
&plein,           "plein",
&ptrocard,        "ptrocard",
&visacard,        "visacard",
&mstrcard,        "mstrcard",
&kiosk,           "kiosk",
&kiosque,         "kiosque",
&newnos,          "newnos",
&topbox,          "topbox",
&lowbox,          "lowbox",
&accrset,         "accrset"
```

```
};

initialize_bitmaps ()
{
        bmap *b = bmaps;
        int  i;

        for ( i = 0; i < sizeof (bmaps) / sizeof (bmap); i++, b++ )
                store_bitmap (b ->amap, b ->file);

        compute_receipt_offsets ();
}
        store_bitmap (map, name)
                bitmap *map;
                char   *name;
        {
                unsigned offset,
                                skip_row   = 0,
                                chop_x     = 0,
                                skip_left  = 0,
                                skip_right = 0,
                                j,
                                i;
                FILE     *f;
                struct   hdStruct h;

                if ( GetPicHeader (name, &f, &h, work_buf) == -1 )
                        return 0;

                if ( strcmp (name, "depno") == 0 )
                {
```

```
        h.y -= 1;
        skip_row = 1;
}
else if ( strcmp (name, "gradeno") == 0 )
{
        skip_left  = 1;
        skip_right = 1;
        chop_x = 2;
        h.x -= chop_x;
        h.y -= 1;
}
else if ( strcmp (name, "rctlettr") == 0 )
{
        skip_left  = 5;
        skip_right = 2;
        skip_row   = 17;
        chop_x = 7;
        h.x  -= chop_x;
        h.y  -= 21;          /* 4 on top, 17 off bottom *
}
else if ( strcmp (name, "newnos") == 0 )
{
        skip_left = 1;       /* 1 on left */
        chop_x    = 1;
        h.x  -=   chop_x;
}
else
        ;
```

```
    allocate_bits (map, h.XOffset, h.YOffset, h.x, h.y);
    offset = map ->offset;

    for ( i = 0; i < skip_row; i++)
            fget (work_buf, h.x + chop_x, f);
    for ( i = 0; i < map ->nrows; i++, offset += h.x )
    {
      for ( j = 0; j < skip_left; j++ ) getc (f);
      fget (work_buf, h.x, f);
      movebytes (my_ds(), work_buf, map ->segment, offset, h.x);
      for ( j = 0; j < skip_right; j++) getc (f);
    }
    fclose (f);
    return 1;
}

allocate_bits (b, ox, oy, dx, dy)
      bitmap *b;
      unsigned ox, oy, dx, dy;
{
      b ->x_origin   = ox;
      b ->y_origin   = oy;
      b ->nrows      = dy;
      alloc_ram (dx * dy, &b ->segment, &b ->offset);
      b ->row_length = dx;
}

compute_receipt_offsets ()
{
      cell *r  = receipt_cells + 1,
```

```
                *p  = receipt_cells;

        int  sum = 0;

        for ( ; r ->value != '\0'; r++, p++ )

        {

                sum += p ->dx;

                r ->offset = sum;

        }

}
```

graph/find_frame.c

```
#include "vars.h"

#include <stdio.h>

static char name_buf[ 35 ];

static frame _frame;

frame *find_frame( n, search_disk )

        char *n;

        int  search_disk;

{

        frame *f;

        for ( f = first_frame( ); f; f = next_frame( f ))

                if (strcmp( n, f ->name ) == 0)

                        return f;

        /* not in RAM, maybe on disk ? */

        if ( search_disk )

                if ( access( n, 0x04/*READ*/ ) == 0 )

                {
```

```
                _frame.first_chunk = NULL;
                COPY_SAFELY( name_buf, n );
                _frame.name = name_buf;
                return &_frame;
        }

    return NULL;        }
```

graph/globals.c

```
#define GBLGEN
#include "vars.h"
```

graph/graph.c

```
#include "vars.h"
#include <stdio.h>

TARStruct  _t1, _t2;
M8Struct   _m1, _m2;

typedef struct {
        TARStruct       *tt;
        M8Struct        *mm;
} targa_board;

#define NBOARDS         2

targa_board targas [ NBOARDS ] =
{
```

```
        &_t1, &_m1,
        &_t2, &_m2
};

main (argc, argv)
        int  argc;
        char *argv[];
{
        request          r;
        unsigned    client;

        Initialize (argc, argv[1], argv[2], argv[3]);

for (;;)
{
  client = RECEIVE_ANY(&r);
  if ( select_board (r.value1) == 1)
    switch ( r.opcode )
    {
        case LOAD_FRAME:     _load_frame (&r);        break;
        case DISPLAY_FRAME:  _display_frame (&r);     break;
        case CASH_IN:        _display_cash_in (&r);   break;
        case ALL_PRICES:     _display_prices (&r);    break;
        case OPEN_SCREEN:    _open_screen (r.value1); break;
        case CREDIT:         _display_credit (&r);    break;
        case GRADE:          _display_grade (&r);     break;
        case PRESET:         _display_preset (&r);    break;
        case RAM_USAGE:      ram_usage ();            break;
        case DRAW_STRING:    _display_string (&r);    break;
        case DRAW_CENTRED:   _display_centred (&r);   break;
```

```
        case CANCEL_CREDIT: _display_cancel (&r);  break;
        case NEXT_ARROW:    _display_next_arrow(&r);  break;
        case RESET_ARROW:   _display_reset_arrow();   break;
        case INIT_ARROW:    _display_init_arrow();    break;
        case PRESET_LABEL:  _display_preset_label (&r); break;
        case TTYPE:         _display_tran_type (&r);  break;
        case CARD_TYPE:     _display_card_type (&r);  break;
        case CASH_IN_LOW:   _display_cash_in_low(&r);  break;
        case CLEAR_PREPAY:  _display_clear_prepay();  break;
        case LOAD_BITS:     _display_load_bits ();    break;
        case OPEN_SCREEN_WARM:  _open_screen_warm ();  break;
        case SYSTEM_CANCEL: _display_system_cancel(&r); break;
        case DRAW_PUMP_NO:  _display_pump_number(&r);  break;
            }
        REPLY(client, &r);
    }
}

Initialize (c, directory, mapfile, base_selector)
    int  c;
    char *directory, *mapfile, *base_selector;
{
    unsigned selector_base;

    if (c != 3 && c != 4)
    {
      tfprintf (stderr,
            "graph graphics_directory mapfile base_selector\n");
      exit (0);
    }
```

```
        selector_base = atoh(base_selector);

        if ( register_name (0, GRAPHICS_NAME, 0) )
                abort ("graphics task can't register");

        chdir (directory);
        initialize_ram ();
        frame_top = NULL;

        _t1.iobase = 0x220;
        _t1.memloc = selector_base;
        _t1.srcsel = selector_base + 8;
        _t2.iobase = 0x230;
        _t2.memloc = selector_base + 16;
        _t2.srcsel = selector_base + 24;

        load_colour_map (mapfile);
}

load_colour_map (mapfile)
        char *mapfile;
{
        FILE *f;

        if ( (f = fopen (mapfile, "r")) == NULL )
        {
                fprintf (stderr, "can't open map %s\n", mapfile);
                exit (0);
        }
        fget (work_buf, sizeof (work_buf), f);
        unpack_map (work_buf, red_map, green_map, blue_map);
        fclose (f);
```

```
}

terminate ( )
{
        unsigned junk;

        dregister_name ( 0, GRAPHICS_NAME, &junk, &junk, &junk );
        exit ( 0 );
}

select_board (n)
        int n;
{
        n--;
        if ( n < 0 || n >= NBOARDS )
        {
          tfprintf (stderr, "invalid targa %d selected\n", n + 1);
          return 0;
        }

        targa = targas [ n ].tt;
        m8    = targas [ n ].mm;
        return 1;
}
```

graph/graph.h

```
#include "/user/steve/dave/dave_request.h"

#define CHUNK_SIZE                    16384
#define M8_ROW_LENGTH          512            /* bytes/pixels */
```

```
#define FRAME_NAME_LENGTH      30

#define COLOUR_MAP_LENGTH      256          /* bytes        */

#define LOAD_FRAME             1            /* requests     */
#define DISPLAY_FRAME          2
#define OPEN_SCREEN            3
#define CASH_IN                4
#define ALL_PRICES             5
#define CREDIT                 6
#define GRADE                  7
#define PRESET                 8
#define RAM_USAGE              9
#define DRAW_STRING            10
#define DRAW_CENTRED           11
#define CANCEL_CREDIT          12
#define TTYPE                  13
#define NEXT_ARROW             14
#define RESET_ARROW            15
#define PRESET_LABEL           16
#define INIT_ARROW             17
#define CARD_TYPE              18
#define CASH_IN_LOW            19
#define CLEAR_PREPAY           20
#define LOAD_BITS              21
#define OPEN_SCREEN_WARM       22
#define SYSTEM_CANCEL          23
#define DRAW_PUMP_NO           24

#define GRAPHICS_NAME "graphics"  /* for registration */
```

```
typedef struct _chunk {
        unsigned                        segment;
        unsigned                        offset;
        unsigned                        linecount;
        struct _chunk                   *next_chunk;
} chunk;


typedef struct {
        unsigned segment;
        unsigned offset;
        unsigned row_length;
        unsigned nrows;
        unsigned x_origin;
        unsigned y_origin;
} bitmap;

typedef struct {
        int     left;
        int     bottom;
        int     right;
        int     top;
} bbox;


typedef struct _frame {
        char            *name;          /* screen name  */
        bbox            b;
        unsigned        has_map;
        char            *red_map;
        char            *green_map;
        char            *blue_map;
```

```
        chunk                *first_chunk;
        struct _frame *next_frame;
} frame;

typedef struct {
        unsigned char red,
                                green,
                                blue;
} map_entry;
```

graph/graph.map

```
 .Segment:1   0000 to 3F1B (16156 bytes)
 .Segment:2   0000 to 02FF (768 bytes)
 .Segment:3   0300 to 110C (3597 bytes)
 .Total size is 5029 (20521) bytes
C01  0053  prologue
C01  005E  epilogue
C01  0067  stk_overflow
C01  007D  <exit>
C01  0083  $ucbeg
C01  0084  <_display_frame>
C01  0106  <pump_colour_maps>
C01  01CB  <main>
C01  0364  <Initialize>
C01  0406  <load_colour_map>
C01  0470  <terminate>
C01  049E  <select_board>
C01  04FE  <draw_init_arrow>
```

```
C01  0534  <draw_arrow>
C01  056A  <draw_reset_arrow>
C01  05A0  <write_entry>
C01  0656  <read_entry>
C01  0712  <draw_preset_label>
C01  07F0  <draw_cash_in_low>
C01  084B  <draw_clear_preway>
C01  08B7  <draw_card_type>
C01  0919  <draw_transaction_type>
C01  09A3  <draw_selected_grade>
C01  0A24  <draw_pump_number>
C01  0A52  <draw_cash_in>
C01  0ACE  <draw_prices>
C01  0B17  <draw_price>
C01  0B88  <draw_credit>
C01  0CC6  <draw_cancel>
C01  0D2A  <draw_system_cancel>
C01  0D8E  <draw_receipt_string>
C01  0DB3  <draw_receipt_centred>
C01  0E14  <string_pixel_length>
C01  0E68  <draw_string>
C01  0ED0  <find_chars_cell>
C01  0F07  <copy_char>
C01  0F8C  <draw_char>
C01  1020  <copy_bitmap>
C01  109D  <initialize_bitmaps>
C01  10DE  <store_bitmap>
C01  12A2  <allocate_bits>
C01  12EF  <compute_receipt_offsets>
```

```
C01  1338  <find_frame>
C01  13B7  <_load_frame>
C01  13E9  <load_fail>
C01  1419  <loadit>
C01  15A8  <free_frame>
C01  1621  <set_colour_maps>
C01  16DC  <load_pixels>
C01  1771  <alloc_chunk>
C01  17CB  <load_lines>
C01  1845  <link_chunk>
C01  1893  <first_frame>
C01  18A2  <next_frame>
C01  18B6  <link_frame>
C01  18FF  <gfree>
C01  191A  <pump_from_disk>
C01  19AA  <initialize_ram>
C01  1A01  <alloc_ram>
C01  1AA1  <ram_remaining>
C01  1AF9  <ram_usage>
C01  1B73  <M8_Init>
C01  1EA7  <_open_screen>
C01  1EE5  <_open_screen_warm>
C01  1F0B  <_display_cash_in>
C01  1F23  <_display_pump_number>
C01  1F3B  <_display_prices>
C01  1F63  <_display_grade>
C01  1F83  <_display_preset>
C01  1F8D  <_display_credit>
C01  1FAD  <_display_cancel>
```

C01 1FCD <_display_system_cancel>

C01 1FEB <[illegible]

C01 2014 <[illegible]

C01 2043 <_display_reset_arrow>

C01 2050 <_display_next_arrow>

C01 2070 <_display_init_arrow>

C01 207D <_display_preset_label>

C01 209D <_display_tran_type>

C01 20BD <_display_card_type>

C01 20D5 <_display_cash_in_low>

C01 20ED <_display_clear_prepay>

C01 20FA <_display_load_bits>

C01 2107 <unpack_map>

C01 216B <pump_pixels>

C01 2196 <blast_frame>

C01 226B <show_frame_by_rows>

C01 22D0 <pump_chunk>

C01 2346 <full_width_frame>

C01 236F <blastrow>

C01 23C6 <movebytes>

C01 23EA <movedata>

C01 240E <my_ds>

C01 241A <GetAddress>

C01 2556 <SetDestBank>

C01 25A2 <SetGenLock>

C01 25E5 <SetSrcBank>

C01 2631 <SetOverscan>

C01 27AC <SetHBorder>

C01 27FA <SetInterlace>

```
C01  2881  <SetM8Gain>
C01  28B4  <SetM8Index>
C01  28DB  <SetM8InMap>
C01  2929  <SetM8Mux>
C01  297E  <SetM8Offset>
C01  29B1  <SetM8OutMap>
C01  29FB  <SetVBorder>
C01  2A62  <SetVCRorCamera>
C01  2B12  <SetDispReg>
C01  2B9F  <SetM8Register>
C01  2BD8  <GetPageMode>
C01  2BFB  <SetBlndReg>
C01  2C4F  <SetBorderColor>
C01  2CFA  <SetContrast>
C01  2D61  <SetHue>
C01  2DC6  <SetM8Function>
C01  2E33  <SetMask>
C01  2E89  <SetMode>
C01  2EDF  <SetRGBorCV>
C01  2F50  <SetSaturation>
C01  2FC4  <SetVertShift>
C01  3000  <VWait>
C01  3084  <GetLine>
C01  30B3  <GetPicHeader>
C01  3263  <putmap>
C01  32AB  <strncpy>
C01  32DF  <strncat>
C01  3318  <strncmp>
C01  334B  <register_name>
```

```
C01  3411  <access>
C01  354D  <get_dir_entry>
C01  358D  <set_dir_entry>
C01  362D  <fseek>
C01  370D  <ftell>
C01  3772  <dregister_name>
C01  3918  <find_admin>
C01  3982  <chdir>
C01  3982  <cd>
C01  39E8  <alloc_segment>
C01  3A26  <alloc_perm_segment>
C01  3A64  <free_segment>
C01  3AA0  <calloc>
C01  3AA6  <malloc>
C01  3AAC  <realloc>
C01  3AB2  <cfree>
C01  3AB2  <free>
C01  3AB8  <fopen>
C01  3ABE  <fclose>
C01  3AC4  <getc>
C01  3ACA  <putc>
C01  3AD0  <ungetc>
C01  3AD6  <fflush>
C01  3ADC  <tfprintf>
C01  3AE2  <tsprintf>
C01  3AE8  <fget>
C01  3AEE  <fput>
C01  3AF4  <fiseek>
C01  3AFA  <rewind>
```

```
C01  3B00  <forward>
C01  3B06  <breakable>
C01  3B0C  <strcat>
C01  3B12  <strcmp>
C01  3B18  <strcpy>
C01  3B1E  <strlen>
C01  3B24  <send>
C01  3B2A  <abort>
C01  3B30  <unbreakable>
C01  3B36  <setjmp>
C01  3B9B  <longjmp>
C01  3C09  lepilogue
C01  3C12  lmul
C01  3C[illegible]  lmodr
C01  3C6A  lmod
C01  3C70  ldivr
C01  3C79  ldiv
C01  3D32  <vc_send_reply>
C01  3D38  <vc_create>
C01  3D3E  <vc_create2>
C01  3D44  <vc_create3>
C01  3D4[illegible]  <ker_vc_destroy>
C01  3D50  <def_server>
C01  3D56  <set_acc_flags>
C01  3D5C  <set_exception>
C01  3D62  <escape_tty>
C01  3D68  <hold>
C01  3D6E  <unhold>
C01  3D74  <time_slice>
```

```
C01  3D7A  <task_info>
C01  3D80  <force_ready>
C01  3D86  <set_priority>
C01  3D8C  <set_user>
C01  3D92  <set_slice>
C01  3D98  <modify_flags>
C01  3D9E  <set_int_mask>
C01  3DA4  <set_int_vec>
C01  3DAA  <alloc_mem>
C01  3DB0  <receive>
C01  3DB6  <reply>
C01  3DBC  <attach>
C01  3DC2  <detach>
C01  3DC8  <await>
C01  3DCE  <signal>
C01  3DD4  <read_msg>
C01  3DDA  <write_msg>
C01  3DE0  <read_port>
C01  3DE6  <csignal>
C01  3DEC  <relay>
C01  3DF2  <creceive>
C01  3DF8  <io_in>
C01  3E05  <io_out>
C01  3E13  <set_extra_segment>
C01  3E13  <set_extra_seg>
C01  3E18  <copy>
C01  3E1B  <memcpy>
C01  3E48  <zero>
C01  3E64  <memset>
```

```
C01  3E85  <atoh>
D00  0000  <User_sp>
D00  0002  <User_ss>
D00  0004  <Exc_bits>
D00  0008  <Exc_allow>
D00  000C  <Exc_pending>
D00  0010  <Exc_fp>
D00  0012  <Exc_pc>
D00  0014  <Exc_permit>
D00  0018  <Exit_status>
D00  001A  <Error_status>
D00  001C  <My_tid>
D00  001E  <Dads_tid>
D00  0020  <Break_count>
D00  0021  <My_tty>
D00  0022  stack base
D00  0024  <Cmd flags>
D00  0025  <My_priority>
D00  0026  <stdin>
D00  0028  <stdout>
D00  002A  <stderr>
D00  002C  <Free_list>
D00  002E  <End_of_free>
D00  0030  <File_list>
D00  0032  <_Argc>
D00  0034  <_Argv>
D00  0034  stk_limit
D00  0036  SAVE
D00  0038  TEMP
```

```
D00  0060  <Code_flags>
D00  0061  <User_num>
D00  0062  <Group_num>
D00  0063  <Team_num>
D00  0065  <My_nid>
D00  0067  <Dads_nid>
D00  0069  <My_tty_nid>
D00  006B  <My_cd_nid>
D00  006D  <Release_num>
D00  006E  <Ndp_save_area>
D00  0070  <Fstack>
D00  0072  <Call_stack_ptr>
D00  0074  <Segment_table_ptr>
D00  0076  <Check_point_sp>
D00  0078  <User_spare>
D00  007E  <Qdb_tid>
D03  0300  <frame_top>
D03  0302  <work_buf>
D03  0602  <m8>
D03  0604  <targa>
D03  0606  <red_map>
D03  0706  <green_map>
D03  0806  <blue_map>
D03  0906  <_t1>
D03  0972  <_t2>
D03  09DE  <_m1>
D03  09F2  <_m2>
D03  0A06  <targas>
D03  0A1A  <receipt_cells>
```

D03 0B78 <a20a>

D03 0B84 <a20b>

D03 0B90 <a21a>

D03 0B9C <a21b>

D03 0BA8 <cash_bits>

D03 0BB4 <price_bits>

D03 0BC0 <receipt_bits>

D03 0BCC <unleaded_bits>

D03 0BD8 <regular_bits>

D03 0BE4 <super_bits>

D03 0BF0 <sansplmb>

D03 0C0C <ordinair>

D03 0C08 <superspl>

D03 0C14 <e12>

D03 0C20 <e13>

D03 0C2C <e18>

D03 0C38 <e19>

D03 0C44 <insere>

D03 0C50 <cashdept>

D03 0C5C <card>

D03 0C68 <carte>

D03 0C74 <fill>

D03 0C80 <plein>

D03 0C8C <ptrocard>

D03 0C98 <visacard>

D03 0CA4 <mstrcard>

D03 0CB0 <kiosk>

D03 0CBC <kiosque>

D03 0CC8 <newnos>

```
D03  0CD4  <topbox>
D03  0CE0  <lowbox>
D03  0CEC  <accrset>
D03  0CF8  <cash_in_font>
D03  0CFE  <price_font>
D03  0D04  <acc_font>
D03  0D0A  <bmaps>
D03  0DDF  <free_list>
```

graph/load_frame.c

```
#include <stdio.h>
#include "vars.h"
#include <setjmp.h>

static jmp_buf load_trap;
static frame *fr;
static FILE  *di;

#define NO_CHUNK_DESCRIPTOR   25
#define NO_SEGMENT            26

_load_frame (r)
        request *r;
{
        int code;

        if (code = setjmp(load_trap))
                load_fail (r, code);
        else
                loadit (r);
```

```
}

load_fail (r, code)
        request *r;
        int                     code;
{
        r->value1 = code;
        free_frame (fr);
        if (di != NULL)
                fclose (di);
}

loadit (r)
        request *r;
{
        long    ram_remaining (),
                ram;
        struct hdStruct th;

        ram = ram_remaining ();

        if ( find_frame (r ->string_data, 0) != NULL )
                                /* frame already in ram? */
                longjmp (load_trap, 1);

        if ((fr=(frame *)calloc(1, sizeof(frame))) == NULL)
                longjmp (load_trap, 2);

        if ( (fr ->name = (char *)calloc(1,
                        strlen(r->string_data) + 1)) == NULL)
                longjmp (load_trap, 3);
```

```
        strcpy(fr->name, r->string_data);

        if ( GetPicHeader (fr ->name, &di, &th, work_buf) == -1 )
                longjmp (load_trap, 4);
        fr ->b.left     = th.XOffset;
        fr ->b.bottom   = th.YOffset;
        fr ->b.right    = th.XOffset + th.x - 1;
        fr ->b.top      = th.YOffset + th.y - 1;
        fr ->has_map = th.mapLength > 0;

        if ( set_colour_maps (di, fr) == 0 )
                longjmp (load_trap, 5);

        load_pixels (di,fr);

        link_frame (fr);

        r ->value1 = 0;
        fclose (di);
        tfprintf (stderr, "use %ld rem %ld\n",
                        ram - ram_remaining (), ram_remaining ());
}

free_frame (f)
        frame *f;
{
        chunk *c, *t;

        gfree (f ->red_map);
        gfree (f ->green_map);
        gfree (f ->blue_map);
        gfree (f ->name);
```

```
        for ( c = f ->first_chunk; c; )
        {
                t = c ->next_chunk;
                gfree (c);
                c = t;
        }
        gfree (f);
}

set_colour_maps (file, f)       /* b g r */
        FILE  *file;
        frame *f;
{
        char     *calloc();

        if ( f ->has_map == 0 )
                return 1;

        f ->blue_map  = calloc(1, COLOUR_MAP_LENGTH);
        f ->green_map = calloc(1, COLOUR_MAP_LENGTH);
        f ->red_map   = calloc(1, COLOUR_MAP_LENGTH);

        if ( f ->blue_map == NULL || f ->green_map == NULL ||
                                        f ->red_map == NULL )
                return 0;

        fget (work_buf, 3 * COLOUR_MAP_LENGTH, file);
        unpack_map (work_buf, f ->red_map, f ->green_map,
                                                f ->blue_map);
        return 1;
```

```
}

load_pixels (file, f)
        FILE  *file;
        frame *f;
{
        chunk   *alloc_chunk(), *c;
        int             lines, lines_per_chunk, l, line_size;

        lines                   = f ->b.top - f ->b.bottom + 1;
        line_size       = f ->b.right - f ->b.left + 1;
        lines_per_chunk = CHUNK_SIZE / line_size;

        while ( lines )
        {
                l  =  lines > lines_per_chunk ? lines_per_chunk :
                                                lines;
                c = alloc_chunk (l * line_size);
                load_lines (file, l, line_size, c);
                link_chunk (f, c);
                lines -= l;
        }
        return 1;
}

chunk *alloc_chunk(nbytes)
        unsigned nbytes;
{
        chunk     *c, *calloc();
        if ( (c = calloc (1, sizeof (chunk))) == NULL)
                longjmp (load_trap, NO_CHUNK_DESCRIPTOR);
```

```
        if ( alloc_ram (CHUNK_SIZE, &c ->segment,
                                        &c ->offset) == NULL)
                longjmp (load_trap, NO_SEGMENT);

        return c;
}


load_lines (file, count, line_size, c)
        FILE  *file;
        int   count, line_size;
        chunk *c;
{
        char      *p;
        unsigned i, j;

        set_extra_segment (c ->segment);
        p = (char *)c ->offset;
        for ( i = 0; i < count; i++ )
        {
         fget (work_buf, line_size, file);   /* read a line */
         for ( j = 0; j < line_size; j++ ) /* copy it to the chunk */
                        @p++ = work_buf [ j ];
        }
        c ->linecount = count;
        }

        link_chunk (f, c)
              frame *f;
              chunk *c;
        {
```

```
        chunk *p, *cc;

        if ( (cc = f ->first_chunk) == NULL)
                f ->first_chunk = c;
        else
        {
                for ( ; cc; cc = cc ->next_chunk )
                        p = cc;
                p ->next_chunk = c;
        }
}

frame *first_frame ( )
{
        return frame_top;
}

frame *next_frame (f)
        frame *f;
{
        return f ->next_frame;
}

link_frame (f)
        frame *f;
{
        frame *p, *c;

        for (p = c = first_frame ( ); c; c = next_frame (c))
                p = c;

        if (p == NULL)
```

```
                frame_top = f;
        else
                p ->next_frame = f;
}

gfree (c)
        char *c;
{
        if (c == NULL)
                return;
        free (c);
}
#include "/user/steve/targa/tardev.h"

M8_Init(t, m)
        TARStruct *t;
        M8Struct  *m;
{
        int bottom, top;

        t->boardType      = TYPE_M8;      /* always an M8     */
        t->xOffset                = 0;
        t->yOffset                = 0;    /* default to no offset */
        t->LinesPerField = DEF_ROWS/2; /* number of lines per field
        t->AlwaysGenLock = 0;
        t->PageMode       = 0;
        t->InterlaceMode = DEF_INT;  /* Default:  Interlace Mode 0
        t->Contrast       = DEF_CONTRAST;
        t->Saturation     = DEF_SATURATION;
        t->Hue            = DEF_HUE;
```

```
t->RGBorCV          = CV;   /* default to Composite video */
t->VCRorCamera      = CAMERA;
t->PanXOrig         = 0;
t->PanYOrig         = 0;
t->PageUpper        =  0xffff; /* set the bank flags to illegal*
t->PageLower        = 0xffff; /* values so that they will be set
                                  /* the first time        */
t->ovrscnAvail      = 0;    /* Assume no Overscan option */

/*        Set defaults for the M8 TARStructure     */

m->there            = 1;
m->inOffset         = DEF_M8OFFSET;
m->inGain           = DEF_M8GAIN;
m->inMap            = DEF_M8INMAP;
m->outMap           = DEF_M8OUTMAP;
m->inputMux         = DEF_M8MUX;
m->loopThru         = 0;
m->modeRegister     = DEF_M8MODE;
m->CGAInterlace     = DEF_CGAINTERLACE;

t->ovrscnOn         = t->ovrscnAvail;
m->there                    = 1;
t->MaxBanks         = 8;
t->BytesPerPixel    = 1;

t->RowsPerBank   =  64;      /* set rows per bank          */
t->AddressShift  =  0;       /* No has zero address shift */

SetSaturation(t->Saturation);
                             /* if initializing CVA, set */
```

```
SetHue(t->Hue);                /* these befroe we quit      */

SetContrast( t->Contrast);


/*      Set Genlock bit if always unlocked      */
/*      set before flipping and jerking screen */

SetMode( (t->AlwaysGenLock<<SHF_GENLOCK) | DEF_MODE);

SetBlndReg(0);     /* disable blend mode on TARGA 32 */
        /* internal logic - SetBlndReg */
        /* makes this a no op for the 8, M8, 16, and 24 */

SetInterlace(t->InterlaceMode);      /* Set Interlace Mode */
SetFixedRegisters();       /* Set Fixed Display Registers */
SetOverscan(t->ovrscnOn);          /* Compute X border     */

top     = 140 - (t->LinesPerField>>1);
                                   /* Set Vertical Border */

bottom = top+t->LinesPerField;

/*
 ** Ensure that YOffset does not blow us out of the screen-
  *   with number of lines specified by Page Length
  */
if ( t->yOffset > 0 )
{
if ( (top -= t->yOffset) < MIN_TOP )
{
        t->yOffset = MIN_TOP-top;
        top = MIN_TOP;
}
bottom -= t->yOffset;
```

```
if ( t->yOffset < 0 )
{
        if ( (bottom -= t->yOffset) > MAX_BOTTOM )
        {
                t->yOffset = MAX_BOTTOM-bottom;
                bottom = MAX_BOTTOM;
        }
        top -= t->yOffset;
}
SetVBorder(top,bottom);

SetVCRorCamera(t->VCRorCamera);      /* set M8 vars */
SetM8Offset(m->inOffset);
SetM8Gain   (m->inGain);
SetM8InMap  (m->inMap);
SetM8OutMap(m->outMap);
SetM8Mux    (m->inputMux);

SetMask(DEF_MASK);       /* Set other Control Registers */
SetRGBorCV (t->RGBorCV );
SetVCRorCamera(t->VCRorCamera);
SetVertShift(256-t->LinesPerField);

if ( VWait() == -1)
                /* is raster register is working correctly */
        return(-1);    /* no -return error flag */
else
        return(0);            /* everything's ok      */
```

```
#define        FIXED_REGS      10
static         int FixedRegs[]=
      {DR6,DR7,DR12,DR13,DR14,DR15,DR16,DR17,DR18,DR19};
static  int FixedValue[]=
      {DEF_DR6,DEF_DR7,DEF_DR12,DEF_DR13,DEF_DR14,
       DEF_DR15,DEF_DR16,DEF_DR17,DEF_DR18,DEF_DR19};
/*
 *    SetFixedRegisters()
 *
 *    Set the registers which have required values
 */
static SetFixedRegisters()
{
      int reg;

      for ( reg=0; reg<FIXED_REGS; reg++)
              SetDispReg(FixedRegs[reg],FixedValue[reg]);
      return;
}
CFLAGS  = -S +Wc,+u
SOURCES = @cfiles
OBJECTS = @objects

graph: $(OBJECTS)
      linkobj c=graph x=objects s=2000 m=graph.map
                              l=/user/steve/dave l=/user/steve/targa
      sort graph.map f=1,2 +r
      copy graph /dave/graph

globals.o: vars.h
```

```
#include <stdio.h>

#define NUM_PIECES     96              /* 6 MB        */
#define PIECE_SIZE     4096    /* paragraphs */
#define K64                    65536L

typedef struct {
      unsigned selector;
      unsigned offset;
      long     size;
} piece;

piece free_list [ NUM_PIECES ];

initialize_ram ()
{
      piece *f = free_list;
      int   i  = NUM_PIECES;

      for ( ; i; i--, f++ )
      {
              f ->selector = alloc_segment (PIECE_SIZE);
              f ->offset = 0;
              f ->size   = K64;
      }
alloc_ram (nbytes, selector, offset)
      unsigned nbytes, *selector, *offset;
{
```

```
        piece *f = free_list;
        int    i = NUM_PIECES;

        if ( (nbytes % 2) == 1 ) nbytes++;
                                        /* word aligned. please */

        for ( ; i; i--, f++ )
                if ( f ->size >= nbytes )
                {
                        f ->size -= nbytes;
                        *selector = f ->selector;
                        *offset   = f ->offset;
                        f ->offset += nbytes;
                        return 1;
                }
        return 0;
}

long ram_remaining ()
{
        piece *f = free_list;
        long  remaining = 0L;
        int   i = NUM_PIECES;

        for ( ; i; i--, f++ )
                remaining += f ->size;

        return remaining;
}

ram_usage ()
```

```
{
        piece **f = free_list;
        int rows,
            i;
        long ram_remaining ();

        for ( rows = 0; rows < NUM_PIECES / 8; rows++ )
        {
                for ( i = 0; i < 8; i++, f++ )
              tfprintf (stderr, "%6ld ", f->size);
                tfprintf (stderr, "\n");
        }
        tfprintf (stderr, "\nrem %ld\n", ram_remaining ());
}
```

graph/objects

```
display.o
globals.o
graph.o
arrows.o
draw.o
find_frame.o
load_frame.o
pump_disk.o
memory.o
m8init.o
service_dave.o
unpack_map.o
pump_pix.o
```

```
#include "vars.h"
#include <stdio.h>
#include <task_msgs.h>
#include <magic.h>

pump_from_disk( f )
        frame *f;
{
        struct hdStruct th;
        FILE    *df;
        int     left,
                    bottom,
                    right,
                    top,
                    i;

        if ( GetPicHeader( f->name, &df, &th, work_buf ) == -1 )
                return;

        left    = th.XOffset;
        bottom  = th.YOffset;
        right   = th.XOffset + th.x - 1;
        top     = th.YOffset + th.y - 1;

        for ( i = bottom; i < top; i++ )
        {
                fgets( work_buf, th.x, df );    /* read a row
```

```
            blastrow( work_buf, left, right, i );
                                                /* display it */
        }
        fclose( df );
}
```

graph/pump_pix.c

```
#include "vars.h"
#include <stdio.h>

int pump_pixels (f)
        frame *f;
{
        if ( full_width_frame (f) )
                blast_frame (f);
        else
                show_frame_by_rows (f);
}

blast_frame (f)
        frame *f;
{
        unsigned  bank, targ_off, byteCount, rows_left, row, junk;
        chunk *c;

        c = f ->first_chunk;
        for ( row = f ->b.bottom; row <= f ->b.top; row += 32 )
        {
                rows_left = f ->b.top - row + 1;
```

```
byteCount = rows_left >= 32 ? CHUNK_SIZE :
                                    rows_left * 512;
GetAddress (&targ_off, &bank, 0, row,      -1);
SetDestBank (bank);
            GetAddress (&junk, &bank, 0, row + 64, -1);
            SetSrcBank (bank);
            movedata (c ->segment, c ->offset, DESTBANK,
                                    targ_off, byteCount >> 1);
            c = c ->next_chunk;
      }
}

show_frame_by_rows (f)
      frame *f;
{
      chunk    *c = f ->first_chunk;
      unsigned row_length = (f ->b.right - f ->b.left) + 1,
                        pump_chunk (),
                        y  = f ->b.bottom;

      for ( ; c != NULL; c = c ->next_chunk)
            y = pump_chunk (c, f ->b.left, y, row_length);
}

pump_chunk (c, x, y, row_length)
      chunk    *c;
      unsigned x, y, row_length;
{
      unsigned i,
```

```
        offset = c ->offset;

for ( i = 0; i < c->linecount; i++ )

    {
        movebytes (c ->segment, offset, my_ds(), work_buf,
                                                row_length);
        blastrow (work_buf, x, x + row_length - 1, y + i);
        offset += row_length;
    }
    return y + i;
}

full_width_frame (f)
    frame *f;
{
    return ((f ->b.right - f ->b.left) + 1) == M8_ROW_LENGTH;
}
```

graph/putentry.c

```
put map(10, count, array)
        int  io;        /* array in IO space to Write to */
        int  count      /*Number of bytes to read        */
        char *array;    /*pointer to byte array          */
    {
        int i;

        for (i=0; i(count; i++)
        io_out(io,*(array++));
    }
```

graph/service_dave.c

```
#include "vars.h"
#include <stdio.h>
```

```
static unsigned border_color = 103;

_open_screen (dave)
        unsigned dave;
{
unsigned i;
        M8_Init (targa, m8);

/*      clear_genlock_trigger (dave);
*/      SetGenLock (1);

/*      VWait ();           /* VBI */
        while (GetLine(RASTERREG) != 100)
                ;
*/
/*
        while (GetField () == 0)
                ;
        while (GetField () != 0)
                ;
        set_genlock_trigger (dave);
*/      pump_colour_maps (red_map, green_map, blue_map);
        SetBorderColor (&border_color);
}

_open_screen_warm ()
{
        pump_colour_maps (red_map, green_map, blue_map);
        SetBorderColor (&border_color);
}
```

```
_display_cash_in (r)
        request *r;
{
        draw_cash_in (r->value2);
}

_display_pump_number (r)
        request *r;
{
        draw_pump_number (r->value2);
}

_display_prices (r)
        request *r;
{
        draw_prices (r->value2, r->value3, r->value4);
}

_display_grade (r)
        request *r;
            draw_selected_grade (r->value2, r->value3);
    }

    _display_preset (r)
            request *r;
    {
    }

    _display_credit (r)
            request *r;
    {
```

```
        draw_credit (r->value2, r->value3);
}

_display_cancel (r)
        request *r;
{
        draw_cancel (r->value2, r->value3);
}

_display_system_cancel (r)
        request *r;
{
        draw_system_cancel (r->value2, r->value3);
}

_display_string (r)
        request *r;
{
        draw_receipt_string (r->string_data, r->value2, r->value3);
}

_display_centred (r)
        request *r;
{
        draw_receipt_centred (r->string_data, r->value2, r->value3,
                                                        r->value4);
}

_display_reset_arrow ()
{
        draw_reset_arrow ();
```

```
}

_display_next_arrow (r)
        request *r;
{
        draw_arrow (r->value2, r->value3);
}

_display_init_arrow ()
{
        draw_init_arrow ();
}

_display_preset_label (r)
        request *r;
        draw_preset_label (r->value2, r->value3);
}

_display_tran_type (r)
        request *r;
{
        draw_transaction_type (r->value2, r->value3);
}

_display_card_type (r)
        request *r;
{
        draw_card_type (r->value2);
}

_display_cash_in_low (r)
```

```
        request *r;
{
        draw_cash_in_low (r->value2);
}

_display_clear_prepay ()
{
        draw_clear_prepay ();
}

_display_load_bits ()
{
        initialize_bitmaps ();
```

graph/unpack_map.c

```
#include "vars.h"

unpack_map (packed, red, green, blue)
        unsigned char *packed, *red, *green, *blue;
{
        int t,
                i;

        for ( t = i = 0; i < COLOUR_MAP_LENGTH; i++)
        {
                blue  [ i ] = packed [ t++ ];
                green [ i ] = packed [ t++ ];
                red   [ i ] = packed [ t++ ];
        }
}
```

graph/vars.h

```
#include "graph.h"
#include "/user/steve/targa/tardev.h"

#ifdef SELGEN
#define VARIABLE
#else
#define VARIABLE extern
#endif

frame *first_frame (),
        *next_frame (),
        *find_frame ();

#define ROW_PIXEL_LENGTH      512

VARIABLE frame *frame_top;
VARIABLE char work_buf [ 3 * COLOUR_MAP_LENGTH ];

VARIABLE M8Struct  *m8;
VARIABLE TARStruct *targa;

VARIABLE char red_map   [ COLOUR_MAP_LENGTH ];
VARIABLE char green_map [ COLOUR_MAP_LENGTH ];
VARIABLE char blue_map  [ COLOUR_MAP_LENGTH ];
```

graph/int/graph_int.c

```
/* graphics task interface routines */

#include "^graph.h"
```

```
static unsigned          graphics_task;
extern request dr;

load_frame (name)
        char *name;
{
        COPY_SAFELY(dr.string_data, name);
        return grequest (LOAD_FRAME, 1);
}

load_bits ()
{
        return grequest (LOAD_BITS, 1);
}

graphics_ram_usage ()
{
        return grequest (RAM_USAGE, 1);
}

display_frame (screen, name)
        unsigned screen;
        char     *name;
{
        COPY_SAFELY(dr.string_data, name);
        grequest (DISPLAY_FRAME, screen);
}

open_screen (screen)
        unsigned screen;
```

```
{
        grequest (OPEN_SCREEN, screen);
}

open_screen_warm (screen)
        unsigned screen;
{
        grequest (OPEN_SCREEN_WARM, screen);
}

graphics_server_alive ()
{
        int junk,
                answer = 0;

        dregister_name (0, GRAPHICS_NAME, &junk, &answer, &junk);
        return answer;
}

display_prices (screen, regular, unleaded, super)
        unsigned screen, regular, unleaded, super;
{
        dr.value2 = regular;
        dr.value3 = unleaded;
        dr.value4 = super;
        grequest (ALL_PRICES, screen);
}

display_clear_prepay (screen)
        unsigned screen;
{
```

```
        grequest (CLEAR_PREPAY, screen);
}

display_transaction_type (screen, language, type)
        unsigned screen, language, type;
{
        dr.value2 = language;
        dr.value3 = type;
        grequest (TTYPE, screen);
}

display_cash_in (screen, cents_in)
        unsigned screen, cents_in;
{
        dr.value2 = cents_in;
        grequest (CASH_IN, screen);
}
        unsigned screen, pump_number;
{
        dr.value2 = pump_number;
        grequest (DRAW_PUMP_NO, screen);
}

display_preset_label (screen, language, amount)
        unsigned screen, language, amount;
{
        dr.value2 = language;
        dr.value3 = amount;
        grequest (PRESET_LABEL, screen);
}
```

```
display_grade (screen, grade, language)
        unsigned screen, grade, language;
{
        dr.value2 = grade;
        dr.value3 = language;
        grequest (GRADE, screen);
}

display_preset (screen, preset, language)
        unsigned screen, preset, language;
{
        dr.value2 = preset;
        dr.value3 = language;
        grequest (PRESET, screen);
}

display_card_type (screen, type)
        unsigned screen, type;
{
        dr.value2 = type;
        grequest (CARD_TYPE, screen);
}

display_cash_in_low (screen, amount)
        unsigned screen, amount;
{
        dr.value2 = amount;
        grequest (CASH_IN_LOW, screen);
}
```

```
display_user_cancel_credit (screen, credit, language)
      unsigned screen, credit, language;
{
      dr.value2 = credit;
      dr.value3 = language;
      grequest (CANCEL_CREDIT, screen);
}

display_system_cancel_credit (screen, credit, language)
      unsigned screen, credit, language;
{
      dr.value2 = credit;
      dr.value3 = language;
      grequest (SYSTEM_CANCEL, screen);
}

display_credit (screen, credit, language)
      unsigned screen, credit, language;
{
      dr.value2 = credit;
      dr.value3 = language;
      grequest (CREDIT, screen);
}

display_string (screen, string, x, y)
      unsigned screen;
      char      *string;
      unsigned x, y;
{
      dr.value2 = x;
```

```
        dr.value3 = y;
        COPY_SAFELY(dr.string_data, string);
        grequest (DRAW_STRING, screen);
}

display_string_centred (screen, string, x1, x2, y)
        unsigned screen;
        char     *string;
        unsigned x1, x2, y;
        dr.value2 = x1;
        dr.value3 = x2;
        dr.value4 = y;
        COPY_SAFELY(dr.string_data, string);
        grequest (DRAW_CENTRED, screen);
}

static grequest (opcode, screen)
        unsigned opcode, screen;
{
        unsigned                junk;

        if ( graphics_task == 0 )
                dregister_name (0, GRAPHICS_NAME, &junk,
                                        &graphics_task, &junk);

        dr.opcode = opcode;
        dr.value1 = screen;
        SEND(graphics_task, &dr);
        return dr.value1;
}
```

```
/* graphics task interface routines */

#include "~graph.h"

static unsigned          graphics_task;

extern request dr;

display_arrow (screen, arrow, color)
      unsigned screen, arrow, color;
{
      dr.value2 = arrow;
      dr.value3 = color;
      return grequest (NEXT_ARROW, screen);
}

display_reset_arrow (screen)
      unsigned screen;
{
      return grequest (RESET_ARROW, screen);
}

display_init_arrow (screen)
      unsigned screen;
{
      return grequest (INIT_ARROW, screen);
}

static grequest (opcode, screen)
      unsigned opcode, screen;
```

```
{
        unsigned                junk;

        if ( graphics_task == 0 )
                dregister_name (0, GRAPHICS_NAME, &junk,
                                        &graphics_task, &junk);

        dr.opcode = opcode;
        dr.value1 = screen;
        return SEND(graphics_task, &dr);
}
```

graph/utils/displayf.c

```
main (argc, argv)
        int argc;
        char *argv[];
{

        if (argc == 3)
          display_frame (atoi(argv[1]), argv[2]);
    else
          printf ( "display_frame screen_number frame_name\n");
}
```

graph/utils/displayf.map

```
.Segment:1    0000 to 1528 (5417 bytes)
.Segment:2    0000 to 02D8 (729 bytes)
.Segment:3    02D9 to 0380 (168 bytes)
.Total size is 18AA (6314) bytes
```

```
D00  0021  <My_tty>
D00  006B  <My_cd_nid>
C01  0A04  <sprintf>
C01  0DFA  <ungetc>
C01  038B  <strncmp>
C01  0E00  <fflush>
C01  0BBA  <dregister_name>
C01  0D60  <find_admin>
C01  0E24  <rewind>
C01  00BD  <load_frame>
C01  0FD3  <unhold>
C01  1015  <memcpy>
C01  105E  <memset>
D00  002E  <End_of_free>
C01  0E6E  lepilogue
D00  001A  <Error_status>
D00  0061  <User_num>
C01  10EF  <fround>
D00  0014  <Exc_permit>
C01  021E  <display_credit>
C01  0241  <display_bonsoir>
C01  012A  <open_screen>
C01  0E36  <strcat>
D00  0012  <Exc_pc>
C01  03BE  <printf>
C01  0118  <strncpy>
C01  1009  <set_int_vec>
D00  002A  <stderr>
```

```
D00  0010  <Exc_fp>
C01  01FB  <display_cancel_credit>
D00  0034  stk_limit
D00  0022  stack_base
D00  0067  <Dads_nid>
D03  02DB  <dr>
C01  01B5  <display_grade>
C01  0E54  <abort>
C01  0E48  <strlen>
C01  0DE2  <fopen>
D00  0078  <User_spare>
C01  0E3C  <strcmp>
C01  0E30  <breakable>
D00  0030  <File_list>
C01  016F  <display_prices>
D00  0070  <Fstack>
D00  001E  <Dads_tid>
D00  0032  <_Argc>
D00  002C  <Free_list>
D00  0018  <Exit_status>
D00  0008  <Exc_allow>
C01  0FA3  <vc_create2>
C01  0FD9  <time_slice>
C01  0FA9  <vc_create3>
D00  0069  <My_tty_nid>
D00  0065  <My_nid>
C01  005E  epilogue
C01  0102  <display_frame>
```

```
D00  0000  <User_sp>
D00  0026  <stdin>
C01  1364  <ftostr>
C01  0DD6  <realloc>
C01  0DDC  <free>
D00  0028  <stdout>
C01  0FAF  <ker_vc_destroy>
C01  0DEE  <getc>
D00  000C  <Exc_pending>
D00  0002  <User_ss>
C01  00E8  <graphics_ram_usage>
C01  0EC6  lmodr
C01  0084  <main>
C01  0E42  <strcpy>
C01  0FB5  <def_server>
D00  0072  <Call_stack_ptr>
D00  001C  <My_tid>
C01  0E12  <fget>
D00  0025  <My_priority>
D00  0060  <Code_flags>
C01  0ED5  ldivr
C01  0FCD  <hold>
D00  006E  <Ndp_save_area>
C01  01D8  <display_preset>
D00  0076  <Check_point_sp>
C01  100F  <alloc_mem>
C01  0198  <display_cash_in>
C01  0E4E  <send>
```

```
C01  0FF1  <set_user>
C01  0067  stk_overflow
C01  14A0  <extract_digit>
C01  0258  <display_string>
C01  0F9D  <vc_create>
D00  0020  <Break_count>
C01  107F  <atoi>
C01  0E06  <tfprintf>
C01  0F97  <vc_send_reply>
C01  0FEB  <set_priority>
C01  11EB  <fscale>
C01  0DCA  <calloc>
D00  0034  <_Argv>
D00  0074  <Segment_table_ptr>
D00  006D  <Release_num>
C01  0083  $ucbeg
C01  028C  <display_string_centred>
D00  0004  <Exc_bits>
C01  0FC7  <escape_tty>
C01  0ECF  lmod
C01  0053  prologue
C01  0FFD  <modify_flags>
D00  0036  SAVE
C01  0EDE  ldiv
C01  0E2A  <forward>
D00  0063  <Team_num>
D00  007E  <Qdb_tid>
C01  0141  <graphics_server_alive>
```

```
C01  0E1E  <fiseek>
C01  0DD0  <malloc>
C01  03DC  <fprintf>
C01  0FC1  <set_exception>
C01  007D  <exit>
C01  0E0C  <tsprintf>
C01  1015  <copy>
C01  0FF7  <set_slice>
D00  0038  TEMP
D00  0062  <Group_num>
C01  0DF4  <putc>
C01  0DE8  <fclose>
C01  0E5A  <unbreakable>
C01  0FDF  <task_info>
C01  0FBB  <set_acc_flags>
C01  0352  <strncat>
C01  0E18  <fput>
D00  0024  <Cmd_flags>
C01  0E77  lmul
C01  1042  <zero>
C01  0E60  pushdouble
C01  1003  <set_int_mask>
C01  0FE5  <force_ready>
C01  0DDC  <cfree>
```

graph/utils/displays.c

```
#include <stdio.h>

main (argc, argv)
        int argc;
```

```
        char *argv[];
{
        if ( argc != 5 )
          tfprintf (stderr, "displays screen string x y\n");
else
          display_string (atoi(argv[1]), argv[2],
                                    atoi(argv[3]), atoi(argv[4]));
```

graph/utils/displays.map

```
 .Segment:1   0000 to 0771 (1906 bytes)
 .Segment:2   0000 to 00B3 (180 bytes)
 .Segment:3   00B4 to 00E3 (48 bytes)
 .Total size is 0856 (2134) bytes
D00  0021  <My_tty>
D00  006B  <My_cd_nid>
C01  05B4  <ungetc>
C01  0341  <strncmp>
C01  05BA  <fflush>
C01  0374  <dregister_name>
C01  051A  <find_admin>
C01  05DE  <rewind>
C01  00ED  <load_frame>
C01  0656  <unhold>
C01  0698  <memcpy>
C01  06E1  <memset>
D00  002E  <End_of_free>
D00  001A  <Error_status>
D00  0061  <User_num>
```

```
D00  0014  <Exc_permit>
C01  022B  <display_credit>
C01  015A  <open_screen>
C01  05F0  <strcat>
D00  0012  <Exc_pc>
C01  02C8  <strncpy>
C01  068C  <set_int_vec>
D00  002A  <stderr>
D00  0010  <Exc_fp>
D00  0034  stk_limit
D00  0022  stack_base
D00  0067  <Dads_nid>
C01  01E5  <display_grade>
C01  060E  <abort>
C01  0602  <strlen>
C01  059C  <fopen>
D00  0078  <User_spare>
C01  05F6  <strcmp>
C01  05EA  <breakable>
D00  0030  <File_list>
C01  019F  <display_prices>
D00  0070  <Fstack>
D00  001E  <Dads_tid>
D00  0032  <_Argc>
D00  002C  <Free_list>
D00  0018  <Exit_status>
D00  0008  <Exc_allow>
C01  0626  <vc_create2>
```

```
C01  065C  <time_slice>
C01  062C  <vc_create3>
D00  0069  <My_ttv_nid>
D00  0065  <My_nid>
C01  005E  epilogue
C01  0132  <display_frame>
D00  0000  <User_sp>
D00  0026  <stdin>
C01  0590  <realloc>
C01  0596  <free>
D00  0028  <stdout>
C01  0632  <ker_vc_destroy>
C01  05A8  <getc>
D00  000C  <Exc_pending>
D00  0002  <User_ss>
C01  0118  <graphics_ram_usage>
C01  0084  <main>
C01  05FC  <strcpy>
C01  0638  <def_server>
D00  0072  <Call_stack_ptr>
D00  001C  <My_tid>
C01  05CC  <fget>
D00  0025  <My_priority>
D00  0060  <Code_flags>
C01  0650  <hold>
D00  006E  <Ndp_save_area>
C01  0208  <display_preset>
D00  0076  <Check_point_sp>
```

```
C01  0692  <alloc_mem>
C01  0108  <display_cash_in>
C01  0608  <send>
C01  0674  <set_user>
C01  0067  stk_overflow
C01  0248  <display_string>
C01  0620  <vc_create>
D00  0020  <Break_count>
C01  0702  <atoi>
C01  05C0  <tfprintf>
C01  061A  <vc_send_reply>
C01  066E  <set_priority>
C01  0584  <calloc>
D00  0034  <_Argv>
D00  0074  <Segment_table_ptr>
D00  006D  <Release_num>
C01  0083  $ucbeg
D00  0004  <Exc_bits>
C01  064A  <escape_tty>
C01  0053  prologue
C01  0680  <modify_flags>
D00  0036  SAVE
C01  05E4  <forward>
D00  0063  <Team_num>
D00  007E  <Qdb_tid>
C01  0171  <graphics_server_alive>
C01  05D8  <fiseek>
C01  058A  <malloc>
C01  0644  <set_exception>
```

```
C01  007D  <exit>
C01  05C6  <tsprintf>
C01  0698  <copy>
C01  067A  <set_slice>
D00  0038  TEMP
D00  0062  <Group_num>
C01  05AE  <putc>
C01  05A2  <fclose>
C01  0614  <unbreakable>
C01  0662  <task_info>
C01  063E  <set_acc_flags>
C01  0308  <strncat>
C01  05D2  <fput>
D00  0024  <Cmd_flags>
C01  06C5  <zero>
C01  0686  <set_int_mask>
C01  0668  <force_ready>
C01  0596  <cfree>
```

graph/utils/load_bits.c

```
#include <stdio.h>

main ()
{
        tfprintf (stdout, "lb: %d\n", load_bits ());
}
```

graph/utils/load_bits.map

```
.Segment:1    0000 to 07D6 (2007 bytes)
.Segment:2    0000 to 009F (160 bytes)
.Segment:3    00A0 to 0147 (168 bytes)
```

.total size is 091F (2335) bytes

```
D00  0021  <My_tty>
D00  006B  <My_cd_nid>
C01  0689  <ungetc>
C01  01FA  <display_preset_label>
C01  0416  <strncmp>
C01  068F  <fflush>
C01  0449  <dregister_name>
C01  05EF  <find_admin>
C01  06B3  <rewind>
C01  00AE  <load_frame>
C01  072B  <unhold>
C01  076D  <memcpy>
C01  07B6  <memset>
D00  002E  <End_of_free>
C01  01A3  <display_clear_prepay>
D00  001A  <Error_status>
D00  0061  <User_num>
D00  0014  <Exc_permit>
C01  0263  <display_card_type>
C01  02C0  <display_credit
C01  0135  <open_screen>
C01  06C5  <strcat>
D00  0012  <Exc_pc>
C01  03A3  <strncpy>
C01  0761  <set_int_vec>
D00  002A  <stderr>
D00  0010  <Exc_fp>
C01  029D  <display_cancel_credit>
```

```
D00  0034  stk_limit
D00  0022  stack_base
D00  0067  <Dads_nid>
D03  00A2  <dr>
C01  021D  <display_grade>
C01  06E3  <abort>
C01  06D7  <strlen>
C01  0671  <fopen>
D00  0078  <User_spare>
C01  06CB  <strcmp>
C01  06BF  <breakable>
D00  0030  <File_list>
C01  0280  <display_cash_in_low>
C01  017A  <display_prices>
D00  0070  <Fstack>
D00  001E  <Dads_tid>
D00  0032  <_Argc>
C01  01BA  <display_transaction_type>
D00  002L  <Free_list>
D00  0018  <Exit_status>
D00  0008  <Exc_allow>
C01  06FB  <vc_create2>
C01  0731  <time_slice>
C01  0701  <vc_create3>
D00  0069  <My_tty_nid>
D00  0065  <My_nid>
C01  005E  epilogue
C01  010D  <display_frame>
```

```
D00  0000  <User_sp>
D00  0026  <stdin>
C01  0665  <realloc>
C01  066B  <free>
D00  0028  <stdout>
C01  0707  <ker_vc_destroy>
C01  067D  <getc>
D00  000C  <Exc_pending>
D00  0002  <User_ss>
C01  00F3  <graphics_ram_usage>
C01  0084  <main>
C01  06D1  <strcpy>
C01  070D  <def_server>
D00  0072  <Call_stack_ptr>
D00  001C  <My_tid>
C01  06A1  <fget>
D00  0025  <My_priority>
D00  0060  <Code_flags>
C01  0725  <hold>
D00  006E  <Ndp_save_area>
C01  0240  <display_preset>
D00  0076  <Check_point_sp>
C01  0767  <alloc_mem>
C01  01DD  <display_cash_in>
C01  06DD  <send>
C01  0749  <set_user>
C01  0067  stk_overflow
C01  02E3  <display_string>
C01  06F5  <vc_create>
```

```
D00  0020  <Break_count>
C01  0695  <tfprintf>
C01  06EF  <vc_send_reply>
C01  0743  <set_priority>
C01  0659  <calloc>
D00  0034  <_Argv>
D00  0074  <Segment_table_ptr>
D00  006D  <Release_num>
C01  0083  $ucbeg
C01  0317  <display_string_centred>
D00  0004  <Exc_bits>
C01  00D9  <load_bits>
C01  071F  <escape_tty>
C01  0053  prologue
C01  0055  <modify_flags>
D00  0036  SAVE
C01  06B9  <forward>
D00  0063  <Team_num>
D00  007E  <Qdb_tid>
C01  014C  <graphics_server_alive>
C01  06A0  <fiseek>
C01  065F  <malloc>
C01  0719  <set_exception>
C01  007D  <exit>
C01  069B  <tsprintf>
C01  076D  <copy>
C01  074F  <set_slice>
D00  0038  TEMP
D00  0062  <Group_num>
```

```
C01  0683  <putc>
C01  0677  <fclose>
C01  06E9  <unbreakable>
C01  0737  <task_info>
C01  0713  <set_acc_flags>
C01  03DD  <strncat>
C01  06A7  <fput>
D00  0024  <Cmd_flags>
C01  079A  <zero>
C01  075B  <set_int_mask>
C01  073D  <force_ready>
C01  066B  <cfree
```

graph/utils/load_frame.c

```
main (argc, argv)
      int argc;
      char *argv[];
{
      printf ( "lf: %d\n", load_frame (argv [1]));
}
```

graph/utils/load_frame.map

```
.Segment:1   0000 to 14A2 (5283 bytes)
.Segment:2   0000 to 02B8 (697 bytes)
.Segment:3   02B9 to 0360 (168 bytes)
.Total size is 1804 (6148) bytes
```

| | | |
|---|---|---|
| D00 | 0021 | <My_tty> |
| D00 | 006B | <My_cd_nid> |
| C01 | 09EE | <sprintf> |
| C01 | 0DE4 | <ungetc> |
| C01 | 0375 | <strncmp> |
| C01 | 0DEA | <fflush> |
| C01 | 0BA4 | <dregister_name> |
| C01 | 0D4A | <find_admin> |
| C01 | 0E0E | <rewind> |
| C01 | 00A7 | <load_frame> |
| C01 | 0FBD | <unhold> |
| C01 | 0FFF | <memcpy> |
| C01 | 104B | <memset> |
| D00 | 002E | <End_of_free> |
| C01 | 0E5B | lepilogue |
| D00 | 001A | <Error_status> |
| D00 | 0061 | <User_num> |
| C01 | 1069 | <fround> |
| D00 | 0014 | <Exc_permit> |
| C01 | 020B | <display_credit> |
| C01 | 022B | <display_bonsoir> |
| C01 | 0114 | <open_screen> |
| C01 | 0E20 | <strcat> |
| D00 | 0012 | <Exc_pc> |
| C01 | 03A8 | <printf> |
| C01 | 0302 | <strncpy> |
| C01 | 0FF3 | <set_int_vec> |
| D00 | 002A | <stderr> |
| D00 | 0010 | <Exc_fp> |

```
C01  01E5  <display_cancel_credit>
D00  0034  stk_limit
D00  0022  stack_base
D00  0067  <Dads_nid>
D03  02BB  <dr>
C01  019F  <display_grade>
C01  0E3E  <abort>
C01  0E32  <strlen>
C01  0DCC  <fopen>
D00  0078  <User_spare>
C01  0E26  <strcmp>
C01  0E1A  <breakable>
D00  0030  <File_list>
C01  0159  <display_prices>
D00  0070  <Fstack>
D00  001E  <Dads_tid>
D00  0032  <_Argc>
D00  002C  <Free_list>
D00  0018  <Exit_status>
D00  0008  <Exc_allow>
C01  0F8D  <vc_create2>
C01  0FC3  <time_slice>
C01  0F93  <vc_create3>
D00  0069  <My_tty_nid>
D00  0063  <My_nid>
C01  005E  epilogue
C01  00EC  <display_frame>
D00  0000  <User_sp>
D00  0026  <stdin>
```

```
C01  12DE  <ftostr>
C01  0DC0  <realloc>
C01  0DC6  <free>
D00  0028  <stdout>
C01  0F99  <ker_vc_destroy>
C01  0DD8  <getc>
D00  000C  <Exc_pending>
D00  0002  <User_ss>
C01  00D2  <graphics_ram_usage>
C01  0EB0  lmodr
C01  0084  <main>
C01  0E2C  <strcpy>
C01  0F9F  <def_server>
D00  0072  <Call_stack_ptr>
D00  001C  <My_tid>
C01  0DFC  <fget>
D00  0025  <My_priority>
D00  0060  <Code_flags>
C01  0EBF  ldivr
C01  0FB7  <hold>
D00  006E  <Ndp_save_area>
C01  01C2  <display_preset>
D00  0076  <Check_point_sp>
C01  0FF9  <alloc_mem>
C01  0182  <display_cash_in>
C01  0E38  <send>
C01  0FDB  <set_user>
C01  0067  stk_overflow
C01  141A  <extract_digit>
```

```
C01  0242  <display_string>
C01  0F87  <vc_create>
D00  0020  <Break_count>
C01  0DF0  <tfprintf>
C01  0F81  <vc_send_reply>
C01  0FD5  <set_priority>
C01  1165  <fscale>
C01  0DB4  <calloc>
D00  0034  <_Argv>
D00  0074  <Segment_table_ptr>
D00  006D  <Release_num>
C01  0083  $ucbeg
C01  0276  <display_string_centred>
D00  0004  <Exc_bits>
C01  0FB1  <escape_tty>
C01  0EB9  lmod
C01  0053  prologue
C01  0FE7  <modify_flags>
D00  0036  SAVE
C01  0EC3  ldiv
C01  0E14  <forward>
D00  0063  <Team_num>
D00  007E  <Qdb_tid>
C01  012B  <graphics_server_alive>
C01  0E08  <fiseek>
C01  0DBA  <malloc>
C01  03C6  <fprintf>
C01  0FAB  <set_exception>
C01  007D  <exit>
```

```
C01  0DF6  <tsprintf>
C01  0FFF  <copy>
C01  0FE1  <set_slice>
D00  0038  TEMP
D00  0062  <Group_num>
C01  0DDE  <putc>
C01  0DD2  <fclose>
C01  0E44  <unbreakable>
C01  0FC9  <task_info>
C01  0FA5  <set_acc_flags>
C01  033C  <strncat>
C01  0E02  <fput>
D00  0024  <Cmd_flags>
C01  0E61  lmul
C01  102C  <zero>
C01  0E4A  pushdouble
C01  0FED  <set_int_mask>
C01  0FCF  <force_ready>
C01  0DC6  <cfree>
```

graph/utils/open_screen.c

```
main (argc, argv)
        int argc;
        char *argv[];
{
        open_screen (atoi(argv[1]));
}
```

graph/utils/open_screen.map

```
.Segment:1   0000 to 07A1 (1954 bytes)
.Segment:2   0000 to 0097 (152 bytes)
.Segment:3   0098 to 013F (168 bytes)
.Total size is 08E2 (2274) bytes
D00  0021  <My_tty>
D00  006B  <My_cd_nid>
C01  05E4  <ungetc>
C01  0371  <strncmp>
C01  05EA  <fflush>
C01  03A4  <dregister_name>
C01  054A  <find_admin>
C01  060E  <rewind>
C01  00A3  <load_frame>
C01  0686  <unhold>
C01  06C8  <memcpy>
C01  0711  <memset>
D00  002E  <End_of_free>
D00  001A  <Error_status>
D00  0061  <User_num>
D00  0014  <Exc_permit>
C01  0204  <display_credit>
C01  0110  <open_screen>
C01  0227  <display_bonsoir>
C01  0620  <strcat>
D00  0012  <Exc_pc>
C01  02FE  <strncpy>
```

```
C01  06BC  <set_int_vec>
D00  002A  <stderr>
D00  0010  <Exc_fp>
C01  01E1  <display_cancel_credit>
D00  0034  stk_limit
D00  0022  stack_base
D00  0067  <Dads_nid>
D03  009A  <dr>
C01  019B  <display_grade>
C01  063E  <abort>
C01  0632  <strlen>
C01  05CC  <fopen>
D00  0078  <User_spare>
C01  0626  <strcmp>
C01  061A  <breakable>
D00  0030  <File_list>
C01  0155  <display_prices>
D00  0070  <Fstack>
D00  001E  <Dads_tid>
D00  0032  <_Argc>
D00  002C  <Free_list>
D00  0018  <Exit_status>
D00  0008  <Exc_allow>
C01  0656  <vc_create2>
C01  068C  <time_slice>
C01  065C  <vc_create3>
D00  0069  <My_tty_nid>
D00  0065  <My_nid>
```

```
C01  005E  epilogue
C01  00E8  <display_frame>
D00  0000  <User_sp>
D00  0026  <stdin>
C01  05C0  <realloc>
C01  05C6  <free>
D00  0028  <stdout>
C01  0662  <ker_vc_destroy>
C01  05D8  <getc>
D00  000C  <Exc_pending>
D00  0002  <User_ss>
C01  00CE  <graphics_ram_usage>
C01  0084  <main>
C01  062C  <strcpy>
C01  0668  <def_server>
D00  0072  <Call_stack_ptr>
D00  001C  <My_tid>
C01  05FC  <fget>
D00  0025  <My_priority>
D00  0060  <Code_flags>
C01  0680  <hold>
D00  006E  <Ndp_save_area>
C01  01BE  <display_preset>
D00  0076  <Check_point_sp>
C01  06C2  <alloc_mem>
C01  017E  <display_cash_in>
C01  0638  <send>
C01  06A4  <set_user>
```

```
C01  0067  stk_overflow
C01  023E  <display_string>
C01  0650  <vc_create>
D00  0020  <Break_count>
C01  0732  <atoi>
C01  05F0  <tfprintf>
C01  064A  <vc_send_reply>
C01  069E  <set_priority>
C01  05B4  <calloc>
D00  0034  <_Argv>
D00  0074  <Segment_table_ptr>
D00  006D  <Release_num>
C01  0083  $ucbeg
C01  0272  <display_string_centred>
D00  0004  <Exc_bits>
C01  067A  <escape_tty>
C01  0053  prologue
C01  06B0  <modify_flags>
D00  0036  SAVE
C01  0614  <forward>
D00  006[illegible]  <Team_num>
D00  007[illegible]  <Qdb_[illegible]>

C01  0127  <graphics_server_alive>
C01  0608  <fiseek>
C01  05BA  <malloc>
C01  0674  <set_exception>
C01  007D  <exit>
C01  05F6  <tsprintf>
```

```
C01  06C8  <copy>
C01  06AA  <set_slice>
D00  0038  TEMP
D00  0062  <Group_num>
C01  05DE  <putc>
C01  05D2  <fclose>
C01  0644  <unbreakable>
C01  0692  <task_info>
C01  066E  <set_acc_flags>
C01  0338  <strncat>
C01  0602  <fput>
D00  0024  <Cmd_flags>
C01  06F5  <zero>
C01  06B6  <set_int_mask>
C01  0698  <force_ready>
C01  05C6  <cfree>
```

logger/logger.c

```
#include "logger.h"
#include <stdio.h>

/* log files are pre-allocated as 2048 byte objects so that */
/* system crashes do not corrupt the filesystem              */

#define BREAK_EXCEPTION              2
#define LOG_FILE_SIZE          2048

FILE  *log_file;
```

```
main (argc, argv)
        int  argc;
        char *argv[];
{
        request r;
        unsigned   task;

        initialize (argc);

        for (;;)
        {
                task = RECEIVE_ANY(&r);
                REPLY(task, &r);
                process (task, &r);

initialize (argc)
        int argc;
{
        char *timestamp();
        int  terminate ();

        if (argc == 0)
                usage ();

        if ( register_name (0, LOGGER_NAME, 0) != 0 )
                abort ("logger can't register");

        chdir (LOG_DIRECTORY);
        make_new_log_file (timestamp(1));

        exc_handler (BREAK_EXCEPTION, 0, terminate);
}
```

```
make_new_log_file (name)
        char *name;
{
        char abuf [ 256 ];
        int  i;

        zero (abuf, sizeof(abuf));
        if ( (log_file = fopen (name, "wv")) != NULL )
        {
                for ( i = 0; i < LOG_FILE_SIZE / sizeof (abuf); i++
                        fput (abuf, sizeof (abuf), log_file);
                fclose (log_file);
                log_file = fopen (name, "rwv");
        }
}

usage ()
{
        fprintf (stderr, "logger\n");
        exit (1);
}

terminate ()
{
        fclose (log_file);
        exit (0);
}

process (task, r)
```

```
unsigned    task;
request  *r;
{
switch ( r->opcode )
{
        case RELOG:             open_new_log_file ();   break;
        case STOP:              terminate ();           break;
        default:                log_it (task, r);       break;
}

open_new_log_file ()
{
      char *timestamp ();

      fclose (log_file);
      make_new_log_file (timestamp(1));
}

log_it (task, r)
      unsigned    task;
      request *r;
{
      int  len;
      char *source_name (),
               *timestamp (),
               message [ 300 ];

      len = tsprintf (message,"%s %04x %s-%s\n",
                 source_name (r->opcode), task, timestamp (0),
                                                r->string_data );
```

```
        if (this_file_full (len))
                open_new_log_file ();

        fput (message, len, log_file);
        fflush (log_file);
}

char *source_names [] = {
        "2260 ", "POS", "DAVE ", "PUMP ",
        "VIDEO", "TOUCH", "EVT Q", "BULLO", "POWER"
};

char *source_name (s)
        unsigned s;
{
        return source_names [ s ];
}

char tbuf [ 40 ];
char *mname [] = {
        "Jan", "Feb", "Mar", "Apr", "May", "Jun",
        "Jul", "Aug", "Sep", "Oct", "Nov", "Dec"
};

char *timestamp (for_filename)
        unsigned for_filename;
{
        unsigned date [ 3 ],
                        y,
                        mo,
                        d,
```

```
                    h,
                    m,
                    s;
    get_date (date);

    d  = (date[0] >> 1) & 0x3f;
    mo = ((date[0] >> 8) & 0xf) - 1;
    y  = (date[0] >> 12) + 80;

    h  = date[1] / 3600;
    m  = (date [1] % 3600) / 60;
    s  = date[1] % 60;

    if ( date [ 0 ] & 0x0001 )
            h += 12;

    if ( for_filename )
       tsprintf (tbuf, "%d%s%d_%02d%02d\0",
                                d, mname [mo], y, h, m );
    else
       tsprintf (tbuf, "%d%s%d %02d%02d%02d\0", d, mname [mo],
                                                y, h, m, s );

    return tbuf;
}

this_file_full (len)
    int len;
{
    long ftell();

    return (ftell (log_file) + len ) > LOG_FILE_SIZE;
}
```

```
#include "/user/steve/dave/dave_request.h"

#define LOGGER_TASK             "/dave/logger"
#define LOGGER_NAME             "davelog"
#define LOG_DIRECTORY "/logs"
#define T2260          0        /* message sources */
#define POS                     1
#define DAVE           2
#define PUMP           3
#define VIDEO          4
#define TOUCH          5
#define EVENT_Q                 6
#define BULLOCH                 7
#define POWER          8

#define STOP           98               /* pseudo source    */
#define RELOG          99               /* pseudo source    */

 .Segment:1   0000 to 150E (5391 bytes)
 .Segment:2   0000 to 036A (875 bytes)
 .Segment:3   036B to 03C0 (86 bytes)
 .Total size is 18D0 (6352) bytes
C01  0053  prologue
C01  005E  epilogue
C01  0067  stk_overflow
C01  007D  <exit>
```

```
C01  0083  $ucbeg
C01  0084  <main>
C01  00D2  <initialize>
C01  0133  <make_new_log_file>
C01  01A7  <usage>
C01  01C9  <terminate>
C01  01E7  <process>
C01  0227  <open_new_log_file>
C01  024C  <log_it>
C01  02B5  <source_name>
C01  02CD  <timestamp>
C01  03BC  <this_file_full>
C01  03F9  <register_name>
C01  04BF  <ftell>
C01  0524  <fprintf>
C01  0B4C  <sprintf>
C01  0D02  <chdir>
C01  0D02  <cd>
C01  0D68  <calloc>
C01  0D6E  <malloc>
C01  0D74  <realloc>
C01  0D7A  <free>
C01  0D7A  <cfree>
C01  0D80  <fopen>
C01  0D86  <fclose>
C01  0D8C  <getc>
C01  0D92  <putc>
C01  0D98  <ungetc>
```

```
C01  0D9E  <fflush>
C01  0DA4  <tfprintf>
C01  0DAA  <tsprintf>
C01  0DB0  <fget>
C01  0DB6  <fput>
C01  0DBC  <fiseek>
C01  0DC2  <rewind>
C01  0DC8  <forward>
C01  0DCE  <breakable>
C01  0DD4  <strcat>
C01  0DDA  <strcmp>
C01  0DE0  <strcpy>
C01  0DE6  <strlen>
C01  0DEC  <send>
C01  0DF2  <abort>
C01  0DF8  <unbreakable>
C01  0DFE  pushdouble
C01  0E0C  lepilogue
C01  0E15  lmul
C01  0E64  lmodr
C01  0E6D  lmod
C01  0E73  ldivr
C01  0E7C  ldiv
C01  0F35  <vc_send_reply>
C01  0F3B  <vc_create>
C01  0F41  <vc_create2>
C01  0F47  <vc_create3>
```

```
C01  0F4D  <ker_vc_destroy>
C01  0F53  <def_server>
C01  0F59  <set_acc_flags>
C01  0F5F  <set_exception>
C01  0F65  <escape_tty>
C01  0F6B  <hold>
C01  0F71  <unhold>
C01  0F77  <time_slice>
C01  0F7D  <task_info>
C01  0F83  <force_ready>
C01  0F89  <set_priority>
C01  0F8F  <set_user>
C01  0F95  <set_slice>
C01  0F9B  <modify_flags>
C01  0FA1  <set_int_mask>
C01  0FA7  <set_int_vec>
C01  0FAD  <alloc_mem>
C01  0FB3  <get_date>
C01  0FB9  <set_date>
C01  0FBF  <get_ticks>
C01  0FC5  <receive>
C01  0FCB  <reply>
C01  0FD1  <attach>
C01  0FD7  <detach>
C01  0FDD  <await>
C01  0FE3  <signal>
C01  0FE9  <read_msg>
C01  0FEF  <write_msg>
```

```
C01  0FF5  <read_port>
C01  0FFB  <csignal>
C01  1001  <relay>
C01  1007  <creceive>
C01  100D  <exc_handler>
C01  1068  <memcpy>
C01  106B  <copy>
C01  1098  <zero>
C01  10B4  <memset>
C01  10D5  <fround>
C01  11D1  <fscale>
C01  134A  <ftostr>
C01  14B6  <extract_digit>
D00  0000  <User_sp>
D00  0002  <User_ss>
D00  0004  <Exc_bits>
D00  0008  <Exc_allow>
D00  000C  <Exc_pending>
D00  0010  <Exc_fp>
D00  0012  <Exc_pc>
D00  0014  <Exc_permit>
D00  0018  <Exit_status>
D00  001A  <Error_status>
D00  001C  <My_tid>
D00  001E  <Dads_tid>
D00  0020  <Break_count>
D00  0021  <My_tty>
D00  0022  stack_base
D00  0024  <Cmd_flags>
```

```
D00  0025  <My_priority>
D00  0026  <stdin>
D00  0028  <stdout>
D00  002A  <stderr>
D00  002C  <Free_list>
D00  002E  <End_of_free>
D00  0030  <File_list>
D00  0032  <_Argc>
D00  0034  <_Argv>
D00  0034  stk_limit
D00  0036  SAVE
D00  0038  TEMP
D00  0060  <Code_flags>
D00  0061  <User_num>
D00  0062  <Group_num>
D00  0063  <Team_num>
D00  0065  <My_nid>
D00  0067  <Dads_nid>
D00  0069  <My_tty_nid>
D00  006B  <My_cd_nid>
D00  006D  <Release_num>
D00  006E  <Ndp_save_area>
D00  0070  <Fstack>
D00  0072  <Call_stack_ptr>
D00  0074  <Segment_table_ptr>
D00  0076  <Check_point_sp>
D00  0078  <User_spare>
D00  007E  <Qdb_tid>
D03  036B  <log_file>
```

```
D03  036D  <source_names>

D03  037F  <tbuf>

D03  03A7  <mname>


CFLAGS  = -S

logger: logger.o

     linkobj logger.o c=logger m=logger.map l=/user/steve/dave

      sort logger.map f=1,2 | copy >logger.map

      copy logger /dave/logger


log_2260.c

log_bulloch.c

log_dave.c

log_eq.c

log_pos.c

log_power.c

log_pump.c

log_touch.c

log_video.c

lrequest.c

relog.c

stop_log.c

#include "^logger.h"

log_2260 (m)

      char *m;

      lrequest (T2260, m);

}
```

```
#include "^logger.h"

log_bulloch (m)
        char *m;
{
        lrequest (BULLOCH, m);
}
#include "^logger.h"

log_dave (m)
        char *m;
{
        lrequest (DAVE, m);
}
#include "^logger.h"

log_eq (m)
        char *m;
{
        lrequest (EVENT_Q, m);
}
#include "^logger.h"

log_pos (m)
        char *m;
{
        lrequest (POS, m);
}
#include "^logger.h"

Log_power( m )
```

```
        char *m;
{
        lrequest( POWER, m );
}
#include "^logger.h"

log_pump (m)
        char *m;
{
        lrequest (PUMP, m);
}
#include "^logger.h"

log_touch (m)
        char *m;
{
        lrequest (TOUCH, m);
}
#include "^logger.h"

log_video (m)
        char *m;
{
        lrequest (VIDEO, m);
}
#include "^logger.h"

static unsigned logger;
extern request dr;

lrequest (s, message)
```

```
        unsigned s;
        char      *message;
{
        unsigned    junk;

        if ( logger == 0 )
        dregister_name (0, LOGGER_NAME, &junk, &logger, &junk);

        COPY_SAFELY(dr.string_data, message);
        dr.opcode = s;
        SEND(logger, &dr);
}
CFLAGS  = -S +Wc,+u
SOURCES = @cfiles
OBJECTS = @objects

^^directory: $(OBJECTS)
        type all done
log_2260.o
log_bulloch.o
log_dave.o
log_eq.o
log_pos.o
log_power.o
log_pump.o
log_touch.o
log_video.o
lrequest.o
relog.o
stop_log.o
```

```
#include "^logger.h"

relog ()
{
        lrequest (RELOG, "");
}
stop_logger ()
{
        lrequest (STOP, "");
}
main ()
{
        relog ();
}
 .Segment:1   0000 to 0542 (1347 bytes)
 .Segment:2   0000 to 008F (144 bytes)
 .Segment:3   0090 to 0137 (168 bytes)
 .Total size is 067B (1659) bytes
D00  0021  <My_tty>
D00  006B  <My_cd_nid>
C01  03F5  <ungetc>
C01  0182  <strncmp>
C01  03FB  <fflush>
C01  01B5  <dregister_name>
C01  035B  <find_admin>
C01  041F  <rewind>
C01  0497  <unhold>
C01  04D9  <memcpy>
C01  0522  <memset>
```

```
D00  002E  <End_of_free>
D00  001A  <Error_status>
D00  0061  <User_num>
D00  0014  <Exc_permit>
C01  0431  <strcat>
D00  0012  <Exc_pc>
C01  010F  <strncpy>
C01  04CD  <set_int_vec>
D00  002A  <stderr>
D00  0010  <Exc_fp>
D00  0034  stk_limit
D00  0022  stack_base
D00  0067  <Dads_nid>
D03  0092  <dr>
C01  044F  <abort>
C01  0443  <strlen>
C01  03DD  <fopen>
D00  0078  <User_spare>
C01  009F  <relog>
C01  0437  <strcmp>
C01  042B  <breakable>
D00  0030  <File_list>
D00  0070  <Fstack>
D00  001E  <Dads_tid>
D00  0032  <_Argc>
D00  002C  <Free_list>
D00  0018  <Exit_status>
D00  0008  <Exc_allow>
```

```
C01  0467  <vc_create2>
C01  049D  <time_slice>
C01  046D  <vc_create3>
D00  0069  <My_tty_nid>
D00  0065  <My_nid>
C01  005E  epilogue
D00  0000  <User_sp>
D00  0026  <stdin>
C01  03D1  <realloc>
C01  03D7  <free>
D00  0028  <stdout>
C01  0473  <ker_vc_destroy>
C01  03E9  <getc>
D00  000C  <Exc_pending>
D00  0002  <User_ss>
C01  0084  <main>
C01  043D  <strcpy>
C01  0479  <def_server>
D00  0072  <Call_stack_ptr>
D00  001C  <My_tid>
C01  040D  <fget>
D00  0025  <My_priority>
D00  0060  <Code_flags>
C01  0491  <hold>
D00  006E  <Ndp_save_area>
D00  0076  <Check_point_sp>
C01  04D3  <alloc_mem>
C01  0449  <send>
```

```
C01  04B5  <set_user>
C01  0067  stk_overflow
C01  0461  <vc_create>
D00  0020  <Break_count>
C01  0401  <tfprintf>
C01  045B  <vc_send_reply>
C01  04AF  <set_priority>
C01  03C5  <calloc>
D00  0034  <_Argv>
D00  0074  <Segment_table_ptr>
D00  006D  <Release_num>
C01  0083  $ucbeg
D00  0004  <Exc_bits>
C01  048B  <escape_tty>
C01  0053  prologue
C01  04C1  <modify_flags>
D00  0036  SAVE
C01  00B7  <lrequest>
C01  0425  <forward>
D00  0063  <Team_num>
D00  007E  <Qdb_tid>
C01  0419  <fiseek>
C01  03CB  <malloc>
C01  0485  <set_exception>
C01  007D  <exit>
C01  0407  <tsprintf>
C01  04D9  <copy>
C01  04BB  <set_slice>
```

```
D00  0038  TEMP
D00  0062  <Group_num>
C01  03EF  <putc>
C01  03C3  <fclose>
C01  0455  <unbreakable>
C01  04A3  <task_info>
C01  047F  <set_acc_flags>
C01  0149  <strncat>
C01  0413  <fput>
D00  0024  <Cmd_flags>
C01  0506  <zero>
C01  04C7  <set_int_mask>
C01  04A9  <force_ready>
C01  03D7  <cfree>
#include <dev.h>

Address_of ( device )
      FILE *device;
{
      struct dev_entry dentry;

      get_attr( device, &dentry );
      return dentry.tty_ioport;
}
/*
 * PutRow: Load a pixel array  into the specified x positions
 *                                  in the specified row.
 *
 *    usage:  Targa 8 and M8:
 *                    PutRow(color,x1,x2,y,screen);
```

```
 *            char  color[];          Pointer to pixel array
 *            int x1, x2;          Starting and ending columns
 *            int  y;                 Row coordinates
 *            int screen;             Active Screen  (see
                                                     note below)
 *
 */
#include "/user/steve/targa/tardev.h"

extern TARStruct *targa;

blastrow (color, x1, x2, y)
      char    *color;
      unsigned x1, x2, y;
{
      int  bank,
               offset;

      GetAddress(&offset, &bank, x1, y, -1);
      SetDestBank(bank);
   set_extra_segment (DESTBANK)
   movebytes (my_ds(), color, DESTBANK, offset, x2 - x1 + 1);
}
/*(c) 1985, Phoenix Computer Products Corp. and Novum Organum,
  Inc. */
/*
A date/time stamp is the number of seconds before (if negative)
or after (if positive) January 1, 1980 at 12:00:00 midnight.

Midnight belongs to the new day.
```

calerr() is set after a call to caljoin(). It returns:

| error code | variable in error | valid range |
|---|---|---|
| 0 | no error | n.a. |
| 1 | error in year | year < 100 or 1920 <= year <= 2019 |
| 2 | error in month | 1 <= month <= 12 |
| 3 | error in day | 1 <= day <= # in mo. |
| 4 | error in hour | 0 <= hour <= 23 |
| 5 | error in minute | 0 <= minute <= 59 |
| 6 | error in second | 0 <= second <= 59 |

Pyr in calsplit() is set to the year with century. Yr in caljoin() takes either the year with century (in which case calerr() can indicate a year-type error) or just the last two digits (in which case the century is implied, and there can be no year-type error).

calfmttxt() takes a type code for which set of names to replace:

| type | # of names | what gets reset |
|---|---|---|
| 0 | n.a. | reset all to original Building Blocks names |
| 1 | 12 | set month names |
| 2 | 7 | set day names |
| 3 | 4 | set day-part names |

The original names are:

| | |
|---|---|
| months | January, February, March, April, May, June, . . . |
| days | Sunday, Monday, Tuesday, Wednesday, Thursday, . . . |
| day-part | Midnight, AM, Noon, PM |

calfmt() formats a string from a control string similarly to strfmt().

There are a special set of conversion specifications:

numeric conversions:

| | | |
|---|---|---|
| %C | century and year | (4 digit year) |
| %Y | year | (2 digit year) |
| %O | month | |
| %D | day | |
| %T | hour | (24 hour clock) |
| %H | hour | (12 hour clock) |
| %I | minute | |
| %S | second | |

string conversions:

| | |
|---|---|
| %M | month name as text |
| %W | weekday as text |
| %P | part of day (AM, PM, etc.) as text |

The usual strfmt options for %d and %s work here for numerics and strings, too. For example, "%02D" will produce a two-digit zero filled number for the day, "%-4.3W" will produce the first 3 characters of the weekday left-adjusted in a 4 character field. Lower case conversion specifiers are OK.

Some popular date formats:

| | |
|---|---|
| 02 Jun 1985 | "%02D %.3M %C" |
| January 3, 1985 | "%M %D, %C" |
| Friday, January 5 | "%W, %M %D" |
| 12/05/85 | "%02O/%02D/%02Y" |

```
Some popular time formats:

      23:12:02                    "%02T:%02I:%02S"

      9:46A                       "%H:%02I%.1P"

      02:42 PM                    "%02H:%02I %P"

Related calls fetch and set a DOS file's date/time stamp:
Flsetcal() and Flgetcal(), which see.

*/

#include "pdefs.h"
/*
#include "psvs.h"
*/

#define DAY_SECS        (24L*60L*60L)
#define FOURYRSECS  ( (4L*365L + 1L) * DAY_SECS )

#define BASEYR       1970
                /* calnow() is 0 on 1/1/1970 at midnight */
#define WDBASEYR        4
                /* day of week, Jan. 1, BASEYR           */
#define MAXYRS         68
                /* # of whole years in 2**31 seconds     */

#define NLEAPS(ryr)
     (    ( ((ryr)+BASEYR-1)>>2 ) - ( (BASEYR-1)>>2 )    )

static          int _calerr, _csecs;
static  int _tzoff = 5*60;
     /* number of minutes behind Greenwich for EST */
```

```
int    calerr()
{
       return( _calerr );
}


long   caljoin( yr, mth, day, hr, mi, sc )
       int     yr, mth, day, hr, mi, sc;
{
       long    cal;
    int     ryr;
      int     _mth_tab();

/* ERROR CHECKING */
     if      ( yr >= (BASEYR-MAXYRS) && yr < (BASEYR+MAXYRS) )
              ryr = yr - BASEYR;       /* 1902 - 2038          */
      else
  if ( yr >= (BASEYR%100-MAXYRS) && yr < (BASEYR%100+MAXYRS) )
              ryr = yr - (BASEYR%100);
                              /* 02 - 138 is 1902 - 2038 */
      else
      if ( yr >= 0 && yr < (BASEYR%100-MAXYRS) )
              ryr = yr + 100 - (BASEYR%100);
                              /* 00 - 01 is 2000 - 2001 */
      else
              {
              _calerr = CE_YR;
              ryr = 0;
              yr  = BASEYR;
              goto endoferrchk;
```

```
        }

if      ( mth < 1 || mth > 12 )
        _calerr = CE_MTH;
else
if      ( day < 1 || day > calmthlen(mth,yr) )
        calerr = CE_DAY;
      else
      if      ( hr  < 1 || hr  > 23 )
              _calerr = CE_HR;
      else
      if      ( mi  < 1 || mi  > 59 )
              _calerr = CE_MIN;
      else
      if      ( sc  < 1 || sc  > 59 )
              _calerr = CE_SEC;
      else
              _calerr = NOERR;

endoferrchk:

/* CONVERSION */
                                        /* from 1/1/BASEYR  */
    cal = 365L*(long)ryr + NLEAPS(ryr)  /* days to  1/  1/yr */
        + (long)_mth_tab(mth,yr)        /* days to  mth/  1/yr */
         + (long)day - 1L;              /* days to  mth/day/yr */
    cal  =  24L*cal + (long)hr;
                        /* hours to mth/day/yr hr:00:00 */
    cal  =  60L*cal + (long)mi
                        /* min's to mth/day/yr hr:mi:00 */
```

```
    + (long)_tzoff;
                    /* min's to mth/day/yr hr:mi:00 GMT */
cal =  60L*cal + (long)sc;
                    /* sec's to mth/day/yr hr:mi:sc GMT */
    return ( cal );
}
calmthlen(mth,yr)
      int      mth,yr;
{
    return ( _mth_tab(mth+1,yr) - _mth_tab(mth,yr) );
}


long  calnow( )
{
      long     caljoin();
      unsigned date[ 2 ];

      int      yr, mth, day, hr, mi, sc;

      get_date( date );
      day = (date[0] >> 1) & 0x3f;
      mth = ((date[0] >> 8) & 0xf);
      yr  = (date[0] >> 12) + 1980;

      hr  = date[1] / 3600;
      mi  = (date [1] % 3600) / 60;
      sc  = date[1] % 60;

      if ( date [ 0 ] & 0x0001 )
              hr += 12;
      _csecs  = 0;
```

```
        return  ( caljoin( yr, mth, day, hr, mi, sc ) );
}


calnwork( beg_cal, end_cal )
        long    beg_cal, end_cal;
{
        int     ndays, nweeks, wkday1, incpt;

        ndays = (int)((end_cal - beg_cal) / DAY_SECS);
        nweeks = (ndays / 7);           /* whole work weeks */

        /* take care of scraps */
        ndays %= 7;
        wkday1 = calwkday ( beg_cal );
        if      (!wkday1)
                {
                if      (ndays > 0)
                        ndays--;
                else if (ndays < 0)
                        ndays++;
                }
        else
                {
                incpt = ndays + wkday1;
                if      (incpt <  0)
                        ndays+=2;
                else if (incpt == 0)
```

```
                ndays++;
            else if (incpt == 7)
                ndays--;

            else if (incpt >  7)
                ndays+=2;
        }
        return  ( 5 * nweeks + ndays );
}


calsplit( cal, pyr, pmth, pday, phr, pmi, psc )
        long    cal;
        int     *pyr, *pmth, *pday, *phr, *pmi, *psc;
{
        int     _mth_tab();
        int     yr, mth, day;

        cal -= (long)_tzoff * 60L;  /* fix stamp to local time */

/* take care of 4 year periods and insure that cal is positive */

    yr   = BASEYR + 4 * (cal/FOURYRSECS);
    cal %= FOURYRSECS;
    if  ( cal < 0 )
        {
        cal += FOURYRSECS;
        yr  -= 4;
        }
```

```
/* take care of time part */

    if  ( psc )
        *psc = cal % 60L;
    cal /= 60L;

    if  ( pmi )
        *pmi = cal % 60L;
    cal /= 60L;

    if  ( phr )
        *phr = cal % 24L;
    cal /= 24L;

/* take care of date part--cal now has # days since 1/1/BASEYR */

    day = (int)cal;

    while ( day >= _mth_tab(13,yr) )
                        /* month 13 is Jan of next year */
        day -= _mth_tab(13,yr++);

    if  ( pyr )
        *pyr = yr;

    for ( mth = 1; day >= _mth_tab(mth+1,yr); mth++ )
        ;

    if  ( pmth )
        *pmth = mth;

day -= _mth_tab(mth,yr);

if  ( pday )
    *pday = (int)(day+1);
```

```
}


calwkday        ( cal )
        long    cal;
{
        int     wkday;
        wkday = (int) ( cal/DAY_SECS + WDBASEYR ) % 7;
        if      (wkday < 0)
                wkday += 7;
        return  ( wkday );
}


caltimezone( zone )
    int zone;
{
    int oldtz;

    oldtz = _tzoff;
    _tzoff = zone;
    return( oldtz );
}
_calcsecs()
{
        return(_csecs);
}


static          _mth_tab( mth, yr )
```

```
        int     mth, yr;
{
static int _ml[] =
        {0,31,59,90,120,151,181,212,243,273,304,334,365};
        int     ml;
        ml = _ml[mth-1];
        if      ( (mth > 3) && !(yr & 3) )
                ml++;
        return  ( ml );
}
address.c
blastrow.c
cal.c
daves_name.c
disallow.c
dr.c
fatou.c
movebytes.c
movedata.c
my_ds.c
my_open.c
print_ctrl.c
static char *name = "daveapp ";

char *daves_name ( n )
        int n;
{
        name [ 7 ] = n + '0';
        return name;
```

```
#include <magic.h>

#define COM             0x0010
#define MODEM_HANGUP    0x0001
#define BREAK                   0x0002

disallow ()
{
        unsigned bit_mask;

        bit_mask = COM | BREAK | MODEM_HANGUP;
        Exc_permit [ 0 ] |= bit_mask;   /* permit these  */
        Exc_allow  [ 0 ] = 0;           /* but don't allow them */
        unbreakable ();
}
 #include "/user/steve/dave/dave_request.h"

 request dr;
fatou (b, l)
        char *b;
        int  l;
{
        long fatol ();

        return (int)fatol (b, l);
}

long fatol (b, l)
        char *b;
        int  l;
{
        long atol();
```

```
        char bb [ 15 ];

        memcpy (bb, b, l);

        bb [ l ] = '\0';

        return atol(bb);

}
CFLAGS  = -S +Wc,+u

SOURCES = @cfiles

OBJECTS = @objects

^directory: $(OBJECTS)

        type all done

mov&ytes (sseg, soff, dseg, doff, bytecount)

     unsigned sseg, soff, dseg, doff, bytecount;

{

        m ( "pushf" );          /* save the flags                  */

        ᵃ ( "cld" );            /* set the increment flag          */

        a( "mov bx,ds" );       /* save DS                         */

        as. "push bx" );        /* save DS                         */

        asm "push es" );        /* save ES                         */

        asm "mov ds,14[bp]" );  /* make DS the source segment */

        asm nov si,16[bp]");    /* make SI the source offset  */

        asm (ov es,18[bp]" );   /* make ES the destination segment */

        asm (v di,20[bp]" );    /* destination offset              */

        asm (   cx,22[bp]" );   /* word count                      */

        asm (   movsb" );

        asm ( "p s" );          /* restore my ES                   */

        asm ( "p " );           /* restore my DS                   */

        asm ( "po );            /* restore the flags               */

}
```

```
movedata (sseg, soff, dseg, doff, count)
      unsigned sseg, soff, dseg, doff, count;
{
      asm ( "pushf" );          /* save the flaos              */
      asm ( "cld" );            /* set the increment flag      */
      asm ( "mov bx,ds" );      /* save DS                     */
      asm ( "push bx" );        /* save DS                     */
      asm ( "push es" );        /* save ES                     */
      asm ( "mov ds,14[bp]");   /* make DS the source segment */
      asm ( "mov si,16[bp]");   /* make SI the source offset  */
      asm ( "mov es,18[bp]" );  /* make ES the destination segment*/
      asm ( "mov di,20[bp]" );  /* destination offset          */

      asm ( "mov cx,22[bp]" );  /* word count                  */
      asm ( "rep movsw" );
      asm ( "pop es" );         /* restore my ES               */
      asm ( "pop ds" );         /* restore my DS               */
      asm ( "popf" );           /* restore the flags           */

my_ds ()
{
       asm ( "mov ax, ds" );
}
#include <stdio.h>
#include <setjmp.h>

FILE *my_open (name, mode, jb, jc)
       char     *name, *mode;
       jmp_buf jb;
       int      jc;
{
```

```
        FILE *f;

        if ( (f = fopen (name, mode)) == NULL )
                longjmp (jb, jc);

        jc += 1;
        return f;
}
address.o
blastrow.o
cal.o
daves_name.o
disallow.o
dr.o
fatou.o
movebytes.o
movedata.o
my_ds.o
my_open.o
print_ctrl.o
```

misc/pdefs.h

```
/*    pfdefs.h                                  */

typedef         unsigned ushort;
typedef         unsigned uint;
typedef int     (*PFI)();/* pointer to function returning int */
typedef         char     *HDL;  /* abstract data type handle */
typedef         long     RHDL;  /* database record handle */
```

```
/*    Some useful macros                    */

/**   General defines used almost everywhere  **/

#define ABS(x)          ((x)<0?-(x):(x))

#define BELL            7

#define BKSP            8

#define BLNK            ' '

#define CPMEOF          0x1A

                       /* <ctl-z> byte for eof in text files*/

#define CRET            '\r'

#define DELCH           0xff

#define DIV2(x)         (((unsigned)(x))>>1)

#define EOS             '\0'

#define EQ                0

#define ESC             27

#define FAST            register

#define FNAMSIZ         81

#define FOREVER         for (;;)

#define FULLBYTE          ~0

#define GT                1

#define HIBYTE(a)       (((unsigned)(a)) >> 8)

#define INRANGE(a,b,c)      (((b)<(a))?(a):(((b)<(c))?(b):(c)))

#define ISALPHA(c)

      ((('a'<=(c))&&((c)<='z')) || (('A'<=(c))&&((c)<='Z')))

#define ISDIGIT(d)      (('0'<=(d))&&((d)<='9'))

#define ISODD(a)        ((a)&0x01)

#define LNFEED            '\n'

#define LOBYTE(a)       ((a)&0xff)

#define LT                (-1)
```

```
#define MAKEWORD(hi,lo) (TOHIBYTE(hi) | LOBYTE(lo))

#define MAX(a,b)        (((a)>(b))?(a):(b))

#define MIN(a,b)        (((a)<=(b))?(a):(b))

#define NO              0

#define NOERR           0

#define NOTFND          (-1)

/*    NULL's for various types of objects     */

#define NULLPTR         ((char *)0)

                          /* use to pass null pointer to funcs*/

#define NULLHDL         ((HDL)0)

#define NULLVAL         ((short)0)

#define NULLPFI         ((PFI)0)

#define NULLLONG        ((long)0)

#define NULLRHDL        ((RHDL)0)

#define TAB               '\t'

#define TIMES2(x)       ((x)<<1)

#define TOHIBYTE(a)     ((a)<<8)

#define TOLOBYTE(a)     (((a)>>8)&0xff)

#define TOLOWER(c)

      (((('A' <= c) && (c <= 'Z')) ? ((c)+('a'-'A')):(c))

#define TOUPPER(c)

      (((('a' <= c) && (c <= 'z')) ? ((c)-('a'-'A')):(c))

#define       YES               1

char  *sypushjmp();

#define SYSETJMP        if (setjmp(sypushjmp())==0) {

#define EXCEPTIONS      sypopjmp();}

#define WHEN(errnum)    else if (syerr()==(errnum))
```

```
#define SYENDJMP        else sylongjmp(syerr());
#define ALLOTHERS       syerr()

typedef struct
    {
    ushort attr;
        /* attributes of file : system, hidden, directory etc.*/
    long    dttm;/* creation date and time of file */
    long    size;/* size of file in bytes */
    char    name[14];/* name of file (or directory) */
        }
FILEINFO;

/*    register values to use with various calls */
#define         REGIS   struct _REGIS

REGIS           {
        uint    ax,bx,cx,dx,di,si,es,ds,bp;
        };

/*    Seek mode parameters for B-tree Keys              */

/*    bkypos()          - position to new current key   */

#define BK_FSTDUP       -2 /* Seek first duplicate KEY value */
#define BK_FST          -1      /* Seek first key in tree. */
#define BK_LST          1       /* Seek last key in tree.  */
#define BK_LSTDUP        2 /* Seek last  duplicate  KEY value. */

/* bkyscan() - get current, next or previous key.     */

#define BK_PRV          -1      /* Retrieve previous key.*/
```

```
#define BK_CUR          0       /* Retrieve current key.*/
#define BK_NXT          1       /* Retrieve next key    */

/* bkysrch()  -  search for a  key.  */

#define BK_LT          -2       /* Seek key < KEY       */
#define BK_LE          -1       /* Seek key <= KEY      */
#define BK_EQ           0       /* Seek key == KEY      */
#define BK_GE           1       /* Seek key >= KEY      */
#define BK_GT           2       /* Seek key > KEY       */

/*    Calendar Period types.                            */

#define        CAL_DAYS        0
#define        CAL_WKDAYS      1
#define        CAL_WKS         2
#define        CAL_MTHS        3
#define        CAL_QTRS        4
#define        CAL_YRS         5

/*    Calendar error indicators.                        */

#define CE_YR           1
#define CE_MTH          2
#define CE_DAY          3
#define CE_HR           4
#define CE_MIN          5
#define CE_SEC          6

/*    CM - communications values                        */

#define        CM_110BAUD      0x00
```

```
#define        CM_150BAUD       0x20
#define        CM_300BAUD       0x40
#define        CM_600BAUD       0x60
#define        CM_1200BAUD      0x80
#define        CM_2400BAUD      0xa0
#define        CM_4800BAUD      0xc0
#define        CM_9600BAUD      0xe0

#define        CM_7BITS         0x02
#define        CM_8BITS         0x03
#define        CM_NOPRTY        0x00
#define        CM_ODDPRTY       0x08
#define        CM_EVENPRTY      0x18

#define        CM_1STOP         0x00
#define        CM_2STOP         0x04

/*    types for shape of cursor.       */

#define        CSR_HIDDEN 0        /* no cursor.    */
#define        CSR_THIN   1        /* one scan line cursor. */
#define        CSR_NORMAL 2 /* two scan line cursor (standard)*/
#define        CSR_FAT    3        /* four lines.   */
#define        CSR_BLOCK  4        /* Block cursor. */
#define        CSR_DASH   5 /* Dash in middle of character.*/
/*    Use the current (logged-in) drive        */

#define DR_CUR_DRV    0

/* Data type codes for search functions and B-trees.  */
```

```
#define DT_STR          1
#define DT_USHORT       2
#define DT_LONG         3
#define DT_BYTES        4
#define DT_SHORT        6
#define DT_ULONG        7

/*    DOS     file attributes.          */

#define FA_ORDINARY     0x00              /* regular file.      */
#define FA_RDONLY       0x01              /* Read only attribute  */
#define FA_HIDDEN       0x02              /* Hidden file */
#define FA_SYS          0x04              /* System file */
#define FA_LABEL        0x08              /* Volume label */
#define FA_DIR          0x10              /* Directory */
#define FA_ARCH         0x20              /* Archive */

/*    Field attributes.          */
#define        FLD_NORMAL       0
#define        FLD_AUTORET      0x0001
#define        FLD_NOREDSP      0x0002
#define        FLD_HIDE         0x0004
#define        FLD_LFRET        0x0008
#define        FLD_CLR_ON_FST   0x0010
#define        FLD_RTRET        0x0010
#define        FLD_ALTERD       0x0100
#define        FLD_VARYING      0x0200

/* Field return codes for 'Special_key()' function. */

#define        FLDRC_IGNORE     0
```

```
#define        FLDRC_DONE        -1
#define        FLDRC_FST         -2
#define        FLDRC_NXT         -3
#define        FLDRC_PRV         -4
#define        FLDRC_LST         -5
#define        FLDRC_ERASE       -6
#define        FLDRC_INITIAL     -7
/* Here are the MSDOS bits for the MSDOS mode portion.        */

#define        FO_RDONLY         0x01

/*     cursor key codes          */

#define K_END          1
#define K_DOWN                   2
#define K_PGDOWN       3
#define K_LF           4
#define K_RT           6
#define K_HOME         7
#define K_UP           8
#define K_PGUP         9
#define        K_CTLEND          11
#define        K_CTLPGDOWN       13
#define        K_CTLLF           14
#define        K_CTLRT           16
#define        K_CTLHOME         17
#define        K_CTLPGUP         19
#define        K_SHIFTTAB        20

/*     edit key codes            */
```

```
#define K_INSERT        1
#define K_DEL           2
#define K_CTLPRTSC      3
#define K_STAR_NUMPAD 4
#define K_MINUS_NUMPAD          5
#define K_PLUS_NUMPAD 6
#define K_CTL_BRK       7 /*  <cntl><break>  =  <edit-key,7> */

/*              Key types                   */

#define         KB_ASCII        0
#define         KB_CSR          1
#define         KB_FNC          2
#define         KB_EDIT         3
#define         KB_ALT          4

/*    for building constants for comparisons          */

#define         FNC_KEY(code)   (MAKEWORD(KB_FNC,(code)))
#define         EDIT_KEY(code)  (MAKEWORD(KB_EDIT,(code)))
#define         ASCII_KEY(code) (MAKEWORD(KB_ASCII,(code)))
      /*Use only with capital alpha's, e.g. CTL_KEY('L') */
#define         CTL_KEY(code)   (ASCII_KEY((code)-'A'+1))
#define         CSR_KEY(code)   (MAKEWORD(KB_CSR,(code)))
#define         ALT_KEY(code)   (MAKEWORD(KB_ALT,code))

#define         KEY_TYPE(key)   TOLOBYTE(key)
#define         KEY_CODE(key)   LOBYTE(key)

/*
*
```

```
* These definitions describe the bits in the keyboard flag.
*
*     Bit     Subject matter   Meaning, when bit is 1
*      7      Insert           state active
*      6      Caps-lock        state active
*      5      Num-lock         state active
*      4      Scroll-lock      state active
*      3      Alt shift        key depressed
*      2      Ctl shift        key depressed
*      1      left-hand shift  key depressed
*      0      rt-hand shift    key depressed
*
**/

/*    KBD     -> key depressed                          */
/*    KBS     -> key state.                             */

#define       KBD_ALTSHIFT          0x08
#define       KBD_CTLSHIFT          0x04
#define       KBD_LFSHIFT           0x02
#define       KBD_RTSHIFT           0x01

#define       KBS_INSERT            0x80
#define       KBS_CAPS              0x40
#define       KBS_NUMLOCK           0x20
#define       KBS_SCROLLLOCK        0x10

/**   Function Return Codes **/

#define RC_SUCCESS    (0)     /* Called function  succeeded  */
#define RC_FAIL       (-1)    /* Called function failed */
```

```
#define RC_EOF          (-1)     /* Signale END-OF-FILE EOF */

#define RC_ESC          1 /* user ended input with <Esc> key.*/

#define RC_ENTER        2

      /* user  ended  by  pressing <enter> key.*/

#define RC_SPECIAL      3

      /* user terminated input by pressing special */

#define RC_OVERFLW      4

      /* field full; insert mode; autoreturn; */

              /*  cursor in middle of field; user typed ascii*/

#define        RC_LOOP          9999

/* RC_LOOP is a special return code */

                /*  to signal that a processing loop should*/

/* continue as normal.  It is used in key input processing */

 /*  for field editing*/

/* and selection-by-cursoring input functions.          */

#define        DB_FAIL          RC_FAIL

#define        DB_SUCCESS       RC_SUCCESS

/*    Reserved Error Codes              */

/*    -257 to -320    Miscellaneous.            */

#define SE_BAD_OBJ     (-257)

              /* Handle was not to proper type of object */

#define SE_OUTOFHEAP    (-258)

              /* out of heap space during giveme() */

#define        SE_GIVEFAR        (-259)

#define        SE_BADPORT        (-260)

/*    -321 to -384    IO system                 */
```

```
#define SE_BADWRITE     (-321)/* write error */
#define SE_BADREAD      (-322)/* read error */
#define         SE_BADSEEK          (-323)
#define         SE_REOPENERR        (-324)/* could not reopen file */

/*    -385 to -448    Database system          */

#define SE_BADPGID      (-385)/* bad page id in record handle */
#define SE_BADCELLID    (-386)/* bad cell id in record handle */
#define SE_NOFREEBUFS   (-387)/* no free buffers in buffer pool */
#define SE_DBPGBAD      (-388)/* smashed database page */
#define SE_DBOVRFLOW    (-389)
        /* database file too big (>30 megabytes) */
#define SE_RECTOOBIG    (-390)
        /* Size of stored record bigger than page*/
#define SE_BUFINCMPAT   (-391)
   /* Buffer system already exists and is incompatible*/
                        /* with needs of database system.*/
/*    -449 to -512    B-tree Indexes           */

#define SE_BADKEYTYP    (-449)/* bad key type in compare */
#define SE_BADDELKEY    (-450)/* error during key deletion */
#define SE_BADBROOT     (-451)/* Root of tree appears bad. */

/*    Justification types for strjust()        */
#define         STR_LJUST       0
#define         STR_RJUST       1
#define         STR_CENTER      2

/* Symbol table wild card - ANY or IGNORE symbol class          */
#define SYT_ANY  0  /* when looking for a symbol of any type */
```

```
/**
*       screen attributes :
*
*       bit number   ON OFF MASK CONSTANT
*
*        0     reverse video   normal video  0X01    VA_NORMAL
*        1     high intensity  low intensity 0X02    VA_HIINTY
*        2     blinking        no blinking   0x04    VA_BLINK
*        3     underline       normal fgd    0x08    VA_ULN
*        8     graphics chars  TTY mode      0x0100  VA_GRAPHICS
*        9     '^'-normal      '^'-special   0x0200  VA_CARET
*       10     '%'-normal      '%'-special   0x0400  VA_PCT
*
**/

#define       VA_NORMAL                 0x00
#define       VA_REVVID                 0x01
#define VA_HIINTY                 0X02
#define VA_BLINK                  0X04
#define VA_ULN                    0x08
#define VA_GRAPHICS               0x0100
#define VA_CARET                  0x0200
#define       VA_PCT                    0x0400

/*    colors for color text modes    */

#define VC_BLACK      0
#define VC_BLUE                   1
#define       VC_GREEN          2
#define       VC_CYAN           3
```

```
#define        VC_RED          4
#define        VC_MAGENTA      5
#define        VC_YELLOW       6
#define        VC_WHITE        7

/*    Video drawing constants          */

#define  VD_NOATTR      -1
    /* Don't use any attributes  when  displaying  chars*/
#define  VD_CURPOS      -1
 /*Leave this cursor  coord  at  its  current  value*/
#define VD_CURSTAT     -2
#define VD_ALLOFIT  0x7FFF

/*    video modes              */

#define        VM_BW40                 0
#define        VM_COLR40               1
#define        VM_BW80                 2
#define        VM_COLR80               3
#define        VM_COLR320              4
#define VM_BW320                5
#define        VM_COLR640              6
#define        VM_MONOCHROME           7

/* Window Movement return code bit masks      */
#define W_UNCHANGED    0
#define W_ALTERED      1
#define W_CHANGED      2

/* Window Movement type codes.                          */
```

```
#define W_POSABS      0
#define W_POSREL      1
#define W_BUFABS      2
#define W_BUFREL      3
#define W_SIZABS      4
#define W_SIZREL      5

/*    Xrec Open modes.                    */

#define        XR_READ        "r"
#define        XR_WRITE       "w"
#define        XR_APPEND      "a"
```

misc/print_ctrl.c

```
#include <stdio.h>

#define DEL  127
#define ENQ    5
#define ACK    6
#define NAK   21

print_ctrl (s)
      char *s;
{
      while (*s)
      {
        switch (*s)
        {
          case ENQ:   tfprintf (stderr, "<ENQ>"); break;
          case ACK:   tfprintf (stderr, "<ACK>"); break;
```

```
        case DEL:    tfprintf (stderr, "<DEL>"); break;
        case NAK:    tfprintf (stderr, "<NAK>"); break;
        default:     if ( *s < 0x20 )
                        tfprintf (stderr, "<CTRL>");
                     else
                        tfprintf (stderr, "%c", *s);
      }
      s++;
    }
    tfprintf (stderr, "\n");     }
```

newpos/accept.c

```
#include "const.h"

static char _buffer [ 300 ],
                    _calculated_bcc,
                    _received_bcc,
                    *pe.
                    *pi;
static unsigned _message_received;

Accept_message_from_remote( )
          /* until timeout or message complete */
{
    unsigned c;

    while ( ( c = Nextchar( ) ) != LINE_TIMED_OUT )
    {
          Store_received_character( c );
          if ( Message_received( ) )
```

```
                    return 1;
        }
        return 0;
}

Reset_message_buffer( )
{
        _message_received = 0;
        _calculated_bcc   = 0;
        _received_bcc     = 0;
        zero( _buffer, sizeof( _buffer ) );
        pi = _buffer;
        pe = _buffer + sizeof( _buffer ) - 10;
                                /* mark safe end of buffer */
}

Store_received_character( c )
        char c;
{
        switch( c )
        {
        case ACK:
        case NAK:
        case SOH:
                        Reset_message_buffer( );
                        _calculated_bcc  = c;
                        *pi++ = c;
                        return;
                        break;
```

```
    }

    if ( pi < pe )          /* there's room to store it */
    {
            *pi = c;        /* so store it              */
            if ( *(pi - 1) == EOT )     /* maybe it's a bcc  *
            {
              _message_received = 1; /* so end of message */
              _received_bcc = c;
            }
              else                  /* otherwise keep going     */
              {                     /* with the current message */
                      pi++;
              _calculated_bcc ^= c;
              }
    }
    else
      Reset_message_buffer( );      /* must be full of junk */
}

Calculated_bcc( )
{
      return _calculated_bcc;
}

Received_bcc( )
{
      return _received_bcc;
}
```

```
char *The_message( )
{
        return  buffer;
}
Message_received( )
{
        return _message_received;
}

Is_start_of_message( c )
        char c;
{
        return c == SOH || c == STX || c == ACK || c == NAK;
}
```

newpos/api.c

```
#include "^daye_request.h"
#include "const.h"
#include "types.h"

static Tid who;
static request *r;

Service_client( _who, _r )
        Tid _who;
        request *_r;
{
        who = _who;
        r   = _r;
```

```
if ( !Valid_client( r->value6 ) )
{
        r->value1 = 0;
        REPLY( who, r );
}
else
  switch( r->opcode )
  {
  case AUTHORIZE_CARD:      _authorize_card( );        break;
  case CAPTURE_SALE:        _capture_sale( );          break;
  case PROBE:               _probe( );                 break;
  case OPEN:                _open( );                  break;
  case DIE:                 _die( );                   break;
  case STATUS_OF_POS:       _pos_status( );            break;
  case GIVE_ME_HEADER_1:    _give_me_header_1( );      break;
  case WHAT_IS_THIS_CARD:   _decode_card( );           break;
  case YOUR_INFO:           _give_info( );             break;
  case YOUR_FIT_RECORD:     _give_fit_record( );       break;
  case RESET_STATS:         _reset_stats( );           break;
  case LOAD_FIT:            _load_fit_record( );       break;
  case LOAD_INFO:           _load_info( );             break;
  case SET_LINK_TIMEOUT:    _set_link_timeout( );      break;
  case CARDS_EXPIRY_DATE:   _cards_date( );            break;
  case GIVE_QUEUE_ENTRY:    _give_entry( );            break;
  case ENABLE_TRANSMISSION: _set_power( 1 );           break;
  case DISABLE_TRANSMISSION: _set_power( 0 );          break;
  case SAVE_DATA:           _save_data( );             break;
  case REGISTERED_HYDRO_USER: _register_hydro_user(); break;
  default:                  REPLY( who, r );           break;
```

```
        }
}

Valid_client( num )
        unsigned num;
{
        return 1 <= num && num <= 2;
}

_register_hydro_user( )
{
        Register_hydro_user( r->value6, r->client );
        REPLY( who, r );
}

_set_power( up )
{
        Set_power_status( up );
        Tell_hydro_users( );
        REPLY( who, r );
}

_save_data( )
{
        Save_all( );
        REPLY( who, r );
}

_set_link_timeout( )
{
        Set_remote_timeout( r->value1 );
```

```
        REPLY( who, r );
}

_give_entry( )
{
        Pos_request *p,
                                q;
        unsigned n,
                        i;

        n = r->value1;
        zero( &q, sizeof( q ) );
        for ( p = First_request( ), i = 0; p && i < n; i++,
                                        p = Next_request( p ) )
                ;
        if ( p )
                q = *p;


        REPLY( who, &q );
}

_cards_date( )
{
        Transaction *t;

        t = Decode_transaction( r );
        r->value1 = Cards_expiry_yymm( t->TRACK2 );
        REPLY( who, r );
}
```

```
_load_info( )
{
        Set_outlet_info( r->string_data );
        REPLY( who, r );
}

_load_fit_record( )
{
        Set_fit_record( r->value1, r->string_data );
        REPLY( who, r );
}

_give_info( )
{
 Copy_outlet_info( r->string_data, sizeof( r->string_data ) );
 REPLY( who, r );
}

_give_fit_record( )
{
        r->value1 = Copy_fit_record( r->value1, r->string_data,
                                     sizeof( r->string_data ) );
        REPLY( who, r );
}

_reset_stats( )
{
        Reset_statistics( );
        REPLY( who, r );
}
```

```
_decode_card( )
{
        Transaction *t;

        t = Decode_transaction( r );
 if ( (r->value1 = Card_is_known_to_me( t->TRACK2 ) ) !=
                                                UNKNOWN_CARD )
                if ( !Card_has_good_date( t->TRACK2 ) )
                        r->value1 = BAD_DATE_CARD;

        REPLY( who, r );
}
_probe( )
{
  Copy_statistics( r->string_data, sizeof( r->string_data ) );
  r->value1 = Pos_coms_available( );
  r->value2 = Pos_info_available( );
  r->value3 = Requests_available( );
  r->value4 = Current_remote_timeout( );
  r->value5 = Sequence_number( );
  r->value6 = Power_good( );
  REPLY( who, r );
}

_die( )
{
        Shutdown_pos( );
        REPLY( who, r );
}
```

```
_open( )
{
        Register_hydro_user( r->value6, r->value7 );
        REPLY( who, r );
}

_give_me_header_1( )
{
        char *Pos_address_1( );

        COPY_SAFELY( r->string_data, Pos_address_1( ) );
        REPLY( who, r );
}

_authorize_card( )
{
        Pos_request *p;
        Transaction *t;

        t = Decode_transaction( r );
        if ( Card_is_known_to_me( t->TRACK2 ) != UNKNOWN_CARD &&
             Card_has_good_date( t->TRACK2 ) &&
                  (p = Allocate_request( )) != NULL_REQUEST )
        {
                Enqueue_authorization_request( p, t );
                r->value1 = 1;
        }
        else
                r->value1 = 0;
        REPLY( who, r );
}
```

```
_capture_sale( )
{
        Pos_request *p;
        Transaction *t;

        t = Decode_transaction( r );

        if ( Emulating( ) )
        {
                r->value1 = 1;
                REPLY( who, r );
                return;
        }

        if ( Card_is_known_to_me( t->TRACK2 ) == UNKNOWN_CARD )
        {
                r->value1 = 0;
                REPLY( who, r );
                return;
        }

        if ( ( p = Allocate_request( ) ) == NULL_REQUEST )
                p = Allocate_reserve( );
        if ( p == NULL_REQUEST )
                r->value1 = 0;                  /* very bad news */
        else
        {
                        Enqueue_capture_request( p, t );
                        r->value1 = 1;
                }
                REPLY( who, r );
```

```
}

_pos_status( )
{
        r->value1 = Emulating( ) ? 1 : Pos_status( );
        REPLY( who, r );
}
```

newpos/bcc_of.c

```
char Bcc_of( string )
        char *string;
{
        char bcc = 0;

        while ( *string )
                bcc ^= *string++;

        return bcc;
}
```

newpos/cards.c

```
#include "^dave_request.h"
#include "types.h"

#define END_SENTINEL '?'
#define START_SENTINEL ';'

char *Position_to_start_sentinel( c )
        char *c;
```

```
{
        for ( ; *c && *c != START_SENTINEL; c++ )
                ;
        return *c ? c : 0;
}

char *Position_to_end_sentinel( c )
        char *c;
{
        for ( ; *c && *c != END_SENTINEL; c++ )
                ;
        return *c ? c : 0;
}

char *Position_past_field_separator( c )
        char *c;
{
        for ( ; *c && *c != '=': c++ )
                ;
        return *c ? c + 1 : 0;
}

Normalize_track2( string )
        char *string;
{
        char *s,
                *e,
                *p,
                calc_bcc,
                cards_bcc;
```

```
if ( (s = Position_to_start_sentinel( string )) &&
        (e = Position_to_end_sentinel( s )) )
{
cards_bcc = *(e + 1);                    /* remember the bcc     */
*(e + 1) = '\0';                         /* stringify the track */
cards_bcc -= '0';                        /* "unchar" it          */
calc_bcc = Bcc_of( s );
if ( calc_bcc >= '0' )                   /* unchar it            */
calc_bcc -= '0';
if ( cards_bcc != calc_bcc )             /* no good card         */
{
        *string = '\0';
        return;
}
 }
 /
      for ( s++, p = string; *s && *s != END_SENTINEL; s++, p++ )
              *p = *s;
      *p = '\0';
}

Card_is_known_to_me( track2 )
      char *track2;
{
      Fit_info *f,
                        *Look_up_card( );
      if ( f = Look_up_card( track2 ) )
              switch( f->CARD_CATEGORY )
              {
```

```
            case 1:         return PETRO_CARD;
            case 2:         return VISA_CARD;
            case 3:         return MASTER_CARD;
            }
        return UNKNOWN_CARD;
}


Card_has_good_date( track2 )
        char *track2;
{
        return  Pos_yymm( ) <= Cards_expiry_yymm( track2 );
}
```

newpos/cfiles accept.c api.c bcc_of.c cards.c decode.c do_work.c dont_know.c encodings.c first.c free_pool.c host_reply.c link_tags.c match.c mode.c my_timer.c pos.c pos_control.c pos_info.c pos_status.c power.c queue.c queue_auth.c queue_cap.c queue_table.c recd_message.c remoteio.c requests.c restore.c save.c sequence.c stats.c the_dead.c newpos/const.h

```
#define POS_PORT                20
#define POS_DATA_STORE          "/dave/pos_data"

#define MAX_FITS                10      /* # of card types   */

#define AWAITING_SEND           1       /* states of a request */
#define AWAITING_LINK_RESPONSE          2
#define AWAITING_HOST_REPLY             3
```

```
#define FIXED_FLOOR_LIMIT              7500    /* by edict    */

#define AUTHORIZATION_REQUEST 100  /* message types        */

#define AUTHORIZATION_REPLY     110

#define CAPTURE_REQUEST                        220

#define CAPTURE_REPLY                  230

#define TABLE_REQUEST                  350

#define OUTLET_TABLE_REQUEST  351

#define FIT_TABLE_REQUEST              352

                                  /* serial line stuff    */

#define LINE_TIMED_OUT        -1    /*     meta character    */

#define SOH                                    0x01

#define STX                                    0x02

#define ETX                                    0x03

#define EOT                                    0x04

#define ACK                                    0x06

#define NAK                                    0x15

#define ONE_TENTH                       2

#define HALF_SECOND                    10

                              /* Authorization abort codes */

#define LINK_UNAVAILABLE  1   /*  no  "cts"  */

#define NO_LINK_RESPONSE  2   /* timeout - no ack or nak      */

#define HOST_TIMEOUT      3   /* no answer from petro canada */

#define LINK_REFUSAL      4   /* got nakked                   */

                              /* Client's replies          */
```

```
#define MAKE_IT_A_POST_PAY     "POSTPAY  "
#define ITS_HOT                "HOTCARD  "
#define MAKE_IT_A_PRE_PAY      "VALIDATED"

                                        /* API requests */

#define AUTHORIZE_CARD         1000
#define CAPTURE_SALE           1001
#define PROBE                  1002
#define OPEN                   1003
#define DIE                    1004
#define STATUS_OF_POS          1005
#define GIVE_ME_HEADER_1         1006
#define WHAT_IS_THIS_CARD        1007
#define YOUR_INFO                        1008
#define YOUR_FIT_RECORD                  1009
#define RESET_STATS                      1010
#define LOAD_INFO                        1011
#define DELETE_FIT                       1012
#define LOAD_FIT                         1013
#define SET_LINK_TIMEOUT         1014
#define CARDS_EXPIRY_DATE        1015
#define GIVE_QUEUE_ENTRY         1016
#define DISABLE_TRANSMISSION   1017
#define ENABLE_TRANSMISSION      1018
#define SAVE_DATA                        1019
#define REGISTERED_HYDRO_USER 1020
```

newpos/decode.c

```
#include "^dave_request.h"

#include "types.h"

static Transaction _t;

Transaction *Decode_transaction( r )

        request *r;

{

        zero( &_t, sizeof ( _t ) );

        _t.AMOUNT   = r->value2;

        _t.PRICE    = r->value3;

        _t.PRODUCT  = r->value4;

        _t.VOLUME   = r->value5;

        _t.CLIENT   = r->client;

        _t.DAVE     = r->value6;

        _t.LANGUAGE_CODE = r->string_data[ 65 ];

        r->string_data[ 65 ] = '\0';

        COPY_SAFELY( _t.TRACK2, r->string_data );

        COPY_SAFELY( _t.AUTH, r->string_data + 60 );

        Normalize_track2( _t.TRACK2 );

        if ( _t.TRACK2[ 0 ] == '\0' )

                zero( _t.TRACK2, sizeof _t.TRACK2 );

        return &_t;

}
```

```
#include "types.h"
#include "const.h"

Do_work( )
{
        Pos_request *r;
        int message_waiting;

        message_waiting = Accept_message_from_remote( );

        if ( (r = First_auth_awaiting_send( )) && Power_good( ) )
        {
         if ( Transmit( r ) )
         {
         r->STATE = AWAITING_LINK_RESPONSE;
         r->EXPIRY_TIME = calnow( ) + Current_remote_timeout( );
                }
      }
        else if
        ( (r = First_capture_awaiting_send( )) && Power_good( ) )
        {
                if ( Transmit( r ) )
          {
          r->STATE = AWAITING_LINK_RESPONSE;
          r->EXPIRY_TIME = calnow( ) + Current_remote_timeout( );
      }
      else if
       ( (r = First_table_awaiting_send( )) && Power_good( ) )
```

```
        {
          if ( Transmit( r ) )
          {
          r->STATE = AWAITING_LINK_RESPONSE;
          r->EXPIRY_TIME = calnow( ) + Current_remote_timeout( );
                }
        }

        if ( message_waiting )
                Process_received_message( );
        Check_for_request_timeouts( );
}
```

newpos/dont_know.c

```
        Dont_know_what_to_do( )
        {
```

newpos/encodings.c

```
#include "types.h"

Encoded_amount( b, amount )
        char *b;
        unsigned amount;
{
        tsprintf( b, "%06u", amount );
        return 6;
}

Encoded_track2( b, track2 )
```

```
        char *b, *track2;
{
        tsprintf( b, "%02d%-40.40s", strlen( track2 ), track2 );
        return 42;
}

Encoded_authorization( b, string )
        char *b, *string;
{
        memcpy( b, string, 5 );
        return 5;
}

Encoded_sales_capture( p, t )
        char *p;
        Transaction *t;
{
        char *s = p,
                buf[ 4 ];

      strcpy( p, "000B" );
        p += 4;

        p += Product_detail( p, t );
        p += Total_due_detail( p, t );

        tsprintf( buf, "%03d", (p - s) - 3 ); /* length sub-field */
        memcpy( s, buf, 3 );

        return p - s;
}
```

```
Product_detail( p, t )
        char *p;
        Transaction *t;
{
        p += Encoded_product_code( p, t->PRODUCT );
        p += Encoded_quantity( p, t->VOLUME );
        p += Encoded_price( p, t->PRICE );
        p += Encoded_amount( p, t->AMOUNT );
        return 16;
}
Total_due_detail( p, t )
        char *p;
        Transaction *t;
{
        strcpy( p, "95" );
        p += 2;
        return Encoded_amount( p, t->AMOUNT ) + 2;
}

Encoded_quantity( p, volume )
        char *p;
        unsigned volume;
{
        return tsprintf( p, "%04u", volume );
}

Encoded_price( p, price )
        char *p;
        unsigned price;
```

```
{
        return tsprintf( p, "%04u", price );
}

Encoded_product_code( p, our_code_for_grade )
        char *p;
        unsigned our_code_for_grade;
{
        unsigned their_grade = 2;       /* default */
        switch( our_code_for_grade )
        {
        case 1:     their_grade = 2; break;
        case 2:     their_grade = 3; break;
        case 3:     their_grade = 1; break;
        }
        return tsprintf( p, "%02d", their_grade );
}
```

newpos/first.c

```
#include "types.h"
#include "const.h"

Pos_request *First_send_waiter( type )
unsigned type;
{
    Pos_request *p;

    for ( p = First_request( ); p; p = Next_request( p ) )
    if ( p->STATE == AWAITING_SEND && p->REQUEST_TYPE == type )
                    return p;
```

```
        return NULL_REQUEST;
}

Pos_request *First_auth_awaiting_send( )
{
        return First_send_waiter( AUTHORIZATION_REQUEST );
}

Pos_request *First_capture_awaiting_send( )
{
        return First_send_waiter( CAPTURE_REQUEST );
}

Pos_request *First_table_awaiting_send( )
{
        return First_send_waiter( TABLE_REQUEST );
}
```

newpos/free_pool.c

```
#include "types.h"

#define NUMBER_OF_NORMAL_ENTRIES        50
#define NUMBER_OF_STANDBY_ENTRIES        2

#define POOL_SIZE
    (NUMBER_OF_NORMAL_ENTRIES + NUMBER_OF_STANDBY_ENTRIES)

static Pos_request *_pool[ POOL_SIZE];

Initialize_request_pool( )
{
        Pos_request *r;
        char *calloc( );
```

```
        int  i;

        for ( i = 0; i < POOL_SIZE; i++ )
        _pool[ i ] = (Pos_request *)calloc( 1,
                                        sizeof( Pos_request ) );
}

Requests_available( )
{
        return Deallocate_request( Allocate_request( ) );
}

Pos_request *Allocate_request( )
        Pos_request *r;
        int         i;

        for ( i = 0; i < NUMBER_OF_NORMAL_ENTRIES; i++ )
                if ( ( r = _pool[ i ] ) != NULL_REQUEST )
                {
                        _pool[ i ] = NULL_REQUEST;
                        return r;
                }

        return NULL_REQUEST;
}

Pos_request *Allocate_reserve( )
{
        Pos_request *r;
        int         i;

        for ( i = NUMBER_OF_NORMAL_ENTRIES; i < POOL_SIZE; i++ )
```

```
            if ( ( r = _pool[ i ] ) != NULL_REQUEST )
            {
                    _pool[ i ] = NULL_REQUEST;
                    return r;
            }

        Log_memory_allocation_failure( );
        return NULL_REQUEST;                    /* real bad news */
}
Deallocate_request( r )
            /* always try to return "RESERVE"s first */
        Pos_request *r;
{
        int i;

        if ( r == NULL_REQUEST )
                return 0;

        for ( i = POOL_SIZE - 1; i >= 0; i-- )
                if ( _pool[ i ] == NULL_REQUEST )
                {
                        _pool[ i ] = r;
                        zero( r, sizeof( *r ) );
                        return 1;
                }
        return 0;
}
```

newpos/host_reply.c

```
#include "types.h"
#include "const.h"
```

```
Process_host_reply( h )
        Host_reply *h;
{
        Pos_request *p;
        int     msg_type = Reply_type( h->TAG.TYPE );

        if ( msg_type == OUTLET_TABLE_REQUEST )
        {
                Update_outlet_info( h->LINK_MESSAGE );
                return;
        }
        else if ( msg_type == FIT_TABLE_REQUEST )
        {
                Update_fit_table( h->LINK_MESSAGE );
                return;
        }
        else                    /* it's a real reply */
                ;

        if ( p = Match_host_reply( h ) )
                switch( msg_type )
                {
                case AUTHORIZATION_REPLY:
                        Process_authorization_reply( h, p );
                        break;
                case CAPTURE_REPLY:
                        Process_capture_reply( h, p );
                        break;
                }
```

```
        else
                Log_unsolicited_host_reply( );
}

Process_authorization_reply( h, p )
        Host_reply *h;
        Pos_request *p;
{
        int answer;

        Dequeue_request( p );
        answer = Tell_my_client( p->CLIENT, h->LINK_MESSAGE );
        Log_authorization_reply( p, answer );
        Deallocate_request( p );
}

Tell_my_client( who, what )
        Tid who;
        char *what;
{
        char *answer,
                *a = Replys_auth_code( what ),
                *r = Replys_response_code( what ),
                l = Replys_language_code( what );

        if ( strlen( what ) < 52 )
                answer = MAKE_IT_A_POST_PAY;
        else if ( Authorized( r, a ) )
                answer = MAKE_IT_A_PRE_PAY;
        else if ( memcmp( r, "04", 2 ) == 0 )
                answer = ITS_HOT;
```

```
        else
                answer = MAKE_IT_A_POST_PAY;

        Send_reply_to_client( who, answer, a, r, 1 );

        return strcmp( answer, MAKE_IT_A_PRE_PAY ) == 0;
}

Send_reply_to_client( who, answer, auth_number,
                                        response_code, language )
        Tid  who;
        char *answer, *auth_number, *response_code, language;
{
        static char _clients_message[ 50 ];

        zero( _clients_message, sizeof( _clients_message ) );
        tsprintf( _clients_message, "%9.9s%5.5s%2.2s%c",
                answer, auth_number, response_code, language );
        pos_event( who, _clients_message );
Authorized( r, a )
        char *r, *a;
{
        if ( (memcmp( r, "00", 2 ) == 0) && memcmp( a, "00000", 5 )
                                                        != 0 )
                return 1;
        else
                return 0;
}

Process_capture_reply( h, p )
        Host_reply *h;
```

```
        Pos_request *p;
{
        if ( Capture_request_satisfied( h ) )
        {
                Dequeue_request( p );
                Log_capture_reply( p );
                Deallocate_request( p );
        }
        else
                Dont_know_what_to_do( );
}

Capture_request_satisfied( h )
        Host_reply *h;
{
return memcmp( Replys_response_code( h->LINK_MESSAGE ),
                                                "00", 2 ) == 0;
}

char Replys_language_code( r )
        char *r;
{
        return *(r + 42);
}

char *Replys_auth_code( r )
        char *r;
{
```

```
        return r + 43;          /* skip the language bit */
}

char *Replys_response_code( r )
        char *r;
{
        return r + 48;
}
```

newpos/link_tags.c

```
#include "types.h"
#include "const.h"

Set_link_tag( t, pkt_type, request_type )
        Link_tag *t;
        char pkt_type;
        unsigned request_type;
{
        t->PACKET_TYPE = pkt_type;
        memcpy( t->TYPE, Request_type( request_type ),
                                        sizeof( Message_type ) );
        t->LINE         = My_line( );
        memcpy( t->SEQUENCE, Next_sequence( ), sizeof( Asequence ) )
}

Equal_link_tags( t1, t2 )
        Link_tag *t1, *t2;
{
        unsigned type1,
        type2;
```

```
type1 = Reply_type( t1->TYPE );

type2 = Reply_type( t2->TYPE );

return type1 == type2 && t1->LINE == t2->LINE &&

memcmp( t1->SEQUENCE, t2->SEQUENCE, sizeof( Asequence ) ) == 0;


}


Tag_matches_request( p, t )
        Pos_request *p;
        Link_tag *t;
{
        unsigned tags_type,
                        types_match;

        tags_type = Reply_type( t->TYPE );

        switch( p->REQUEST_TYPE )
        {
        case AUTHORIZATION_REQUEST:
                types_match = tags_type == AUTHORIZATION_REPLY; break;
        case CAPTURE_REQUEST:
                types_match = tags_type == CAPTURE_REPLY;       break;
        default:
                types_match = 0;                                break;
        }

        return types_match &&
           memcmp( p->TAG.SEQUENCE, t->SEQUENCE,
                                        sizeof( Asequence ) ) == 0 &&
                p->TAG.LINE == t->LINE;
}
```

newpos/makefile

```
CFLAGS  = -S +Wc,+u
SOURCES = @cfiles
OBJECTS = @objects

pos: $(OBJECTS)
        linkobj c=pos x=objects m=pos.map l=/user/steve/dave
        sort pos.map f=1,2 +r
        copy pos /dave/pos
```

newpos/match.c

```
#include "types.h"
#include "const.h"

/*   1. a queue entry matches a link response if and only if
        the sequence numbers agree and the queue entry is in
        "awaiting link response" state
*/

Pos_request *Match_link_response( l )
        Link_response *l;
{
        Pos_request *p;

        for ( p = First_request( ); p; p = Next_request( p ) )
        {
                if ( p->REQUEST_TYPE == CAPTURE_REQUEST &&
                        Equal_link_tags( &p->TAG, &l->TAG ) &&
```

```
                p->STATE != AWAITING_SEND )
                return p;
        if ( p->STATE != AWAITING_LINK_RESPONSE )
                continue;
        if ( Equal_link_tags( &p->TAG, &l->TAG ) )
                return p;
    }

    return NULL_REQUEST;
}

/*  2. a queue entry matches a reply if and only if the
       sequence numbers agree and the queue entry is in
       "awaiting reply" state
*/

Pos_request *Match_host_reply( h )
    Host_reply *h;
{
    Pos_request *p;

    for ( p = First_request( ); p; p = Next_request( p ) )
    {
        if ( p->STATE != AWAITING_HOST_REPLY )
                continue;
        if ( Tag_matches_request( p, &h->TAG ) )
                return p;
    }
    return NULL_REQUEST;
}
```

newpos/mode.c

```
static unsigned _the_mode;

Set_real_mode( )
{
        _the_mode = 1;
}

Set_dummy_mode( )
{
        _the_mode = 0;
}

Emulating( )
{
        return _the_mode == 0;
}
```

newpos/my_timer.c

```
#include <timer.h>

static unsigned timer_running,
                        my_port;

Set_timer_port( port )
        unsigned port;
{
        my_port = port;
}
```

```
Reset_my_timer( )
{
        timer_running = 0;
}

Cancel_my_timer( )
{
        if (timer_running)
                set_timer( TIMER_CANCEL, RELATIVE, 0, 0, my_port );
        timer_running = 0;
}

Set_my_timer( ticks )
        unsigned ticks;
{
        Cancel_my_timer( );

        set_timer( TIMER_SIGNAL, RELATIVE, ticks, 0, my_port );
        timer_running = 1;
}

Delay( ticks )
        unsigned ticks;
{
        Cancel_my_timer( );
        set_timer( TIMER_WAKEUP, RELATIVE, ticks );
}
```

```
accept.o
api.o
bcc_of.o
cards.o
decode.o
do_work.o
dont_know.o
encodings.o
first.o
free_pool.o
host_reply.o
link_tags.o
match.o
mode.o
my_timer.o
pos.o
pos_control.o
pos_info.o
pos_status.o
power.o
queue.o
queue_auth.o
queue_cap.o
queue_table.o
recd_message.o
remoteio.o
requests.o
```

```
restore.o

save.o

[illegible]

stats.o

the_dead.o
```

newpos/pos.c

```
#include "^dave_request.h"

#include "types.h"

#include "const.h"

#include <stdio.h>

#include <setjmp.h>


#define USAGE          1

#define NO_TIMER       2

#define NO_DEVICE      3

static jmp_buf          initial_trap;

main( argc, argv )

      int  argc;

      char *argv[];

{

      unsigned code,

                        task;

      request  r;

      if ( code = setjmp( initial_trap ) )

              Initial_error( code );

      else

              Initialize( argc, argv );

      for (;;)
```

```
        {
                task = RECEIVE_ANY( &r );
                if ( (task >> 8) == POS_PORT )
                {
                        Reset_my_timer( );
                        Do_work( );
                }
                else
                        Service_client( task, &r );
                Set_my_timer( HALF_SECOND );
                Maintain_pos_status( );
        }
}

Initialize( argc, argv )
        int  argc;
        char *argv[];
{
        log_pos( "start" );
        if (argc != 4 && argc != 5)
                longjmp( initial_trap, USAGE );

        if ( attach( POS_PORT ) != 0 )
                longjmp( initial_trap, NO_TIMER );

        Set_my_line( argv[ 3 ] );
        Set_real_mode( );
        Set_power_status( 1 );
        if ( argc == 5 )
                Set_dummy_mode( );
        Reset_message_buffer( );
```

```
        Initialize_request_pool( );
        Initialize_queue( );
        Initialize_statistics( );
        Set_remote_timeout( atoi( argv[ 2 ] ) );
        Restore_all( );
        Open_remote( argv[ 1 ], initial_trap, NO_DEVICE );
        Set_timer_port( POS_PORT );
        Enqueue_table_request( );
        Set_my_timer( 1 );

        log_pos ("ready");
}


Initial_error( code )
        unsigned code;
{
        char *message;

        switch( code )
        {
                case NO_TIMER:  message = "no timer port";   break;
                case NO_DEVICE: message = "no device";       break;
                case USAGE:     Usage( );
                                                             exit( 0 );
                                                             break;
        }
        log_pos( message );
        exit( 1 );
}

Usage( )
```

```
{
        fprintf( stderr, "pos device link timeout line no\n" );
}
```

newpos/pos.map

```
 .Segment:1    0000 to 4153 (16724 bytes)
 .Segment:2    0000 to 042C (1069 bytes)
 .Segment:3    042D to 098F (1379 bytes)
 .Total size is 4AE4 (19172) bytes
C01  0053  prologue
C01  005E  epilogue
C01  0067  stk_overflow
C01  007D  <exit>
C01  0083  $ucbeg
C01  0084  <Accept_message_from_remote>
C01  00B5  <Reset_message_buffer>
C01  00E9  <Store_received_character>
C01  0164  <Calculated_bcc>
C01  0174  <Received_bcc>
C01  0184  <The_message>
C01  0193  <Message_received>
C01  01A2  <Is_start_of_message>
C01  01D0  <Service_client>
C01  02C6  <Valid_client>
C01  02E8  <_register_hydro_user>
C01  031C  <_set_power>
C01  0344  <_save_data>
C01  03a3  <_set_link_timeout>
C01  038E  <_give_entry>
```

```
C01  0414  <_cards_date>
C01  0453  <_load_info>
C01  047C  <_load_fit_record>
C01  04AE  <_give_info>
C01  04DB  <_give_fit_record>
C01  051A  <_reset_state>
C01  0539  <_decode_card>
C01  059A  <_probe>
C01  060F  <_die>
C01  062E  <_open>
C01  0662  <_give_me_header_1>
C01  0693  <_authorize_card>
C01  0711  <_capture_sale>
C01  07D1  <_pos_status>
C01  0806  <Bcc_of>
C01  082F  <Position_to_start_sentinel>
C01  0865  <Position_to_end_sentinel>
C01  089B  <Position_past_field_separator>
C01  08D4  <Normalize_track2>
C01  097E  <Card_is_known_to_me>
C01  09CC  <Card_has_good_date>
C01  09F0  <Decode_transaction>
C01  0AAC  <Do_work>
C01  0BA9  <Dont_know_what_to_do>
C01  0BB3  <Encoded_amount>
C01  0BD2  <Encoded_track2>
C01  0BFB  <Encoded_authorization>
```

| | | |
|---|---|---|
| C01 | 0C1A | <Encoded_sales_capture> |
| C01 | 0C8A | <Product_detail> |
| C01 | 0CE6 | <Total_due_detail> |
| C01 | 0D14 | <Encoded_quantity> |
| C01 | 0D30 | <Encoded_price> |
| C01 | 0D4C | <Encoded_product_code> |
| C01 | 0D9C | <First_send_waiter> |
| C01 | 0DE5 | <First_auth_awaiting_send> |
| C01 | 0DFB | <First_capture_awaiting_send> |
| C01 | 0E11 | <First_table_awaiting_send> |
| C01 | 0E27 | <Initialize_request_pool> |
| C01 | 0E60 | <Requests_available> |
| C01 | 0E76 | <Allocate_request> |
| C01 | 0EC4 | <Allocate_reserve> |
| C01 | 0F15 | <Deallocate_request> |
| C01 | 0F78 | <Process_host_reply> |
| C01 | 100A | <Process_authorization_reply> |
| C01 | 104A | <Tell_my_client> |
| C01 | 10F6 | <Send_reply_to_client> |
| C01 | 1137 | <Authorized> |
| C01 | 1179 | <Process_capture_reply> |
| C01 | 11B0 | <Capture_request_satisfied> |
| C01 | 11E2 | <Replys_language_code> |
| C01 | 11F7 | <Replys_auth_code> |
| C01 | 1209 | <Replys_response_code> |
| C01 | 121B | <Set_link_tag> |

```
C01  1268  <Equal_link_tags>
C01  12D5  <Tag_matches_request>
C01  1376  <Match_link_response>
C01  13F9  <Match_host_reply>
C01  1447  <Set_real_mode>
C01  1457  <Set_dummy_mode>
C01  1467  <Emulating>
C01  147F  <Set_timer_port>
C01  148F  <Reset_my_timer>
C01  149F  <Cancel_my_timer>
C01  14D1  <Set_my_timer>
C01  14FD  <Delay>
C01  151B  <main>
C01  1595  <Initialize>
C01  165F  <Initial_error>
C01  16B3  <Usage>
C01  16CB  <Shutdown_pos>
C01  16E8  <Outlet_information>
C01  16F7  <Fit_table>
C01  170D  <Pos_address_1>
C01  171C  <Set_outlet_info>
C01  1737  <Set_fit_record>
C01  176D  <Copy_outlet_info>
C01  1794  <Copy_fit_record>
C01  17DB  <Pos_info_available>
C01  17FF  <Pos_vymm>
C01  1840  <Pos_timeout_for>
```

```
C01  1874  <Cards_expiry_yymm>
C01  1898  <Look_up_card>
C01  18F5  <Fit_expiry_date>
C01  197B  <Set_my_line>
C01  198D  <My_line>
C01  199D  <Update_outlet_line>
C01  1A9D  <Update_fit_table>
C01  1B38  <Decode_and_load_fit_record>
C01  1C03  <Set_ascii_field>
C01  1C5F  <Make_into_strings>
C01  1C95  <Next_separator>
C01  1CCB  <Pos_status>
C01  1CFD  <Maintain_pos_status>
C01  1D28  <Pos_coms_available>
C01  1D3B  <Set_power_status>
C01  1D4B  <Power_good>
C01  1D5A  <Register_hydro_user>
C01  1D79  <Tell_hydro_users>
C01  1DCB  <Initialize_queue>
C01  1DE1  <Enqueue_request>
C01  1E0D  <Dequeue_request>
C01  1E4C  <First_request>
C01  1E5E  <Next_request>
C01  1E6F  <Enqueue_authorization_request>
C01  1EFC  <Encode_auth_link_message>
C01  1F87  <Enqueue_capture_request>
```

```
C01  1FF7  <Encode_capture_link_message>
C01  20A5  <Enqueue_table_request>
C01  210F  <Encode_table_request_link_message>
C01  2167  <Process_received_message>
C01  21BF  <Process_link_response>
C01  2220  <Positive_link_response>
C01  227B  <Negative_link_response>
C01  22D1  <Purge_queues>
C01  2301  <All_purpose_nak>
C01  2339  <Open_remote>
C01  2389  <Set_remote_timeout>
C01  2399  <Current_remote_timeout>
C01  23A8  <Remote_available_now>
C01  23D1  <Close_remote>
C01  23EF  <Transmit>
C01  244D  <Nextchar>
C01  2495  <Request_type>
C01  24D9  <Reply_type>
C01  2598  <Restore_all>
C01  26C1  <Save_all>
C01  27A9  <Next_sequence>
C01  27DC  <Set_sequence_number>
C01  27EC  <Sequence_number>
C01  27FB  <Initialize_statistics>
C01  281D  <Reset_statistics>
C01  2841  <Time_stats>
C01  2854  <Log_statistics
```

```
C01  287D  <Log_remote_unavailable>
C01  288E  <Compute_oldest_capture>
C01  2924  <Log_queued_capture>
C01  2935  <Log_queued_authorization>
C01  2946  <Log_link_timeout>
C01  2957  <Log_aborted_authorization>
C01  299D  <Log_link_refusal>
C01  29AE  <Log_host_timeout>
C01  29BF  <Log_unsolicited_link_response>
C01  29D0  <Log_unsolicited_host_reply>
C01  29E1  <Log_authorization_reply>
C01  2A89  <Log_capture_reply>
C01  2B1A  <Log_lrc_error>
C01  2B2B  <Log_memory_allocation_failure>
C01  2B3C  <Check_for_request_timeouts>
C01  2BE5  <Timeout_table_request>
C01  2C01  <Timeout_authorization_request>
C01  2C8E  <Abort_authorization_request>
C01  2CD1  <pos_event>
C01  2CEB  <power_event>
C01  2D05  <log_pos>
C01  2D1C  <event>
C01  2D65  <lrequest>
C01  2DBD  <Address_of>
C01  2DD9  <calerr>
C01  2DEB  <calioin>
```

```
C01  2FFA  <calmthlen>
C01  3027  <calnow>
C01  30D6  <calnwork>
C01  31CD  <calsplit>
C01  34D1  <calwkday>
C01  3UUC  <caltimezone>
C01  3557  <_calcsecs>
C01  359B  <disallow>
C01  35BA  <my_open>
C01  35ED  <sleep>
C01  3633  <abs_sleep>
C01  3658  <set_timer>
C01  36BF  <strncpy>
C01  36F9  <strncat>
C01  3732  <strncmp>
C01  3765  <set_attr>
C01  37DF  <get_attr>
C01  3859  <set_option>
C01  38CB  <get_option>
C01  392C  <flush_input>
C01  398B  <dregister_name>
C01  3B31  <find_admin>
C01  3B9B  <char_waiting>
C01  3C44  <calloc>
C01  3C4A  <malloc>
C01  3C50  <realloc>
C01  3C56  <ctree>
```

```
C01  3C56  <free>
C01  3C5C  <fopen>
C01  3C62  <fclose>
C01  3C68  <getc>
C01  3C6E  <putc>
C01  3C74  <ungetc>
C01  3C7A  <fflush>
C01  3C80  <tfprintf>
C01  3C86  <tsprintf>
C01  3C8C  <fget>
C01  3C92  <fput>
C01  3C98  <fiseek>
C01  3C9E  <rewind>
C01  3CA4  <forward>
C01  3CAA  <breakable>
C01  3CB0  <strcat>
C01  3CB6  <strcmp>
C01  3CBC  <strcpy>
C01  3CC2  <strlen>
C01  3CC8  <send>
C01  3CCE  <abort>
C01  3CD4  <unbreakable>
C01  3CDA  <setjmp>
C01  3D3F  <longjmp>
C01  3DAD  <nargs>
C01  3DC3  <memcmp>
```

```
C01  3DEE  <memchr>
C01  3E1B  <memccpy>
C01  3E56  lepilogue
C01  3E5F  lmul
C01  3EAE  lmodr
C01  3EB7  lmod
C01  3EBD  ldivr
C01  3EC6  ldiv
C01  3F7F  <vc_send_reply>
C01  3F85  <vc_create>
C01  3F8B  <vc_create2>
C01  3F91  <vc_create3>
C01  3F97  <ker_vc_destroy>
C01  3F9D  <def_server>
C01  3FA3  <set_acc_flags>
C01  3FA9  <set_exception>
C01  3FAF  <escape_tty>
C01  3FB5  <hold>
C01  3FBB  <unhold>
C01  3FC1  <time_slice>
C01  3FC7  <task_info>
C01  3FCD  <force_ready>
C01  3FD3  <set_priority>
C01  3FD9  <set_user>
C01  3FDF  <set_slice>
C01  3FE5  <modify_flags>
C01  3FEB  <set_int_mask>
```

```
C01  3FF1  <set_int_vec>
C01  3FF7  <alloc_mem>
C01  3FFD  <get_date>
C01  4003  <set_date>
C01  4009  <get_ticks>
C01  400F  <receive>
C01  4015  <reply>
C01  401B  <attach>
C01  4021  <detach>
C01  4027  <await>
C01  402D  <signal>
C01  4033  <read_msg>
C01  4039  <write_msg>
C01  403F  <read_port>
C01  4045  <csignal>
C01  404B  <relay>
C01  4051  <creceive>
C01  4057  <io_in>
C01  4064  <io_out>
C01  4072  <set_extra_seg>
C01  4072  <set_extra_segment>
C01  407A  <copy>
C01  407A  <memcpy>
C01  40A7  <zero>
C01  40C3  <memset>
C01  40E4  <atoi>
```

```
DOO  0000  <User_sp>
DOO  0002  <User_ss>
DOO  0004  <Exc_bits>
DOO  0008  <Exc_allow>
DOO  000C  <Exc_pending>
DOO  0010  <Exc_fp>
DOO  0012  <Exc_pc>
DOO  0014  <Exc_permit>
DOO  0018  <Exit_status>
DOO  001A  <Error_status>
DOO  001C  <My_tid>
DOO  001E  <Dads_tid>
DOO  0020  <Break_count>
DOO  0021  <My_tty>
DOO  0022  stack_base
DOO  0024  <Cmd_flags>
DOO  0025  <My_priority>
DOO  0026  <stdin>
DOO  0028  <stdout>
DOO  002A  <stderr>
DOO  002C  <Free_list>
DOO  002E  <End_of_free>
DOO  0030  <File_list>
DOO  0032  <_Argc>
DOO  0034  <_Argv>
DOO  0034  stk_limit
DOO  0036  SAVE
DOO  0038  TEMP
DOO  0060  <Code_flags>
```

```
D00   0061   <User_num>
D00   0062   <Group_num>
D00   0063   <Team_num>
D00   0065   <My_nid>
D00   0067   <Dads_nid>
D00   0069   <My_tty_nid>
D00   006B   <My_cd_nid>
D00   006D   <Release_num>
D00   006E   <Ndp_save_area>
D00   0070   <Fstack>
D00   0072   <Call_stack_ptr>
D00   0074   <Segment_table_ptr>
D00   0076   <Check_point_sp>
D00   0078   <User_spare>
D00   007E   <Qdb_tid>
D03   07BD   <_my_line>
D03   08E8   <dr>
```

newpos/pos_control.c

```
#include "const.h"

Shutdown_pos( )
{
        Close_remote( );
        detach( POS_PORT );
        Save_all( );
        exit( );
}
```

```
#include "types.h"

#include "const.h"

static Outlet_info _Me;

static Fit_info _Fit[ MAX_FITS ];

Outlet_info *Outlet_information( )

{

        return &_Me;

}

Fit_info *Fit_table( size )

        unsigned *size;

{

        *size = sizeof( _Fit );

        return _Fit;

}

char *Pos_address_1( )

{

        return _Me.ADDRESS1;

}

Set_outlet_info( i )

        Outlet_info *i;

{
```

```
        _Me = *i;
}

Set_fit_record( n, f )
        unsigned n;
        Fit_info *f;
{
        if ( n >= MAX_FITS )
                return;
        else
                memcpy( _Fit + n, f, sizeof( Fit_info ) );
}

Copy_outlet_info( b, len )
        char *b;
        int  len;
{
 memcpy( b, &_Me, len < sizeof( _Me ) ? len : sizeof( _Me ) );
}

Copy_fit_record( n, b, len )
        int  n;
        char *b;
        int  len;
{
        if ( n < MAX_FITS )
        {
                memcpy( b, _Fit + n,
```

```
            len < sizeof( Fit_info ) ? len : sizeof( Fit_info ) );
            return 1;
        }
        return 0;
}

Pos_info_available( )
{
        return _Fit[ 0 ].CARD_PREFIX[ 0 ] != '\0' &&
                    _Me.ADDRESS1[ 0 ] != '\0';
}

Pos_yymm( )
{
        int yr,
                mth,
                day,
                hr,
                min,
                sec;

        calsplit( calnow( ), &yr, &mth, &day, &hr, &min, &sec );

        yr -= 1900;
        return yr * 100 + mth;
}

Pos_timeout_for( track2 )
        char *track2;
```

```
{
        Fit_info *f,
                        *Look_up_card( );
        if ( f = Look_up_card( track2 ) )
                return f->TIMEOUT;

        return 0;
}

Cards_expiry_yymm( track2 )
        char *track2;
{
        Fit_info *f,
                        *Look_up_card( );

        f = Look_up_card( track2 );
        return Fit_expiry_date( f, track2 );
}


Fit_info *Look_up_card( data )
        char *data;
{
        char *d;
        int  i;
        Fit_info *f = _Fit;

        if ( *data == '\0' )
                return 0;
```

```
        for ( i = 0; i < MAX_FITS; i++, f++ )
                if ( memcmp( data, f->CARD_PREFIX,
                                strlen( f->CARD_PREFIX) ) == 0 )
                        return f;

        return 0;
}

Fit_expiry_date( f, data )
        Fit_info *f;
        char     *data;
{
        char buffer[ 5 ];
        int  i;

        if ( f == 0 )
                return 0;

        if ( f->EXPIRY_DATE_RELATIVE == 0 )  /* use fixed */
        {
                data += f->EXPIRY_DATE_FIXED;
                data--;
        }
        else
        {
                for ( i = 0; i < f->EXPIRY_DATE_RELATIVE; i++ )
                data = Position_past_field_separator( data );
        }
```

```
        zero( buffer, sizeof( buffer ) );
        memcpy( buffer, data, 4 );
        return atoi( buffer );
}

char _my_line;

Set_my_line( s )
        char *s;
{
        _my_line = *s;
}

char My_line()
{
        return _my_line;
}

Update_outlet_info( m )
        char *m;
{
        char *Set_ascii_field( );

        if ( strlen( m ) < 160 )
                return;

        Make_into_strings( m );
        m = Set_ascii_field( m, _Me.OUTLET_NAME,
                                sizeof( _Me.OUTLET_NAME ) );
        m = Set_ascii_field( m, _Me.ADDRESS1,
```

```
                                    sizeof( _Me.ADDRESS1 ) );
        m = Set_ascii_field( m, _Me.ADDRESS2,
                                    sizeof( _Me.ADDRESS2 ) );
        m = Set_ascii_field( m, _Me.PROVINCE,
                                    sizeof( _Me.PROVINCE ) );
        m = Set_ascii_field( m, _Me.POSTAL_CODE,
                                    sizeof( _Me.POSTAL_CODE ) );
        m = Set_ascii_field( m, _Me.TELEPHONE,
                                    sizeof( _Me.TELEPHONE ) );
        m = Set_ascii_field( m, _Me.SERVICE_STATION_NUMBER,
                            sizeof( _Me.SERVICE_STATION_NUMBER ) );
        m = Set_ascii_field( m, _Me.PROVINCE_NUMBER,
                                sizeof( _Me.PROVINCE_NUMBER ) );
        m = Set_ascii_field( m, _Me.OUTLET_NUMBER,
                                    sizeof( _Me.OUTLET_NUMBER ) );
        m = Set_ascii_field( m, _Me.DEVICE_NUMBER,
                                    sizeof( _Me.DEVICE_NUMBER ) );
        m = Set_ascii_field( m, _Me.SECURITY_CODE,
                                    sizeof( _Me.SECURITY_CODE ) );
}

Update_fit_table( m )
        char *m;
{

        int l = strlen( m ) - 2;
                records;
```

```
        i;

    Fit_info *f = _Fit;

    if ( l < 42 || ( l % 42 ) != 0 )
            return;

    records = l / 42;
    if ( records > MAX_FITS )
            records = MAX_FITS;

    zero( _Fit, sizeof( _Fit ) );
    Make_into_strings( m );
    for ( i = 0; i < records; i++, m += 42, f++ )
            Decode_and_load_fit_record( m, f );
}

Decode_and_load_fit_record( m, f )
    char *m;
    Fit_info *f;
{
    char *Set_ascii_field( ),
            *p,
            c;

    Set_ascii_field(  m, f->CARD_PREFIX,
                                sizeof( f->CARD_PREFIX ) );

    for ( p = f->CARD_PREFIX; *p && *p != ' '; p++ )
            ;
```

```
        if ( *p == ' ' )
                *p = '\0';

    m += 6;
        f->TIMEOUT = atoi( m );
        m += 4;
        f->ACCT_FIXED = atoi( m );
        m += 3;
        f->ACCT_FIXED_LENGTH = atoi( m );
        m += 3;
        f->EXPIRY_DATE_RELATIVE = atoi( m );
        m += 3;
        f->EXPIRY_DATE_FIXED = atoi( m );
        c = *(m + 21);
        f->CARD_CATEGORY = c - '0';
}

char *Set_ascii_field( data, buf, len )
        char *data, *buf, *len;
{
        if ( *data == EOT )
                return;

        zero( buf, len );
        for ( --len ; *data && len; len-- )
                *buf++ = *data++;

        return data + strlen( data ) + 1;
}
```

```
Make_into_strings( m )
        char *m;
{
        char *Next_separator( ),
                *p;

 for ( p = Next_separator( m ); p; p = Next_separator( p ) )
                *p++ = '\0';
}

char *Next_separator( s )
        char *s;
{
        for ( ; *s && *s != '/'; s++ )
                ;

        return *s ? s : 0;
}
```

newpos/pos_status.c

```
Pos_status( )
{
        return Pos_info_available( ) && Pos_coms_available( ) &&
                Requests_available( ) && Power_good( );
}

static int _try_counter,
                _hits;

Maintain_pos_status( )
```

```
                    /* one hit in 10 seconds means things ok */
{
        if ( _try_counter == 20 )
        {
                _try_counter = 0;
                _hits        = 0;
        }
        _try_counter++;
        _hits += Remote_available_now( );
}

Pos_coms_available( )
{
 return _hits + Remote_available_now( );
                                        /* in case we just reset */
}
```

newpos/power.c

```
#define MAX_USERS  10

static unsigned _power;
                /* we could be in a power down situation */
Set_power_status( up )
        unsigned up;
{
        _power = up;
}

Power_good( )
{
```

```
        return _power;
}

static unsigned user[ MAX_USERS ];

Register_hydro_user( num, atask )
        unsigned num. atask;
{
        num--;
        user[ num ] = atask;
}

Tell_hydro_users( )
{
        unsigned i;
        for ( i = 0; i < MAX_USERS ; i++ )
        {
                if ( user[ i ] == 0 )
                        continue;
                power_event( user[ i ], _power ? "POWER_GOOD" :
                                                "POWER_FAIL" );
        }
}
```

newpos/queue.c

```
#include "types.h"

static Pos_request __dummy;
static Pos_request *_top,
                        *_bottom;
```

```
Initialize_queue( )
{
        _top      = &__dummy;
        _bottom   = &__dummy;
}

Enqueue_request( r )
        Pos_request  *r;
{
        _bottom->NEXT = r;
        r->PREV = _bottom;
        r->NEXT = NULL_REQUEST;
        _bottom = r;
}

Dequeue_request( r )
        Pos_request *r;
{
        Pos_request *n,
                                        *p;
        p = r->PREV;
        n = r->NEXT;
        p->NEXT = n;
        if ( n )
                n->PREV = p;
        else
                _bottom = p;
}

Pos_request *First_request( )
```

```
{
        return _top->NEXT;
}

Pos_request *Next_request( r )
        Pos_request *r;
{
        return r->NEXT;
}
```

newpos/queue_auth.c

```
#include "^dave_request.h"
#include "types.h"
#include "const.h"

Enqueue_authorization_request( p, t )
        Pos_request *p;
        Transaction *t;
{
char *Next_sequence( );

p->CLIENT         = t->CLIENT;
p->TRY_COUNTER    = 0;
p->STATE          = AWAITING_SEND;
p->TIMEOUT        = Pos_timeout_for( t->TRACK2 );
p->CREATION_TIME  = calnow( );
p->EXPIRY_TIME    = p->CREATION_TIME + Current_remote_timeout( );
p->REQUEST_TYPE   = AUTHORIZATION_REQUEST;

Encode_auth_link_message( p, t );
```

```
        Enqueue_request( p );
        Log_queued_authorization( );
}

Encode_auth_link_message( p, t )
        Pos_request *p;
        Transaction *t;
{
        char *c = p->LINK_MESSAGE;

        if ( t->AMOUNT == 0 )
                t->AMOUNT = FIXED_FLOOR_LIMIT;

        Set_link_tag( &p->TAG, SOH, AUTHORIZATION_REQUEST );
        zero( p->LINK_MESSAGE, sizeof( Link_message ) );
        c += Encoded_amount( c, t->AMOUNT );
        c += Encoded_track2( c, t->TRACK2 );
        *c++ = EOT;
        p->BCC = Bcc_of( &p->TAG );
}
```

newpos/queue_cap.c

```
#include "^dave_request.h"
#include "types.h"
#include "const.h"

Enqueue_capture_request( p, t )
        Pos_request *p;
        Transaction *t;
{
```

```
        char *Next_sequence( );

        p->CLIENT          = t->CLIENT;
        p->TRY_COUNTER     = 0;
        p->STATE           = AWAITING_SEND;
        p->CREATION_TIME = calnow( );
        p->EXPIRY_TIME     = 0L;
        p->REQUEST_TYPE    = CAPTURE_REQUEST;

        Encode_capture_link_message( p, t );

        Enqueue_request( p );
        Log_queued_capture( );
}

Encode_capture_link_message( p, t )
        Pos_request *p;
        Transaction *t;
{
        char *c = p->LINK_MESSAGE;

        Set_link_tag( &p->TAG, SOH, CAPTURE_REQUEST );
        zero( p->LINK_MESSAGE, sizeof( p->LINK_MESSAGE ) );
        c += Encoded_amount( c, t->AMOUNT );
        c += Encoded_track2( c, t->TRACK2 );
        *c++ = t->LANGUAGE_CODE;
        c += Encoded_authorization( c, t->AUTH );
        c += Encoded_sales_capture( c, t );
        *c++ = EOT;
        p->BCC = Bcc_of( &p->TAG );
}
```

```
#include "^dave_request.h"

#include "types.h"

#include "const.h"

Enqueue_table_request( )

{

        Pos_request *p;

        p = Allocate_request( );

        p->CLIENT         = 0;

        p->TRY_COUNTER    = 0;

        p->STATE          = AWAITING_SEND;

        p->CREATION_TIME  = calnow( );

        p->EXPIRY_TIME    = 0L;

        p->REQUEST_TYPE   = TABLE_REQUEST;

        Encode_table_request_link_message( p );

        Enqueue_request( p );

}

Encode_table_request_link_message( p )

        Pos_request *p;

{

        char *c = p->LINK_MESSAGE;

        Set_link_tag( &p->TAG, SOH, TABLE_REQUEST );

        zero( p->LINK_MESSAGE, sizeof( p->LINK_MESSAGE ) );
```

```
        *c++ = EOT;

        p->BCC = Bcc_of( &p->TAG );

}
```

newpos/recd_message.c

```
#include "types.h"

#include "const.h"

Process_received_message( )

{

        char *m,

                *The_message( );

        if ( Calculated_bcc( ) !=  Received_bcc( ) )

        {

                Log_lrc_error( );

                Reset_message_buffer( );

                return;

        }

        m = The_message( );

        switch( *m )

        {

        case ACK:

        case NAK:       Process_link_response( m );     break;

        case SOH:       Process_host_reply( m );        break;

        }

        Reset_message_buffer( );

}
```

```
Process_link_response( l )
Link_response *l;
{
        Pos_request *r;

        if ( All_purpose_nak( l ) )
                Purge_queues( );
        else if ( r = Match_link_response( l ) )
                switch( l->TAG.PACKET_TYPE )
                {
                case ACK:  Positive_link_response( r ); break;
                case NAK:  Negative_link_response( r ); break;
                }
        else
                Log_unsolicited_link_response( );
}

/*      mark request reply pending          */

Positive_link_response( r )
Pos_request *r;
{
        r->STATE = AWAITING_HOST_REPLY;
        if ( r->REQUEST_TYPE == AUTHORIZATION_REQUEST )
r->EXPIRY_TIME = calnow( ) + r->TIMEOUT + Current_remote_timeout( );
}

/* if this is an authorization request, abort it */
/* if this is a capture request, enable retry    */
```

```
Negative_link_response( r )
Pos_request *r;
{
        switch( r->REQUEST_TYPE )
        {
        case CAPTURE_REQUEST:
                Log_link_refusal( );
                r->STATE = AWAITING_SEND;
                r->EXPIRY_TIME = 0L;
                break;
        case AUTHORIZATION_REQUEST:
                Abort_authorization_request( r, LINK_REFUSAL );
                break;
        }
}

/* disaster has befallen the pos link */
/* all queue entries are "timed out"  */

Purge_queues( )
{
        Pos_request *r;

        for ( r = First_request( ); r; r = Next_request( r ) )
                Negative_link_response( r );
}
```

```
All_purpose_nak( l )
Link_response *l;
{
 return l->TAG.PACKET_TYPE == NAK && memcmp( l->TAG.TYPE,
                                                    "0000", 4 ) == 0;
}
```

newpos/remoteio.c

```
#include "const.h"
#include "types.h"
#include <stdio.h>
#include <setjmp.h>

static FILE *pos_in,
                    *pos_out;

static unsigned io_port;

Open_remote( device_name, trap, error )
        char    *device_name;
        jmp_buf *trap;
        int     error;
{
        disallow( );
        pos_in  = my_open( device_name, "rv",  trap, error );
        pos_out = my_open( device_name, "wvu", trap, error );
        flush_input( pos_in );
        io_port = Address_of( pos_in );
}
```

```
static int _secs;

Set_remote_timeout( secs )
        unsigned secs;
{
        _secs = secs;
}

Current_remote_timeout( )
{
        return _secs;
}

#define DCD 0x0080
#define DSR 0x0020
#define MSR 6

Remote_available_now( ) /* determined by 8250 Data Carrier Detect */
{
        return ( io_in( io_port + MSR ) & DSR ) ? 1 : 0;
}

Close_remote( )
{
        fclose( pos_in );
        fclose( pos_out );
}

Transmit( r )
Pos_request *r;
{
```

```
r->TRY_COUNTER++;
if ( Remote_available_now( ) )
{
        fput( &r->TAG, strlen( &r->TAG ), pos_out );
        fput( &r->BCC, 1, pos_out );
        return 1;
    }
    else
    {
        Log_remote_unavailable( );
        return 0;
    }
}

Nextchar( )
{
    int t = LINE_TIMED_OUT;

    if ( !char_waiting( pos_in ) )
        Delay( ONE_TENTH );

    if ( char_waiting( pos_in ) )/* this is an 8 bit line */
        t = getc( pos_in );

    return t;
}
```

```
#include "types.h"
#include "const.h"

char *Request_type( type )
        unsigned type;
{
        char *s;

        switch( type )
        {
        case AUTHORIZATION_REQUEST:   s = "0100"; break;
        case CAPTURE_REQUEST:         s = "0220"; break;
        case TABLE_REQUEST:               s = "0350"; break;
        default:                      s = "0000"; break;
        }
        return s;
}

Reply_type( atype )
        char *atype;
{
        if ( memcmp( atype, "0110", 4 ) == 0 )
                return AUTHORIZATION_REPLY;
        else if ( memcmp( atype, "0100", 4 ) == 0 )
                return AUTHORIZATION_REQUEST;
        else if ( memcmp( atype, "0230", 4 ) == 0 )
```

```
            return CAPTURE_REPLY;
        else if ( memcmp( atype, "0220", 4 ) == 0 )
            return CAPTURE_REQUEST;
        else if ( memcmp( atype, "0351", 4 ) == 0 )
            return OUTLET_TABLE_REQUEST;
        else if ( memcmp( atype, "0352", 4 ) == 0 )
            return FIT_TABLE_REQUEST;
        else
            return 0;
}
```

newpos/restore.c

```
#include "types.h"
#include "const.h"
#include <stdio.h>

Restore_all( )
{
        Pos_request *r,
                        p;
        FILE *f;
        Statistics  *The_stats( );
        Outlet_info *Outlet_information( );
        Fit_info *Fit_table( ),
                    *i;
        unsigned size;

        if ( f = fopen( POS_DATA_STORE, "r" ) )
        {
```

```
log_pos( "restoring data" );
fget( &size, sizeof( size ), f );
Set_sequence_number( size );
fget( &size, sizeof( size ), f );
Set_remote_timeout( size );
fget( The_stats( ), sizeof( Statistics ), f );
fget( Outlet_information( ), sizeof( Outlet_info ), f );
i = Fit_table( &size );
fget( i, size, f );
while ( fget( &p, sizeof( p ), f ) == sizeof( p ) )
{
        if ( (r = Allocate_request( ) ) == NULL_REQUEST )
                r = Allocate_reserve( );
        if ( r )
        {
                *r = p;
                r->NEXT = NULL_REQUEST;
                Enqueue_request( r );
        }
}
fclose( f );
f = fopen( POS_DATA_STORE, "w" );
fclose( f );
      }
}
```

```
#include "types.h"
#include "const.h"
#include <stdio.h>

Save_all( )
{
        FILE *f;
        unsigned size;
        Pos_request *p,
                                *t;
        Statistics *The_stats( );
        Outlet_info *Outlet_information( );
        Fit_info *Fit_table( ),
                        *i;

        if ( f = fopen( POS_DATA_STORE, "w" ) )
        {
         size = Sequence_number( );
         fput( &size, sizeof( size ), f );
         size = Current_remote_timeout( );
         fput( &size, sizeof( size ), f );
         fput( The_stats( ), sizeof( Statistics ), f );
         fput( Outlet_information( ), sizeof( Outlet_info ), f
                i = Fit_table( &size );
                fput( i, size, f );
```

```
            for ( p = First_request( ); p; p = t )
            {
                    t = Next_request( p );
                    fput( p, sizeof( *p ), f );
        Dequeue_request( p );
                    Deallocate_request( p )
            }
            fclose( f );
    }
    else
            log_pos( "CATASTROPHE - CANT SAVE DATA" );
}
```

newpos/sequence.c

```
#include "types.h"

#define MAX_SEQUENCE 999

static unsigned _sequence;
static char _seqbuf[ sizeof( Asequence ) + 1 ];

char *Next_sequence( )
{
    tsprintf( _seqbuf, "%03u", _sequence++ );
    if ( _sequence > MAX_SEQUENCE )
            _sequence = 0;
    return _seqbuf;

}
```

```
Set_sequence_number( n )
        unsigned n;
{
        _sequence = n;
}

unsigned Sequence_number( )
{
        return _sequence;
}
```

newpos/stats.c

```
#include "const.h"
#include "types.h"

static Statistics _s;

Initialize_statistics( )
{
        zero( &_s, sizeof( _s ) );
        _s.START = calnow( );
}

Reset_statistics( )
{
        unsigned queued_a,
                        queued_c;
```

```
        queued_a = _s.QUEUED_AUTHORIZATIONS;
        queued_c = _s.QUEUED_CAPTURES;

        Initialize_statistics( );

        _s.QUEUED_AUTHORIZATIONS = queued_a;
        _s.QUEUED_CAPTURES = queued_c;
}

Statistics *The_stats( )
{
        Compute_oldest_capture( );
        return &_s;
}

Copy_statistics( b, len )
        char *b;
{
        Compute_oldest_capture( );
        memcpy( b, &_s, len < sizeof( _s ) ? len : sizeof( _s ) );
}

Log_remote_unavailable( )
{
        _s.LINK_DOWNS++;
}

Compute_oldest_capture( )
{
        Pos_request *p;
        Timestamp  oldest,
```

```
        now = calnow( );

oldest = now;
for ( p = First_request( ); p; p = Next_request( p ) )
if ( p->REQUEST_TYPE == CAPTURE_REQUEST && p->
                                CREATION_TIME <= oldest )
        oldest = p->CREATION_TIME;

_s.OLDEST_CAPTURE = oldest == now ? 0L : oldest;
}


Log_queued_capture( )
{
        _s.QUEUED_CAPTURES++;
}

Log_queued_authorization( )
{
        _s.QUEUED_AUTHORIZATIONS++;
}

Log_link_timeout( )
{
        _s.LINK_TIMEOUTS++;
}

Log_aborted_authorization( reason )
        unsigned reason;
{
        switch( reason )
        {
```

```
case HOST_TIMEOUT:          Log_host_timeout( );          break;
case LINK_UNAVAILABLE:      Log_remote_unavailable( );    break;
case NO_LINK_RESPONSE:      Log_link_timeout( );          break;
case LINK_REFUSAL:          Log_link_refusal( );          break;
}
_s.AUTH_ABORTS++;
        _s.QUEUED_AUTHORIZATIONS--;
}

Log_link_refusal( )
{
        _s.LINK_REFUSALS++;
}

Log_host_timeout( )
{
        _s.HOST_TIMEOUTS++;
}

Log_unsolicited_link_response( )
{
        _s.LINK_SYNC_ERRORS++;
}

Log_unsolicited_host_reply( )
{
        _s.HOST_SYNC_ERRORS++;
}

Log_authorization_reply( p, answer )
```

```
        Pos_request *p;
        unsigned    answer;
{
        Timestamp dt;

        _s.AUTH_COUNT++;
_s.QUEUED_AUTHORIZATIONS--;

if ( answer )
        _s.CARDS_AUTHORIZED++;
else
        _s.CARDS_DECLINED++;

dt = gettime( ) - p->CREATION_TIME;
if ( _s.SHORTEST_AUTH == 0L )
        _s.SHORTEST_AUTH = dt;

if ( dt > _s.LONGEST_AUTH )
        _s.LONGEST_AUTH = dt;

_s.TOTAL_AUTH_SECONDS += dt;
_s.AVERAGE_AUTH_RESPONSE = _s.TOTAL_AUTH_SECONDS / _s.AUTH_COUNT;
}

Log_capture_reply( p )
        Pos_request *p;
{
        Timestamp dt;

        _s.CAPTURE_COUNT++;
        _s.QUEUED_CAPTURES--;
```

```
dt = calnow( ) - p->CREATION_TIME;

if ( _s.SHORTEST_CAPTURE == 0L )

        _s.SHORTEST_CAPTURE = dt;

    if ( dt > _s.LONGEST_CAPTURE )

            _s.LONGEST_CAPTURE = dt;

 _s.TOTAL_CAPTURE_SECONDS += dt;

 _s.AVERAGE_CAPT_RESPONSE = _s.TOTAL_CAPTURE_SECONDS /
                                                _s.CAPTURE_COUNT;

}

Log_lrc_error( )

{

      _s.LRC_ERRORS++;

}

Log_memory_allocation_failure( )

                /* means bad logic bug in system */

{

      _s.INTERNAL_FAILURES++;

}
```

newbies/the_dead.c

```
#include "types.h"

#include "const.h"


Check_for_request_timeouts( )

{

      rq_request *p;

      Timestamp   now = calnow( );
```

```
for ( p = First_request( ); p; p = Next_request( p ) )
        if ( p->EXPIRY_TIME <= now )
                switch( p->REQUEST_TYPE )
                {
                case TABLE_REQUEST:
                        Timeout_table_request( p );
                        break;
                case AUTHORIZATION_REQUEST:
                        Timeout_authorization_request( p );
                        break;
                case CAPTURE_REQUEST:
                 if ( p->STATE == AWAITING_LINK_RESPONSE )
                 {
            p->EXPIRY_TIME = now + Current_remote_timeout( );
                  p->STATE = AWAITING_SEND;
                  Log_link_timeout( );
                          break;
                 }
}

Timeout_table_request( p )
        Pos_request *p;
{
        Dequeue_request( p );
        Deallocate_request( p );
}

Timeout_authorization_request( p )
        Pos_request *p;
```

```
{
    unsigned reason;

    if ( Emulating( ) )
    {
            Send_reply_to_client( p->CLIENT, MAKE_IT_A_PRE_PAY,
                                        "99999", "00", '3' );
            Dequeue_request( p );
            Deallocate_request( p );
            Log_aborted_authorization( 30000 );
            return;
    }

    switch( p->STATE )
    {
    case AWAITING_AEND:         reason = LINK_UNAVAILABLE;
case AWAITING_LINK_RESPONSE: reason = NO_LINK_RESPONSE; break;
case AWAITING_HOST_REPLY:  reason = HOST_TIMEOUT;      break;
}
        Abort_authorization_request( p, reason );
}

Abort_authorization_request( r, reason )
        Pos_request *r;
        unsigned    reason;
{
 Dequeue_request( r );
 Send_reply_to_client( r->CLIENT, MAKE_IT_A_POST_PAY, "00000",
                                                "99", '3' );
```

```
        Log_aborted_authorization( reason );
        Deallocate_request( r );
}
```

newpos/types.h

```
#define MAX_LINK_MESSAGE_LENGTH 128

typedef char Message_type[ 4 ];
typedef char Link_message[ MAX_LINK_MESSAGE_LENGTH ];
typedef long Timestamp;
typedef char Asequence[ 3 ];
typedef unsigned Tid;

typedef struct {
        char            PACKET_TYPE;
        Message_type TYPE;
        char            LINE;           /* either A or B */
        Asequence    SEQUENCE;
} Link_tag;

/* The request data type    */

typedef struct _pr {
        struct _pr *NEXT;           /* queue link      */
        struct _pr *PREV;           /* queue link      */
        Tid      CLIENT;            /* who wants to know    */
        unsigned REQUEST_TYPE;      /* binary of Message type
        unsigned TIMEOUT;           /* how long to wait
        unsigned TRY_COUNTER;
        unsigned STATE;             /* awaiting link resp
                                    /* awaiting repl
```

```
                                        /* awaiting send          */
  Timestamp CREATION_TIME;
  Timestamp EXPIRY_TIME;
  Link_tag TAG;
  Link_message LINK_MESSAGE;            /* what goes out the wire */
  char      BCC;                        /* it goes out too        */
} Pos_request;

#define NULL_REQUEST  (Pos_request *)0

typedef struct {
      Link_tag          TAG;
      char              TERMINATOR;                /* EOT     */
      char              LRC;                       /* LRC     */
} Link_response;

typedef struct {
      Link_tag          TAG;
      Link_message LINK_MESSAGE;
} Host_reply;

typedef struct {
      char OUTLET_NAME[ 31 ];
      char ADDRESS1[ 19 ];
      char ADDRESS2[ 19 ];
      char PROVINCE[ 31 ];
      char POSTAL CODE[ 7 ];
      char TELEPHONE[ 11 ];
      char SERVICE_STATION_NUMBER[ 6 ];
      char PROVINCE_NUMBER[ 3 ];
```

```
        char OUTLET_NUMBER[ 6 ];
        char DEVICE_NUMBER[ 3 ];
        char SECURITY_CODE[ 7 ];
} Outlet_info;

typedef struct {
        char CARD_PREFIX [ 6 ];
        int  TIMEOUT;
        int  ACCT_FIXED;
        int  ACCT_FIXED_LENGTH;
        int  EXPIRY_DATE_RELATIVE;
        int  EXPIRY_DATE_FIXED;
        char CARD_CATEGORY;
} Fit_info;

typedef struct {
        unsigned AMOUNT;
        unsigned PRICE;
        unsigned PRODUCT;
        unsigned VOLUME;
        unsigned CLIENT;
        unsigned DAVE;
        char     LANGUAGE_CODE;
        char     TRACK2[ 80 ];
        char     AUTH[ 10 ];
} Transaction;

typedef struct {
        Timestamp START;
```

```
        Timestamp OLDEST_CAPTURE;
        long      TOTAL_AUTH_SECONDS;
        long      TOTAL_CAPTURE_SECONDS;
        unsigned  LONGEST_AUTH;
        unsigned  SHORTEST_AUTH;
        unsigned  AVERAGE_AUTH_RESPONSE;
        unsigned  AUTH_COUNT;
        unsigned  AUTH_ABORTS;
        unsigned  CARDS_AUTHORIZED;
        unsigned  CARDS_DECLINED;
        unsigned  LONGEST_CAPTURE;
        unsigned  SHORTEST_CAPTURE;
        unsigned  AVERAGE_CAPT_RESPONSE;
        unsigned  CAPTURE_COUNT;
        unsigned  LINK_DOWNS;
        unsigned  LINK_TIMEOUTS;
        unsigned  LINK_REFUSALS;
        unsigned  LINK_SYNC_ERRORS;
        unsigned  HOST_TIMEOUTS;
        unsigned  HOST_REFUSALS;
        unsigned  HOST_SYNC_ERRORS;
        unsigned  LRC_ERRORS;
        unsigned  INTERNAL_FAILURES;
        unsigned  QUEUED_AUTHORIZATIONS;
        unsigned  QUEUED_CAPTURES;
} Statistics;

/* functions */
```

```
Timestamp calnow( );

char *Request_type( ),
        *Replys_response_code( ),
        *Replys_auth_code( ),
         Replys_language_code( ),
         My_line( ),
         Bcc_of( );

Pos_request *Allocate_request( ),
                        *First_request( ),
                        *Allocate_reserve( ),
                        *Next_request( ),
                        *Match_link_response( ),
                        *Match_host_reply( ),
                        *First_auth_awaiting_send( ),
                        *First_capture_awaiting_send( );

Transaction *Decode_transaction( );
```

newpos/dead/pos.c

```
#include "types.h"
#include "const.h"
#include <stdio.h>

main( argc, argv )
      int  argc;
      char *argv[];
{
      Initialize( argc, argv );
```

```
}

Initialize( argc, argv )
        int  argc;
        char *argv[];
{
        Initialize_request_pool( );
        Initialize_queue( );
        Open_remote( argv[ 1 ], initial_trap, NO_DEVICE );
        set_timer_port( POS_PORT );
}

#define TAG1 "0100A999"
#define TAG2 "0100A111"

Test_matching( )
{
Pos_request *r;
Link_response l;
Host_reply h;

r = Allocate_request( );
strcpy( &r->TAG, TAG1 );
r->STATUS = AWAITING_LINK_RESPONSE;
Enqueue_request( r );
r = Allocate_request( );
strcpy( &r->TAG, TAG2 );
r->STATUS = AWAITING_HOST_REPLY;
Enqueue_request( r );
}
```

```
strcpy( &l.TAG, TAG1 );
if ( r = Match_link_response( &l ) )
        tfprintf( stderr, "HIT\n" );
else
        tfprintf( stderr, "NOHIT\n" );

strcpy( &l.TAG, TAG2 );
if ( r = Match_link_response( &l ) )
        tfprintf( stderr, "HIT\n" );
else
        tfprintf( stderr, "NOHIT\n" );

strcpy( &h.TAG, TAG1 );
if ( r = Match_host_reply( &h ) )
        tfprintf( stderr, "HIT\n" );
      else
              tfprintf( stderr, "NOHIT\n" );

      strcpy( &h.TAG, TAG2 );
      if ( r = Match_host_reply( &h ) )
              tfprintf( stderr, "HIT\n" );
      else
              tfprintf( stderr, "NOHIT\n" );
}


test_allocator( )
{
      int i;
      Pos_request *r,
                          *p;
```

```
i = 1;
p = Allocate_request( );
while ( r = Allocate_request( ) )
        i++;

Deallocate_request( p );
tfprintf( stderr, "DR %d\n", Deallocate_request( r ) );

tfprintf( stderr, "%d\n", i );

i = 0;
while ( r = Allocate_request( ) )
        i++;
      tfprintf( stderr, "%d\n", i );
}

test_links( )
{
      Pos_request *r1,
                                  *r2,
                                  *r3;
      r1 = Allocate_request( );
      strcpy( r1->LINK_MESSAGE, "Hello World 1" );
      Enqueue_request( r1 );
      r2 = Allocate_request( );
      strcpy( r2->LINK_MESSAGE, "Hello World 2" );
      Enqueue_request( r2 );
      r3 = Allocate_request( );
      strcpy( r3->LINK_MESSAGE, "Hello World 3" );
      Enqueue_request( r3 );
```

```
        Dump_queue( );
        Dequeue_request( r3 );
        Dequeue_request( r1 );
        Enqueue_request( r1 );
        Dump_queue( );
}
```

newpos/int/admin_int.c

```
/* admin interface to the pos */

#include "^^dave_request.h"
#include "^types.h"
#include "^const.h"

static unsigned    pos_server;
extern request dr;

pos_probe( s, info, ram, line, timer, sequence, power )
        Statistics *s;
        unsigned *info, *ram, *line, *timer, *sequence, *power;
{
        unsigned ls = sizeof ( *s ),
                         lb = sizeof ( dr.string_data );

        zero( dr.string_data, sizeof( dr.string_data ) );
        pos_admin_cmd( 1, PROBE );
        *info     = dr.value2;
        *ram      = dr.value3;
        *line     = dr.value1;
        *timer    = dr.value4;
        *sequence = dr.value5;
```

```
        *power     = dr.value6;
        memcpy( s, dr.string_data, ls < lb ? ls : lb );
}

pos_die( )
{
        pos_admin_cmd( 1, DIE );
}

pos_reset_stats( )
{
        pos_admin_cmd( 1, RESET_STATS );
}

pos_give_me_your_info( i )
        Outlet_info *i;
{
        unsigned li = sizeof ( *i ),
                         lb = sizeof ( dr.string_data );

        zero( dr.string_data, sizeof( dr.string_data ) );
        pos_admin_cmd( 1, YOUR_INFO );
        memcpy( i, dr.string_data, li < lb ? li : lb );
}

pos_give_me_a_fit_record( n, i )
        int n;
        Fit_info *i;
{
        unsigned li = sizeof ( *i ),
                         lb = sizeof ( dr.string_data );
```

```
    zero( dr.string_data, sizeof( dr.string_data ) );
        dr.value1 = n;
        pos_admin_cmd( i, YOUR_FIT_RECORD );
        memcpy( i, dr.string_data, li < lb ? li : lb );
        return dr.value1;
}

pos_delete_fit_record( n )
        int n;
{
        dr.value1 = n;
        pos_admin_cmd( i, DELETE_FIT );
}

pos_load_info( i )
        Outlet_info *i;
{
        unsigned lb = sizeof( dr.string_data );

        memcpy( dr.string_data, i, sizeof( *i ) < lb ?
                                                sizeof( *i ) : lb );
        pos_admin_cmd( i, LOAD_INFO );
}

pos_load_fit( n, i )
        int n;
        Fit_info *i;
{
        unsigned lb = sizeof( dr.string_data );
```

```
        dr.value1 = n;
        memcpy( dr.string_data, i, sizeof( *i ) < lb ?
                                        sizeof( *i ) : lb );
        pos_admin_cmd( 1, LOAD_FIT );
}


pos_set_link_timeout( n )
        unsigned n;
{
        dr.value1 = n;
        pos_admin_cmd( 1, SET_LINK_TIMEOUT );
}

pos_give_queue_entry( n, p )
        unsigned n;
        Pos_request *p;
{
        dr.value1 = n;
        if (pos_server == 0)
                pos_server = detach( POS_PORT );
        dr.opcode   = GIVE_QUEUE_ENTRY;
        dr.client   = event_queue_id( );
        dr.value6   = 1;

        send( pos_server, &dr, p, sizeof( dr ) );
        return p->LINK_MESSAGE[ 0 ] != '\0';
}
```

```
pos_admin_cmd( dave, opcode )
        unsigned dave, opcode;
{
        if (pos_server == 0)
                pos_server = detach( POS_PORT );
        dr.opcode    = opcode;
        dr.client    = event_queue_id( );
        dr.value6    = dave;

        return SEND( pos_server, &dr );
}
```

newpos/int/cfiles

```
admin_int.c
pos_int.c
power_int.c
```

newpos/int/makefile

```
CFLAGS  = -S +Wc,+u
SOURCES = @cfiles
OBJECTS = @objects

^^directory: $(OBJECTS)
        type all done
```

newpos/int/objects

```
admin_int.o
pos_int.o
power_int.o
```

newpos/int/pos_int.c

```
/* dave's interface to the pos */

#include "^^dave_request.h"
#include "^const.h"

extern request dr;
static unsigned    pos_server;

pos_active( dave )
      unsigned dave;
{
      dr.value1 = 0;
      pos_cmd( dave, STATUS_OF_POS, "", "" );
      return dr.value1;
}

char *pos_whats_header_1( dave )
      unsigned dave;
{
      pos_cmd( dave, GIVE_ME_HEADER_1, "", "" );
      return dr.string_data;
}
```

```
pos_whats_cards_date( dave, track2 )
        unsigned dave;
        char      *track2;
{
        dr.value1 = 0;
        pos_cmd( dave, CARDS_EXPIRY_DATE, track2, "" );
        return dr.value1;
}


pos_decode_card( dave, track2 )
        unsigned dave;
        char      *track2;
{
        dr.value1 = 0;
        pos_cmd( dave, WHAT_IS_THIS_CARD, track2, "" );
        return dr.value1;
}

pos_authorize_card( dave, amount, track2 )
        unsigned dave, amount;
        char      *track2;
{
        dr.value2 = amount;
        dr.value1 = 0;
        pos_cmd( dave, AUTHORIZE_CARD, track2, "" );
        return dr.value1;
}

pos_capture_transaction( dave, track2, auth, amount,
                                        grade, volume, price )
```

```
unsigned dave;
        char      *track2, *auth;
        unsigned amount, grade, volume, price;
{
        dr.value2 = amount;
        dr.value3 = price;
        dr.value4 = grade;
        dr.value5 = volume;
        pos_cmd( dave, CAPTURE_SALE, track2, auth );
}

pos_server_alive( )
{
        return detach( POS_PORT );
}

open_pos_server( dave )
        unsigned dave;
{
        return pos_cmd( dave, OPEN, "", "" );
}

pos_cmd( dave, opcode, track2, auth )
        unsigned dave, opcode;
        char      *track2, *auth;
{
        zero( dr.string_data, sizeof( dr.string_data ) );

        if (pos_server == 0)
```

```
        pos_server = detach( POS_PORT );

    dr.opcode    = opcode;

    dr.client    = event_queue_id( );

    dr.value6    = dave;

    COPY_SAFELY( dr.string_data, track2 );

    strncpy( dr.string_data + 60, auth, 7 );

    return SEND( pos_server, &dr );

}
```

```
/* power monitor's interface to the pos */

#include "^^dave_request.h"
#include "^const.h"

extern request dr;

pos_disable_transmissions( )
{
        pos_cmd( 1, DISABLE_TRANSMISSION );
}

pos_enable_transmissions( )
{
        pos_cmd( 1, ENABLE_TRANSMISSION );
}

pos_save_data( )
{
        pos_cmd( 1, SAVE_DATA );
}

static pos_cmd( dave, opcode )
        unsigned dave, opcode;
{
        dr.opcode   = opcode;
        dr.values   = dave;
```

```
        return SEND( detach( POS_PORT ), &dr );
}
```

power/delay.c

```
#include <timer.h>

Delay( ticks )
        unsigned ticks;
{
        set_timer( TIMER_WAKEUP, RELATIVE, ticks );
}
```

power/makefile

```
CFLAGS  = -S
SOURCES = @cfiles
OBJECTS = @objects

pump: $(OBJECTS)
        linkobj c=pump x=objects m=pump.map l=/user/steve/dave
        sort pump.map f=1,2 | copy >pump.map
        copy pump /dave/pump

globals.o: vars.h
```

```
#include <stdio.h>

/* dave's power monitor */

#define THIRTY_SECONDS                    600

#define POWER_GOOD

#define SHUTDOWN_STARTED        2

#define SHUTDOWN_COMPLETE       3

unsigned Current_state;

main( argc, argv )
        int argc;
        char *argv[];
{
        unsigned power;

        Initialize( argc, argv );

        for (;;)
        {
          power = Power_available_now( );
          switch( Current_state )
          {
case POWER_GOOD:          Power_good_state( power );          break;
case SHUTDOWN_STARTED:    Shutdown_started_state( power );    break;
case SHUTDOWN_COMPLETE:   Shutdown_complete_state( power );   break;
```

```
        }
                Delay( THIRTY_SECONDS );
        }
}

Power_good_state( power )
        unsigned power;
{
        if ( !power )
        {
                Current_state = SHUTDOWN_STARTED;
                Log_power( "POWER OFF DETECTED" );
                pos_disable_transmissions( );
        }
}

Shutdown_started_state( power )
        unsigned power;
{
        if ( !power )
        {
                Current_state = SHUTDOWN_COMPLETE;
                pos_save_data( );
                Log_power( "POWER OFF SHUTDOWN COMPLETE" );
        }
        else
        {
```

```
                Current_state = POWER_GOOD;
                pos_enable_transmissions( );
                Log_power( "POWER RESTORED" );
        }
}

Shutdown_complete_state( power )
        unsigned power;
{
        if ( power )
        {
                pos_enable_transmissions( );
                Current_state = POWER_GOOD;
                Log_power( "POWER RESTORED" );
        }
}

Initialize( argc, argv )
        int argc;
        char *argv[];
{
        if ( argc != 2 )
        {
                tfprintf( stderr, "power <device>\n" );
                exit( );
        }
        Current_state = POWER_GOOD;
```

```
    Log_power( "START" );

    if ( !Open_power_monitor( argv[ 1 ] ) )
    {
            Log_power( "no device" );
            exit( );
    }

    Log_power( "READY" );

}
```

power/power.map

```
.Segment:1   0000 to 0ABA (2747 bytes)
.Segment:2   0000 to 018C (397 bytes)
.Segment:3   018D to 023C (176 bytes)
.Total size is 0CF8 (3320) bytes
C01  0053  prologue
C01  005E  epilogue
C01  0067  stk_overflow
C01  007D  <exit>
C01  0083  $ucbeg
C01  0084  <Open_power_monitor>
C01  00CD  <Power_available_now>
C01  0104  <main>
C01  0167  <Power_good_state>
C01  018A  <Shutdown_started_state>
C01  01C2  <Shutdown_complete_state>
C01  01E6  <Initialize>
C01  0241  <Delay>
C01  025C  <Log_power>
C01  0273  <lrequest>
C01  02CB  <pos_disable_transmissions>
C01  02E3  <pos_enable_transmissions>
C01  02FB  <pos_save_data>
C01  0348  <Address_of>
C01  0364  <disallow>
C01  0383  <sleep
```

```
C01  03C9  <abs_sleep>
C01  03EE  <set_timer>
C01  0455  <strncpy>
C01  048F  <strncat>
C01  04C8  <strncmp>
C01  04FB  <set_attr>
C01  0575  <get_attr>
C01  05EF  <set_option>
C01  0661  <get_option>
C01  06C2  <dregister_name>
C01  0868  <find_admin>
C01  08D2  <calloc>
C01  08D8  <malloc>
C01  08DE  <realloc>
C01  08E4  <free>
C01  08E4  <cfree>
C01  08EA  <fopen>
C01  08F0  <fclose>
C01  08F6  <getc>
C01  08FC  <putc>
C01  0902  <ungetc>
C01  0908  <fflush>
C01  090E  <tfprintf>
C01  0914  <tsprintf>
C01  091A  <fget>
C01  0920  <fput>
C01  0926  <fiseek>
```

```
C01  092C  <rewind>
C01  0932  <forward>
C01  0938  <breakable>
C01  093E  <strcat>
C01  0944  <strcmp>
C01  094A  <strcpy>
C01  0950  <strlen>
C01  0956  <send>
C01  095C  <abort>
C01  0962  <unbreakable>
C01  0968  <vc_send_reply>
C01  096E  <vc_create>
C01  0974  <vc_create2>
C01  097A  <vc_create3>
C01  0980  <ker_vc_destroy>
C01  0986  <def_server>
C01  098C  <set_acc_flags>
C01  0992  <set_exception>
C01  0998  <escape_tty>
C01  099E  <hold>
C01  09A4  <unhold>
C01  09AA  <time_slice>
C01  09B0  <task_info>
C01  09B6  <force_ready>
C01  09BC  <set_priority>
C01  09C2  <set_user>
```

```
C01  09C8  <set_slice>
C01  09CE  <modify_flags>
C01  09D4  <set_int_mask>
C01  09DA  <set_int_vec>
C01  09E0  <alloc_mem>
C01  09E6  <receive>
C01  09EC  <reply>
C01  09F2  <attach>
C01  09F8  <detach>
C01  09FE  <await>
C01  0A04  <signal>
C01  0A0A  <read_msg>
C01  0A10  <write_msg>
C01  0A16  <read_port>
C01  0A1C  <csignal>
C01  0A22  <relay>
C01  0A28  <creceive>
C01  0A2E  <io_in>
C01  0A3B  <io_out>
C01  0A49  <set_extra_seg>
C01  0A49  <set_extra_segment>
C01  0A51  <copy>
C01  0A51  <memcpy>
C01  0A7E  <zero>
C01  0A9A  <memset>
D00  0000  <User_sp>
D00  0002  <User_ss>
```

```
D00  0004  <Exc_bits>
D00  0008  <Exc_allow>
D00  000C  <Exc_pending>
D00  0010  <Exc_fp>
D00  0012  <Exc_pc>
D00  0014  <Exc_permit>
D00  0018  <Exit_status>
D00  001A  <Error_status>
D00  001C  <My_tid>
D00  001E  <Dads_tid>
D00  0020  <Break_count>
D00  0021  <My_tty>
D00  0022  stack_base
D00  0024  <Cmd_flags>
D00  0025  <My_priority>
D00  0026  <stdin>
D00  0028  <stdout>
D00  002A  <stderr>
D00  002C  <Free_list>
D00  002E  <End_of_free>
D00  0030  <File_list>
D00  0032  <_Argc>
D00  0034  <_Argv>
D00  0034  stk_limit
D00  0036  SAVE
D00  0038  TEMP
D00  0060  <Code_flags>
D00  0061  <User_num>
D00  0062  <Group_num>
```

```
D00  0063  <Team_num>
D00  0065  <My_nid>
D00  0067  <Dads_nid>
D00  0069  <My_tty_nid>
D00  006B  <My_cd_nid>
D00  006D  <Release_num>
D00  006E  <Ndp_save_area>
D00  0070  <Fstack>
D00  0072  <Call_stack_ptr>
D00  0074  <Segment_table_ptr>
D00  0076  <Check_point_sp>
D00  0078  <User_spare>
D00  007E  <Qdb_tid>
D03  0191  <Current_state>
D03  0195  <dr>
```

power/sample.c

```
#include <stdio.h>

static FILE *power_monitor;

static unsigned io_port;

Open_power_monitor( device_name )
      char    *device_name;
{
disallow( );
if ( ( power_monitor = fopen( device_name, "wvu" ) ) != NULL )
{
        power_monitor  = fopen( device_name, "wvu" );
```

```
            io_port = Address_of( power_monitor );
            return 1;
        }
        return 0;
}

#define DCD 0x0080
#define MSR 6

/* 0 bit means power good, */
/* 1 bit means power fail  */

Power_available_now( ) /* determined by 8250 Data Carrier Detect
{
        int bit;
        bit =  ( io_in( io_port + MSR ) & DCD ) ? 1 : 0;
        return !bit;
}
```

pump/ciile

```
globals.c
lts.c
messages.c
my_timer.c
failure.c
tidle.c
versions.c
pump.c
service_dave.c
```

```
#define GIVE_STATUS                 'S' /* LTS command codes */
#define READ_DISPLAY_DATA           'D'
#define AUTHORIZE                   'C'
#define READ_PRICES                 'B'
#define SET_PRICES                  'G'
#define GIVE_OPTIONS                'O'
#define SET_PRE_PAYMENT             'E'
#define GIVE_PRE_PAYMENT_STATUS     'R'
#define CLEAR_POWER_UP              'P'
#define GIVE_VERSION                'V'
#define SET_SALE_COMPLETE           'T'
#define GIVE_CASH_TOTAL             'X'
#define GIVE_CREDIT_TOTAL           'Y'
#define TURN_MOTOR_OFF              'F'
#define TURN_MOTOR_ON               'N'
#define SET_ALLOCATION              'M'

#define LTS_COMMAND_LENGTH          7

#define HOOK            0x0001   /* LTS Status Bits-Byte 1*/
#define MOTOR           0x0002
#define ZERO_FUEL       0x0004
#define REAL_FUEL_BIT   0x0008
#define SALE_COMPLETE   0x0010

#define POWER_UP        0x0100   /* LTS Status Bits-Byte
```

```
#define PUMP_TIMEOUT          0x0200
#define TEMPERATURE_FAILURE 0x0400
#define PULSER_FAILURE                0x0800
#define LOCAL_PRICE_CHANGE    0x1000
#define NOT_IN_SERVICE                0x2000

#define  LTS_TIMEOUT        0x0001 /* LTS NAK status Bits-Byte 1*/
#define LTS_MESSAGE_LENGTH  0x0002
#define LTS_BCC                               0x0003
#define LTS_SEQUENCE_RANGE  0x0004
#define LTS_SEQUENCE_MATCH    0x0005
#define LTS_ID                                0x0006
#define LTS_CONTEXT                   0x0007
#define LTS_UNKNOWN                   0x0008

#define LTS_AUTH_INVALID 0x0001 /*LTS NAK status bits-Byte 2*/
#define LTS_PUMP_ON_INVALID 0x0002
#define LTS_NO_PREPAY         0x0003
#define LTS_NO_PRICES         0x0004
#define LTS_BAD_DATA          0x0005
#define LTS_DATA_REJECTED     0x0006

#define METER_FACTORS         0x0001
#define PRICE_VALID                   0x0002
#define MANAGER_MODE          0x0004
#define INSPECTOR_MODE                0x0008
#define HANDLE_OFF_HOOK               0x0010
#define TIMEOUT                               -1
#define MAX_MESSAGE                   80
#define ACK                                   0x06
```

```
#define ENQ                    0x05
#define NAK                    0x15
#define DEL                    0x7f
#define MAX_RETRIES            5
#define HALF_SECOND            10
#define FIFTH_SECOND           4
#define ONE_SECOND             20

#define NHOSES                 3
#define LOST_PUMP              'L'
#define BAD_STATUS             'S'

#define UNCHAR(b)   ((b) - '0')
#define TOCHAR(b)   ((b) + '0')

#define TOUCHCOM_MODE          0
#define NATIVE_MODE            1
```

pump/excepts.h

```
#define NO_DEVICE              1
#define NO_TIMER               2
#define NO_STATUS              3
#define NO_PRICES              4
#define USAGE                  10

#define NO_DISPLAY_DATA        5
#define NO_PUMP                6
#define NO_PRESET              7
#define NO_AUTHORIZE           8
#define NO_POWER_RESET         9
```

```
#define NO_SALE_COMPLETE    10
#define NO_VERSION          11
#define BAD_VERSION         12
#define NO_PRICE_CHANGE     13
#define NO_CASH_TOTAL       14
#define NO_CREDIT_TOTAL     15
#define NO_MOTOR_ON         16
#define NO_MOTOR_OFF        17
#define NO_ALLOCATION       18
```

pump/failure.c

```
analyze_and_log_failure( daves_op )
        unsigned daves_op;
{
        char *pf,
                logm[ 80 ];

        if ( ack_status( ) == 0 && nak_status( ) == 0 )
                pf = "link";
        else if ( ack_status( ) && check_character( ) )
                pf = "check";
        else if ( nak_status( ) )
                pf = "nak";
        else
                pf = "status";

tsprintf( logm, "%s failure lop %d dop %d ns %02x as %02x cc %02x
            pf, lts_opcode( ), daves_op,
            nak_status( ), ack_status( ), check_character( ) );
```

```
        log_pump( logm );
}
```

pump/func.h

```
unsigned lts_status (),
                lts_display_data (),
                lts_power_up_reset (),
                lts_good_reply ();

char  *lts_command (),
              *lts_software_version (),
              *lts_data ();
```

pump/globals.c

```
#include "const.h"
#include "pump.h"

#define GBLGEN
#include "vars.h"
```

pump/lts.c

```
#include "const.h"
#include "pump.h"
#include "vars.h"
#include "func.h"
#include "excepts.h"

char _version_buffer [ 15 ];

char *lts_software_version ()
{
```

```
char        *c = lts_command (GIVE_VERSION, 0);
unsigned  i = MAX_RETRIES,
                status = 0;

zero (_version_buffer, sizeof (_version_buffer));

for ( ; i; i-- )
        if ( pump_command (c) )
                if ( lts_good_reply (0) )
                {
                memcpy (_version_buffer, lreply.lr.r_data, 12);
                return _version_buffer;
        }

lts_failure (NO_VERSION);
return 0;
lts_turn_motor_on( )
{
        char        *c = lts_command( TURN_MOTOR_ON, 0 );
        unsigned  i = MAX_RETRIES,
                        status = 0;

        for ( ; i; i-- )
                if ( pump_command( c ) )
                        if ( status = lts_good_reply( 0 ) )
                                return status;

        lts_failure( NO_MOTOR_ON );
}

lts_turn_motor_off( )
{
```

```
        char      *c = lts_command( TURN_MOTOR_OFF, 0 );
        unsigned  i = MAX_RETRIES,
                          status = 0;

        for ( ; i; i-- )
                if ( pump_command( c ) )
                        if ( status = lts_good_reply( 0 ) )
                                return status;

        lts_failure( NO_MOTOR_OFF );
}

lts_change_prices( data )
        char *data;
{
        unsigned i = MAX_RETRIES,
                        len;
        char      *c = lts_command (SET_PRICES, 0);

        for ( ; i; i-- )
        {
                if ( !pump_command (c) )
                        continue;
                if ( lts_good_reply ('K') )
                {
                        c = lts_data ( data, 0, &len);
                        send_command (c, len);
                        return;
                }
        }
```

```
        lts_failure (NO_PRICE_CHANGE);
}

lts_set_allocation_limit( )
{
        unsigned i = MAX_RETRIES,
                        len;
        char      *c = lts_command( SET_ALLOCATION, 0);

        for ( ; i; i-- )
        {
           if ( !pump_command (c) )
                   continue;
           if ( lts_good_reply ('D') )
           {
                   c = lts_data( "007500", 0, &len);
                           /* == credit card "floor" limit */
                   send_command( c, len);
                   return;
           }
        }
        lts_failure( NO_ALLOCATION );
}

lts_cash_totals( hose, b )
        unsigned hose;
        char *b;
{
        unsigned i = MAX_RETRIES,
                        len;
```

```
char      *c = lts_command( GIVE_CASH_TOTAL, hose );

for ( ; i; i-- )
{
        if ( !pump_command( c ) )
                continue;
        if ( lts_good_reply( 0 ) )
        {
                        memcpy( b, lreply.lr.r_data, 25 );
                        return;
                }
        }
        lts_failure( NO_CASH_TOTAL );
}

lts_credit_totals( hose, b )
        unsigned hose;
        char *b;
{
        unsigned i = MAX_RETRIES,
                        len;
        char      *c = lts_command( GIVE_CREDIT_TOTAL, hose );

        for ( ; i; i-- )
        {
                if ( !pump_command( c ) )
                        continue;
                if ( lts_good_reply( 0 ) )
                {
                        memcpy( b, lreply.lr.r_data, 25 );
                        return;
```

```
        }
        }
        lts_failure( NO_CREDIT_TOTAL );
}

unsigned lts_status (h)
        int     h;
{
        char    *c = lts_command (GIVE_STATUS, h);
        unsigned  i = MAX_RETRIES,
                        status = 0;

        for ( ; i; i-- )
                if ( pump_command (c) )
                        if ( status = lts_good_reply (0) )
                        {
                                if (status & POWER_UP )
                                        lts_power_up_reset ();
                                return status;
                        }

        lts_failure (NO_STATUS);
}

unsigned lts_power_up_reset ()
{
        char    *c = lts_command (CLEAR_POWER_UP, 0);
        unsigned  i = MAX_RETRIES,
                        status = 0;

        for ( ; i; i-- )
```

```
    if ( pump command (c) )
            if ( status = lts.good_reply ) {
                    return status;
        lts_failure (NO_POWER_RESET);
}

lts_prices( b )
        char *b;
{
        char *c = lts_command (READ_PRICES, 0);
        int  i  = MAX_RETRIES;

        for ( ; i; i-- )
                if ( pump_command (c) )
                {
                        memcpy (b, lreply.lr.r_data, 24);
                        return;
                }

        lts_failure (NO_PRICES);
}

unsigned lts_display_data (buffer)
        char    *buffer;
{
  char    *c = lts_command (READ_DISPLAY_DATA, selected_hose);
  unsigned i = MAX_RETRIES,
                status;

  for ( ; i; i-- )
          if ( pump_command (c) )
```

```
        if ( status = lts_good_reply (0) )
        {
                memcpy (buffer, lreply.lr.r_data +  2,
                                                    17);
                return status;
        }

    lts_failure (NO_DISPLAY_DATA);
}

lts_preset (amount)
    unsigned amount;
{
    unsigned i = MAX_RETRIES,
                len;
    char     *c = lts_command (SET_PRE_PAYMENT, 0),
                ascii_amount [ 20 ];

    tsprintf (ascii_amount, "%04u", amount);

    for ( ; i; i-- )
    {
        if ( !pump_command (c) )
            continue;
        if ( lts_good_reply ('L') )
        {
            c = lts_data (ascii_amount, 0, &len);
            send_command (c, len);
            return;
        }
    }
```

```
        lts_failure (NO_PRESET);
}

lts_preset_status ()
{
        unsigned i = MAX_RETRIES;

        char *c = lts_command (GIVE_PRE_PAYMENT_STATUS, 0);

        for ( ; i; i--)
        {
                if ( !pump_command (c) )
                        continue;

                if ( lts_good_reply ('M') )
                        return;
        }
        lts_failure (NO_PRESET);
}

lts_sale_complete ()
{
        char *c = lts_command (SET_SALE_COMPLETE, 0);
        int  i  = MAX_RETRIES;

        for ( ; i; i-- )
                if ( pump_command (c))
                        if ( lts_good_reply (0))
                                return;

        lts_failure (NO_SALE_COMPLETE);
```

```
}

lts_authorize (h)
        int     h;
{
        char *c = lts_command (AUTHORIZE, h);
        int  i  = MAX_RETRIES;

        for ( ; i; i-- )
                if ( pump_command (c) )
                        if ( lts_good_reply (0) )
                                return;
        lts_failure (NO_AUTHORIZE);
}

unsigned __ack_status,
                __nak_status,
                __opcode;

char    __check_char;

unsigned lts_good_reply( c )
        char c;
{
        __check_char = c;
        if ( lreply.r_type == ACK )
        {
                __ack_status = lreply.lr.r_status;
                if ( c == 0  )
                        return __ack_status;
                else
```

```
                return lreply.lr.r_data [ 0 ] == __check_char;
        }
        else
                __nak_status = lreply.lr.r_data [ 0 ];
        return 0;
}

clear_lts_status( opcode )
        unsigned opcode;
{
        __ack_status = 0;
        __nak_status = 0;
        __opcode     = opcode;
}

check_character( )
{
        return __check_char;
}

ack_status( )
{
        return __ack_status;
}

nak_status( )
{
        return __nak_status;
}

lts_opcode( )
```

```
{
        return __opcode;
}

lts_failure( code )
        int code;
{
        longjmp( *selected_trap, code );
        code += 1;
}
```

pump/makefile

```
CFLAGS  = -S
SOURCES = @cfiles
OBJECTS = @objects

pump: $(OBJECTS)
        linkobj c=pump x=objects m=pump.map l=/user/steve/dave
        sort pump.map f=1,2 | copy >pump.map
        copy pump /dave/pump

globals.o: vars.h
```

pump/messages.c

```
#include "const.h"
#include "pump.h"
#include "vars.h"

static char lts_buf [ LTS_COMMAND_LENGTH * 5 ] = { ENQ };

lts_data (data, h, len)
```

```
        char    *data;
        int             h, *len;
{
        register char *c = lts_buf + 1;

        *c++ = '1';                     /* sequence number  */
        *c++ = TOCHAR(pump_number);     /* id field - pump  */
        *c++ = TOCHAR(h);               /* id field - hose  */
        strcpy (c, data);
        c += strlen (data);
       *c++ = DEL;                      /* end of message   */
        *c++ = calculate_bcc (lts_buf, c - lts_buf);
        *len = c - lts_buf;

        return lts_buf;
}


char *lts_command (opcode, h)
        char    opcode;
        int     h;
{
        register char *c = lts_buf + 1;

        *c++ = '1';                     /* sequence number  */
        *c++ = TOCHAR(pump_number);     /* id field - pump  */
        *c++ = TOCHAR(h);               /* id field - hose  */
        *c++ = opcode;
       *c++ = DEL;                      /* end of message   */
        *c++ = calculate_bcc (lts_buf, LTS_COMMAND_LENGTH - 1);

        return lts_buf;
```

```
}

calculate_bcc (m, l)
        char *m;
        int  l;
{
        register int bcc = 0;
        register char *p = m;

        for ( ; l; l-- )
                bcc ^= *p++;

        return bcc;
}

send_command (m, len)
        char *m;
        int  len;
{
        fflush (input);
        fput (m, len, output);
}

pump_in (data)
        char *data;
{
        int i,
            c;

        *data = 0;                      /* assume failure     */

        for ( i = 0; i < 20; i++ )
```

```
                    /* look for start of message */
        switch ( c = nextchar () )
        {
    case ACK:
    case NAK:       return get_message (c, data);  break;
    default:        break;
        }
    return 0;           /* no start, so no  message  */
}

get_message (c; data)
    int  c;
    char *data;
{
int bcc,
        i,
        num_chars = 1;

bcc     = c;                /* initialize bcc      */
*data++ = c;                /* save start character */
for ( i = 0; i < 20 && c != DEL; )
                /* number of timeouts allowed */
        if ( (c = nextchar ()) != TIMEOUT )
        {
         if  ( num_chars == MAX_MESSAGE - 2)
                            /* don't overflow */

         {
                *data = '\0';
                return 0;       /* message is too big */
```

```
            }
            else
            {
            *data++ = c; /* just store the character */
            bcc ^= c; /* update bcc          */
            num_chars++;/* update chars rec'd count */
            }
        }
        else                /* timeout and count it  */
            i++;
if ( i == 20 )              /* must have timed out */
            return 0;
    else
            *data = '\0';
    return bcc == nextchar ();  /* bad bcc or a timeout */
}

pump_command( c )
    char *c;
{
    send_command( c, LTS_COMMAND_LENGTH );
    zero( &lreply, sizeof( lreply ) );
    clear_lts_status( c [ 4 ] );          /* save the opcode */

    return pump_in( &lreply );
}

#define ONE_TENTH_SECOND        2
```

```
nextchar ()
{
        int t = TIMEOUT;

        if ( char_waiting (input) )
                t = getc (input) & 0x7f;
        else
        {
                delay (ONE_TENTH_SECOND);
                                /* inter-character timeout */
                if ( char_waiting (input) )
                        t = getc (input) & 0x7f;
        }
        return t;
}
```

pump/my_timer.c

```
#include <timer.h>

static unsigned timer_running,
                        my_port;

set_timer_port (port)
        unsigned port;
{
        my_port = port;
}

reset_my_timer ()
{
        timer_running = 0;
```

```
}

cancel_my_timer ()
{
        if (timer_running)
                set_timer (TIMER_CANCEL, RELATIVE, 0, 0, my_port);
        timer_running = 0;
}

set_my_timer (ticks)
        unsigned ticks;
{
        cancel_my_timer ();
        set_timer (TIMER_SIGNAL, RELATIVE, ticks, 0, my_port);
        timer_running = 1;
}

delay (ticks)
        unsigned ticks;
{
        cancel_my_timer ();
        set_timer (TIMER_WAKEUP, RELATIVE, ticks);
}
```

pump/objects

```
pump.o
service_dave.o
lts.o
failure.o
```

```
tidle.o

versions.o

my_timer.o

messages.o

globals.o
```

pump/pump.c

```
#include "const.h"

#include "pump.h"

#include "vars.h"

#include "func.h"

#include "excepts.h"


static unsigned timer_port;

main( argc, argv )

        int  argc;

        char *argv[];

{

        unsigned task,

                        code;

        request p;

        if ( code = setjmp (initial_trap) )

                initial_error (code);

        else

                initialize (argc, argv);

        for ( ;; )

        {
```

```
            task = RECEIVE ANY(&p);
            if ( (task >> 8) == timer_port )
                    timer_fired( );
        else
                    service_dave (task, &p);
            set_my_timer( ONE_SECOND );
        }
}

initialize (pc, parms)
        int  pc;
        char *parms[];
{
        selected_trap = &initial_trap;

        if (pc != 3 && pc != 4)
                longjmp (initial_trap, USAGE);

        if (pc == 4)
                debug = strcmp(parms[3],"+d") == 0;

        log_pump ("start");
        set_timer_port (timer_port = atoi(parms [ 1 ]));
        disallow ();
 input = my_open (parms [ 2 ], "rv", initial_trap, NO_DEVICE);
 output = my_open (parms [ 2 ], "wvu", initial_trap, NO_DEVICE);
/*
   bulloch_output = my_open (parms [ 3 ], "wvu", initial_trap,
                                                NO_DEVICE);
*/
```

```
            longjmp (initial_trap, NO_TIMER);

        flush_input (input);

        initialize_pump( );

        set_my_timer (1);

        log_pump ("ready");

}

timer_fired ( )

{

        reset_my_timer( );

        selected_trap = &idle_trap;

        if ( setjmp( selected_trap ) )

                tell_dave_about_it( );

        else

                touchcom_idle_timer( );

}

initialize_pump ()

{

        unsigned status;

        if (!valid_version (lts_software_version()))

                longjmp (selected_trap, BAD_VERSION);

        status      = lts_status (0);

        pump_number = UNCHAR(lreply.r_pump);

        lts_set_allocation_limit( );
```

```
}

initial_error (code)
        unsigned code;
{
        char *m;

        switch (code)
        {
        case NO_DEVICE: m = "no serial channel";        break;
        case NO_TIMER:  m = "no timer";                 break;
        case NO_PRICES: m = "no prices";                break;
        case NO_STATUS: m = "no status";                break;
        case BAD_VERSION: m = "bad version";            break;
        case NO_ALLOCATION:  m = "no allocation";       break;
        case USAGE:     usage ();                       break;
        }
        log_pump( m );
        exit (1);
}

usage ()
{
        tfprintf (stderr,
            "pump timer_port pump device bulloch_device +d\n");
        exit (1);
}
```

pump/pump.h

```
#include "/user/steve/dave/dave_request.h"
```

```
#define PUMP_TASK                "/dave/pump"


#define D_READY_FOR_FILL                1
#define D_HOSE_SELECTED                 2
#define D_FILLING_DATA                  3
#define D_PRESET_THE_PUMP               4
#define D_STATUS_REQUEST                6
#define D_PRICES                        7
#define D_OPEN                          8
#define D_NATIVE                        10
#define D_TOUCHCOM                      11
#define D_AUTHORIZE                     12
#define D_SET_SALE_COMPLETE             13
#define D_GIVE_ID                       14
#define D_BE_QUIET                      15
#define D_REPORT_OUT_OF_SERVICE         16
#define D_HOSE_FILLED                   17
#define D_IS_HOOK_DOWN                  18
#define D_CHANGE_PRICES                 19
#define D_HALT_PUMP                     20
#define D_RESTART_PUMP                  21
#define D_HOSE_TOTALS                   22
#define D_PUMP_IS_HOOK_DOWN_NOW         23
typedef struct {
        char    r_type;
        char    r_seq;
        char    r_pump;
        char    r_hose;
        union {
```

```
            unsigned r_status;
            char     r_data [ MAX_MESSAGE ];
        } lr;
} lts_reply;
```

pump/pump.map

```
 .Segment:1   0000 to 2394 (9109 bytes)
 .Segment:2   0000 to 034B (844 bytes)
 .Segment:3   034C to 0685 (874 bytes)
 .Total size is 2A4B (10827) bytes
C01  0053  prologue
C01  005E  epilogue
C01  0067  stk_overflow
C01  007D  <exit>
C01  0083  $ucbeg
C01  0084  <main>
C01  00F9  <initialize>
C01  01E4  <timer_fired>
C01  020D  <initialize_pump>
C01  024E  <initial_error>
C01  02B1  <usage>
C01  02D3  <service_dave>
C01  033C  <_service>
C01  03FC  <_hook_down_now>
C01  0447  <_price_request>
C01  046D  <_read_hose_totals>
C01  04C2  <_change_prices>
C01  05C8  <_id_request>
```

| | | |
|---|---|---|
| C01 | 0613 | <_hose_filled> |
| C01 | 0635 | <_filling_data> |
| C01 | 0661 | <_be_quiet> |
| C01 | 0671 | <_tell_me_your_troubles> |
| C01 | 0681 | <dave_wants_to_know> |
| C01 | 0690 | <dave_has_been_told> |
| C01 | 06A0 | <_ready_to_fill> |
| C01 | 072B | <_preset_the_pump> |
| C01 | 0753 | <_set_sale_complete> |
| C01 | 0772 | <_status_request> |
| C01 | 07C5 | <_hose_selected> |
| C01 | 086D | <_authorize_pump> |
| C01 | 08B6 | <preset_amount_pumped> |
| C01 | 0928 | <allocation_limit_reached> |
| C01 | 0953 | <do_transaction> |
| C01 | 097C | <wait_for_fuel_flow> |
| C01 | 0A76 | <change_of_hose> |
| C01 | 0AA8 | <wait_for_filling_stop> |
| C01 | 0B73 | <_wait_for_hook_down> |
| C01 | 0BDB | <check_for_operator_abort> |
| C01 | 0C36 | <lts_software_version> |
| C01 | 0CBB | <lts_turn_motor_on> |
| C01 | 0D1E | <lts_turn_motor_off> |
| C01 | 0D81 | <lts_change_prices> |
| C01 | 0DFC | <lts_set_allocation_limit> |
| C01 | 0E78 | <lts_cash_totals> |
| C01 | 0EE3 | <lts_credit_totals> |
| C01 | 0F4E | <lts_status> |
| C01 | 0FBB | <lts_power_up_reset> |

```
C01  101E  <lts_prices>
C01  1079  <lts_display_data>
C01  10E8  <lts_preset>
C01  1175  <lts_preset_status>
C01  11D0  <lts_sale_complete>
C01  1228  <lts_authorize>
C01  127F  <lts_good_reply>
C01  12C9  <clear_lts_status>
C01  12E5  <check_character>
C01  12F5  <ack_status>
C01  1304  <nak_status>
C01  1313  <lts_opcode>
C01  1322  <lts_failure>
C01  133D  <analyze_and_log_failure>
C01  13B6  <touchcom_idle_timer>
C01  1437  <tell_dave_about_it>
C01  1467  <valid_version>
C01  14AA  <set_timer_port>
C01  14BA  <reset_my_timer>
C01  14CA  <cancel_my_timer>
C01  14FC  <set_my_timer>
C01  1528  <delay>
C01  1546  <lts_data>
C01  15AE  <lts_command>
C01  15FD  <calculate_bcc>
C01  162A  <send_command>
C01  164E  <pump_in>
C01  16A6  <get_message>
C01  1738  <pump_command>
```

```
C01  1779  <nextchar>
C01  17D5  <pump_event>
C01  17EF  <log_pump>
C01  1806  <load_pump_total>
C01  1854  <event>
C01  189D  <lrequest>
C01  18F5  <disallow>
C01  1914  <fatou>
C01  192C  <fatol>
C01  195B  <my_open>
C01  198E  <sleep>
C01  19D4  <abs_sleep>
C01  19F9  <set_timer>
C01  1A60  <strncpy>
C01  1A9A  <strncat>
C01  1AD3  <strncmp>
C01  1B06  <flush_input>
C01  1B65  <dregister_name>
C01  1D0B  <find_admin>
C01  1D75  <char_waiting>
C01  1E1E  <calloc>
C01  1E24  <malloc>
C01  1E2A  <realloc>
C01  1E30  <cfree>
C01  1E30  <free>
C01  1E36  <fopen>
C01  1E3C  <fclose>
C01  1E42  <getc>
C01  1E48  <putc>
```

```
C01  1E4E  <ungetc>
C01  1E54  <fflush>
C01  1E5A  <tfprintf>
C01  1E60  <tsprintf>
C01  1E66  <fget>
C01  1E6C  <fput>
C01  1E72  <fiseek>
C01  1E78  <rewind>
C01  1E7E  <forward>
C01  1E84  <breakable>
C01  1E8A  <strcat>
C01  1E90  <strcmp>
C01  1E96  <strcpy>
C01  1E9C  <strlen>
C01  1EA2  <send>
C01  1EA8  <abort>
C01  1EAE  <unbreakable>
C01  1EB4  <setjmp>
C01  1FA9  <longjmp>
C01  1F87  <nargs
C01  1F9D  <memr...
C01  1FC8  <memchr>
C01  1FF5  <memccpy>
C01  2030  <atol>
C01  20CC  lepilogue
C01  20D5  lmul
C01  2124  lmodr
C01  212D  lmod
```

```
C01  2133  ldivr
C01  213C  ldiv
C01  21F5  <vc_send_reply>
C01  21FB  <vc_create>
C01  2201  <vc_create2>
C01  2207  <vc_create3>
C01  220D  <ker_vc_destroy>
C01  2213  <def_server>
C01  2219  <set_acc_flags>
C01  221F  <set_exception>
C01  2225  <escape_tty>
C01  222B  <hold>
C01  2231  <unhold>
C01  2237  <time_slice>
C01  223D  <task_info>
C01  2243  <force_ready>
C01  2249  <set_priority>
C01  224F  <set_user>
C01  2255  <set_slice>
C01  225B  <modify_flags>
C01  2261  <set_int_mask>
C01  2267  <set_int_vec>
C01  226D  <alloc_mem>
C01  2273  <receive>
C01  2279  <reply>
C01  227F  <attach>
C01  2285  <detach>
C01  228B  <await>
```

```
C01  2291  <signal>
C01  2297  <read_msg>
C01  229D  <write_msg>
C01  22A3  <read_port>
C01  22A9  <csignal>
C01  22AF  <relay>
C01  22B5  <creceive>
C01  22BB  <memcpy>
C01  22BB  <copy>
C01  22E8  <zero>
C01  2304  <memset>
C01  2325  <atoi>
D00  0000  <User_sp>
D00  0002  <User_ss>
D00  0004  <Exc_bits>
D00  0008  <Exc_allow>
D00  000C  <Exc_pending>
D00  0010  <Exc_to
D00  0012  <Exc_pc>
D00  0014  <Exc_permit>
D00  0018  <Exit_status>
D00  001A  <Error_status>
D00  001C  <My_tid>
D00  001E  <Dads_tid>
D00  0020  <Break_count>
D00  0021  <My_tty>
D00  0022  stack_base
D00  0024  <Cmd_flags>
D00  0025  <My_priority>
```

```
D00  0026  <stdin>
D00  0028  <stdout>
D00  002A  <stderr>
D00  002C  <Free_list>
D00  002E  <End_of_free>
D00  0030  <File_list>
D00  0032  <_Argc>
D00  0034  stk_limit
D00  0034  <_Argv>
D00  0036  SAVE
D00  0038  TEMP
D00  0060  <Code_flags>
D00  0061  <User_num>
D00  0062  <Group_num>
D00  0063  <Team_num>
D00  0065  <My_nid>
D00  0067  <Dads_nid>
D00  0069  <My_tty_nid>
D00  006B  <My_cd_nid>
D00  006D  <Release_num>
D00  006E  <Ndp_save_area>
D00  0070  <Fstack>
D00  0072  <Call_stack_ptr>
D00  0074  <Segment_table_ptr>
D00  0076  <Check_point_sp>
D00  0078  <User_spare>
D00  007E  <Qdb_tid>
D03  03E6  <ht>
```

```
D03  051B  <_version_buffer>
D03  052A  <__ack_status>
D03  052C  <__nak_status>
D03  052E  <__opcode>
D03  0530  <__check_char>
D03  0560  <debug>
D03  0562  <my_client>
D03  0564  <input>
D03  0566  <bulloch_output>
D03  0568  <output>
D03  056A  <selected_hose>
D03  056C  <pump_number>
D03  056E  <ireply>
D03  05DA  <request_trap>
D03  05F2  <idle_trap>
D03  060A  <selected_trap>
D03  060E  <dr>
```

pump/service_dave.c

```
#include "const.h"
#include "pump.h"
#include "vars.h"
#include "func.h"
#include "excepts.h"

static char event_msg [ MAX_STRING_DATA ];
static unsigned preset_amount;

service_dave( dave, p )
```

```
        unsigned dave;
        request *p;
{
        int code;

        REPLY( dave, p );

        cancel_my_timer( );
        zero( event_msg, sizeof( event_msg ) );

        selected_trap = &request_trap;
        if ( code = setjmp( request_trap ) )
        {
                pump_event( my_client, "PUMP FAILURE", code );
                analyze_and_log_failure( p->opcode );
        }
        else
                _service( p );
}

_service( p )
        request *p;
{
        switch ( p->opcode )
        {
                case  D_READY_FOR_FILL:  _ready_to_fill(   );
                                                        break;
                case  D_HOSE_SELECTED:   _hose_selected(   );
                                                        break;
                case  D_FILLING_DATA:  _filling_data(   );
                                                        break;
```

```
case  D_PRESET_THE_PUMP: _preset_the_pump(
                          p->value1 );  break;
case  D_STATUS_REQUEST: _status_request(  ):
                                        break;
case D_PRICES:          _price_request( );
                                        break;
case D_OPEN:    my_client = p->client;  break
case D_NATIVE:                          break;
case D_TOUCHCOM:                        break;
case D_AUTHORIZE: _authorize_pump( p->value1 );
                                        break;
case D_SET_SALE_COMPLETE:   _set_sale_complete( );
                                        break;
case D_GIVE_ID: _id_request( );         break;
case D_BE_QUIET: _be_quiet( );          break;
case D_REPORT_OUT_OF_SERVICE:
     _tell_me_your_troubles( );         break;
case D_HOSE_FILLED: _hose_filled( );    break;
case D_IS_HOOK_DOWN:    _wait_for_hook_down( );
                                        break;
case D_CHANGE_PRICES:   _change_prices( );
                                        break;
case D_HOSE_TOTALS:     _read_hose_totals( );
                                        break;
case D_PUMP_IS_HOOK_DOWN_NOW: _hook_down_now( );
                                        break;
default: pump_event(my_client,
                "UNKNOWN REQUEST",1);   break;
```

```
        }
}

_hook_down_now( )
{
        unsigned status;

        status = lts_status( 0 );
        COPY_SAFELY( event_msg,
                (status & HOOK) == 0 ? "HOOKDOWN" : "HOOKUP" );
        pump_event( my_client, event_msg, 0 );
}
_price_request( )
{
        lts_prices( event_msg );
        pump_event( my_client, event_msg, 0 );
}

typedef struct {
        char cash_total [ 50 ];
        char credit_total [ 50 ];
} hose_total;

hose_total ht [ NHOSES ];

_read_hose_totals( )
{
        hose_total *h = ht;
        unsigned   i;

        zero ( ht, sizeof( ht ) );
```

```
        for ( i = 1; i <= NHOSES; i++, h++ )
        {
                lts_cash_totals( i, h->cash_total );
                lts_credit_totals( i, h->credit_total );
        }
}

static unsigned _i_am_this_pump;

_change_prices( p )
        request *p;
{
        unsigned i,
                        t;

        lts_change_prices( p->string_data );
        lts_prices( event_msg );
        if ( memcmp( event_msg, p->string_data, 24 ) == 0 )
        {
                _read_hose_totals( );
                for ( t = 1, i = 0; i < NHOSES; i++ )
                {
            load_pump_total( p->value1, _i_am_this_pump,
                                ht[ i ].cash_total, t++ );
            load_pump_total( p->value1, _i_am_this_pump,
                                ht[ i ].credit_total, t++ );
                }
                load_pump_total( p->value1, 0, "", 0 );
                pump_event( my_client, "PRICES CHANGED", 0 );
        }
```

```
_be_quiet( )
{
        idle_reporting_flag = 0;
}

_tell_me_your_troubles( )
{
        idle_reporting_flag = 1;
}

dave_wants_to_know( )
{
        return idle_reporting_flag;
}

dave_has_been_told( )
{
        idle_reporting_flag = 0;
}

/* pump is ready for fill if current status shows no */
/* abnormal conditions   */

_ready_to_fill( )
{
        unsigned status,
                        not_ok = (NOT_IN_SERVICE);
        char      *version = lts_software_version( ),
                        vmsg[ 50 ];

        if ( !valid_version( version ))
```

```
        else
                pump_event( my_client, "", 1 );
}

_id_request( )
{
        unsigned status;
        status = lts_status( 0 );
        COPY_SAFELY( event_msg, "PUMPID" );
        event_msg [ 6 ] = lreply.r_pump;
        _i_am_this_pump = UNCHAR(lreply.r_pump);
        pump_event( my_client, event_msg, 0 );
}

static char _hose_used_to_fill;

_hose_filled( )
{
        event_msg [ 0 ] = _hose_used_to_fill;
        pump_event (my_client, event_msg, 0);
}

_filling_data( )
{
        lts_display_data( event_msg );
        _hose_used_to_fill = lreply.r_hose;
        pump_event( my_client, event_msg, 0 );
}

static int idle_reporting_flag;
```

```
{
        pump_event( my_client, "BAD VERSION", 0 );
        tsprintf( vmsg, "bad version %12.12s", version );
        log_dump( vmsg );
        return;
    }

    status = lts_status( 0 );
    pump_event( my_client,
     (status & not_ok) ? "U/S(PUMP)" : "READY", 0 );
    analyze_and_log_failure( 0_REPORT_OUT_OF_SERVICE );
}

_preset_the_pump( an_amount )
    unsigned an_amount;
{
    lts_preset( an_amount );
    lts_preset_status( );
    pump_event( my_client, "PRESET", 0 );
}

_set_sale_complete ()
{
    lts_sale_complete( );
    pump_event( my_client, "SALE_COMPLETE", 0 );
}

_status_request( )
{
    unsigned status;
```

```
        strcpy( event_msg, "S" );
        status = lts_status( 0 );
        event_msg [ 1 ] = '0';
        memcpy( event_msg + 2, &status, sizeof (status) );
        event_msg [ 5 ] = '\0';
        pump_event( my_client, event_msg, 0 );
}

/* sample hooks until you find one that is off hook */
/*  or   you  timeout  */

#define MAX_SELECT_TIMEOUTS  120
                        /* total time then is 60 seconds */
#define WARNING_TIMEOUTS   60
                        /* starts 30 seconds before timeout */
_hose_selected( )
{
      unsigned timeouts = MAX_SELECT_TIMEOUTS,
                        status;

      for ( ; timeouts; timeouts-- )
      {
            status = lts_status( 0 );
            if ( status & HOOK )
            {
                  selected_hose   = UNCHAR(lreply.r_hose);
                  COPY_SAFELY (event_msg, "HOSE");
                  event_msg [ 4 ] = lreply.r_hose;
                  pump_event (my_client, event_msg, 0);
                  return 1;
```

```
            }
            delay( HALF_SECOND );
            if ( timeouts == WARNING_TIMEOUTS )
                    pump_event( my_client, "WARNING", 0 );
        }
        pump_event( my_client, "TIMEOUT", 0 );
        return 0;
}

static long _previous_volume_pumped;

_authorize_pump( amount )
        unsigned amount;
{
        lts_preset( amount );
        lts_preset_status( );
        preset_amount = amount;
        lts_authorize( selected_hose );
        pump_event( my_client, "AUTHORIZED", 0 );
        _previous_volume_pumped = 0L;
        do_transaction( );
}

preset_amount_pumped( display_data )
        char *display_data;
{
        long volume_pumped,
                dv,
                fatol( );
        unsigned amount_pumped,
```

```
fatou ();

        volume_pumped = fatol( display_data + 4, 6 );
        dv = volume_pumped - _previous_volume_pumped;
        _previous_volume_pumped = volume_pumped;

        if ( preset_amount == 0 )    /* it's a "fill" */
                return 0;
        amount_pumped = fatou( display_data + 10, 6 );
        return amount_pumped >= preset_amount;
}

allocation_limit_reached( display_data )
        char *display_data;
{
        return memcmp( display_data + 10, "007500", 6 ) == 0;
}


/* the pump has been authorized.  the outcomes are:   */
/*                                                    */
/*     1) the user picks up a different hose than     */
/*        the one that triggered the authorize        */
/*     2) fuel starts to flow                         */
/*     3) the user never pumps, and LTS times him out */
/*     4) a system reset occurs                       */
/*     5) the user fills to the preset amount         */
/*     6) the user starts to fill and puts the hook   */
/*        back.                                       */
/*                                                    */
```

```
do_transaction( )
{
        if ( wait_for_fuel_flow( ) )
        {
                pump_event( my_client, "FUEL FLOW", 0 );
                wait_for_filling_stop( );
        }
        lts_turn_motor_off( );
}

/* outcomes are:                                    */
/*                                                  */
/* 1) user picks up a different hose                */
/*    ==> tell dave                                 */
/* 2) fuel starts to flow                           */
/*    ==> tell dave                                 */
/* 3) the warning trigger fires                     */
/*    ==> tell dave                                 */
/* 4) the motor turns off                           */
/*    ==> tell dave                                 */

#define TWO_SECONDS             40
#define  WARNING_TIME       42  /* approx 20 seconds left */
#define  START_TIMEOUTS     80  /*  160  seconds          */

wait_for_fuel_flow( )
{
        unsigned timeouts = 0,
            abend    = (PULSER_FAILURE | TEMPERATURE_FAILURE),
            warned   = 0,
```

```
status;

for ( ; timeouts < START_TIMEOUTS; timeouts++ )
{
  check_for_operator_abort( );
  status = lts_status( selected_hose );
  if ( status & REAL_FUEL_BIT )  /* fuel is flowing */
                return 1;
        else if ( (status & HOOK) == 0 )
                                /*  he put the hook back!*/
        timeouts = change_of_hose( ) ? 0 : START_TIMEOUTS;
        else if (status & abend)       /* pump is beat   */
        {
                pump_event( my_client, "ABNORMAL", 0 );
                analyze_and_log_failure( D_AUTHORIZE );
                return 0;
        }
        else if ( (status & PUMP_TIMEOUT) ||
                                /* lts gave up on the guy */
            (status & MOTOR) == 0)
                pump_event( my_client, "TIMEOUT", 0 );
                return 0;
        }
        else if ( timeouts == WARNING_TIME && !warned )
        {
                pump_event( my_client, "WARNING", 0 );
                warned = 1;
        }
        delay( TWO_SECONDS );
```

```
        }
        return 0;
}

/* customer had authorized, but put the hook back.   */
/* LTS has terminated the transaction.  assume the   */
/* customer wants to change grade, and re-authorize */

change_of_hose( )
{
        if ( _hose_selected( ) )          /* get a new hose   */
        {
         lts_preset( preset_amount );
                                  /* preset for new transaction*/
         lts_preset_status( );
         lts_authorize( selected_hose );  /* re-authorize */
                return 1;
        }
        return 0;
}

/*     4) a system reset occurrs                          */
/*     5) the user fills to the preset amount             */
/*     6) the user starts to fill and puts the hook       */
/*        back.                                           */
/*                                                        */

#define FILL_TIMEOUTS 400    /* 12 minutes */

wait_for_filling_stop( )
{
```

```
unsigned timeouts = FILL_TIMEOUTS,
         abend    =
(POWER_UP | PULSER_FAILURE | PUMP_TIMEOUT | TEMPERATURE_FAILURE),
         status;

for ( ; timeouts; timeouts--)
{
        check_for_operator_abort( );
        status = lts_display_data( event_msg + 2 );
        if ( status & abend )
        {
                pump_event( my_client, "ABNORMAL", 0 );
                analyze_and_log_failure( D_AUTHORIZE );
                return;
        }
        if ( (status & NORM) == 0 || preset_amount_pumped(
                                        (event_msg + 2) )
        {
                pump_event( my_client, "NORMAL", 0 );
                return;
        }
        if ( allocation_limit_reached( event_msg + 2 ) )
        {
                pump_event( my_client, "NORMAL", 0 );
                return;
        }
        delay( TWO_SECONDS );
}
pump_event( my_client, "LONG TIMEOUT", 1 );
```

```
}

#define HOOK_DOWN_TIMEOUTS      600          /* five minutes */

_wait_for_hook_down( )
{
        unsigned timeouts = HOOK_DOWN_TIMEOUTS.
                            status;

        for ( ; timeouts; timeouts-- )
        {
                status = lts_status( 0 );
                if ( (status & HOOK) == 0 )
                {
                        pump_event( my_client, "HOOKDOWN", 0 );
                        return;
                }
                delay( HALF_SECOND );
        }
        pump_event( my_client, "TIMEOUT", 0 );
}


check_for_operator_abort( )
{
        unsigned the_client;
        request  r;

        if ( the_client = CRECEIVE(0, &r) )
        {
                switch( r.opcode )
```

```
            {
            case D_HALT_PUMP:    lts_turn_motor_off( ); break;
            case D_RESTART_PUMP: lts_turn_motor_on( ); break;
            }
            REPLY( the_client, &r );
        }
}
```

pump/tidle.c

```
#include "const.h"
#include "pump.h"
#include "vars.h"
#include "func.h"

static int version_sampler;

touchcom_idle_timer ()
{
        unsigned status,
                        good_version = 1,
                        not_ok = (NOT_IN_SERVICE);

        if (version_sampler == 0)
        {
            version_sampler = 300;
          good_version    = valid_version (lts_software_version ());
        }
        version_sampler--;

        status = lts_status( 0 );
```

```
    if ( dave_wants_to_know( ) )
            if ( !good_version || (status & not_ok) )
            {
                    pump_event (my_client, "U/S(PUMP)", 0);
                    dave_has_been_told( );
                      analyze_and_log_failure( 0 );
              }

      if ( status & POWER_UP )
              lts_power_up_reset( );
}

tell_dave_about_it ()
{
      if ( dave_wants_to_know () )
      {
              pump_event( my_client, "U/S(PUMP)", 0 );
              dave_has_been_told( );
              analyze_and_log_failure( 0 );
      }
}
```

pump/versions.c

```
static char *vtab [ ] = {
      "700200870626",
      "999997870504",
      "999991870520"
};
```

```
valid_version (v)
        char *v;
{
        int i;
return 1;  /* HACK */
        for ( i = 0; i < sizeof (vtab) / sizeof (char *); i++)
                if (strcmp (v, vtab [ i ]) == 0 )
                        return 1;
        return 0;
}
```

pump/int/cfiles pump_int.c pump/vars.h

```
#include <stdio.h>
#include <setjmp.h>

#ifdef GBLGEN
#define VARIABLE
#else
#define VARIABLE extern
#endif

VARIABLE unsigned       debug,
                        my_client;
```

```
VARIABLE FILE          *input,
                       *bulloch_output,
                       *output;

VARIABLE unsigned      selected_hose,
                       pump_number;


VARIABLE lts_reply  lreply;

VARIABLE jmp_buf       initial_trap,
                       request_trap,
                       idle_trap,
                       *selected_trap;
```

SCHEDULE B

```
/user_cmds/gotouchcom

/user_cmds/selectors
/user_cmds/goservers
/user_cmds/godave 1
```

```
/user_cmds/selectors

/user_cmds/select A 0 ffff 2
```

```
/user_cmds/select A8 0 8000 2
/user_cmds/select D 0 ffff 2
/user_cmds/select D8 0 8000 2
                    /user_cmds/goservers
"
" logger
"
/dave/logger &
"
"
stty -oflow baud=1200 bits=7 par=odd >$term1
stty -etab -ers -edel -echo -edit -mapcr >$term1
"
" start 2260
"
/dave/2260 $term1 A1 B2 &
/dave/switch &
"
" start power monitor
/dave/power $term6 &
"
stty -oflow baud=1200 bits=8 par=none >$term5
stty -etab -ers -edel -echo -edit -mapcr >$term5
/dave/pos $term5 10  A  &
"
" graphics
"
```

```
/dave/graph /dave/art daves_map 370 &
/user_cmds/loadstart
/user_cmds/loadenglish
/user_cmds/loadfrench
/user_cmds/loaderrors

                    /user_cmds/oodave

"
"
if eq #1 1 goto dave1
if eq #1 2 goto dave2
goto nop
:dave1
type starting dave 1
"
"
chattr /dave/dave1check s=-b
"
" dave 1's devices
"
" video player
"
stty baud=9600 >$term2
stty -etab -ers -edel -echo -edit -mapcr >$term2
/dave/dc9 22 $term2 &
"
" touch screen
"
```

```
stty baud=4800 bits=7 stop=2 par=even >$term3
stty -etab -ers -edel -echo -edit -mapcr >$term3
/dave/touch 23 $term3 &
"
" pump and bulloch
"
"
stty -oflow baud+4800 bits=7 sopt=2 par=even >$term4
stty -etab -ers -edel -echo -edit -mapcr >$term4
"
stty -oflow baud=1200 bits=7 stop=2 par=even >$term8
stty -etab -ers -edel -echo -edit -mapcr >$term8
/dave/pump 24 $term4 $term8 &
/dave/bulloch $term8 28 $term4 &
"
"
"dave
/dave/dave 1 #2 &
goto nop
"
;dave2
type starting dave 2
"
"
chattr /dave/dave2check s=-b
"
"
" dave 2's devices
```

```
"
" video player
"
stty baud=9600 >$term5
stty -etab -ers -edel -echo -edit -mapcr >$term5
/dave/dc9 25 $term5 &
"
" touch screen
"
stty baud=4800 bits=7 stop=2 par=none >$term6
stty -etab -ers -edel -echo edit -mapcr >$term6
/dave/touch 26 $term6 &
"
" pump
"
stty -oflow baud=4800 bits=7 stop=2 par=even >$term7
stty -etab -ers -edel -echo -edit -mapcr >$term7
/dave/pump 27 $term7 &
"
" the man hisself
"
/dave/dave 2 #2 &
"
:nop
```

/user_cmds/loadstart

```
/user_cmds/load_frame a1
/user_cmds/open_screen 1
/user_cmds/displayf 1 a1
```

```
/user_cmds/displayf 1 e1

/user_cmds/open_screen 2

/user_cmds/displayf 2 a1

/user_cmds/displayf 2 e1

/user_cmds/load_bits

                    /user_cmds/loadenglish

/user_cmds/load_frame a2
/user_cmds/load_frame a4
/user_cmds/load_frame a6
/user_cmds/load_frame a8
/user_cmds/load_frame a10
/user_cmds/load_frame a12
/user_cmds/load_frame a14
/user_cmds/load_frame a16
/user_cmds/load_frame a18
/user_cmds/load_frame a20
/user_cmds/load_frame a20c
/user_cmds/load_frame a22
/user_cmds/load_frame a22a
/user_cmds/load_frame a24

                    /user_cmds/loaderrors

/user_cmds/load_frame sp_11
/user_cmds/load_frame sp_11f
/user_cmds/load_frame sp_13
/user_cmds/load_frame sp_13f
```

```
/user_cmds/load_frame sp_15
/user_cmds/load_frame sp_15f
/user_cmds/load_frame sp_16
/user_cmds/load_frame sp_16f
/user_cmds/load_frame sp_17
/user_cmds/load_frame sp_17f
/user_cmds/load_frame sp_2
/user_cmds/load_frame sp_21
/user_cmds/load_frame sp_21f
/user_cmds/load_frame sp_22
/user_cmds/load_frame sp_22f
/user_cmds/load_frame sp_2f
/user_cmds/load_frame sp_5
/user_cmds/load_frame sp_5f
/user_cmds/load_frame sp_6
/user_cmds/load_frame sp_6f
/user_cmds/load_frame sp_7
/user_cmds/load_frame sp_7f
/user_cmds/load_frame sp_8
/user_cmds/load_frame sp_8f
/user_cmds/load_frame sp_full
/user_cmds/load_frame sp_half
```

/user_cmds/loadfrench

```
/user_cmds/load_frame  a3
/user_cmds/load_frame  a5
/user_cmds/load_frame  a7
/user_cmds/load_frame  a9
/user_cmds/load_frame  a11
/user_cmds/load_frame  a13
```

```
/user_cmds/load_frame  a15

/user_cmds/load_frame  a17

/user_cmds/load_frmae  a19

/user_cmds/load_frame  a21

/user_cmds/load_frame  a21c

/user_cmds/load_frame  a23

/user_cmds/load_frame  a23a

/user_cmds/load_frame  a25
```

What is claimed is:

1. An interactive pump system capable of interacting with and responding to responses from a user, the system comprising;

a pump means;

a central processing unit connected to the pump means; and a display and input means including a plurality of instruction displays, and being connected to the pump means and the central processing unit;

wherein the pump means is operable to transmit transaction data, concerning fluid pumped, to the display and input means which will display the transaction data, display one instruction display, and transfer input responses from a user to the central processing unit, the central processing unit being operable to process the input responses and to control the pump means according to the responses, characterised in that the central processing unit includes pump task means, display and input task means and application task means, each task means, in operation running concurrently with the other task means, with the pump task means controlling the pump means, the display and input task means controlling the display and input means, and the application task means receiving and processing the input responses and transferring results into pump directions to the pump task means.

2. The system of claim 1, wherein the pump task means is arranged, in controlling the pump means, to process the pump directions and transfer pump commands to, and receive pump responses from, the pump means; the display and input task means being arranged, in controlling the display and input means, to transfer displays and input commands to, and receive display responses and input responses from, the display and input means, process the display and input responses and transfer resultant display and input requests to the application task means, and the application task means is arranged to process the display and input requests and transfer resultant pump direction to the pump task means.

3. The system of claim 2, wherein the pump task means additionally is arranged to process the pump responses and transfer resultant pump requests to the application task means, the application task means additionally being arranged to process the pump requests and transfer resultant display and input directions to the display and input task means, which process the display and input directions.

4. The system of claim 3, wherein the central processing unit further comprises a queue, and queue task means for controlling the queue and for transferring requests from the pump task means and display and input task means to the queue, and the next request in the queue being transferred to the application task means upon an order from the application task means.

5. The system of claim 3 or 4, wherein the display and input means comprises display means and input means, the input means being connected to the central processing unit, the display means being connected to the pump means and the central processing unit, the display means being arranged to display the instruction displays and the input means transferring the input responses to the central processing unit, and wherein the display and input task means further comprises display task means and input task means, the display task means being arranged to control the display means by transferring display commands to, and receiving the display responses from, the display means, the input task means being arranged to control the input means by transferring input commands to, and receiving input responses from, the input means, the pump, display and input task means processing the pump, display and input responses and transferring pump, display and input requests to the application task means, the application task means processing display, input and pump requests and transferring resultant pump display, input and pump directions to the display input and pump task means.

6. The system of claim 5, wherein the display and input means comprises a graphics generator, a video mixing means connected to the graphics generator and to the pump means, and a monitor connected to the video mixing means, wherein the graphics generator is connected to the central processing unit and is arranged to generate a graphic display signal representing a graphic instruction display, the pump means is arranged to generate a transaction data signal representing the transaction data to be displayed, the video mixing means is arranged to mix the graphic instruction display signal and the transaction data signal and transfer the mixed signal to the monitor to form at least part of an instruction display.

7. The system of claim 6, wherein the display and input means further comprises a sync generator, connected to the pump means and the graphics generator, for synchronizing the transaction data signal and the graphic instruction display signal.

8. The system of claim 7, wherein the display and input means further comprises a motion instruction display signal source, a signal combining means connected to the signal mixing means and the monitor, and a switch means connected to the central processing unit, with the sync generator being additionally connected to the motion instruction display signal source, the signal combining means and the switch means, the sync generator being arranged to synchronize the signals from the graphic generator, the pump means, and the motion instruction display source, the combining means selecting and combining from the signals from the signal mixing means and the motion instruction display signal source according to a signal sent from the central processing unit via the switch means and the sync generator to generate a combined instruction display signal, and transferring the combined instruction display signal to the monitor to form at least part of an instruction display, and wherein the central processing unit further comprises a graphics task means, a motion display task means, and a switch task means, which task means are arranged respectively to control the graphics generator, the motion instruction display signal source and the switch means by transferring respective commands to, and receiving respective responses from, the graphics generator, the motion instruction display signal source, and the switch means, the graphics task means and the motion display task means forming the display task means, and the display commands and responses being provided by the graphics and the motion display commands and responses, with the graphics, motion display and switch task means processing their respective responses and transferring respective resultant requests to the application task means, and the application task means additionally being arranged to process those requests and transfer respective directions to each of the task means.

9. The system of claim 8, wherein the display and input means further comprises an audio signal source, and wherein the central processing unit further comprises an audio task means for controlling the audio signal source by transferring audio commands to, and receiving audio responses from, the audio signal source, the audio task means processing the audio responses and transferring resultant audio requests to the application task means, the application task means additionally being arranged to process those requests and transfer respective directions to each of the task means.

10. The system of claim 9, further comprising payment means connected to the central processing unit, for accepting payment and transferring payment data to the central processing unit, and wherein the central processing unit further comprises payment task means for controlling the payment means by transferring payment commands to, and receiving payment responses from, the payment means, processing the payment responses and transferring resultant payment requests to the application task, the application task additionally being arranged to process the payment requests and transfer respective resultant directions to each of the task means.

11. The system of claim 10, wherein the payment means further comprises a card reader and a cash reader, each reader being connected to the central processing unit, accepting the payment and transferring the payment data to the central processing unit.

12. The system of claim 11, wherein the payment means further comprises a card and note controlling means for controlling the card reader and the cash reader and connected between the central processing unit and the card and cash readers.

13. The system of claim 10 and comprising kiosk computing means, connected to the central processing unit, for accepting point of sale data including the transaction data from the pump means and for controlling the pump means via the central processing unit, and wherein the central processing unit further comprises point of sale data task means and kiosk computer task means, the point of sale task means being arranged to communicate the point of sale data to the kiosk computer and the kiosk computer task means allowing the kiosk computing means to control the pump means by transferring respective commands to, and receiving respective responses from, the kiosk computing means, the point of sale data and kiosk computer task means processing their respective responses and transferring respective resultant requests to the application task means, and with the application task means additionally being arranged to process those requests and transfer respective directions to each of the task means.

14. The system of claim 13 and comprising external source means connected to and communicating with the central processing unit for diagnosing respective task means problems.

15. The system of claim 14, wherein the external source means comprises a modem connected to the central processing unit.

16. The system of claim 15, wherein the display and input means comprises a touch sensitive screen and associated electronics, the screen being positioned over a monitor of the display and input means and being arranged to accept input responses from a user.

* * * * *

UNITED STATES PATENT AND TRADEMARK OFFICE

CERTIFICATE OF CORRECTION

PATENT NO. : 5,027,282

DATED : June 25, 1991

INVENTOR(S) : Peter W. Hollidge

It is certified that error appears in the above-identified patent and that said Letters Patent is hereby corrected as shown below:

Add the Drawings Sheets, consistings of Figs. 14 - 22, as shown on the attached pages.

Signed and Sealed this

Eleventh Day of February, 1997

Bruce Lehman

*Attest:*

BRUCE LEHMAN

*Attesting Officer*

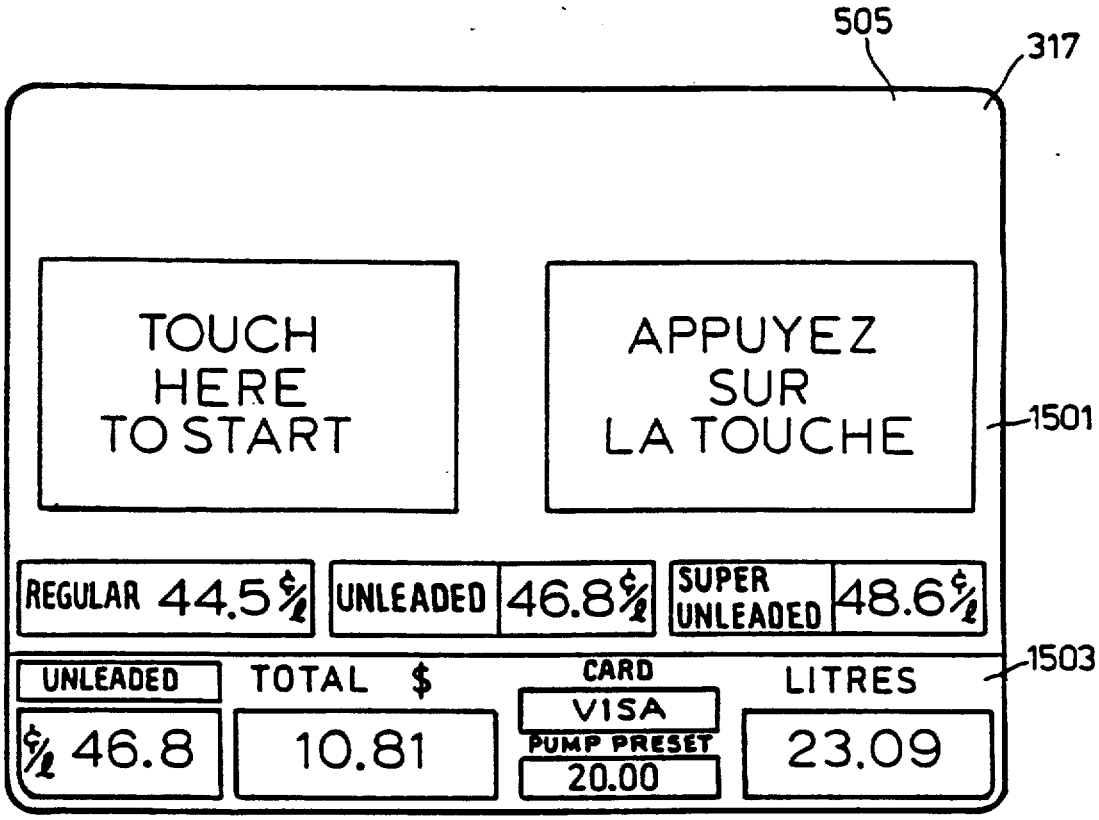
FIG.15
FIG.16
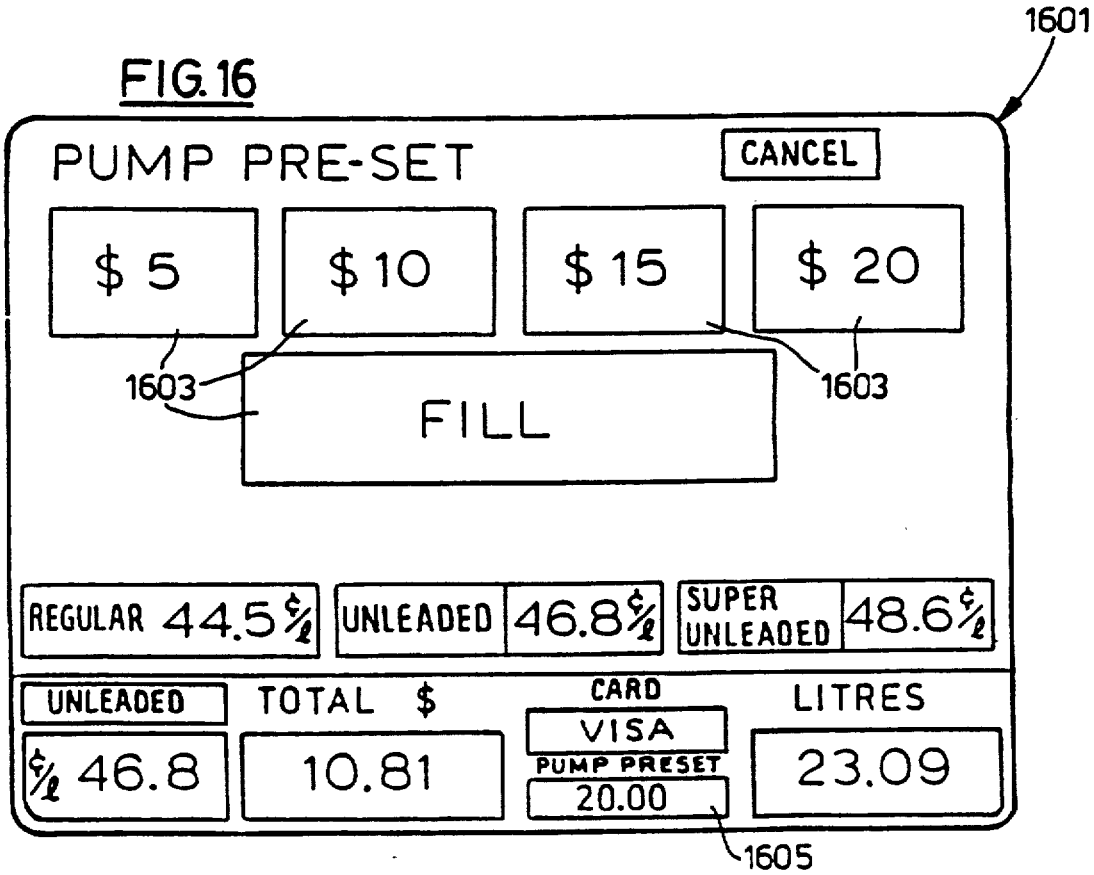

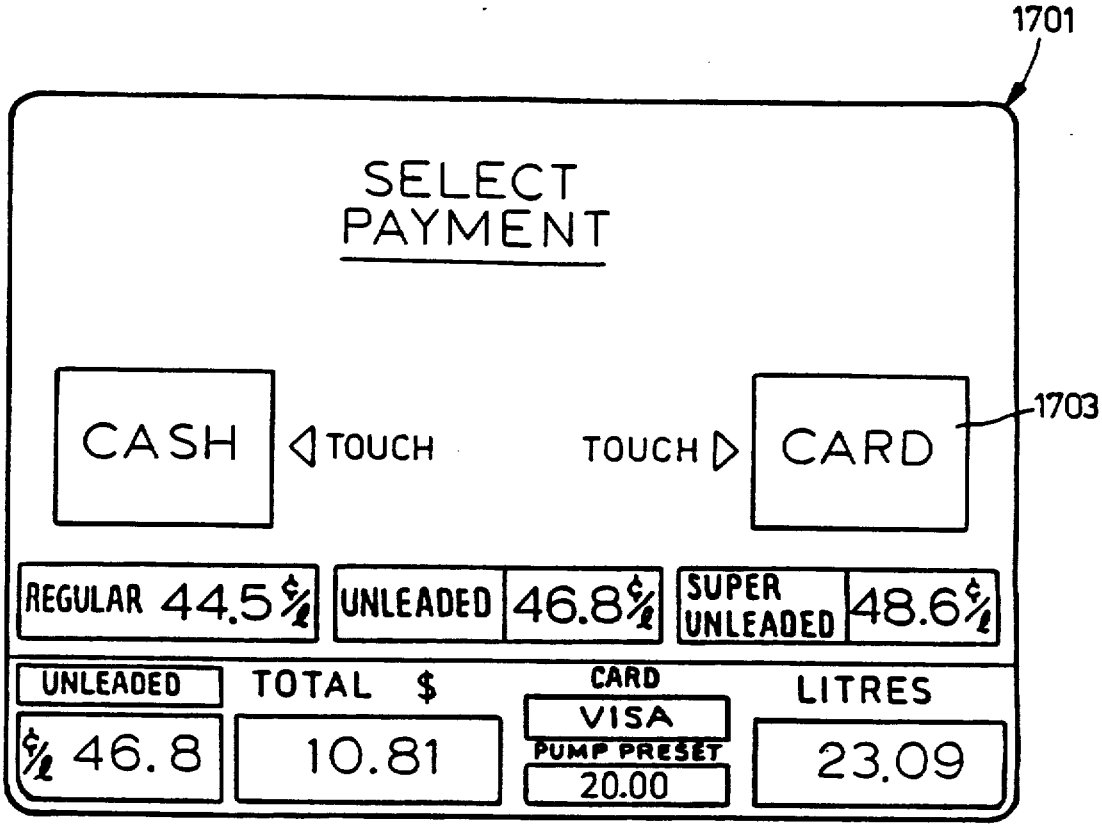
FIG.17
FIG.18
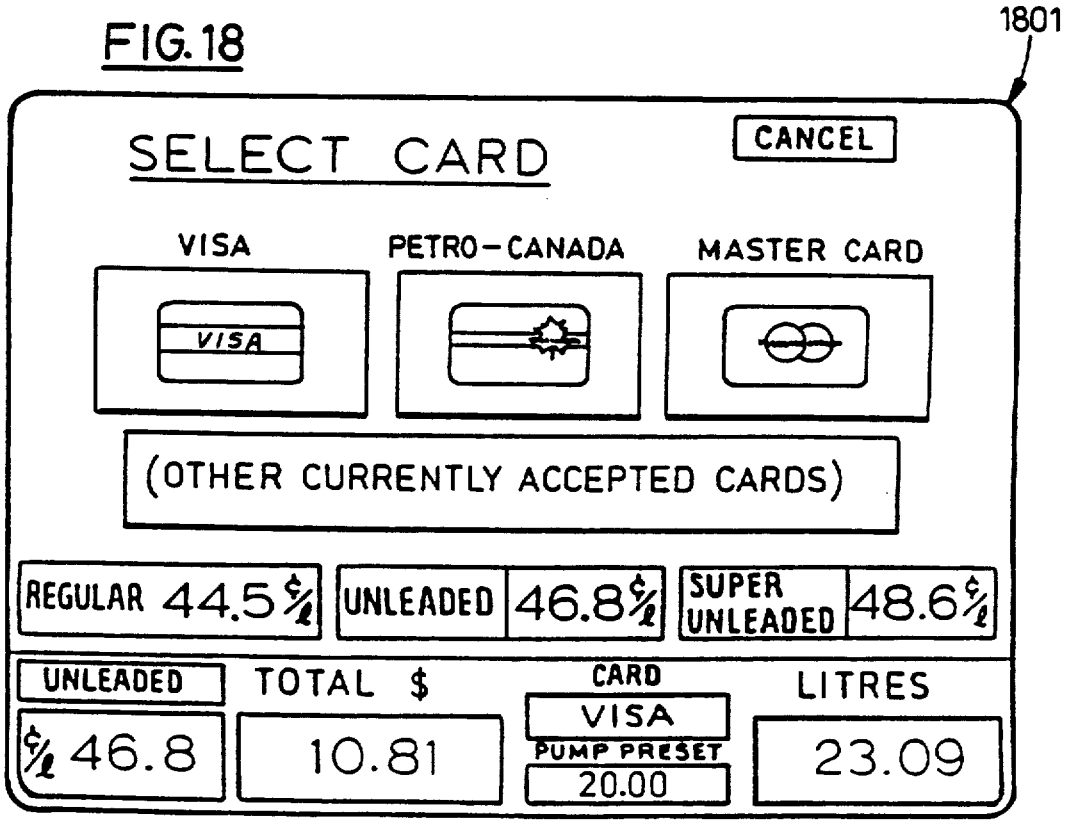

1901
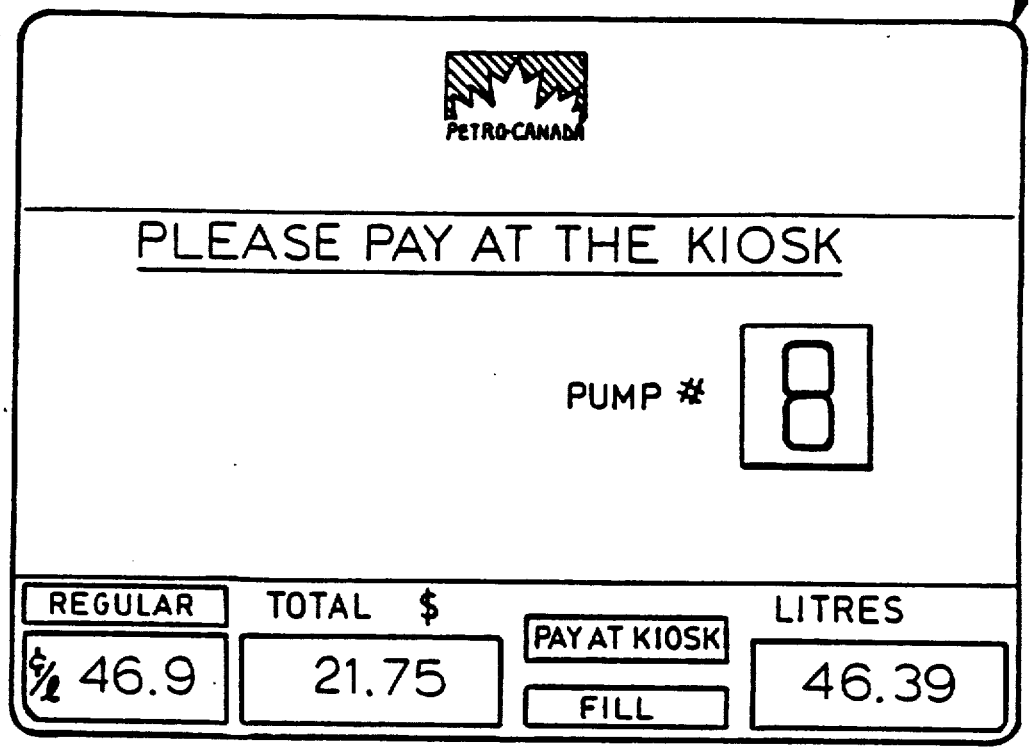
FIG. 19
FIG. 20
2001
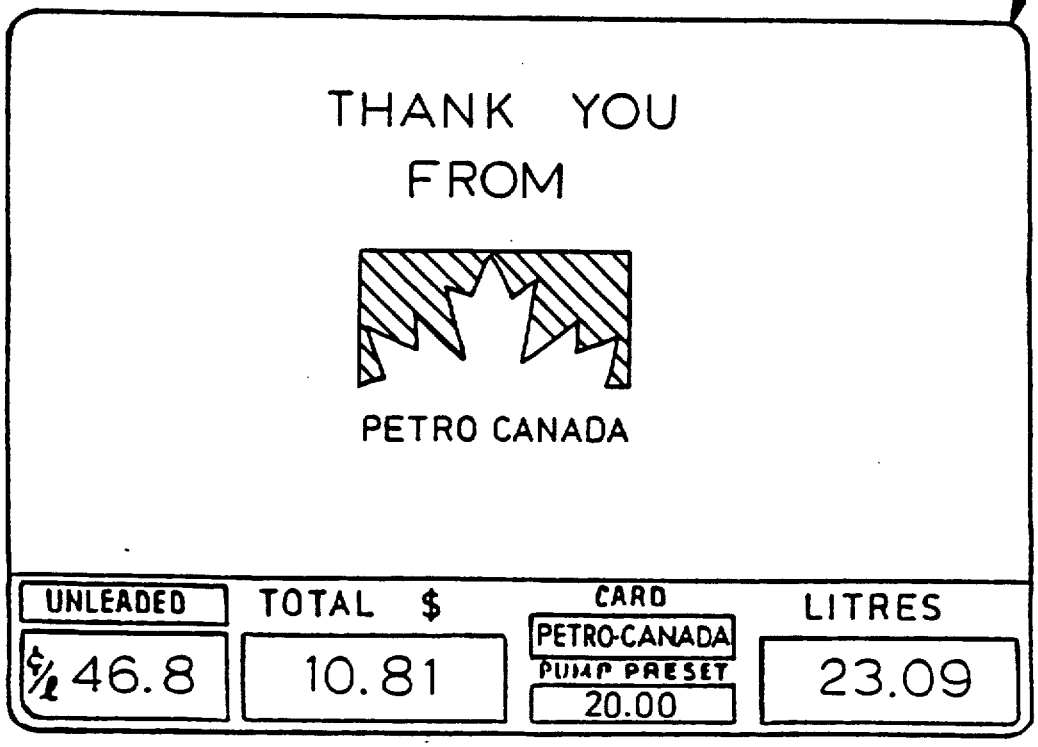

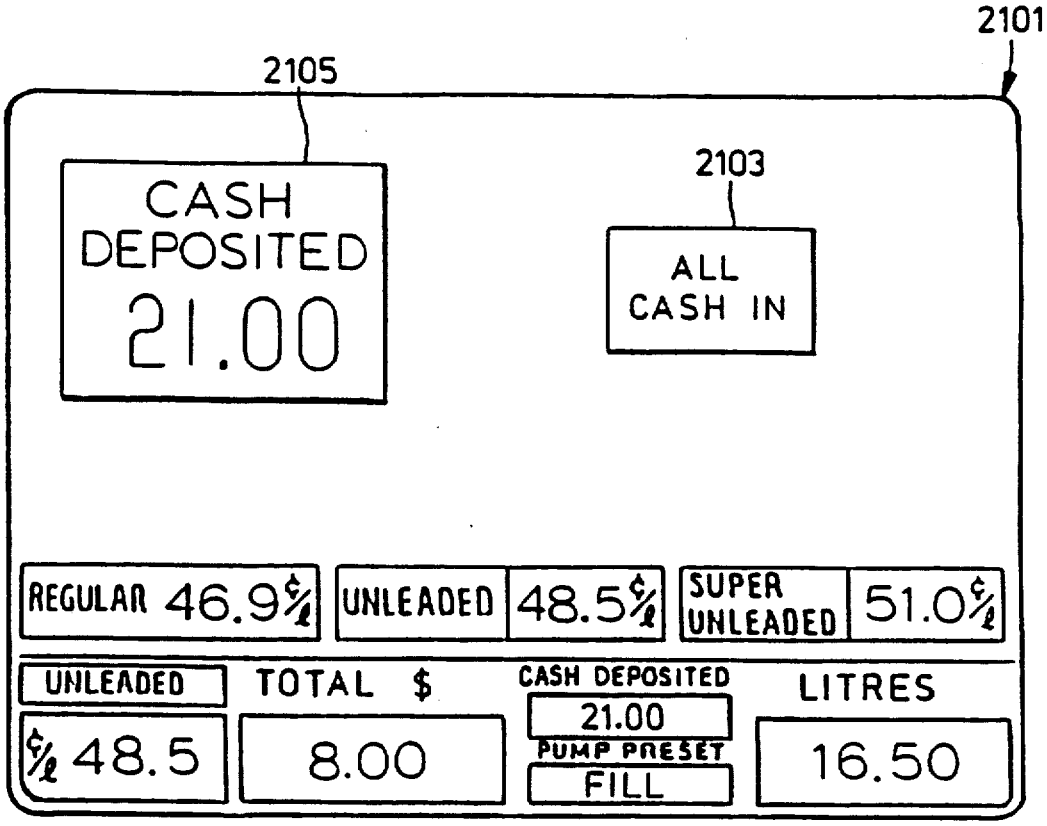
FIG. 21
FIG. 22
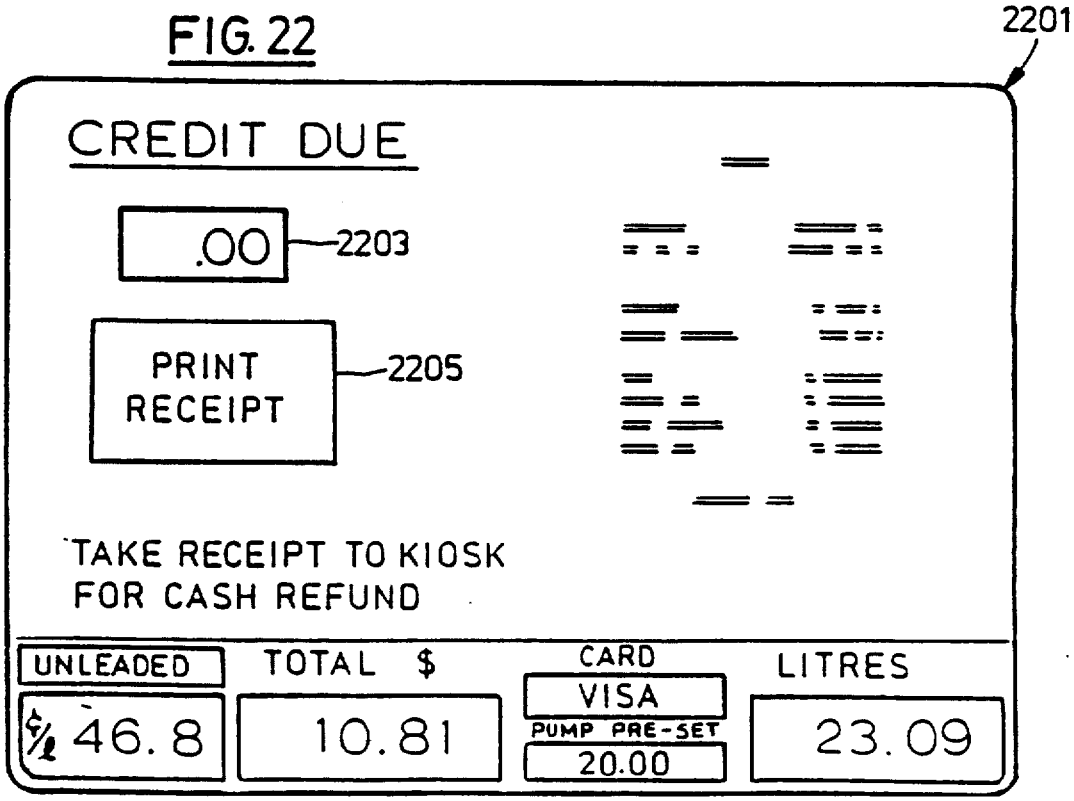

*Commissioner of Patents and Trademarks*